US011509055B2

(12) United States Patent
Fujishiro et al.

(10) Patent No.: US 11,509,055 B2
(45) Date of Patent: Nov. 22, 2022

(54) WIRELESS COMMUNICATION DEVICE, AUTOMATIC DOOR, AND AUTOMATIC DOOR SYSTEM

(71) Applicant: KYOCERA Corporation, Kyoto (JP)

(72) Inventors: Masato Fujishiro, Yokohama (JP); Sunao Hashimoto, Yokohama (JP); Nobuki Hiramatsu, Yokohama (JP); Jun Kitakado, Yokohama (JP); Hiroshi Uchimura, Kagoshima (JP); Shinji Isoyama, Yokohama (JP); Susumu Kashiwase, Machida (JP); Hiroshi Yamasaki, Yokohama (JP); Masamichi Yonehara, Yokohama (JP); Yasuhiko Fukuoka, Yokohama (JP); Takanori Ikuta, Kyoto (JP); Toi Kanda, Tokyo (JP)

(73) Assignee: KYOCERA CORPORATION, Kyoto (JP)

( * ) Notice: Subject to any disclaimer, the term of this patent is extended or adjusted under 35 U.S.C. 154(b) by 156 days.

(21) Appl. No.: 16/964,175

(22) PCT Filed: Jan. 7, 2019

(86) PCT No.: PCT/JP2019/000112
§ 371 (c)(1),
(2) Date: Jul. 22, 2020

(87) PCT Pub. No.: WO2019/142678
PCT Pub. Date: Jul. 25, 2019

(65) Prior Publication Data

US 2020/0350687 A1 Nov. 5, 2020

(30) Foreign Application Priority Data

Jan. 22, 2018 (JP) ..... JP2018-008402
Jan. 22, 2018 (JP) ..... JP2018-008404
Jan. 22, 2018 (JP) ..... JP2018-008420

(51) Int. Cl.
*H01Q 13/08* (2006.01)
*H01Q 1/24* (2006.01)
(Continued)

(52) U.S. Cl.
CPC ..... *H01Q 13/08* (2013.01); *E05F 15/75* (2015.01); *E05F 15/77* (2015.01); *H01Q 1/24* (2013.01);
(Continued)

(58) Field of Classification Search
CPC ..... H01Q 13/08; H01Q 1/24; H01Q 15/14; E05F 15/75; E05F 15/77; E05Y 2900/132
(Continued)

(56) References Cited

U.S. PATENT DOCUMENTS 7,053,629 B2 * 5/2006 Nevermann ..... G01D 5/48 455/117
2007/0273588 A1 * 11/2007 Kim ..... H01Q 9/0407 343/700 MS
(Continued)

FOREIGN PATENT DOCUMENTS

CN 106814160 A 6/2017
CN 206329436 U 7/2017
(Continued)

OTHER PUBLICATIONS

Wei Liu et al., "Metamaterial-Based Wideband Shorting-Wall Loaded Mushroom Array Antenna", 2015 9th European Conference on Antennas and Propagation(EUCAP), EURAAP, Apr. 13, 2015, pp. 1-4, XP033212584, 4pp.
(Continued)

*Primary Examiner* — Hai V Tran
(74) *Attorney, Agent, or Firm* — Hauptman Ham, LLP

(57) ABSTRACT

A wireless communication device includes an antenna and is used for storage as an electrical conductive body. The
(Continued)

antenna includes a first conductor and a second conductor, one or more third conductors, a fourth conductor, and a feeding line. The first conductor and the second conductor face each other in a first axis. The one or more third conductors are located between the first conductor and the second conductor and extend in the first axis. The fourth conductor is connected to the first conductor and the second conductor and extends in the first axis. The feeding line is connected to any one of the third conductors. The first conductor and the second conductor are capacitively coupled to each other via the third conductor. The fourth conductor faces a conductor part of the storage.

12 Claims, 120 Drawing Sheets

(51) Int. Cl.
*H01Q 15/14* (2006.01)
*E05F 15/75* (2015.01)
*E05F 15/77* (2015.01)

(52) U.S. Cl.
CPC ..... *H01Q 15/14* (2013.01); *E05Y 2900/132* (2013.01)

(58) Field of Classification Search
USPC ..... 343/702
See application file for complete search history.

(56) References Cited

U.S. PATENT DOCUMENTS

| | | | | |
|---|---|---|---|---|
| 2011/0260831 | A1 | 10/2011 | Ieda et al. | |
| 2016/0203687 | A1* | 7/2016 | Lee ..... | G08B 13/08 340/545.2 |
| 2016/0261048 | A1 | 9/2016 | Suzuki et al. | |

FOREIGN PATENT DOCUMENTS

| | | | |
|---|---|---|---|
| GB | 2067842 | A | 7/1981 |
| GB | 2355114 | A | 4/2001 |
| JP | H886149 | A | 4/1996 |
| JP | 2006200919 | A | 8/2006 |
| JP | 2010163756 | A | 7/2010 |
| JP | 201538506 | A | 2/2015 |
| JP | 201725481 | A | 2/2017 |
| JP | 2017223063 | A | 12/2017 |
| JP | 20183255 | A | 1/2018 |
| WO | 2016115010 | A1 | 7/2016 |

OTHER PUBLICATIONS

Yasutaka Murakami et al., Low-Profile Design and Bandwidth Characteristics of Artificial Magnetic Conductor with Dielectric Substrate, 2015, pp. 172-179, vol. J98-B, No. 2, IEEE, Japan, 9pp.
Yasutaka Murakami et al., Optimum Configuration of Reflector for Dipole Antenna with AMC Reflector, 2015, pp. 1212-1220, vol. 98-B, No. 11, IEEE, 10pp.

* cited by examiner

WIRELESS COMMUNICATION DEVICE, AUTOMATIC DOOR, AND AUTOMATIC DOOR SYSTEM

CROSS-REFERENCE TO RELATED APPLICATIONS

This application is a National Stage of PCT international application Ser. No. PCT/JP2019/000112 filed on Jan. 7, 2019 which designates the United States, incorporated herein by reference, and which is based upon and claims the benefit of priority from Japanese Patent Application No. 2018-008402 filed on Jan. 22, 2018, Japanese Patent Application No. 2018-008404 filed on Jan. 22, 2018, and Japanese Patent Application No. 2018-008420 filed on Jan. 22, 2018, the entire contents of which are incorporated herein by reference.

FIELD

This disclosure relates to a wireless communication device, an automatic door, and an automatic door system.

BACKGROUND

Electromagnetic waves radiated from an antenna are reflected by a conductor such as metal or a dielectric. The electromagnetic waves reflected by the conductor or the dielectric have a phase shift of 180°. The reflected electromagnetic waves are synthesized with the electromagnetic waves radiated from the antenna. The electromagnetic waves radiated from the antenna may have a small amplitude due to the synthesis with the electromagnetic waves having a phase shift. As a result, the amplitude of the electromagnetic waves radiated from the antenna becomes smaller. By setting a distance between the antenna and the conductor or the dielectric to be ¼ of a wavelength λ of the radiated electromagnetic waves, the influence of the reflected waves is reduced.

On the other hand, technologies for reducing the influence of the reflected waves by an artificial magnetic conductor have been proposed. The technologies are described in Non Patent Literatures 1 and 2, for example.

CITATION LIST

Non Patent Literature

Non Patent Literature 1: Murakami et al., "Low-Profile Design and Band Characteristics of Artificial Magnetic Conductor Using Dielectric Substrate," IEICE (B), Vol. J98-B No. 2, pp. 172-179.

Non Patent Literature 2: Murakami et al., "Optimal Configuration of Reflector for Dipole Antenna with AMC Reflector," IEICE (B), Vol. J98-B No. 11, pp. 1212-1220.

SUMMARY

A wireless communication device according to an aspect of the present disclosure includes an antenna and is used for an automatic door. The antenna includes a first conductor, a second conductor, one or more third conductors, a fourth conductor, and a feeding line. The first conductor and the second conductor face each other in a first axis. The one or more third conductors are located between the first conductor and the second conductor and extend in the first axis. The fourth conductor is connected to the first conductor and the second conductor and extends in the first axis. The feeding line is connected to any one of the third conductors. The first conductor and the second conductor are capacitively coupled to each other via the third conductor. The fourth conductor faces a conductor part of the automatic door.

An automatic door according to an aspect of the present disclosure includes a wireless communication device that includes an antenna, and a conductor part. The antenna includes a first conductor, and a second conductor, one or more third conductors, a fourth conductor, and a feeding line. The first conductor and the second conductor face each other in a first axis. The one or more third conductors are located between the first conductor and the second conductor and extend in the first axis. The fourth conductor is connected to the first conductor and the second conductor and extends in the first axis. The feeding line is connected to any one of the third conductors. The first conductor and the second conductor are capacitively coupled to each other via the third conductor. The fourth conductor faces the conductor part.

An automatic door system according to an aspect of the present disclosure includes an automatic door that includes a wireless communication device including an antenna; and a controller that is configured to open and close the automatic door. The antenna includes a first conductor, a second conductor, one or more third conductors, a fourth conductor, and a feeding line. The first conductor and the second conductor face each other in a first axis. The one or more third conductors are located between the first conductor and the second conductor and extend in the first axis. The fourth conductor is connected to the first conductor and the second conductor and extends in the first axis. The feeding line is connected to any one of the third conductors. The first conductor and the second conductor are capacitively coupled to each other via the third conductor. The fourth conductor faces a conductor part of the automatic door. The controller opens and closes the automatic door based on a signal transmitted from the antenna.

A wireless communication device according to an aspect of the present disclosure includes an antenna and is used for storage of an electrical conductive body. The antenna includes a first conductor, a second conductor, one or more third conductors, a fourth conductor, and a feeding line. The first conductor and the second conductor face each other in a first axis. The one or more third conductors are located between the first conductor and the second conductor and extend in the first axis. The fourth conductor is connected to the first conductor and the second conductor and extends in the first axis. The feeding line is electromagnetically connected to any one of the third conductors. The first conductor and the second conductor are capacitively coupled to each other via the third conductor. The fourth conductor faces the storage.

A wireless communication device according to an aspect of the present disclosure includes a sensor and an antenna. The antenna includes a first conductor, a second conductor, at least one third conductor, a fourth conductor, and a feeding line. The first conductor and the second conductor face each other in a first axis. The at least one third conductor is located between the first conductor and the second conductor and extends in the first axis. The fourth conductor is connected to the first conductor and the second conductor and extends in the first axis. The feeding line is electromagnetically connected to any one of the at least one third conductor. The first conductor and the second conductor are capacitively coupled to each other via the third conductor. The antenna transmits a signal based on a detection result of the sensor.

BRIEF DESCRIPTION OF DRAWINGS

FIG. 97 is a schematic diagram illustrating a configuration example of an automatic door.

FIG. 98 is a schematic diagram illustrating a configuration example of an automatic door system.

FIG. 99 is a schematic diagram illustrating an application example of the wireless communication device.

FIG. 100 is an explanatory diagram illustrating a configuration example of a moving part.

FIG. 101 is a schematic diagram illustrating an application example of the wireless communication device.

FIG. 102 is a schematic diagram illustrating an application example of the wireless communication device.

FIG. 103 is a schematic diagram illustrating an application example of the wireless communication device.

FIG. 104 is a schematic diagram illustrating a configuration example of a human sensor.

FIG. 105 is a network diagram between the wireless communication device according to one embodiment and an electronic device that receives a signal from the wireless communication device.

FIG. 106 is an external view of a door to which the wireless communication device according to one embodiment is fixed.

FIG. 107 is an external view of a blind to which the wireless communication device according to one embodiment is fixed.

FIG. 108 is an external view of a shutter to which the wireless communication device according to one embodiment is fixed.

Figure 109:
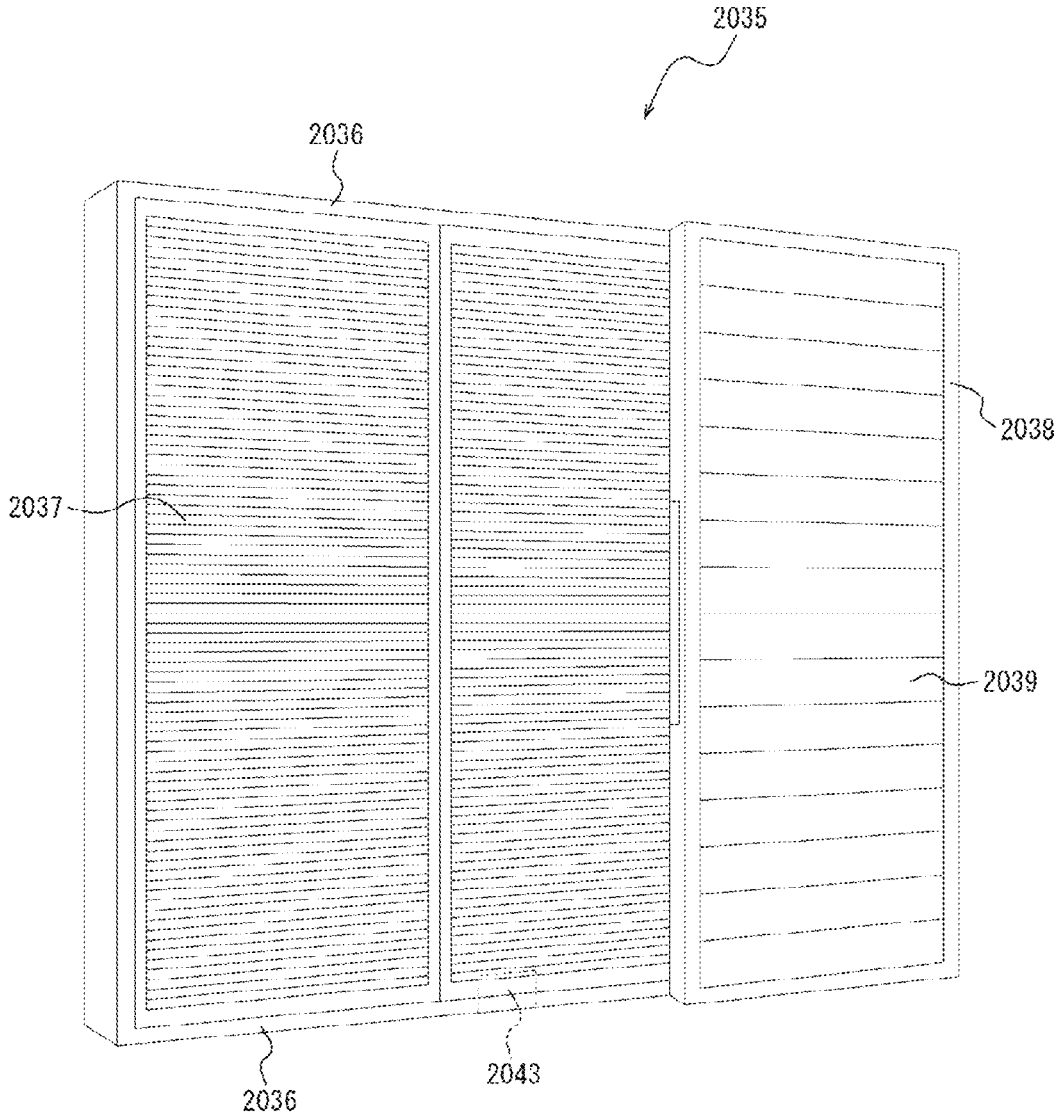

FIG. 109 is an external view of a rain door to which the wireless communication device according to one embodiment is fixed.

Figure 110:
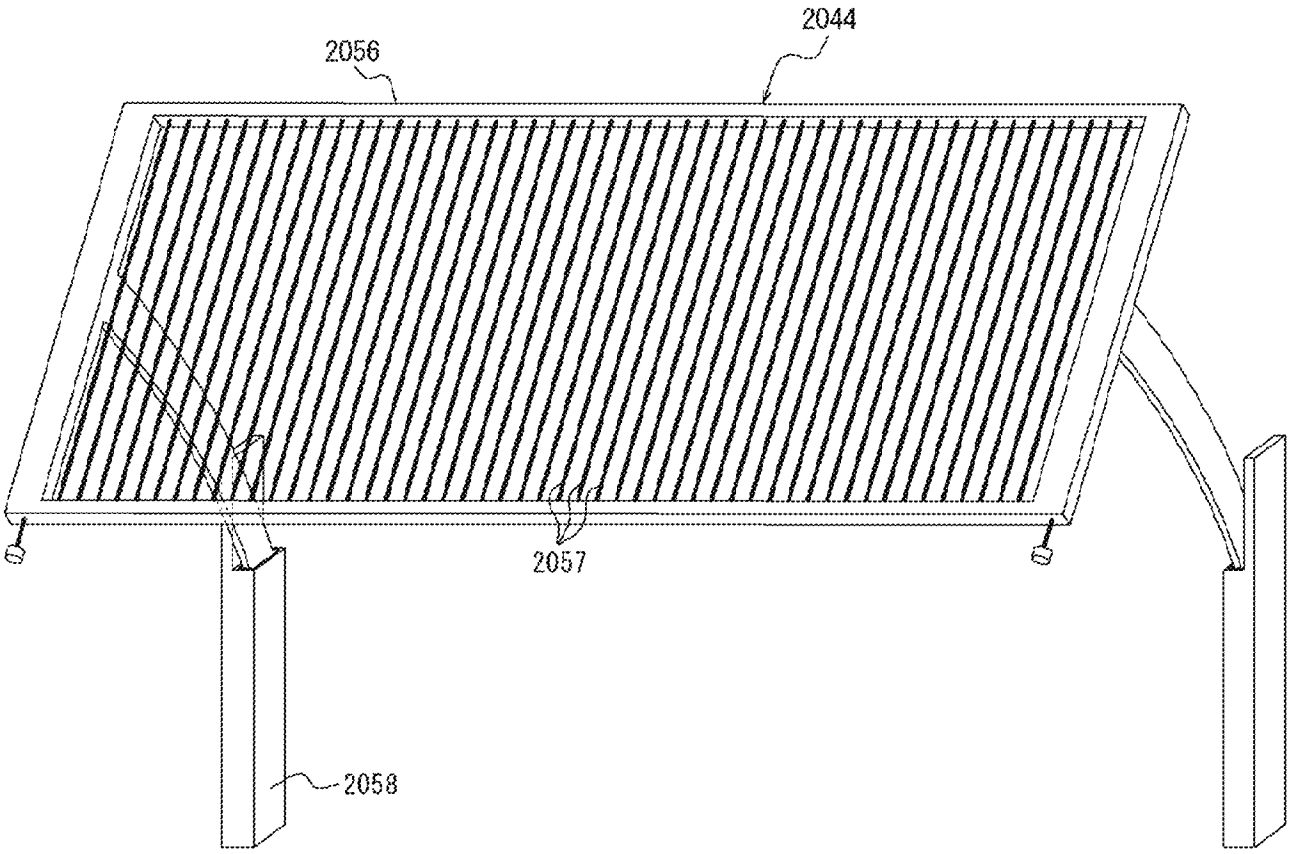

FIG. 110 is an external view of an example of a parking facility to which the wireless communication device according to one embodiment is fixed.

Figure 111:
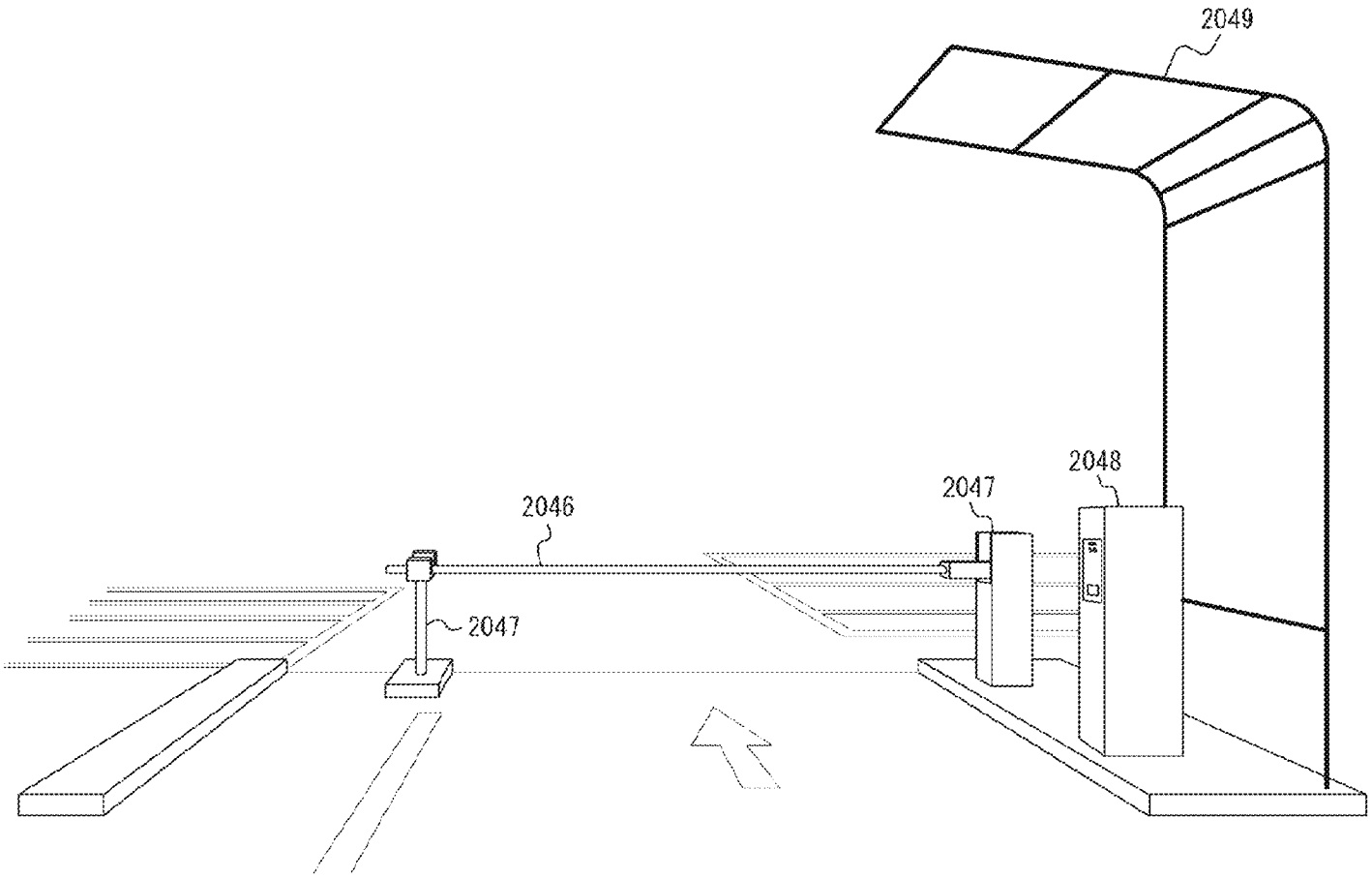

FIG. 111 is an external view of another example of the parking facility to which the wireless communication device according to one embodiment is fixed.

Figure 112:
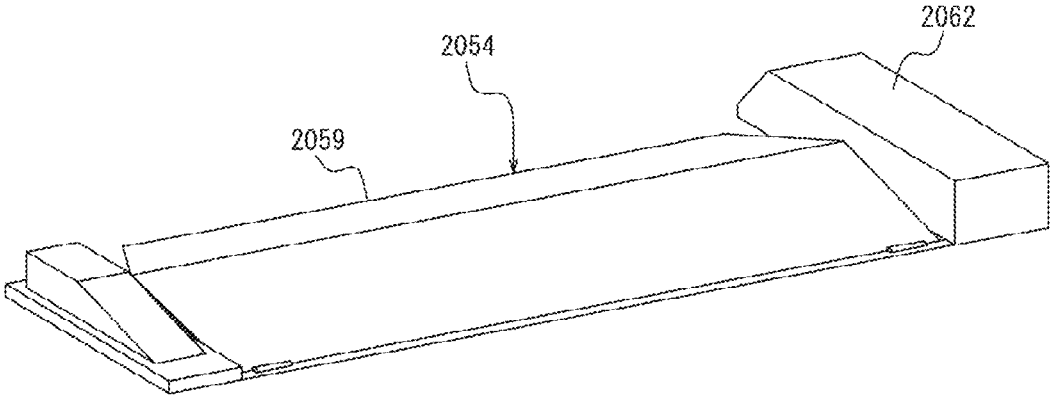

FIG. 112 is an external view of another example of the parking facility to which the wireless communication device according to one embodiment is fixed.

Figure 113:
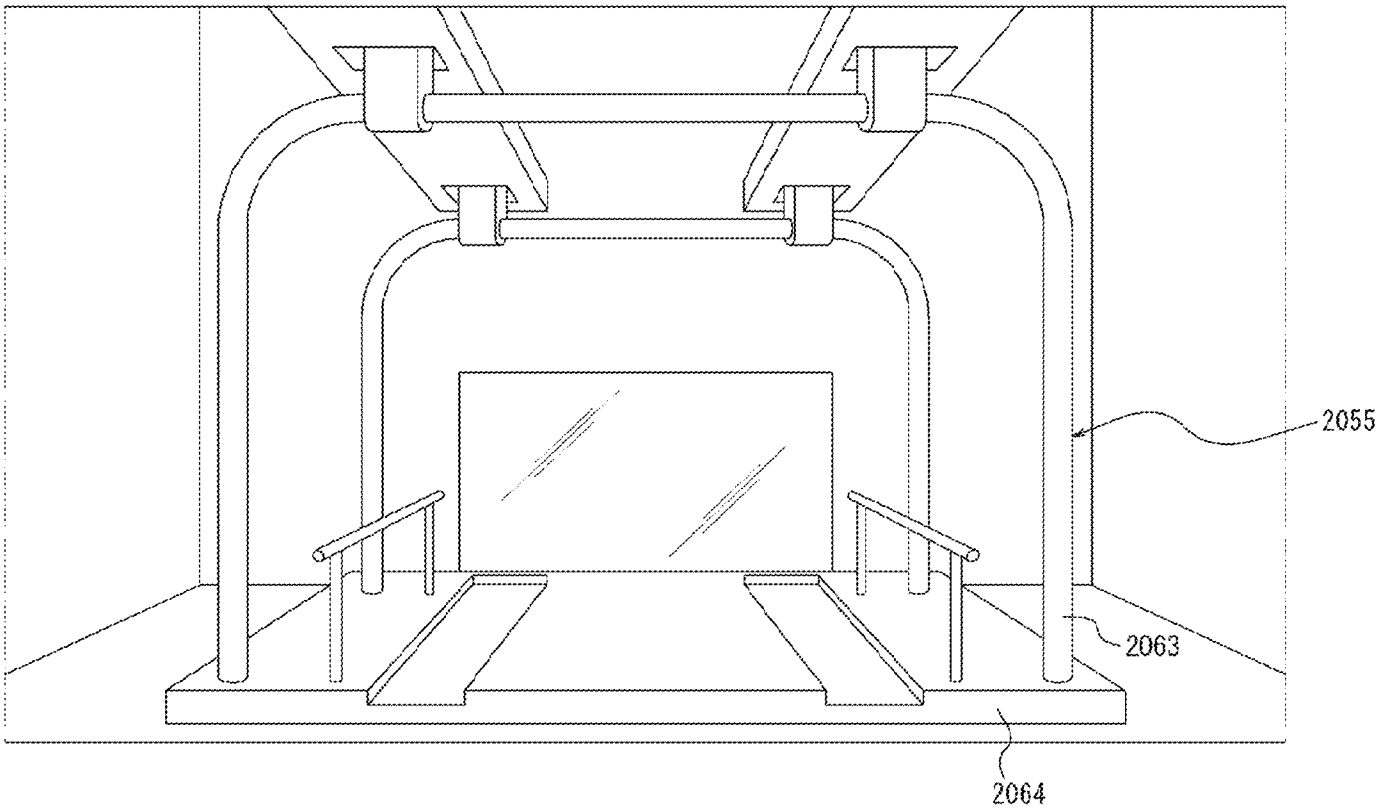

FIG. 113 is an external view of another example of the parking facility to which the wireless communication device according to one embodiment is fixed.

Figure 114:
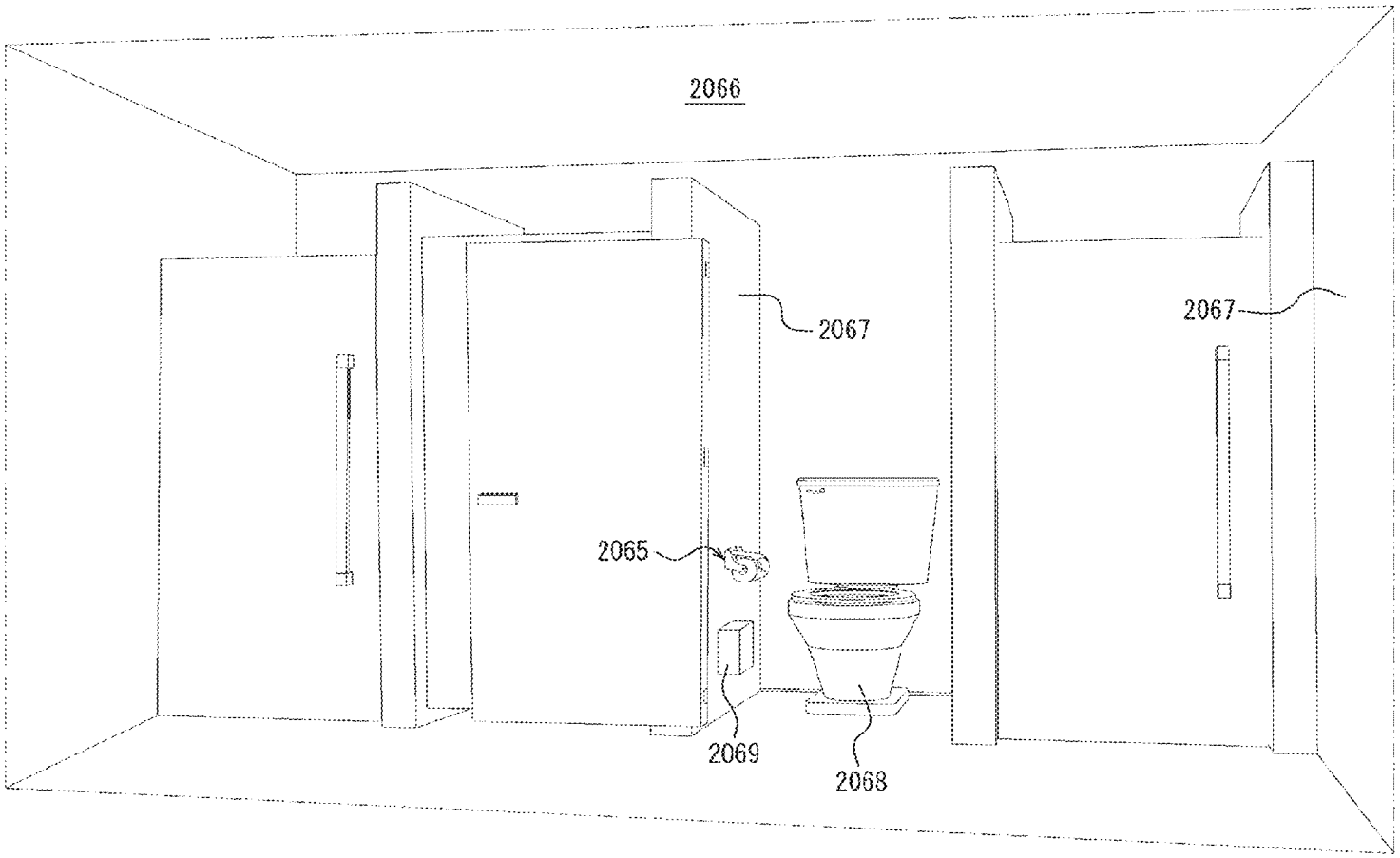

FIG. 114 is an external view of a toilet to which the wireless communication device according to one embodiment is fixed.

Figure 115:
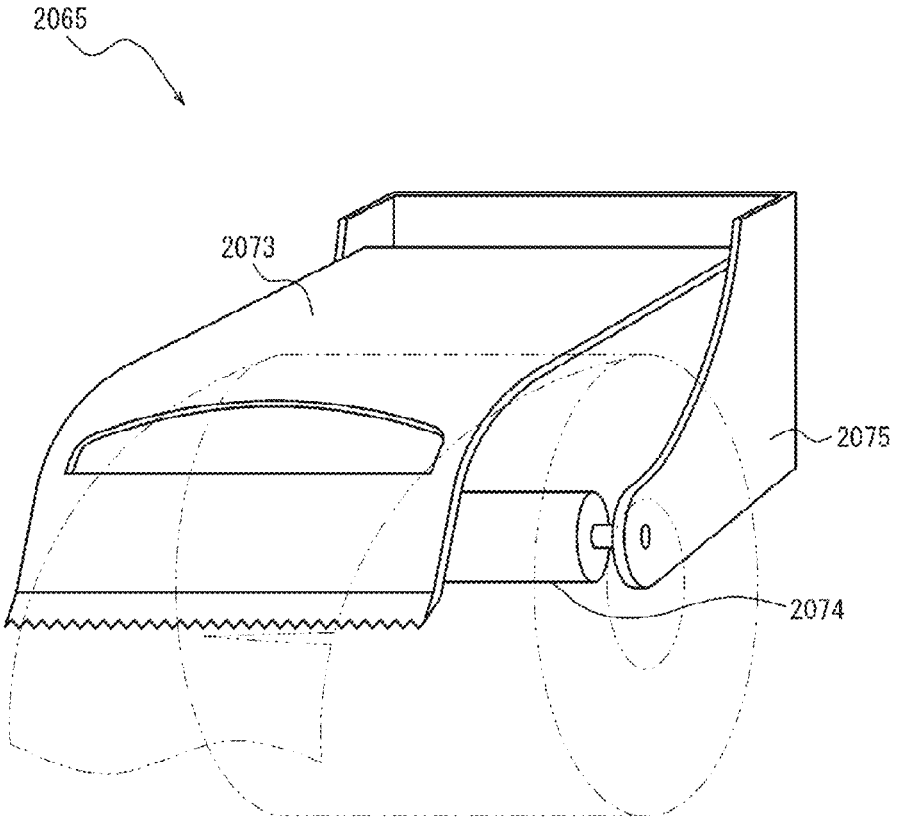

FIG. 115 is an external view of a toilet paper holder to which the wireless communication device according to one embodiment is fixed.

Figure 116:
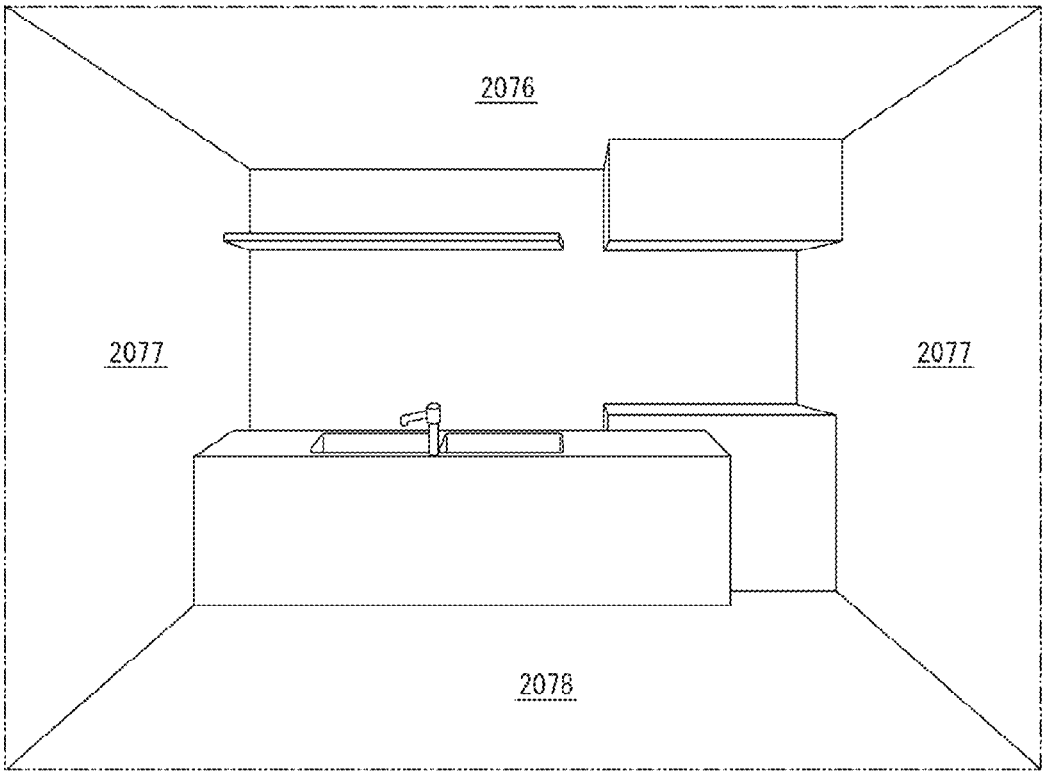

FIG. 116 is an internal view of an interior of architecture to which the wireless communication device according to one embodiment is fixed.

Figure 117:
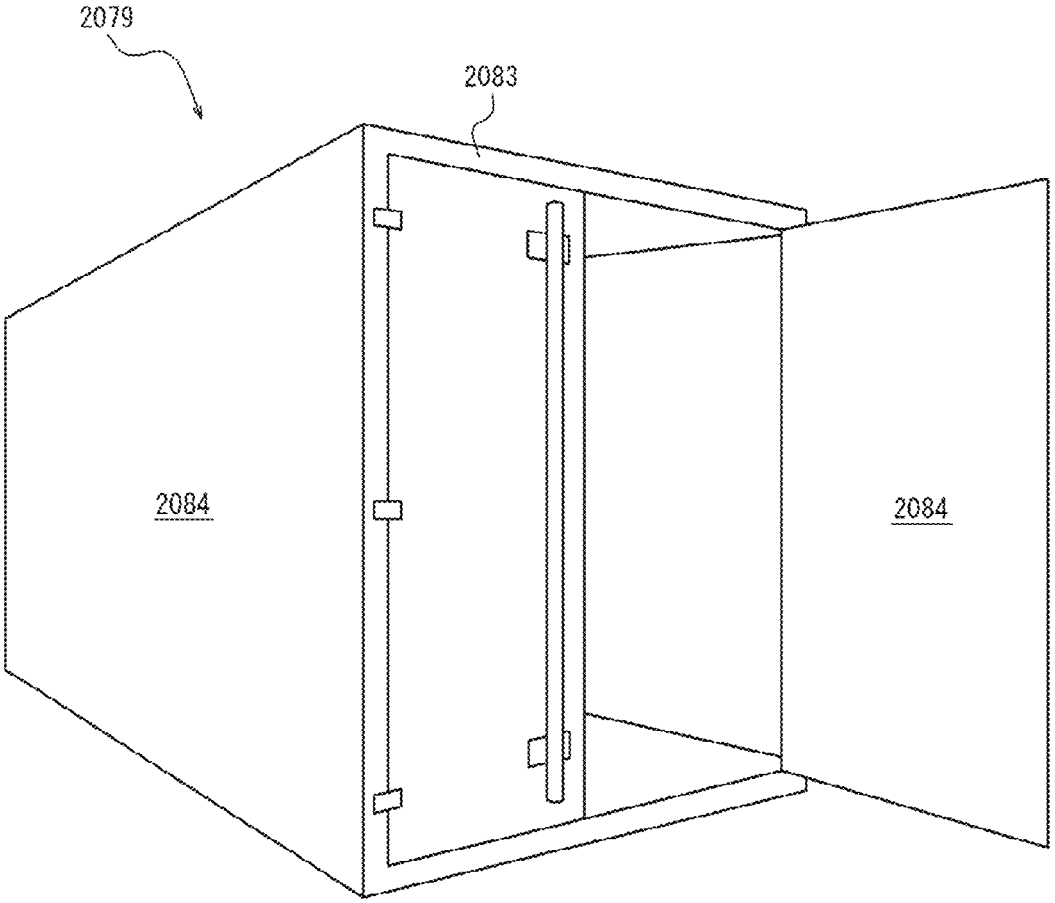

FIG. 117 is an external view of a storing item to which the wireless communication device according to one embodiment is fixed.

Figure 118:
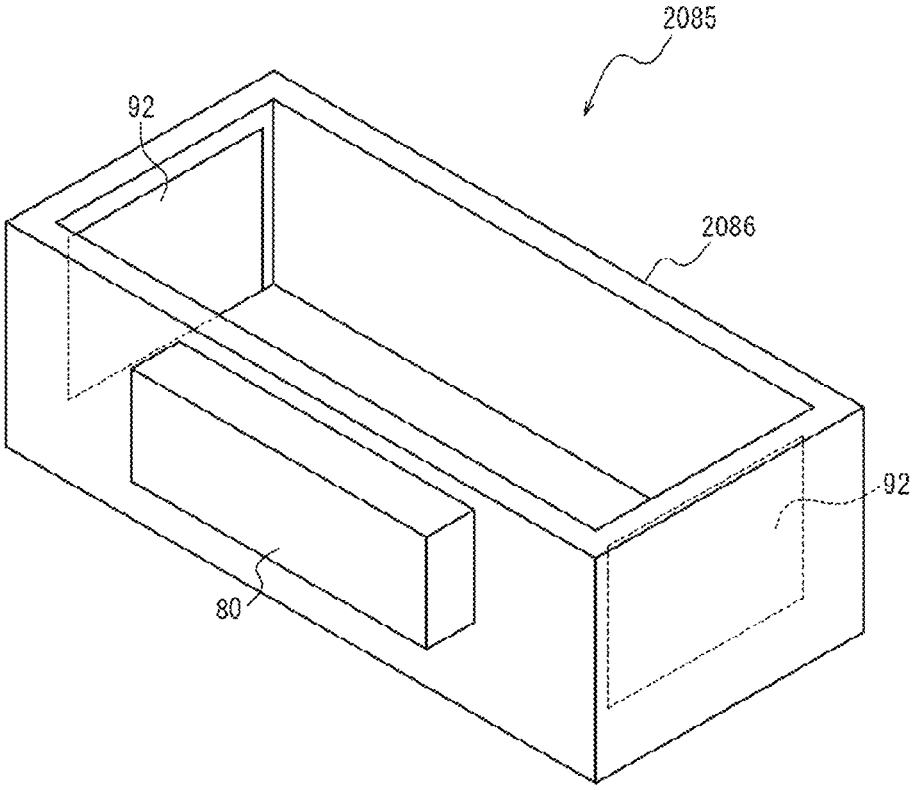

FIG. 118 is an external view of a liquid leakage sensor module to which the wireless communication device according to one embodiment is fixed.

DESCRIPTION OF EMBODIMENTS

The present disclosure relates to providing a wireless communication device, an automatic door, and an automatic door system using a novel resonant structure. According to the present disclosure, the influence of reflected waves due to a conductor such as a metal or a dielectric is small. According to the present disclosure, usefulness of wireless communication technology used in the vicinity of the conductor or the dielectric is improved.

A plurality of embodiments of the present disclosure will be described below. The resonant structure may include a resonator. The resonant structure, which includes the resonator and other members, may be implemented in a plurality of ways. A resonator 10 illustrated in FIGS. 1 to 62 includes a base 20, pair conductors 30, a third conductor 40, and a fourth conductor 50. The base 20 is in contact with the pair conductors 30, the third conductor 40, and the fourth conductor 50. In the resonator 10, the pair conductors 30, the third conductor 40, and the fourth conductor 50 function as a resonator. The resonator 10 may resonate at a plurality of resonance frequencies. Among of the resonance frequencies of the resonator 10, one resonance frequency is a first frequency $f_1$. A wavelength of the first frequency $f_1$ is $\lambda_1$. The resonator 10 may use at least one of the at least one resonance frequency as an operating frequency. The resonator 10 uses the first frequency $f_1$ as the operating frequency.

The base 20 may include either a ceramic material or a resin material as a composition. Examples of the ceramic material include an aluminum oxide sintered body, an aluminum nitride sintered body, a mullite sintered body, a glass ceramic sintered body, crystallized glass in which crystal component is precipitated in glass base material, and a microcrystalline sintered body such as mica or aluminum titanate. Examples of the resin material include an epoxy resin, a polyester resin, a polyimide resin, a polyamide-imide resin, a polyetherimide resin, and ones in which uncured products such as a liquid crystal polymer are cured.

The pair conductors 30, the third conductor 40, and the fourth conductor 50 may include any of a metal material, an alloy of metal materials, a cured product material of a metal paste, and a conductive polymer as a composition. The pair conductors 30, the third conductor 40, and the fourth conductor 50 may all be made of the same material. The pair conductors 30, the third conductor 40, and the fourth conductor 50 may all be made of different materials. Any combination of the pair conductors 30, the third conductor 40, and the fourth conductor 50 may be made of the same material. Examples of the metal material include copper, silver, palladium, gold, platinum, aluminum, chromium, nickel, cadmium lead, selenium, manganese, tin, vanadium, lithium, cobalt, titanium, and the like. The alloy contains a plurality of metal materials. Examples of the metal paste agent include a powder of a metal material kneaded with an organic solvent and a binder. Examples of the binder include an epoxy resin, a polyester resin, a polyimide resin, a polyamideimide resin, and a polyetherimide resin. Examples of the conductive polymer include a polythiophene-based polymer, a polyacetylene-based polymer, a polyaniline-based polymer, a polypyrrole-based polymer, and the like.

The resonator 10 has two pair conductors 30. The pair conductors 30 include a plurality of conductors. The pair conductors 30 include a first conductor 31 and a second conductor 32. The pair conductors 30 may include three or more conductors. Each conductor of the pair conductors 30 is separated from other conductors in a first axis. In each conductor of the pair conductors 30, one conductor may be paired with another conductor. Each conductor of the pair conductors 30 may be seen as an electric conductor from the resonator between the paired conductors. The first conductor 31 is located away from the second conductor 32 in the first axis. Each of the conductors 31 and 32 extends along a second plane intersecting the first axis.

In the present disclosure, the first axis (first axis) is indicated as an x direction. In the present disclosure, a third axis (third axis) is indicated as a y direction. In the present disclosure, a second axis (second axis) is indicated as a z direction. In the present disclosure, a first plane (first plane) is indicated as an xy plane. In the present disclosure, a second plane (second plane) is indicated as a yz plane. In the present disclosure, a third plane (third plane) is indicated as a zx plane. Each of these planes is a plane (plane) in a coordinate space (coordinate space) and does not indicate a specific plate (plate) or a specific surface (surface). In the present disclosure, a surface integral (surface integral) in the xy plane may be referred to as a first surface integral. In the present disclosure, a surface integral in the yz plane may be referred to as a second surface integral. In the present disclosure, a surface integral in the zx plane may be referred to as a third surface integral. The surface integral (surface integral) is counted in units of a square meter (square meter)

or the like. In the present disclosure, a length in the x direction may be simply referred to as "length". In the present disclosure, a length in the y direction may be simply referred to as "width". In the present disclosure, a length in the z direction may be simply referred to as "height".

In one example, the conductors 31 and 32 are located at respective end portions of the base 20 in the x direction. A part of each of the conductors 31 and 32 may face an outside of the base 20. A part of each of the conductors 31 and 32 may be located inside the base 20, and another part thereof may be located outside the base 20. Each of the conductors 31 and 32 may be located in the base 20.

The third conductor 40 functions as a resonator. The third conductor 40 may include at least one of a line type resonator, a patch type resonator, and a slot type resonator. In one example, the third conductor 40 is located on the base 20. In one example, the third conductor 40 is located at an end of the base 20 in the z direction. In one example, the third conductor 40 may be located in the base 20. A part of the third conductor 40 may be located inside the base 20, and another part thereof may be located outside the base 20. A surface of a part of the third conductor 40 may face the outside of the base 20.

The third conductor 40 includes at least one conductor. The third conductor 40 may include a plurality of conductors. When the third conductor 40 includes a plurality of conductors, the third conductor 40 may be referred to as a third conductor group. The third conductor 40 includes at least one conductive layer. The third conductor 40 includes at least one conductor in one conductive layer. The third conductor 40 may include a plurality of conductive layers. For example, the third conductor 40 may include three or more conductive layers. The third conductor 40 includes at least one conductor in each of the plurality of conductive layers. The third conductor 40 extends in the xy plane. The xy plane includes the x direction. Each conductive layer of the third conductor 40 extends along the xy plane.

In an example of a plurality of embodiments, the third conductor 40 includes a first conductive layer 41 and a second conductive layer 42. The first conductive layer 41 extends along the xy plane. The first conductive layer 41 may be located on the base 20. The second conductive layer 42 extends along the xy plane. The second conductive layer 42 may be capacitively coupled to the first conductive layer 41. The second conductive layer 42 may be electrically connected to the first conductive layer 41. The two capacitive layers that are capacitively coupled to each other may face each other in the y direction. The two capacitive layers that are capacitively coupled to each other may face each other in the x direction. The two conductive layers that are capacitively coupled to each other may face each other in the first plane. It may be said that the two conductive layers facing each other in the first plane have two conductors in one conductive layer. At least a part of the second conductive layer 42 may be located overlapping the first conductive layer 41 as viewed in the z direction. The second conductive layer 42 may be located in the base 20.

The fourth conductor 50 is located away from the third conductor 40. The fourth conductor 50 is electrically connected to each of the conductors 31 and 32 of the pair conductors 30. The fourth conductor 50 is electrically connected to the first conductor 31 and the second conductor 32. The fourth conductor 50 extends along the third conductor 40. The fourth conductor 50 extends along the first plane. The fourth conductor 50 extends from the first conductor 31 to the second conductor 32. The fourth conductor 50 is located on the base 20. The fourth conductor 50 may be located in the base 20. A part of the fourth conductor 50 may be located inside the base 20, and another part thereof may be located outside the base 20. A surface of a part of the fourth conductor 50 may face the outside of the base 20.

In an example of a plurality of embodiments, the fourth conductor 50 may function as a ground conductor in the resonator 10. The fourth conductor 50 may be a potential reference of the resonator 10. The fourth conductor 50 may be connected to the ground of a device including the resonator 10.

In an example of a plurality of embodiments, the resonator 10 may include the fourth conductor 50 and a reference potential layer 51. The reference potential layer 51 is located away from the fourth conductor 50 in the z direction. The reference potential layer 51 is electrically insulated from the fourth conductor 50. The reference potential layer 51 may be the potential reference of the resonator 10. The reference potential layer 51 can be electrically connected to the ground of the device including the resonator 10. The fourth conductor 50 can be electrically separated from the ground of the device including the resonator 10. The reference potential layer 51 faces either the third conductor 40 or the fourth conductor 50 in the z direction.

In an example of a plurality of embodiments, the reference potential layer 51 faces the third conductor 40 via the fourth conductor 50. The fourth conductor 50 is located between the third conductor 40 and the reference potential layer 51. An interval between the reference potential layer 51 and the fourth conductor 50 is narrower than an interval between the third conductor 40 and the fourth conductor 50.

In the resonator 10 including the reference potential layer 51, the fourth conductor 50 may include one or more conductors. In the resonator 10 including the reference potential layer 51, the fourth conductor 50 may include one or more conductors, and the third conductor 40 may be one conductor connected to the pair conductors 30. In the resonator 10 including the reference potential layer 51, each of the third conductor 40 and the fourth conductor 50 may include at least one resonator.

In the resonator 10 including the reference potential layer 51, the fourth conductor 50 may include a plurality of conductive layers. For example, the fourth conductor 50 may include a third conductive layer 52 and a fourth conductive layer 53. The third conductive layer 52 may be capacitively coupled to a fourth conductive layer 53. The third conductive layer 52 may be electrically coupled to the first conductive layer 41. The two capacitive layers that are capacitively coupled to each other may face each other in the y direction. The two capacitive layers that are capacitively coupled to each other may face each other in the x direction. The two conductive layers that are capacitively coupled to each other may face each other in the xy plane.

The distance between two conductive layers facing each other and capacitively coupled to each other in the z direction is shorter than the distance between the conductor group and the reference potential layer 51. For example, the distance between the first conductive layer 41 and the second conductive layer 42 is shorter than the distance between the third conductor 40 and the reference potential layer 51. For example, the distance between the third conductive layer 52 and the fourth conductive layer 53 is shorter than the distance between the fourth conductor 50 and the reference potential layer 51.

Each of the first conductor 31 and the second conductor 32 may include one or more conductors. Each of the first conductor 31 and the second conductor 32 may be one conductor. Each of the first conductor 31 and the second conductor 32 may include a plurality of conductors. Each of the first conductor 31 and the second conductor 32 may include at least one fifth conductive layer 301 and a plurality of fifth conductors 302. The pair conductors 30 include at least one fifth conductive layer 301 and a plurality of fifth conductors 302.

The fifth conductive layer 301 extends in the y direction. The fifth conductive layer 301 extends along the xy plane. The fifth conductive layer 301 is a layered conductor. The fifth conductive layer 301 may be located on the base 20. The fifth conductive layer 301 may be located in the base 20. The plurality of fifth conductive layers 301 are separated from each other in the z direction. The plurality of fifth conductive layers 301 are arranged along the z direction. The plurality of fifth conductive layers 301 partially overlap each other on the z direction. The fifth conductive layer 301 electrically connects a plurality of fifth conductors 302. The fifth conductive layer 301 is a connecting conductor that electrically connects a plurality of fifth conductors 302. The fifth conductive layer 301 can be electrically connected to any conductive layer of the third conductor 40. In one embodiment, the fifth conductive layer 301 is electrically connected to the second conductive layer 42. The fifth conductive layer 301 may be integrated with the second conductive layer 42. In one embodiment, the fifth conductive layer 301 may be electrically connected to the fourth conductive 50. The fifth conductive layer 301 may be integrated with the fourth conductive 50.

Each of the fifth conductors 302 extends in the z direction. The plurality of fifth conductors 302 are separated from each other in the y direction. The distance between the fifth conductors 302 is equal to or less than half the wavelength of $\lambda_1$. If the distance between the fifth conductors 302 electrically connected is equal to or less than $\lambda_1/2$, each of the first conductor 31 and the second conductor 32 can reduce leakage of electromagnetic waves in a resonance frequency band from between the fifth conductors 302. Since the leakage of electromagnetic waves in the resonance frequency band is reduced, the pair conductors 30 appear as an electric conductor from the unit structure. At least a part of the plurality of fifth conductors 302 is electrically connected to the fourth conductor 50. In one embodiment, a part of the plurality of fifth conductors 302 may electrically connect the fourth conductor 50 and the fifth conductive layer 301. In one embodiment, the plurality of fifth conductors 302 may electrically be connected to the fourth conductor 50 via the fifth conductive layer 301. A part of the plurality of fifth conductors 302 may electrically connect one fifth conductive layer 301 to another fifth conductive layer 301. The fifth conductor 302 may adopt a via conductor and a through hole conductor.

The resonator 10 includes the third conductor 40 that functions as a resonator. The third conductor 40 can function as an artificial magnetic conductor (AMC; Artificial Magnetic Conductor). The artificial magnetic conductor may also be called a reactive impedance surface (RIS; Reactive Impedance Surface).

The resonator 10 includes the third conductor 40 that functions as a resonator between two pair conductors 30 facing each other in the x direction. The two pair conductors 30 can be seen as the electric conductor (Electric Conductor) extending from the third conductor 40 to the yz plane. In the resonator 10, an end in the y direction is electrically opened. In the resonator 10, the zx planes at both ends in the y direction have high impedance. The zx planes at both ends of the resonator 10 in the y direction can be seen as a magnetic conductor from the third conductor 40. The resonator 10 is surrounded by two electric conductors and two high impedance surfaces (magnetic conductors), so that the resonator of the third conductor 40 has an artificial magnetic conductor character (Artificial Magnetic Conductor Character) in the z direction. Since the resonator 10 is surrounded by two electric conductors and two high impedance planes, the resonator of the third conductor 40 has a finite number of artificial magnetic conductor characters.

In the "artificial magnetic conductor characteristic", a phase difference between an incident wave and a reflected wave at an operating frequency is 0°. In the resonator 10, the phase difference between the incident wave and the reflected wave at the first frequency $f_1$ is 0°. In the "artificial magnetic conductor character", the phase difference between the incident wave and the reflected wave at the operating frequency band is −90° to +90°. The operating frequency band is a frequency band between a second frequency $f_2$ and a third frequency $f_3$. The second frequency $f_2$ is the frequency at which the phase difference between the incident wave and the reflected wave is +90°. The third frequency $f_3$ is the frequency at which the phase difference between the incident wave and the reflected wave is −90°. A width of the operating frequency band determined based on the second and third frequencies may be 100 MHz or more when the operating frequency is about 2.5 GHz, for example. The width of the operating frequency band may be 5 MHz or greater, for example, when the operating frequency is about 400 MHz.

The operating frequency of the resonator 10 may be different from the resonance frequency of each resonator of the third conductor 40. The operating frequency of the resonator 10 can vary depending on the length, size, shape, material, and the like of the base 20, the pair conductors 30, the third conductor 40, and the fourth conductor 50.

In an example of a plurality of embodiments, the third conductor 40 may include at least one unit resonator 40X. The third conductor 40 may include one unit resonator 40X. The third conductor 40 may include a plurality of unit resonators 40X. The unit resonator 40X is located overlapping the fourth conductor 50 as viewed in the z direction. The unit resonator 40X faces the fourth conductor 50. The unit resonator 40X can function as a frequency selective surface (FSS; Frequency Selective Surface). The plurality of unit resonators 40X are arranged along the xy plane. The plurality of unit resonators 40X are regularly arranged along the xy plane. The unit resonator 40X may be arranged in a square grid (square grid), an oblique grid (oblique grid), a rectangular grid (rectangular grid), and a hexagonal grid (hexagonal grid).

The third conductor 40 may include a plurality of conductive layers that are arranged in the z direction. Each of the plurality of conductive layers of the third conductor 40 includes at least one unit resonator. For example, the third conductor 40 includes a first conductive layer 41 and a second conductive layer 42.

The first conductive layer 41 includes at least one first unit resonator 41X. The first conductive layer 41 may include one first unit resonator 41X. The first conductive layer 41 may include a plurality of first divisional resonators 41Y obtained by dividing one first unit resonator 41X into a plurality of parts. The plurality of first divisional resonators 41Y may be at least one first unit resonator 41X with an adjacent unit structure 10X. The plurality of first divisional resonators 41Y are located at an end portion of the first conductive layer 41. The first unit resonator 41X and the first divisional resonator 41Y can be called the third conductor.

The second conductive layer 42 includes at least one second unit resonator 42X. The second conductive layer 42 may include one second unit resonator 42X. The second conductive layer 42 may include a plurality of second divisional resonators 42Y obtained by dividing one second unit resonator 42X into a plurality parts. The plurality of second divisional resonators 42Y may be at least one second unit resonator 42X with an adjacent unit structure 10X. The plurality of second divisional resonators 42Y are located at an end portion of the second conductive layer 42. The second unit resonator 42X and the second divisional resonator 42Y can be called the third conductor.

At least a part of the second unit resonator 42X and the second divisional resonator 42Y is located overlapping the first unit resonator 41X and the first divisional resonator 41Y as viewed in the Z direction. In the third conductor 40, at least a part of the unit resonator and the divisional resonator of each layer are stacked in the Z direction to form one unit resonator 40X. The unit resonator 40X includes at least one unit resonator in each layer.

When the first unit resonator 41X includes a line type resonator or a patch type resonator, the first conductive layer 41 has at least one first unit conductor 411. The first unit conductor 411 may function as the first unit resonator 41X or the first divisional resonator 41Y. The first conductive layer 41 has a plurality of first unit conductors 411 arranged in n rows and m columns in xy directions, where n and m are natural numbers of one or greater, which are independent of each other. In the example illustrated in FIGS. 1 to 9 and the like, the first conductive layer 41 has six first unit conductors 411 arranged in a grid form of 2 rows and 3 columns. The first unit conductor 411 may be arranged in a square grid, an oblique grid, a rectangular grid, and a hexagonal grid. The first unit conductor 411 corresponding to the first divisional resonator 41Y is located at an end portion in the xy plane of the first conductive layer 41.

When the first unit resonator 41X is a slot type resonator, at least one conductive layer of the first conductive layer 41 extends in the xy directions. The first conductive layer 41 has at least one first unit slot 412. The first unit slot 412 may function as the first unit resonator 41X or the first divisional resonator 41Y. The first conductive layer 41 includes a plurality of first unit slots 412 arranged in n rows and m columns in the xy directions, where n and m are natural numbers of one or greater, which are independent of each other. In the example illustrated in FIGS. 6 to 9 and the like, the first conductive layer 41 has six first unit slots 412 arranged in a grid form of 2 rows and 3 columns. The first unit slots 412 may be arranged in a square grid, an oblique grid, a rectangular grid, and a hexagonal grid. The first unit slot 412 corresponding to the first divisional resonator 41Y is located at an end portion in the xy plane of the first conductive layer 41.

When the second unit resonator 42X is a line type resonator or a patch type resonator, the second conductive layer 42 includes at least one second unit conductor 421. The second conductive layer 42 may include a plurality of second unit conductors 421 arranged in the xy directions. The second unit conductor 421 may be arranged in a square grid, an oblique grid, a rectangular grid, and a hexagonal grid. The second unit conductor 421 may function as the second unit resonator 42X or the second divisional resonator 42Y. The second unit conductor 421 corresponding to the second divisional resonator 42Y is located at an end portion in the xy plane of the second conductive layer 42.

At least part of the second unit conductor 421 overlaps at least one of the first unit resonator 41X and the first divisional resonator 41Y as viewed in the z direction. The second unit conductor 421 may overlap a plurality of first unit resonators 41X. The second unit conductor 421 may overlap a plurality of first divisional resonators 41Y. The second unit conductor 421 may overlap one first unit resonator 41X and four first divisional resonators 41Y. The second unit conductor 421 may overlap only one first unit resonator 41X. A center of gravity of the second unit conductor 421 may overlap one first unit resonator 41X. The center of gravity of the second unit conductor 421 may be located between the plurality of first unit resonators 41X and the first divisional resonators 41Y. The center of gravity of the second unit conductor 421 may be located between two first unit resonators 41X arranged in the x direction or the y direction.

At least a part of the second unit conductor 421 may overlap two first unit conductors 411. The second unit conductor 421 may overlap only one first unit resonator 411. The center of gravity of the second unit conductor 421 may be located between two first unit conductors 411. The center of gravity of the second unit conductor 421 may overlap one first unit resonator 411. At least a part of the second unit conductor 421 may overlap the first unit slot 412. The second unit conductor 421 may overlap only one first unit slot 412. The center of gravity of the second unit conductor 421 may be located between two first unit slots 412 arranged in the x direction or the y direction. The center of gravity of the second unit conductor 421 may overlap one first unit slot 412.

When the second unit resonator 42X is a slot type resonator, at least one conductive layer of the second conductive layer 42 extends along the xy plane. The second conductive layer 42 has at least one second unit slot 422. The second unit slot 422 may function as the second unit resonator 42X or the second divisional resonator 42Y. The second conductive layer 42 may include a plurality of second unit slots 422 arranged in the xy plane. The second unit slot 422 may be arranged in a square grid, an oblique grid, a rectangular grid, and a hexagonal grid. The second unit slot 422 corresponding to the second divisional resonator 42Y is located at an end portion in the xy plane of the second conductive layer 42.

At least part of the second unit slot 422 overlaps at least one of the first unit resonator 41X and the first divisional resonator 41Y in the y direction. The second unit slot 422 may overlap a plurality of first unit resonators 41X. The second unit slot 422 may overlap a plurality of first divisional resonators 41Y. The second unit slot 422 may overlap one first unit resonator 41X and four first divisional resonators 41Y. The second unit slot 422 may overlap only one first unit resonator 41X. A center of gravity of the second unit slot 422 may overlap one first unit resonator 41X. The center of gravity of the second unit slot 422 may be located between a plurality of first unit resonators 41X. The center of gravity of the second unit slot 422 may be located between two first unit resonators 41X and the first divisional resonator 41Y arranged in the x direction or the y direction.

At least a part of the second unit slot 422 may overlap two first unit conductors 411. The second unit slot 422 may overlap only one first unit conductor 411. The center of gravity of the second unit slot 422 may be located between two first unit conductors 411. The center of gravity of the second unit slot 422 may overlap one first unit conductor 411. At least a part of the second unit slot 422 may overlap the first unit slot 412. The second unit slot 422 may overlap only one first unit slot 412. The center of gravity of the second unit slot 422 may be located between the two first unit slots 412 arranged in the x direction or the y direction. The center of gravity of the second unit slot 422 may overlap one first unit slot 412.

The unit resonator 40X includes at least one first unit resonator 41X and at least one second unit resonator 42X. The unit resonator 40X may include one first unit resonator 41X. The unit resonator 40X may include the plurality of first unit resonators 41X. The unit resonator 40X may include one first divisional resonator 41Y. The unit resonator 40X may include the plurality of first divisional resonators 41Y. The unit resonator 40X may include a part of the first unit resonator 41X. The unit resonator 40X may include one or more partial first unit resonators 41X. The unit resonator 40X includes a plurality of partial resonators among one or more partial first unit resonators 41X, and one or more first divisional resonators 41Y. The plurality of partial resonators included in the unit resonator 40X are combined with the first unit resonator 41X corresponding to at least one partial resonator. The unit resonator 40X may not include a first unit resonator 41X, but may include a plurality of first divisional resonators 41Y. The unit resonator 40X may include four first divisional resonators 41Y, for example. The unit resonator 40X may include only the plurality of partial first unit resonator 41X. The unit resonator 40X may include one or more partial first unit resonators 41X, and one or more first divisional resonators 41Y. The unit resonator 40X may include, for example, two partial first unit resonators 41X, and two first divisional resonators 41Y. The unit resonator 40X may have substantially the same mirror images as those of the first conductive layers 41 provided at each end thereof in the x direction. The first conductive layer 41 included in the unit resonator 40X may be substantially symmetric with respect to a center line extending in the z direction.

The unit resonator 40X may include one second unit resonator 42X. The unit resonator 40X may include the plurality of second unit resonators 42X. The unit resonator 40X may include one second divisional resonator 42Y. The unit resonator 40X may include the plurality of second divisional resonators 42Y. The unit resonator 40X may include a part of the second unit resonators 42X. The unit resonator 40X may include one or more partial second unit resonators 42X. The unit resonator 40X includes a plurality of partial resonators from one or more partial second unit resonators 42X, and one or more second divisional resonators 42Y. The plurality of partial resonators included in the unit resonator 40X are combined with the second unit resonator 42X corresponding to at least one resonator. The unit resonator 40X may not include the second unit resonator 42X, but may include the plurality of second divisional resonators 42Y. The unit resonator 40X may include four second divisional resonators 42Y, for example. The unit resonator 40X may include only the plurality of partial second unit resonators 42X. The unit resonator 40X includes one or more partial second unit resonators 42X, and one or more second divisional resonators 42Y. The unit resonator 40X includes, for example, two partial second unit resonators 42X, and two second divisional resonators 42Y. The unit resonator 40X may have substantially the same mirror images as those of the second conductive layers 42 provided on each end thereof in the x direction. The second conductive layer 42 included in the unit resonator 40X may be substantially symmetric with respect to a center line extending in the y direction.

In an example of a plurality of embodiments, the unit resonator 40X includes one first unit resonator 41X and a plurality of partial second unit resonators 42X. For example, the unit resonator 40X includes one first unit resonator 41X and half of four second unit resonators 42X. The unit resonator 40X includes one first unit resonator 41X and two second unit resonator 42X. The configuration included in the unit resonator 40X is not limited to this example.

The resonator 10 may include at least one unit structure 10X. The resonator 10 may include a plurality of unit structures 10X. The plurality of unit structures 10X may be arranged in the xy plane. The plurality of unit structures 10X may be arranged in a square grid (square grid), an oblique grid (oblique grid), a rectangular grid (rectangular grid), and a hexagonal grid (hexagonal grid). The unit structure 10X includes a repeating unit of any of a square grid, an oblique grid, a rectangular grid, and a hexagonal grid. The unit structure 10X may function as an artificial magnetic conductor (AMC) by being arranged infinitely along the xy plane.

The unit structure 10X may include at least part of the base 20, at least part of the third conductor 40, and at least part of the fourth conductor 50. Parts of the base 20, the third conductor 40, and the fourth conductor 50 included in the unit structure 10X overlap as viewed in the z direction. The unit structure 10X includes the unit resonator 40X, a part of the base 20 overlapping the unit resonator 40X as viewed in the z direction, and the fourth conductor 50 overlapping the unit resonator 40X as viewed in the z direction. The resonator 10 may include, for example, six unit structures 10X arranged in 2 rows and 3 columns.

The resonator 10 may have at least one unit structure 10X between two pair conductors 30 facing each other in the x direction. The two pair conductors 30 can be seen as the electric conductor extending from the unit structure 10X to the yz plane. In the unit structure 10X, an end of the y direction is opened. The unit structure 10X has high impedance in the zx planes at both ends in the y direction. The unit structure 10X can be seen as the magnetic conductor in the zx planes at both ends in the y direction. The unit structure 10X may be line symmetric with respect to the z direction when repeatedly arranged. The unit structure 10X is surrounded by two electric conductors and two high impedance planes (magnetic conductors), and as a result, has an artificial magnetic conductor character in the z direction. The unit structure 10X is surrounded by two electric conductors and two high impedance planes (magnetic conductors), and as a result, has a finite number of artificial magnetic conductor characters.

The operating frequency of the resonator 10 may be different from that of the first unit resonator 41X. The operating frequency of the resonator 10 may be different from that of the second unit resonator 42X. The operating frequency of the resonator 10 may change depending on the combination of the first unit resonator 41X and the second unit resonator 42X that constitute the unit resonator 40X.

The third conductor 40 may include the first conductive layer 41 and the second conductive layer 42. The first conductive layer 41 includes at least one first unit conductor 411. The first unit conductor 411 includes a first connecting conductor 413 and a first floating conductor 414. The first connecting conductor 413 is connected to any of the pair conductors 30. The first floating conductor 414 is not connected to the pair conductors 30. The second conductive layer 42 includes at least one second unit conductor 421. The second unit conductor 421 includes a second connecting conductor 423 and a second floating conductor 424. The second connecting conductor 423 is connected to any of the pair conductors 30. The second floating conductor 424 is not connected to the pair conductors 30. The third conductor 40 may include the first unit conductor 411 and the second unit conductor 421.

The first connecting conductor 413 may have a longer length along the x direction than the first floating conductor 414. The first connecting conductor 413 may have a shorter length along the x direction than the first floating conductor 414. The first connecting conductor 413 may have half the length along the x direction, as compared with the first floating conductor 414. The second connecting conductor 423 may have a longer length along the x direction than the second floating conductor 424. The second connecting conductor 423 may be a shorter length along the x direction than the second floating conductor 424. The second connecting conductor 423 may have half the length along the x direction as compared with the second floating conductor 424.

The third conductor 40 may include a current path 40I that is a current path between the first conductor 31 and the second conductor 32 when the resonator 10 resonates. The current path 40I may be connected to the first conductor 31 and the second conductor 32. The current path 40I has electrostatic capacitance between the first conductor 31 and the second conductor 32. The electrostatic capacitance of the current path 40I is electrically connected in series between the first conductor 31 and the second conductor 32. The conductors on the current path 40I are separated between the first conductor 31 and the second conductor 32. The current path 40I may include a conductor connected to the first conductor 31 and a conductor connected to the second conductor 32.

In some embodiments, in the current path 40I, the first unit conductor 411 and the second unit conductor 421 partially face each other in the z direction. In the current path 40I, the first unit conductor 411 and the second unit conductor 421 are capacitively coupled to each other. The first unit conductor 411 has a capacitive component at the end portion in the x direction. The first unit conductor 411 may have a capacitive component at the end portion in the y direction that faces the second unit conductor 421 in the z direction. The first unit conductor 411 may have a capacitive component at the end portion in the x direction and the end portion in the y direction that faces the second unit conductor 421 in the z direction. The second unit conductor 421 has a capacitive component at the end portion in the x direction. The second unit conductor 421 may have a capacitive component at the end portion in the y direction that faces the first unit conductor 411 in the z direction. The second unit conductor 421 may have a capacitive component at the end portion in the x direction and the end portion in the y direction that faces the first unit conductor 411 in the z direction.

The resonator 10 can have a lower resonance frequency by increasing the electrostatic capacitance coupling in the current path 40I. When achieving a desired operating frequency, the resonator 10 can have a shorter length along the x direction by increasing the electrostatic capacitance coupling of the current path 40I. In the third conductor 40, the first unit conductor 411 and the second unit conductor 421 are capacitively coupled facing each other in a stacking direction of the base 20. In the third conductor 40, the electrostatic capacitance between the first unit conductor 411 and the second unit conductor 421 can be adjusted by the opposing area.

In a plurality of embodiments, the length of the first unit conductor 411 along the y direction is different from that of the second unit conductor 421 along the y direction. In the resonator 10, when the relative position between the first unit conductor 411 and the second unit conductor 421 is shifted from the ideal position along the xy plane, since the length along the third axis is different between the first unit conductor 411 and the second unit conductor 421, it is possible to reduce the change in the magnitude of the electrostatic capacitance.

In a plurality of embodiments, the current path 40I includes one conductor spatially separated from the first conductor 31 and the second conductor 32 and capacitively coupled to the first conductor 31 and the second conductor 32.

In a plurality of embodiments, the current path 40I includes the first conductive layer 41 and the second conductive layer 42. The current path 40I includes at least one first unit conductor 411 and at least one second unit conductor 421. The current path 40I includes two first connecting conductors 413, two second connecting conductors 423, and any of one first connecting conductor 413 and one second connecting conductor 423. In the current path 40I, the first unit conductor 411 and the second unit conductor 421 may be arranged alternately along the first axis.

In a plurality of embodiments, the current path 40I includes the first connecting conductor 413 and the second connecting conductor 423. The current path 40I includes at least one first connecting conductor 413 and at least one second connecting conductor 423. In the current path 40I, the third conductor 40 has electrostatic capacitance between the first connecting conductor 413 and the second connecting conductor 423. In an example of the embodiment, the first connecting conductor 413 may face the second connecting conductor 423 and have electrostatic capacitance. In an example of the embodiment, the first connecting conductor 413 may be capacitively connected to the second connecting conductor 423 via another conductor.

In a plurality of embodiments, the current path 40I includes the first connecting conductor 413 and the second floating conductor 424. The current path 40I includes two first connecting conductors 413. In the current path 40I, the third conductor 40 has electrostatic capacitance between the two first connecting conductors 413. In an example of the embodiment, two first connecting conductors 413 may be capacitively connected to each other via at least one second floating conductor 424. In an example of the embodiment, two first connecting conductors 413 may be capacitively connected to at least one first floating conductor 414 via a plurality of second floating conductors 424.

In a plurality of embodiments, the current path 40I includes the first floating conductor 414 and the second connecting conductor 423. The current path 40I includes two second connecting conductors 423. In the current path 40I, the third conductor 40 has electrostatic capacitance between two second connecting conductors 423. In an example of the embodiment, two second connecting conductors 423 may be capacitively connected to each other via at least one first floating conductor 414. In an example of the embodiment, two second connecting conductors 423 may be capacitively connected to each other via at least one first floating conductor 414 and at least one second floating conductor 424.

In a plurality of embodiments, each of the first connecting conductor 413 and the second connecting conductor 423 may have a length of a quarter of a wavelength $\lambda$ at the resonance frequency. Each of the first connecting conductor 413 and the second connecting conductor 423 may function as a resonator having a length of half of the wavelength $\lambda$. Each of the first connecting conductor 413 and the second connecting conductor 423 can oscillate in an odd mode and an even mode due to the capacitance coupling of the respective resonators. The resonator 10 may set the resonance frequency in the even mode after the electrostatic capacitance coupling as the operating frequency.

The current path 40I may be connected to the first conductor 31 at a plurality of locations. The current path 40I may be connected to the second conductor 32 at a plurality of locations. The current path 40I may include a plurality of conductive paths that independently conduct electricity from the first conductor 31 to the second conductor 32.

In the second floating conductor 424 that is capacitively coupled to the first connecting conductor 413, an end of the second floating conductor 424 on the side that is capacitively coupled has a shorter distance from the first connecting conductor 413 than a distance from the pair conductors 30. In the first floating conductor 414 that is capacitively coupled to the second connecting conductor 423, the end of the first floating conductor 414 on the side that is capacitively coupled has the shorter distance from the second connecting conductor 423 than the distance from the pair conductors 30.

In the resonators 10 of a plurality of embodiments, the conductive layers of the third conductor 40 may have different lengths in the y direction. The conductive layer of the third conductor 40 is capacitively coupled to another conductive layer in the z direction. In the resonator 10, if the lengths of the conductive layers in the y direction are different, variation in electrostatic capacitance is small even if the conductive layer is shifted to the y direction. When the lengths of the conductive layers of the resonator 10 are different in the y direction, it is possible to widen a tolerable range of displacement of the conductive layers in the y direction.

In the resonators 10 of a plurality of embodiments, the third conductor 40 has electrostatic capacitance due to the electrostatic capacitance coupling between the conductive layers. A plurality of capacitance sites having the electrostatic capacitance may be arranged in the y direction. The plurality of capacitance sites arranged in the y direction may have an electromagnetically parallel relationship. When the resonator 10 has a plurality of capacitance sites that are electrically arranged in parallel, individual capacitance errors can be complemented to each other.

When the resonator 10 is in a resonance state, a current flowing through the pair conductors 30, the third conductor 40, and the fourth conductor 50 loops. When the resonator 10 is in a resonance state, an alternating current flows through the resonator 10. In the resonator 10, the current flowing through the third conductor 40 is a first current, and the current flowing through the fourth conductor 50 is a second current. When the resonator 10 is in the resonance state, the first current flows in the x direction in a direction different from that of the second current. For example, when the first current flows in a +x direction, the second current flows in a −x direction. When the first current flows in the −x direction, the second current flows in a +x direction. That is, when the resonator 10 is in the resonance state, the loop current alternately flows in the +x direction and the −x direction. The resonator 10 radiates electromagnetic waves by repeatedly inverting the loop current that generates a magnetic field.

In a plurality of embodiments, the third conductor 40 includes the first conductive layer 41 and the second conductive layer 42. Since in the third conductor 40, the first conductive layer 41 and the second conductive layer 42 are capacitively coupled to each other, it appears as that a current globally flows in one direction in the resonance state. In a plurality of embodiments, the current flowing through each conductor has a high density at the end portion in the y direction.

In the resonator 10, the first current and the second current loop via the pair conductors 30. In the resonator 10, the first conductor 31, the second conductor 32, the third conductor 40, and the fourth conductor 50 serve as a resonance circuit. The resonance frequency of the resonator 10 is the resonance frequency of the unit resonator. When the resonator 10 includes one unit resonator or when the resonator 10 includes part of the unit resonator, the resonance frequency of resonator 10 varies depending on the electromagnetic coupling of the base 20, the pair conductors 30, the third conductor 40, and the fourth conductor 50 with the surroundings of the resonator 10. For example, when periodicity of the third conductor 40 is poor, the entire resonator 10 is one unit resonator, or entire resonator 10 is a part of one unit resonator. For example, the resonance frequency of the resonator 10 varies depending on the length of the first conductor 31 and the second conductor 32 in the z direction, the length of the third conductor 40 and the fourth conductor 50 in the x direction, and the electrostatic capacitance of the third conductor 40 and the fourth conductor 50. For example, the resonator 10 having a large capacitance between the first unit conductor 411 and the second unit conductor 421 can make the resonance frequency a low frequency while reducing the length of the first conductor 31 and the second conductor 32 in the z direction and the length of the third conductor 40 and the fourth conductor 50 in the x direction.

In a plurality of embodiments, in the resonator 10, the first conductive layer 41 serves as an effective radiation surface of the electromagnetic waves in the z direction. In a plurality of embodiments, in the resonator 10, the first surface integral of the first conductive layer 41 is larger than the first surface integral of another conductive layer. The resonator 10 can increase the radiation of the electromagnetic waves by increasing the first surface integral of the first conductive layer 41.

In a plurality of embodiments, the resonator 10 may include one or more impedance elements 45. The impedance element 45 has an impedance value between a plurality of terminals. The impedance element 45 changes the resonance frequency of the resonator 10. The impedance element 45 may include a resistor (Resistor), a capacitor (Capacitor), and an inductor (Inductor). The impedance element 45 can include a variable element whose impedance value may change. The variable element may change the impedance value according to an electric signal. The variable element may change the impedance value by physical mechanism.

The impedance element 45 may be connected to two unit conductors of the third conductor 40 arranged in the x direction. The impedance element 45 may be connected to two first unit conductors 411 arranged in the x direction. The impedance element 45 may be connected to the first connecting conductor 413 and the first floating conductor 414 which are arranged in the x direction. The impedance element 45 may be connected to the first conductor 31 and the first floating conductor 414. The impedance element 45 may be connected to the unit conductor of the third conductor 40 at a central portion in the y direction. The impedance element 45 is connected to the central portion of the y direction of two first unit conductors 411.

The impedance element 45 is electrically connected in series between two conductors arranged in the x direction in the xy plane. The impedance element 45 may be electrically connected in series between two first unit conductors 411 arranged in the x direction. The impedance element 45 may electrically be connected in series between the first connecting conductor 413 and the first floating conductor 414, which are arranged in the x direction. The impedance element 45 may be electrically connected in series between the first conductor 31 and the first floating conductor 414.

The impedance element 45 may be electrically connected in parallel to two first unit conductors 411 and second unit conductor 421 that are stacked in the z direction and have electrostatic capacitance. The impedance element 45 may be electrically connected in parallel to the second connecting conductor 423 and the first floating conductor 414 that are stacked in the z direction and have electrostatic capacitance.

The resonator 10 can reduce the resonance frequency by adding a capacitor as the impedance element 45. The resonator 10 can increase the resonance frequency by adding an inductor as the impedance element 45. The resonator 10 may include the impedance elements 45 having different impedance values. The resonator 10 may include capacitors having different electric capacities as the impedance elements 45. The resonator 10 may include inductors having different inductances as the impedance elements 45. In the resonator 10, the adjustment range of the resonance frequency is caused to be large by adding the impedance elements 45 having different impedance values. The resonator 10 may include both a capacitor and an inductor as the impedance elements 45. In the resonator 10, the adjustment range of the resonance frequency is caused to be large by simultaneously adding the capacitor and the inductor as the impedance element 45. By providing the impedance element 45, the entire resonator 10 may be a unit resonator or the entire resonator 10 may be a part of a unit resonator.

Figure 1:
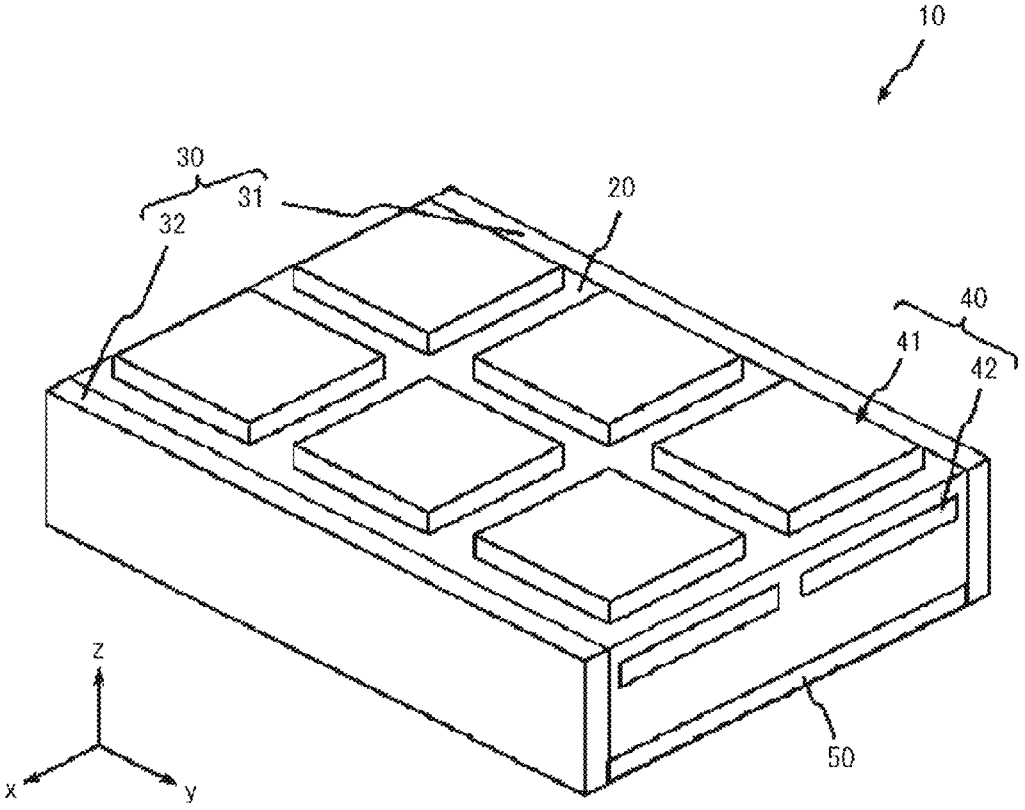
FIG. 1 is a perspective view illustrating one embodiment of a resonator.
Figure 2:
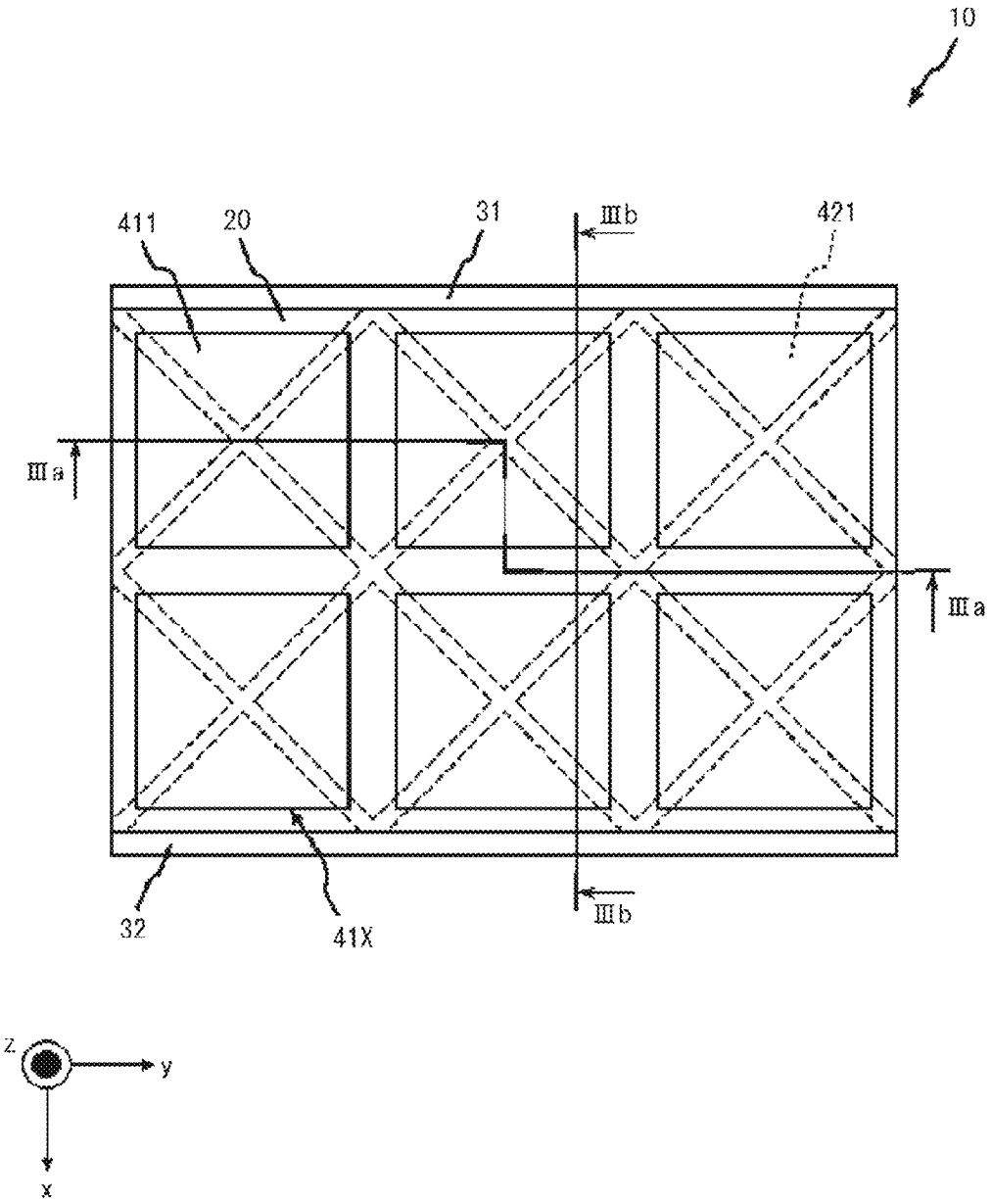
FIG. 2 is a plan view of the resonator illustrated in FIG. 1.
Figure 3A:
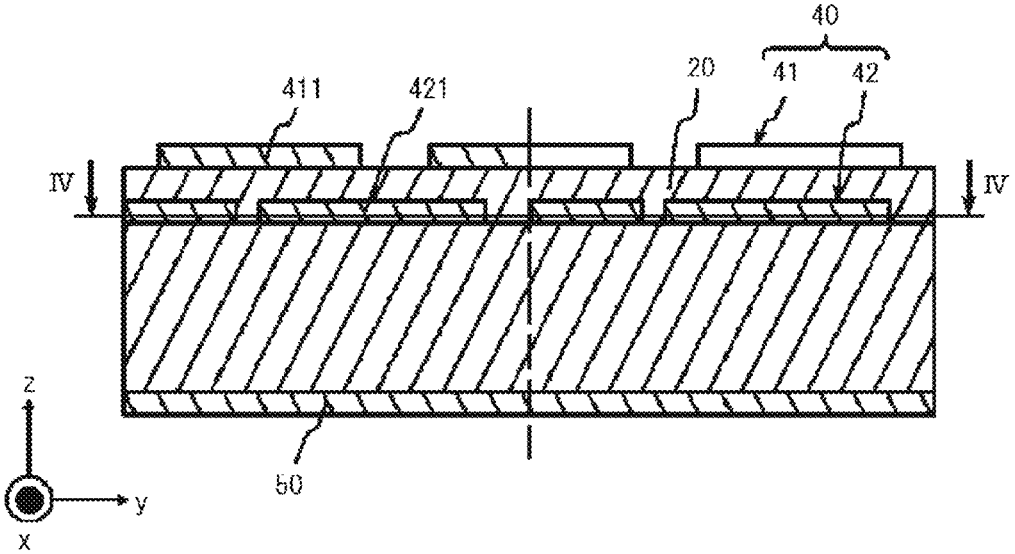
FIG. 3A is a cross-sectional view of the resonator illustrated in FIG. 1.
Figure 3B:
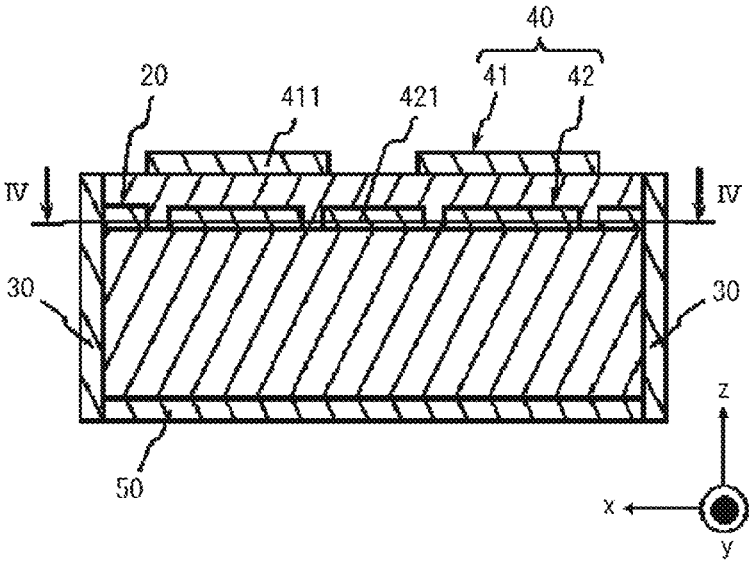
FIG. 3B is a cross-sectional view of the resonator illustrated in FIG. 1.
Figure 4:
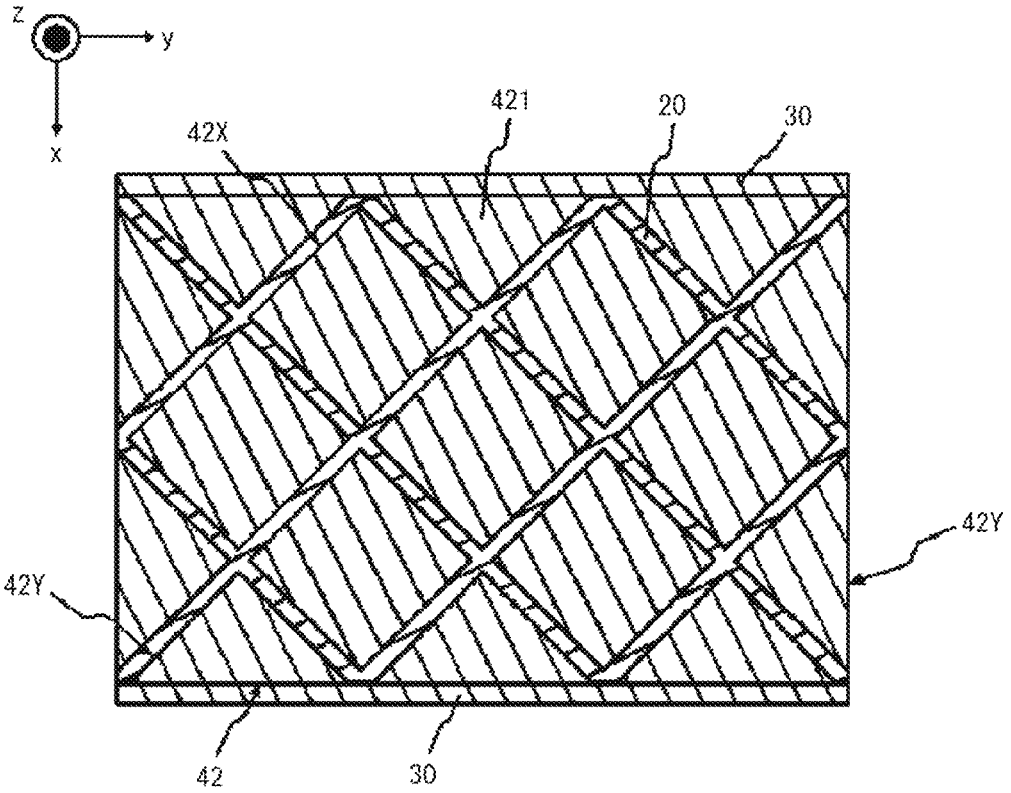
FIG. 4 is a cross-sectional view of the resonator illustrated in FIG. 1.
Figure 5:
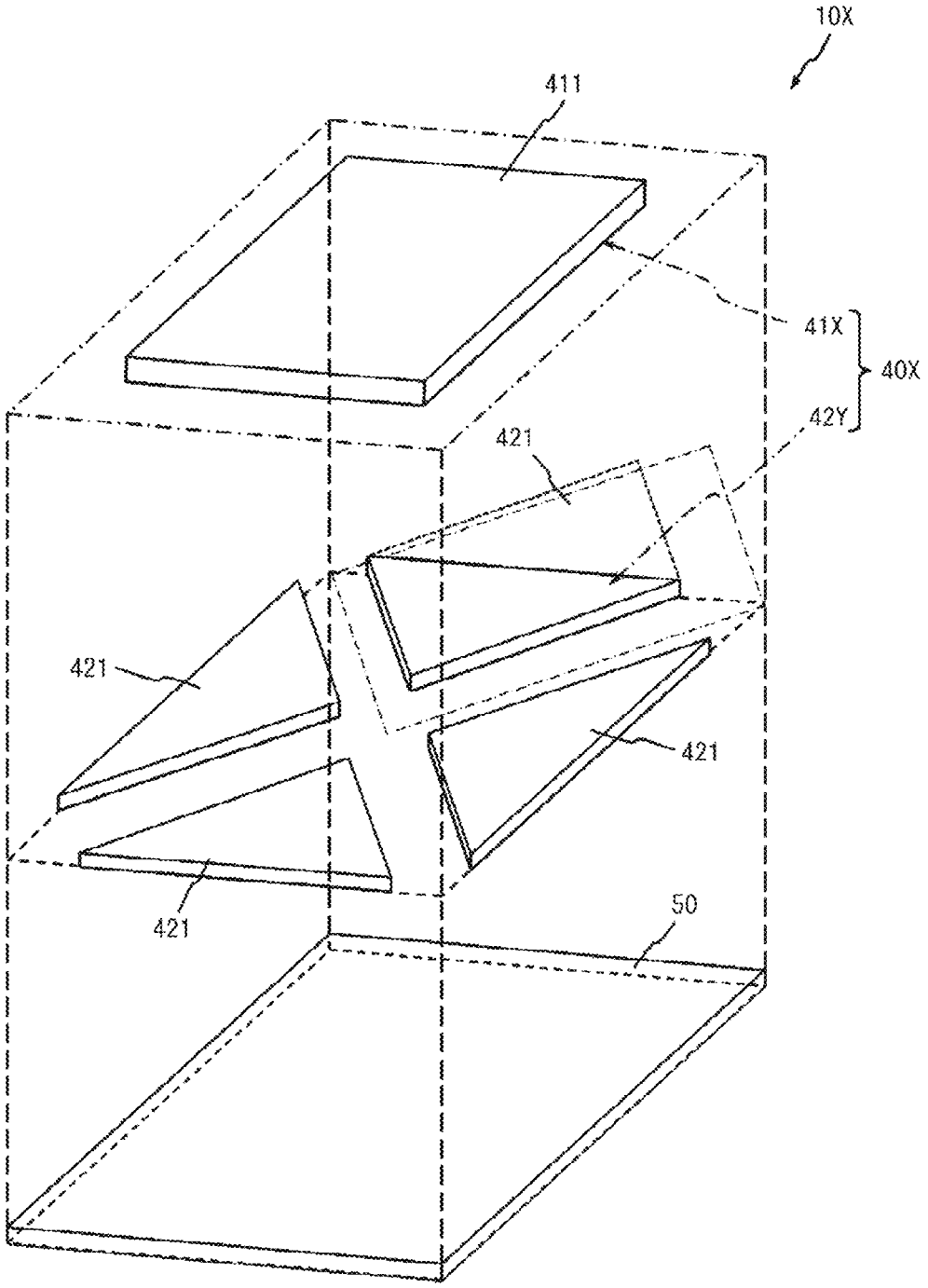
FIG. 5 is a conceptual diagram illustrating a unit structure of the resonator illustrated in FIG. 1.

FIGS. 1 to 5 are diagrams illustrating the resonator 10, which is an example of a plurality of embodiments. FIG. 1 is a schematic diagram of the resonator 10. FIG. 2 is a plan view of the xy plane from the z direction. FIG. 3A is a cross-sectional view taken along line IIIa-IIIa illustrated in FIG. 2. FIG. 3B is a cross-sectional view taken along line IIIb-IIIb illustrated in FIG. 2. FIG. 4 is a cross-sectional view taken along the line IV-IV illustrated in FIGS. 3A and 3B. FIG. 5 is a conceptual diagram illustrating the unit structure 10X which is an example of a plurality of embodiments.

In the resonator 10 illustrated in FIGS. 1 to 5, the first conductive layer 41 includes the patch type resonator as the first unit resonator 41X. The second conductive layer 42 includes the patch type resonator as the second unit resonator 42X. The unit resonator 40X includes one first unit resonator 41X and four second divisional resonators 42Y. The unit structure 10X includes the unit resonator 40X as well as a part of the base 20 and a part of the fourth conductor 50 overlapping the unit resonator 40X as viewed in the z direction.

Figure 6:
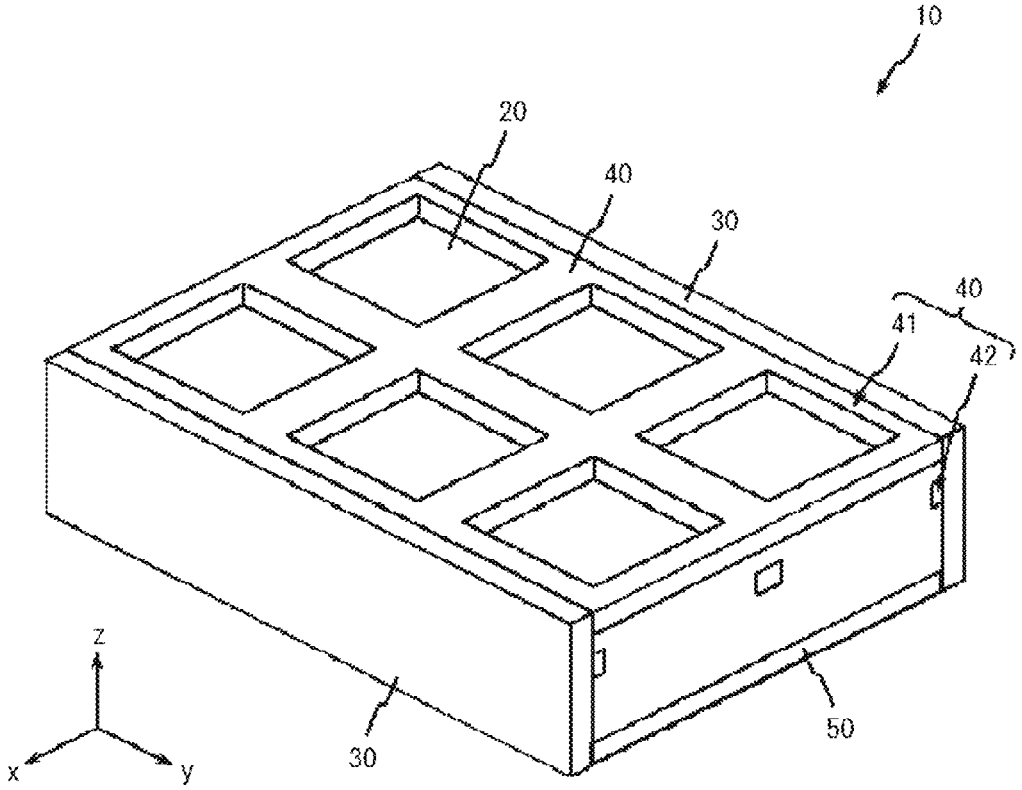
FIG. 6 is a perspective view illustrating one embodiment of a resonator.
Figure 7:
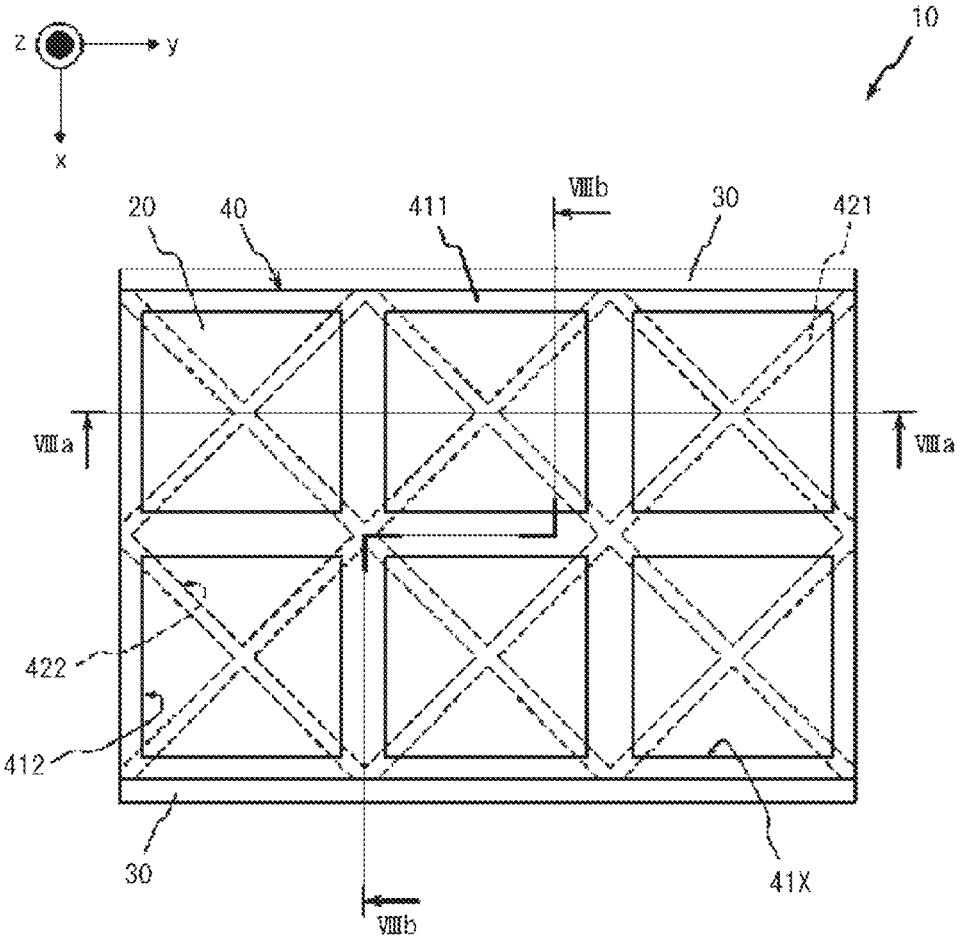
FIG. 7 is a plan view of the resonator illustrated in FIG. 6.
Figure 8A:
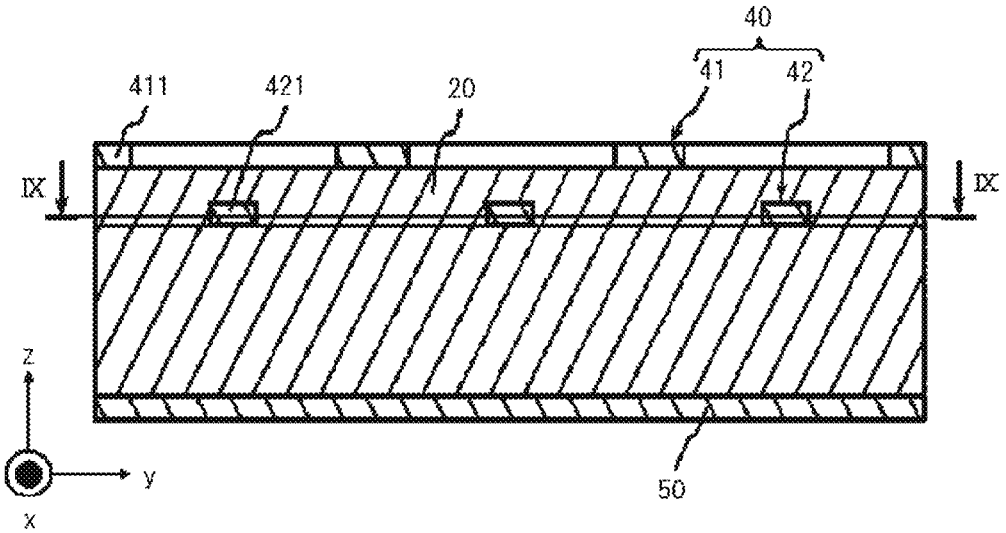
FIG. 8A is a cross-sectional view of the resonator illustrated in FIG. 6.
Figure 8B:
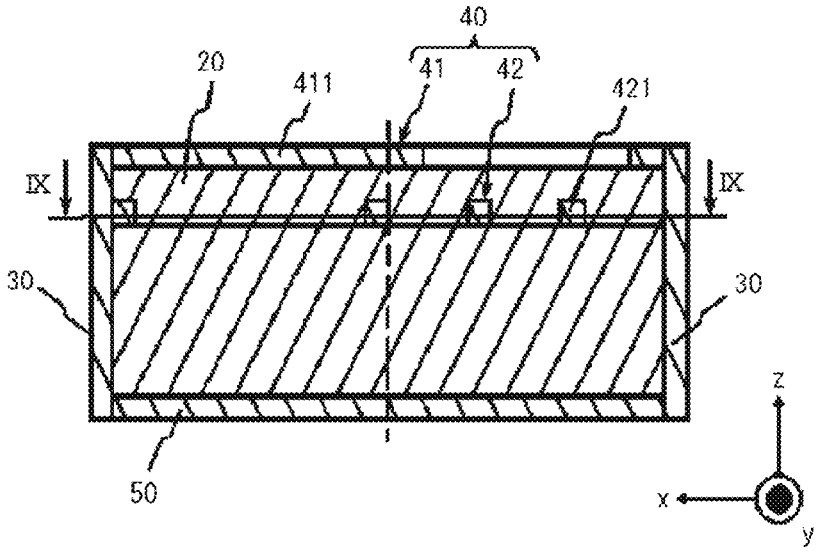
FIG. 8B is a cross-sectional view of the resonator illustrated in FIG. 6.
Figure 9:
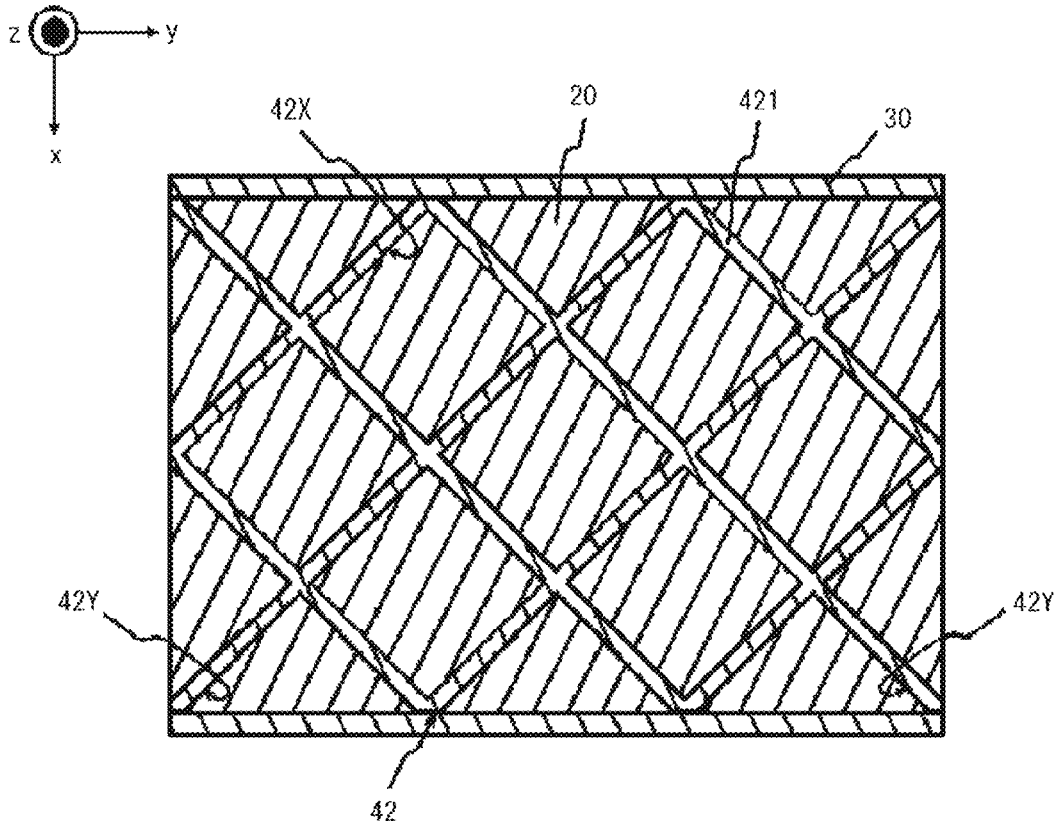
FIG. 9 is a cross-sectional view of the resonator illustrated in FIG. 6.

FIGS. 6 to 9 are diagrams illustrating the resonator 10, which is an example of a plurality of embodiments. FIG. 6 is a schematic diagram of the resonator 10. FIG. 7 is a plan view of the xy plane from the z direction. FIG. 8A is a cross-sectional view taken along line VIIIa-VIIIa illustrated in FIG. 7. FIG. 8B is a cross-sectional view taken along line VIIIb-VIIIb illustrated in FIG. 7. FIG. 9 is a cross-sectional view taken along the line IX-IX illustrated in FIGS. 8A and 8B.

In the resonator 10 illustrated in FIGS. 6 to 9, the first conductive layer 41 includes the slot type resonator as the first unit resonator 41X. The second conductive layer 42 includes the slot type resonator as the second unit resonator 42X. The unit resonator 40X includes one first unit resonator 41X and four second divisional resonators 42Y. The unit structure 10X includes the unit resonator 40X as well as a part of the base 20 and a part of the fourth conductor 50 overlapping the unit resonator 40X as viewed in the z direction.

Figure 10:
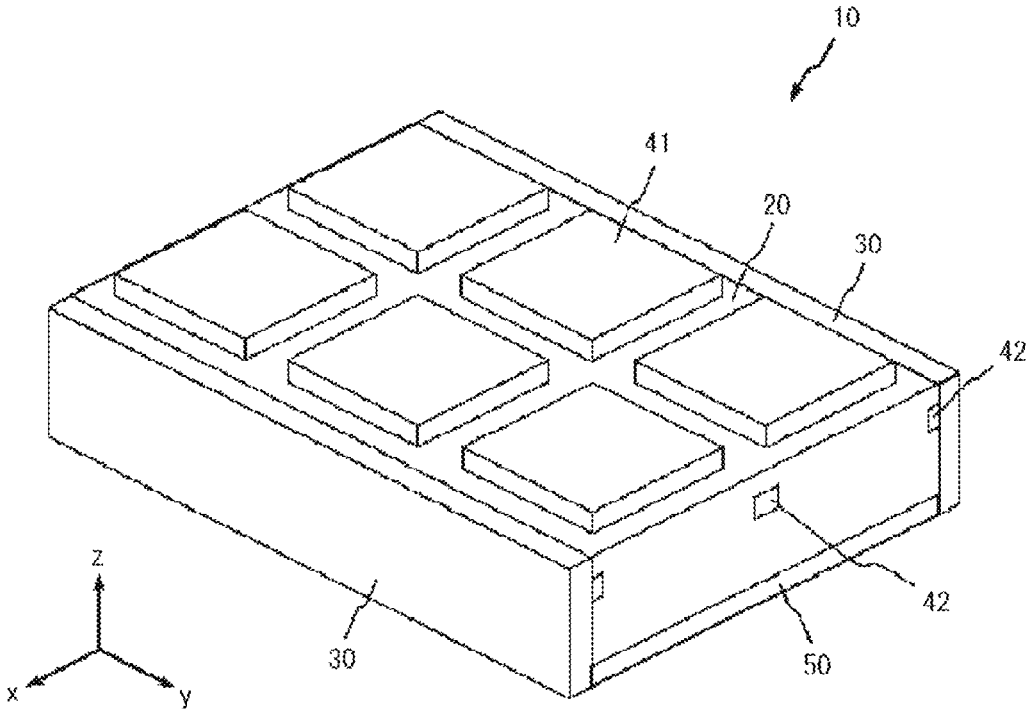
FIG. 10 is a perspective view illustrating one embodiment of a resonator.
Figure 11:
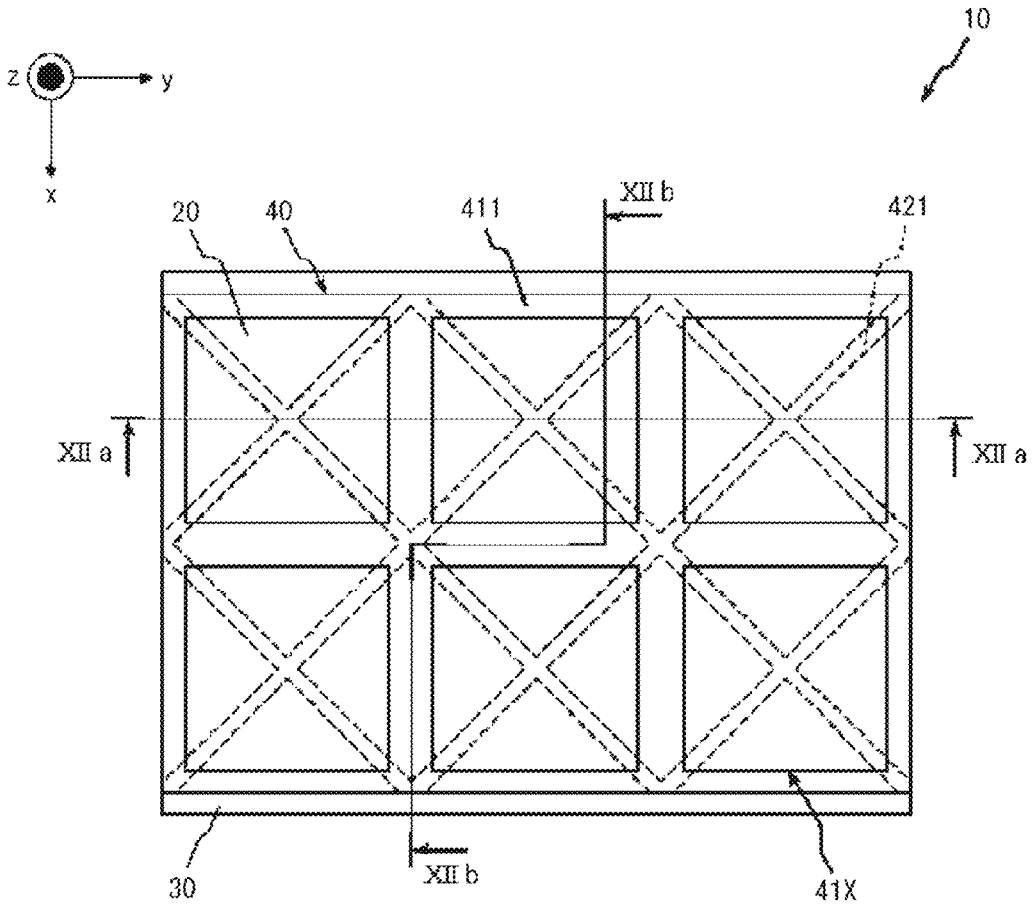
FIG. 11 is a plan view of the resonator illustrated in FIG. 10.
Figure 12A:
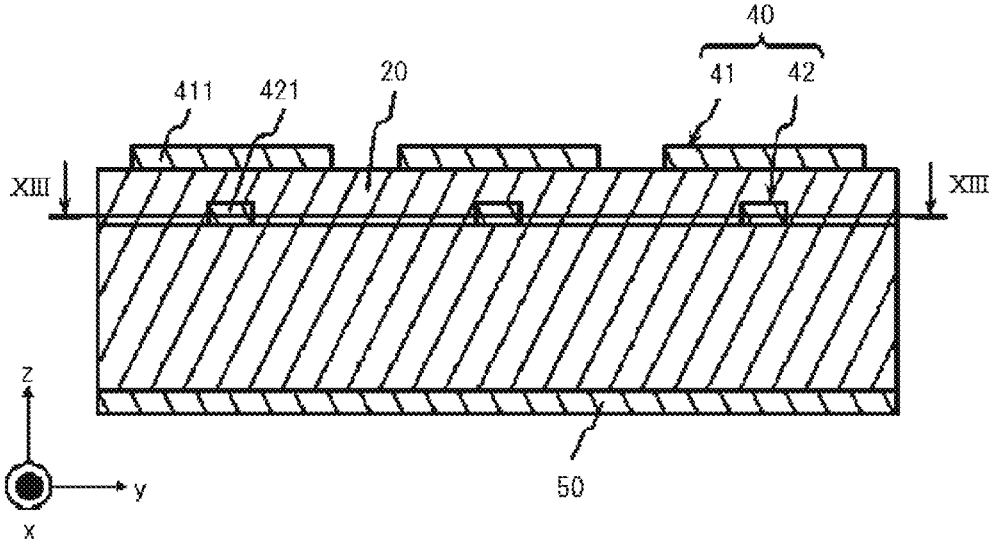
FIG. 12A is a cross-sectional view of the resonator illustrated in FIG. 10.
Figure 12B:
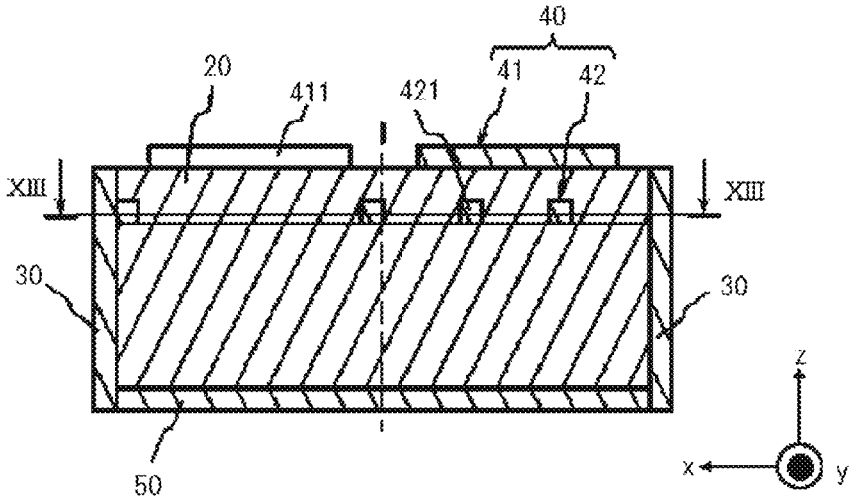
FIG. 12B is a cross-sectional view of the resonator illustrated in FIG. 10.
Figure 13:
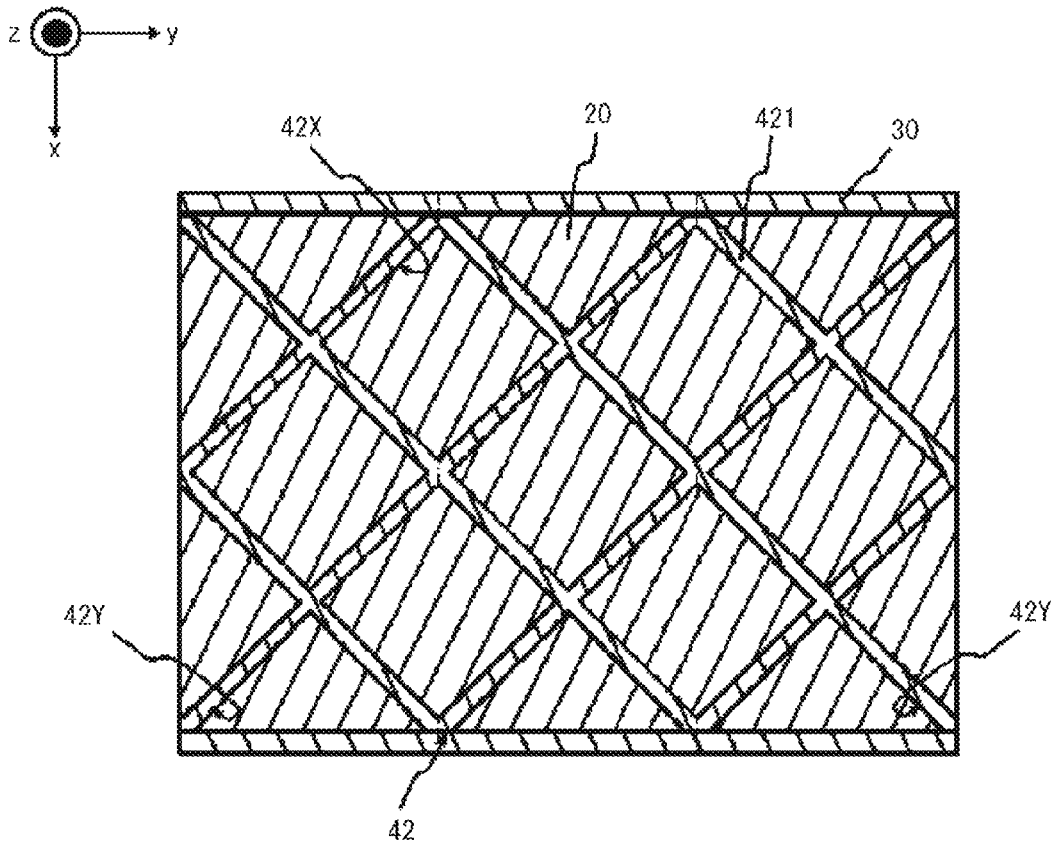
FIG. 13 is a cross-sectional view of the resonator illustrated in FIG. 10.

FIGS. 10 to 13 are diagrams illustrating the resonator 10, which is an example of a plurality of embodiments. FIG. 10 is a schematic diagram of the resonator 10. FIG. 11 is a plan view of the xy plane from the z direction. FIG. 12A is a cross-sectional view taken along line XIIa-XIIa illustrated in FIG. 11. FIG. 12B is a cross-sectional view taken along line XIIb-XIIb illustrated in FIG. 11. FIG. 13 is a cross-sectional view taken along the line XIII-XIII illustrated in FIGS. 12A and 12B.

In the resonator 10 illustrated in FIGS. 10 to 13, the first conductive layer 41 includes the patch type resonator as the first unit resonator 41X. The second conductive layer 42 includes the slot type resonator as the second unit resonator 42X. The unit resonator 40X includes one first unit resonator 41X and four second divisional resonators 42Y. The unit structure 10X includes the unit resonator 40X as well as a part of the base 20, and a part of the fourth conductor 50 overlapping the unit resonator 40X as viewed in the z direction.

Figure 14:
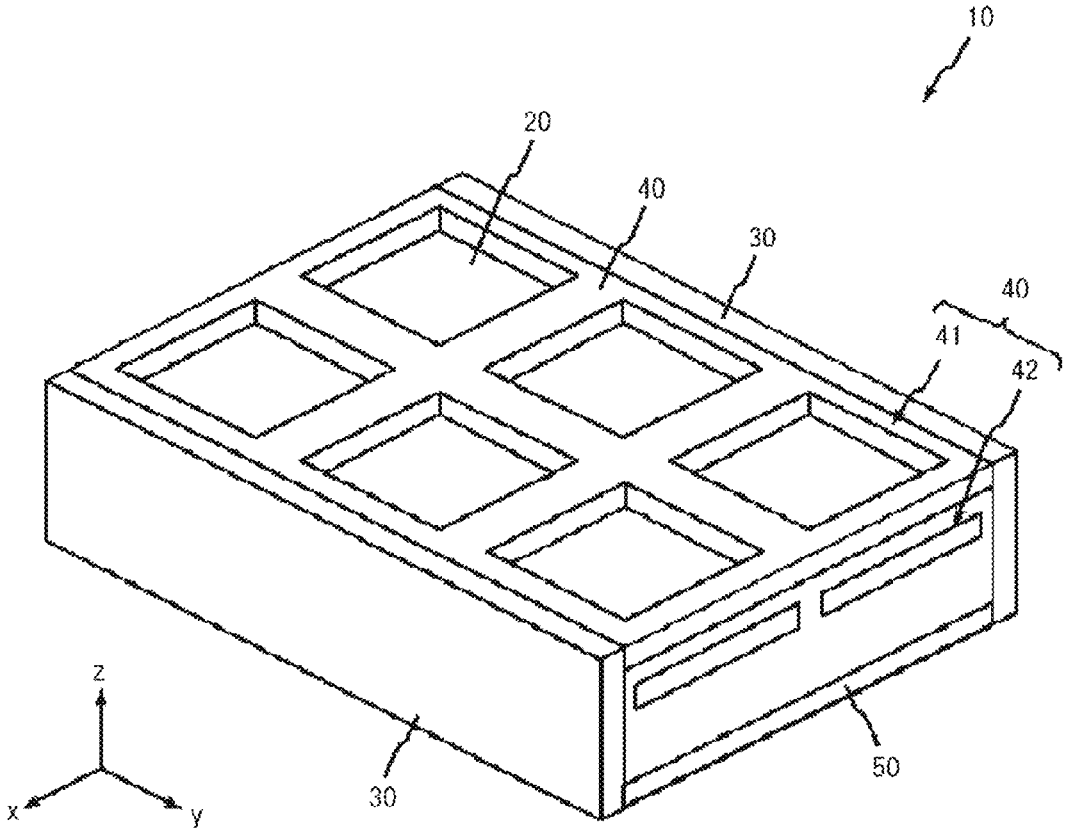
FIG. 14 is a perspective view illustrating one embodiment of a resonator.
Figure 15:
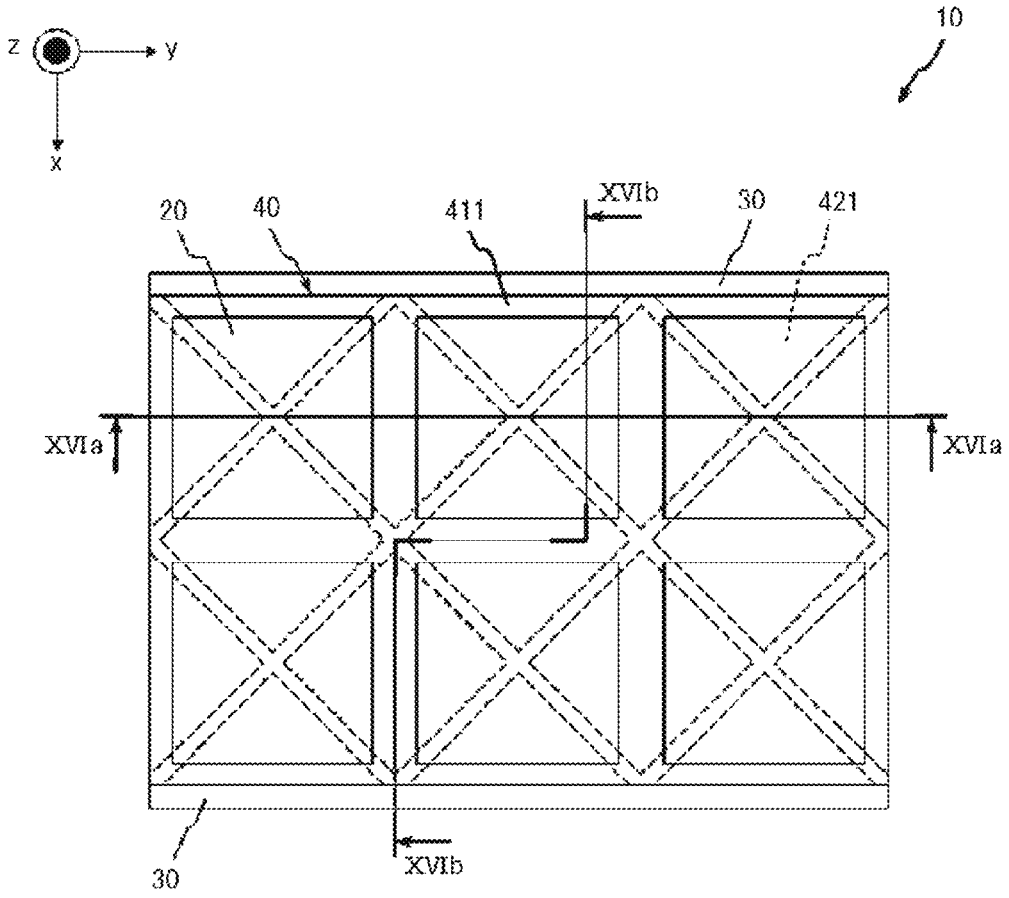
FIG. 15 is a plan view of the resonator illustrated in FIG. 14.
Figure 16A:
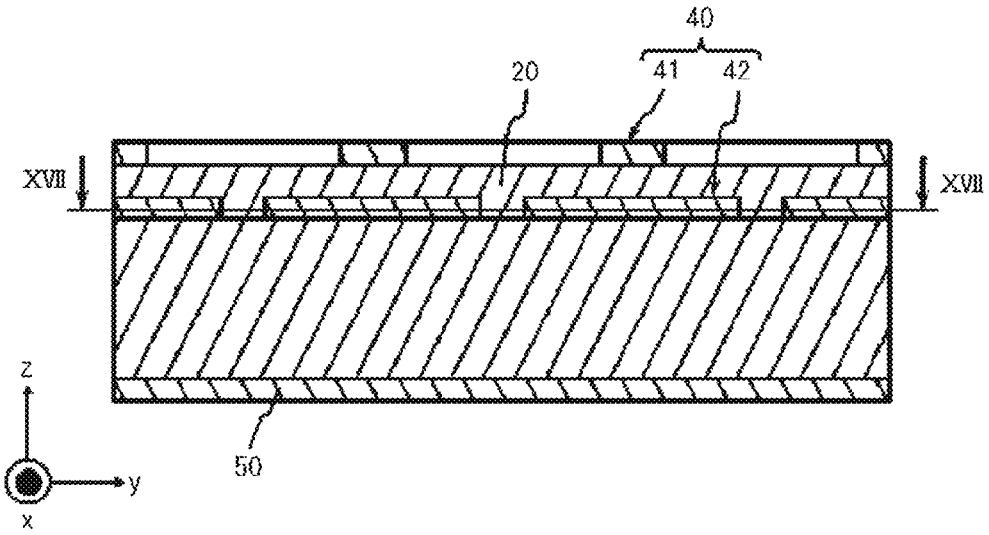
FIG. 16A is a cross-sectional view of the resonator illustrated in FIG. 14.
Figure 16B:
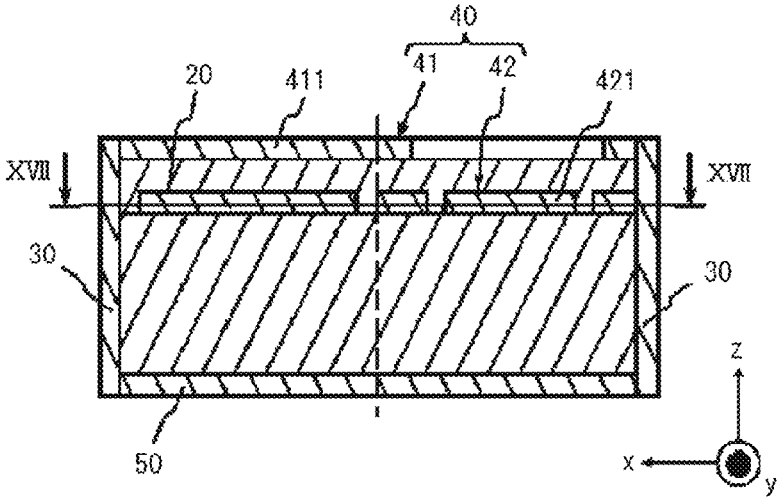
FIG. 16B is a cross-sectional view of the resonator illustrated in FIG. 14.
Figure 17:
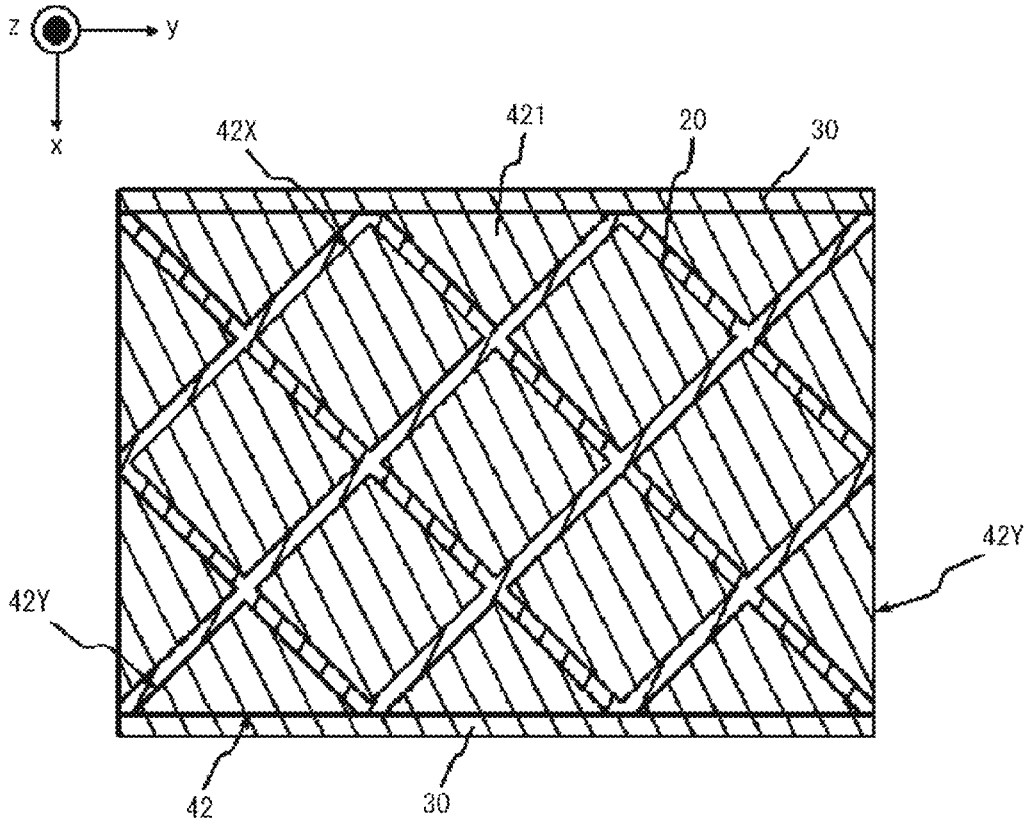
FIG. 17 is a cross-sectional view of the resonator illustrated in FIG. 14.

FIGS. 14 to 17 are diagrams illustrating the resonator 10, which is an example of a plurality of embodiments. FIG. 14 is a schematic diagram of the resonator 10. FIG. 15 is a plan view of the xy plane from the z direction. FIG. 16A is a cross-sectional view taken along line XVIa-XVIa illustrated in FIG. 15. FIG. 16B is a cross-sectional view taken along line XVIb-XVIb illustrated in FIG. 15. FIG. 17 is a cross-sectional view taken along the line XVII-XVII illustrated in FIGS. 16A and 16B.

In the resonator 10 illustrated in FIGS. 14 to 17, the first conductive layer 41 includes the slot type resonator as the first unit resonator 41X. The second conductive layer 42 includes the patch type resonator as the second unit resonator 42X. The unit resonator 40X includes one first unit resonator 41X and four second divisional resonators 42Y. The unit structure 10X includes the unit resonator 40X as well as a part of the base 20 and a part of the fourth conductor 50 overlapping the unit resonator 40X as viewed in the z direction.

Figure 18:
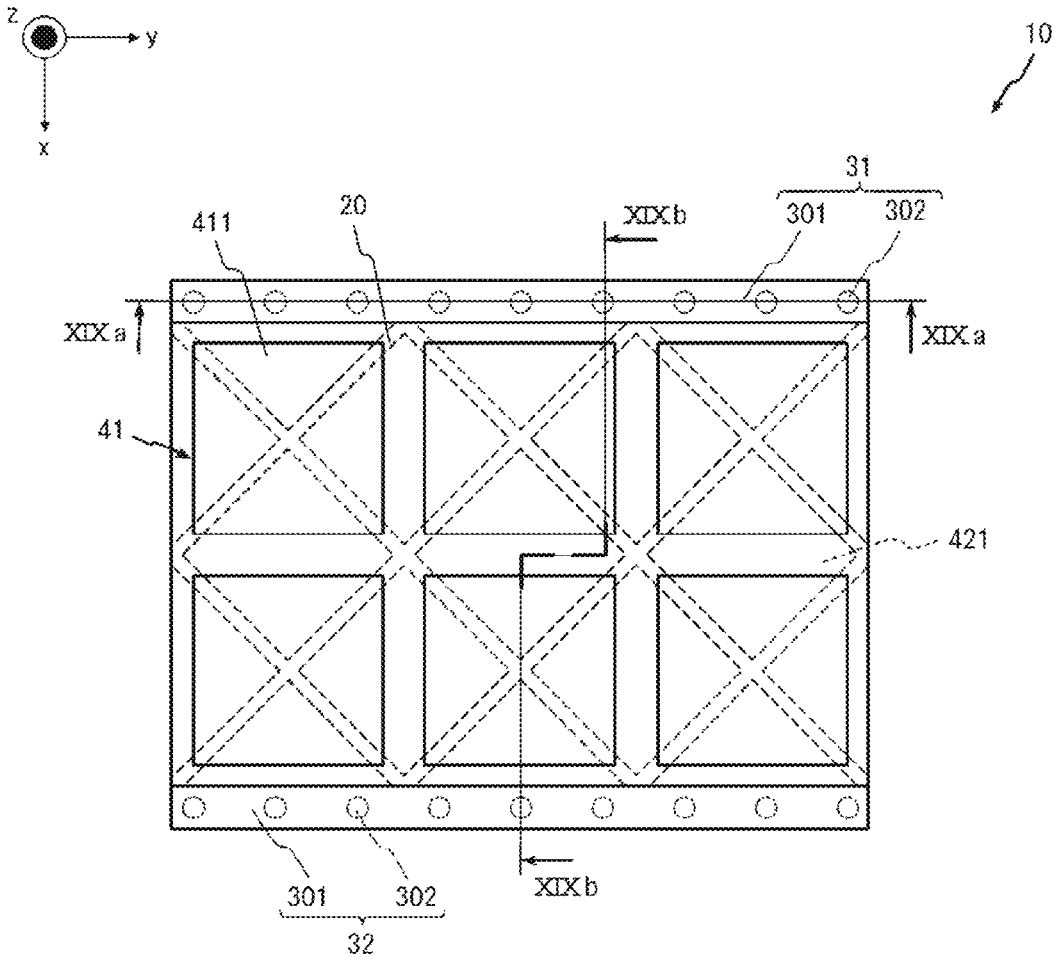
FIG. 18 is a plan view illustrating one embodiment of a resonator.
Figure 19A:
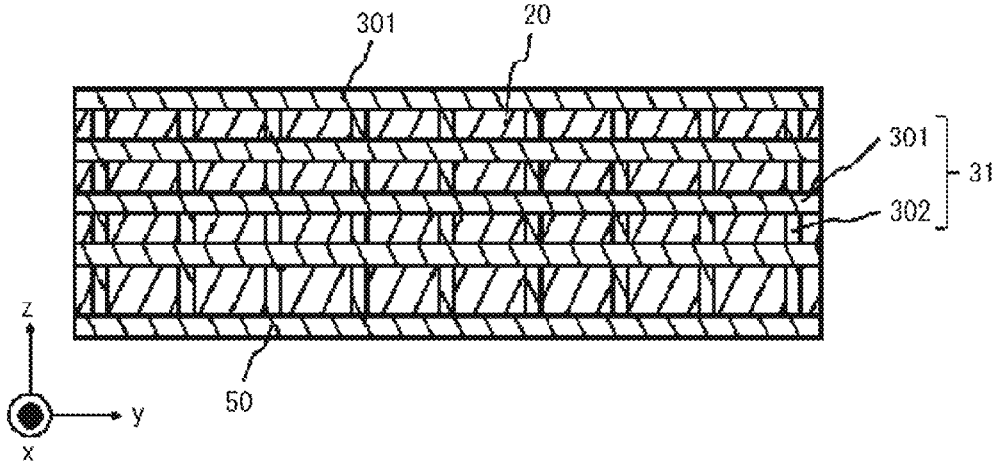
FIG. 19A is a cross-sectional view of the resonator illustrated in FIG. 18.
Figure 19B:
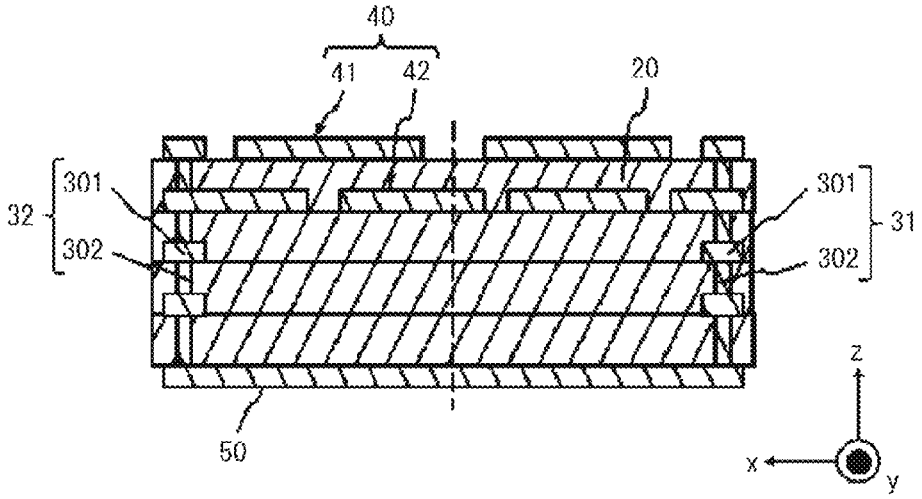
FIG. 19B is a cross-sectional view of the resonator illustrated in FIG. 18.

The resonator 10 illustrated in FIGS. 1 to 17 is an example. The configuration of the resonator 10 is not limited to the configuration illustrated in FIGS. 1 to 17. FIG. 18 is a diagram illustrating a resonator 10 including pair conductors 30 having another configuration. FIG. 19A is a cross-sectional view taken along line XIXa-XIXa illustrated in FIG. 18. FIG. 19B is a cross-sectional view taken along line XIXb-XIXb illustrated in FIG. 18.

Figure 20:
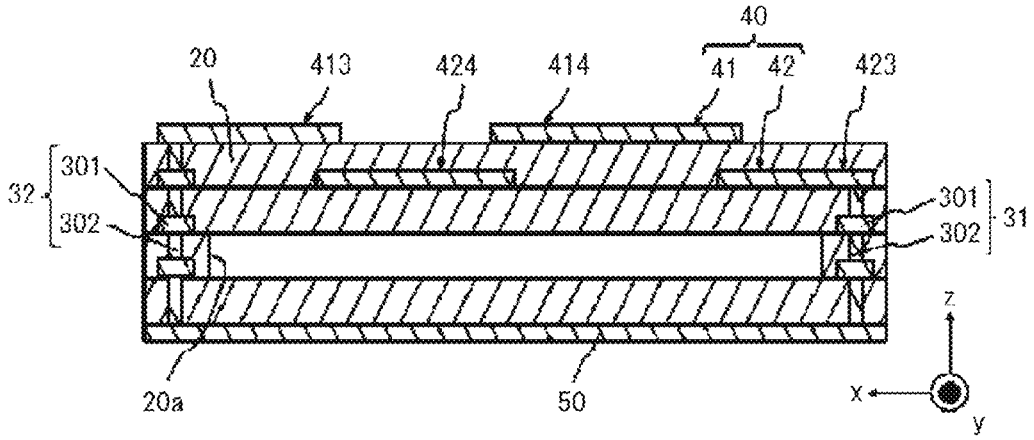
FIG. 20 is a cross-sectional view illustrating one embodiment of a resonator.

The base 20 illustrated in FIGS. 1 to 19 is an example. The configuration of the base 20 is not limited to the configuration illustrated in FIGS. 1 to 19. The base 20 may include a cavity 20*a* provided therein as illustrated in FIG. 20 In the z direction, the cavity 20*a* is located between the third conductor 40 and the fourth conductor 50. The permittivity of the cavity 20*a* is lower than that of the base 20. When the base 20 has the cavity 20*a*, an electromagnetic distance between the third conductor 40 and the fourth conductor 50 can be shortened.

Figure 21:
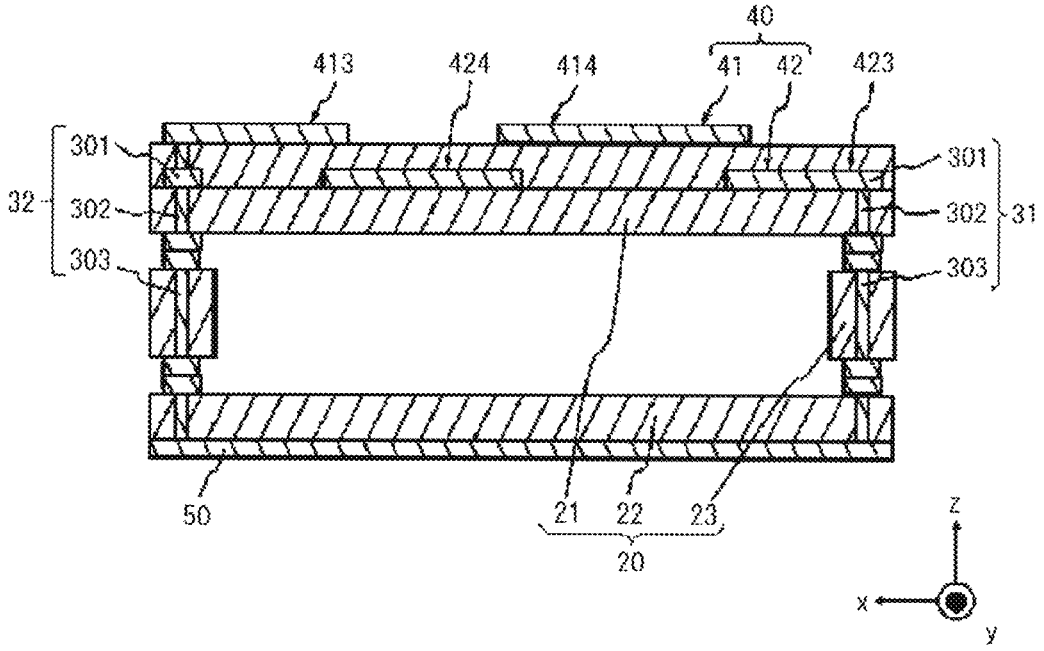
FIG. 21 is a plan view illustrating one embodiment of the resonator.

The base 20 may include a plurality of members as illustrated in FIG. 21. The base 20 may include a first base 21, a second base 22, and a connector 23. The first base 21 and the second base 22 may be mechanically connected via the connector 23. The connector 23 may include a sixth conductor 303 provided therein. The sixth conductor 303 is electrically connected to the fifth conductive layer 301 or the fifth conductor 302. The sixth conductor 303 is with the fifth conductive layer 301 and the fifth conductor 302 into the first conductor 31 or the second conductor 32.

Figure 22A:
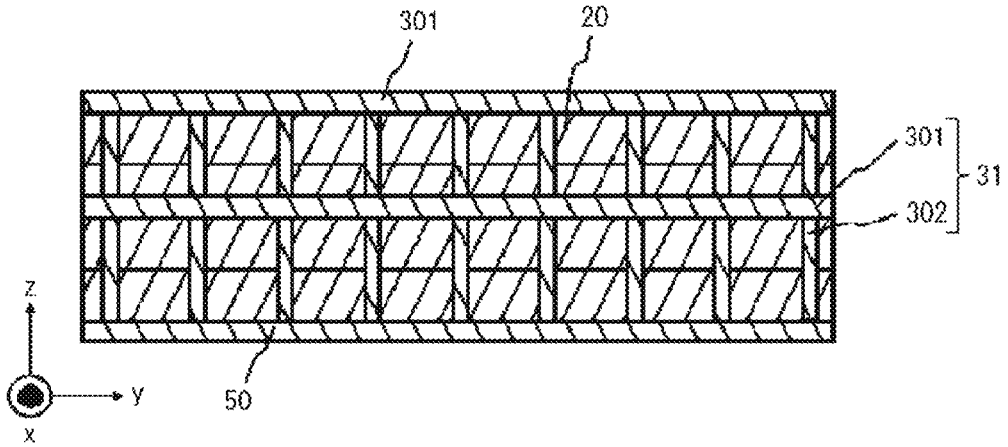
FIG. 22A is a cross-sectional view illustrating one embodiment of the resonator.
Figure 22B:
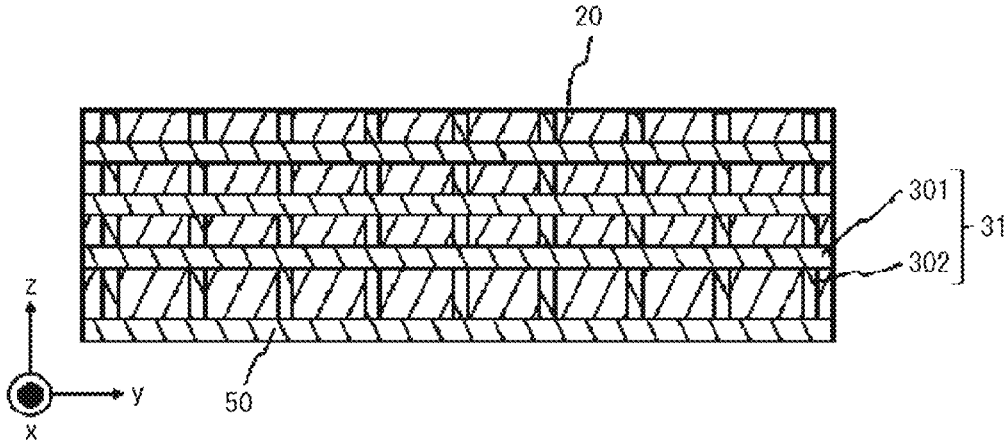
FIG. 22B is a cross-sectional view illustrating one embodiment of the resonator.
Figure 22C:
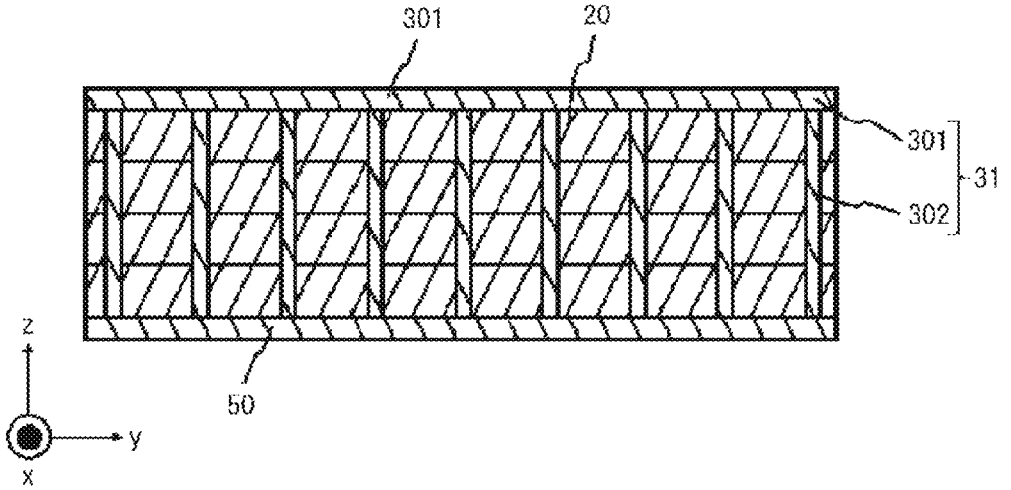
FIG. 22C is a cross-sectional view illustrating one embodiment of the resonator.

The pair conductors 30 illustrated in FIGS. 1 to 21 is an example. The configuration of the pair conductors 30 is not limited to the configuration illustrated in FIGS. 1 to 21. FIGS. 22 to 28 are diagrams illustrating the resonator 10 including the pair conductors 30 having another configuration. FIGS. 22A to 22C are cross-sectional views corresponding to FIG. 19A. As illustrated in FIG. 22A, the number of fifth conductive layers 301 may change as appropriate. As illustrated in FIG. 22B, the fifth conductive layer 301 may not be located on the base 20. As illustrated in FIG. 22C, the fifth conductive layer 301 may not be located in the base 20.

Figure 23:
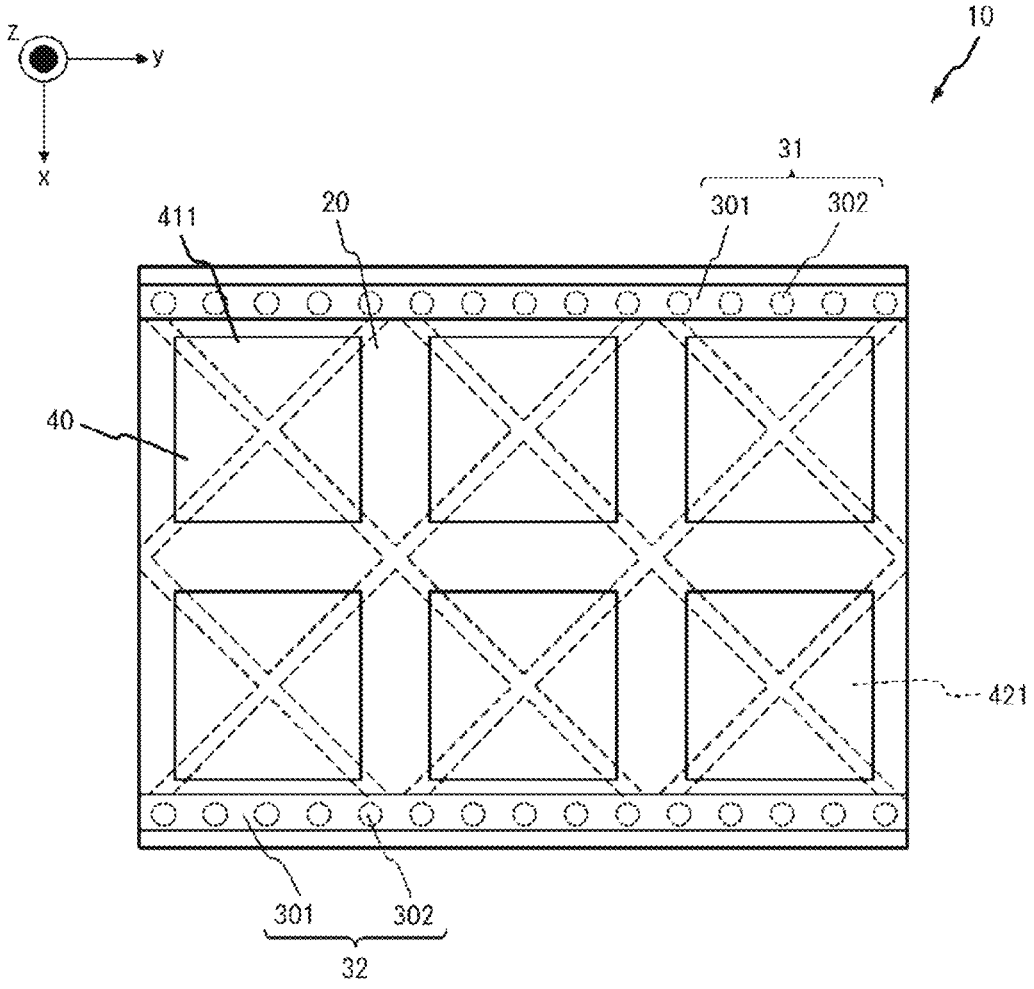
FIG. 23 is a plan view illustrating one embodiment of the resonator.
Figure 24:
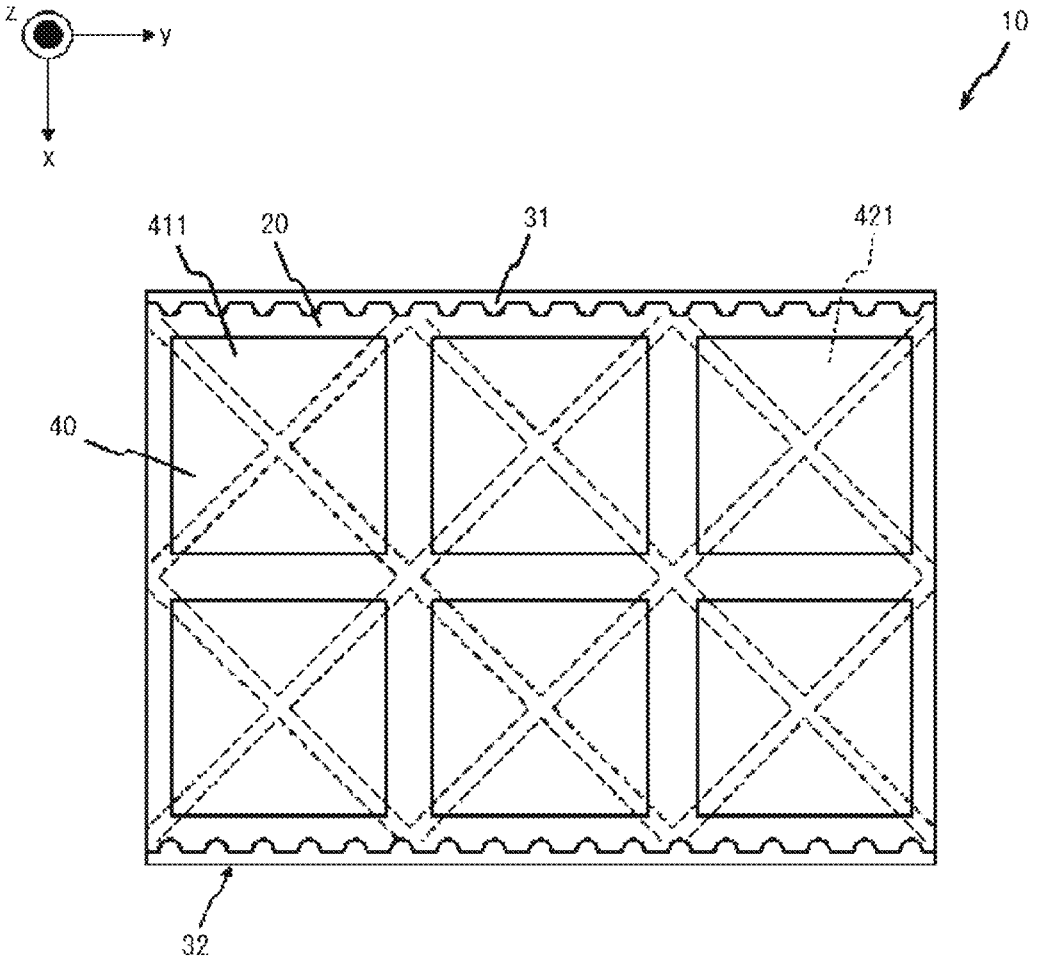
FIG. 24 is a plan view illustrating one embodiment of the resonator.

FIG. 23 is a plan view corresponding to FIG. 18. As illustrated in FIG. 23, the resonator 10 may separate the fifth conductor 302 from a boundary of the unit resonator 40X. FIG. 24 is a plan view corresponding to FIG. 18. As illustrated in FIG. 24, two pair conductors 30 may have convex portions that protrude toward the other pair conductors 30 forming a pair. Such a resonator 10 may be formed, for example, by applying metal paste to the base 20 having a recess and curing the metal paste.

Figure 25:
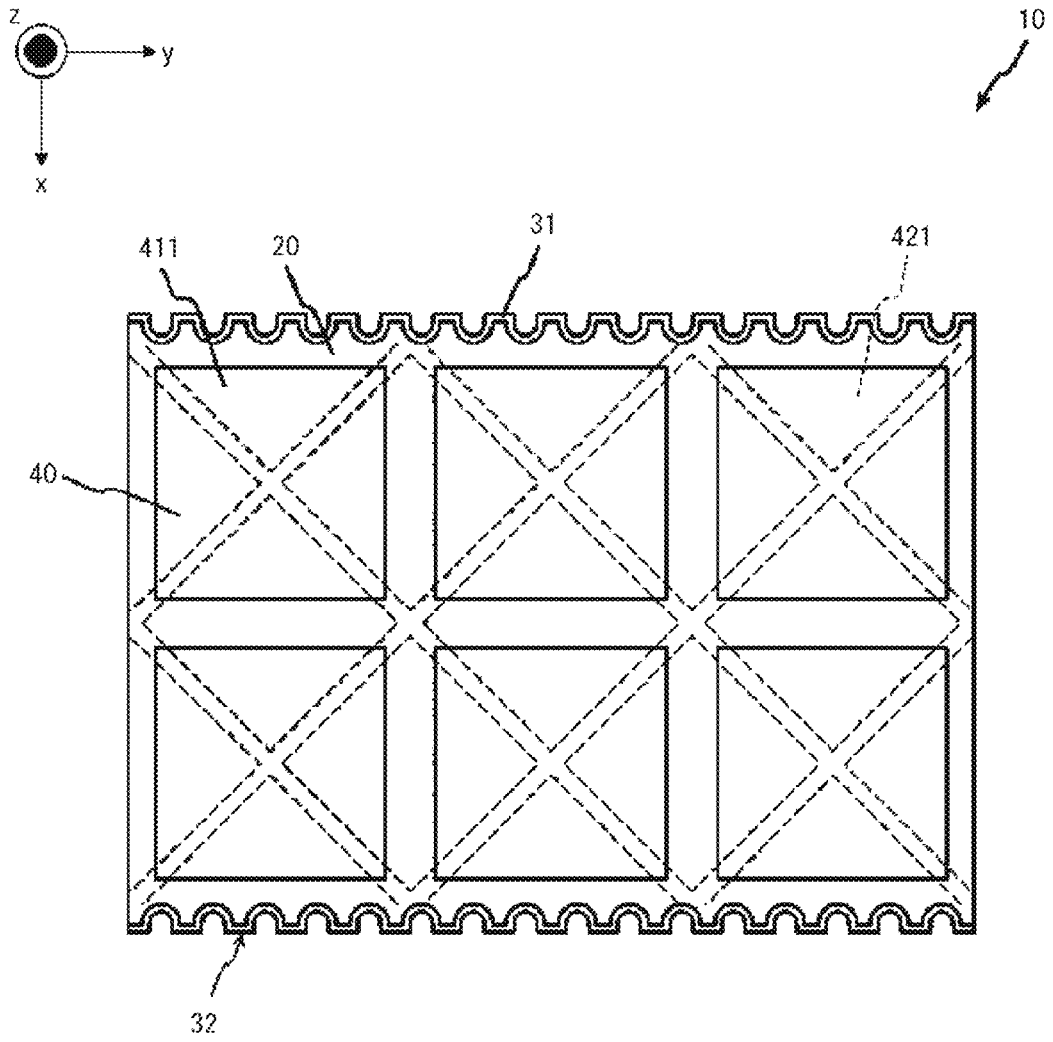
FIG. 25 is a plan view illustrating one embodiment of the resonator.

FIG. 25 is a plan view corresponding to FIG. 18. As illustrated in FIG. 25, the base 20 may have a recess. As illustrated in FIG. 25, the pair conductors 30 have a recess that is recessed inward from an outer surface in the x direction. As illustrated in FIG. 25, the pair conductors 30 extend along a surface of the base 20. Such a resonator 10 may be formed, for example, by spraying a fine metal material on the base 20 having the recess.

Figure 26:
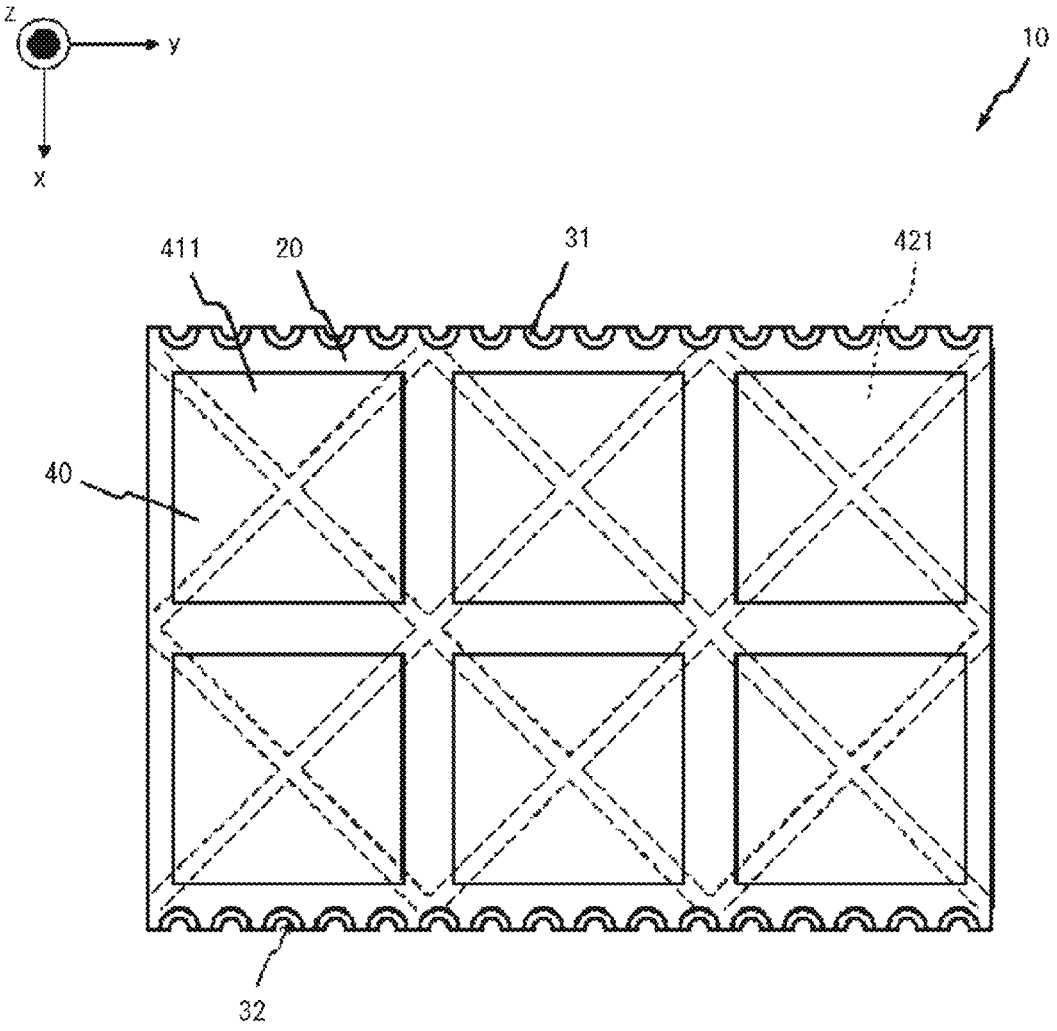
FIG. 26 is a plan view illustrating one embodiment of the resonator.

FIG. 26 is a plan view corresponding to FIG. 18. As illustrated in FIG. 26, the base 20 may have a recess. As illustrated in FIG. 26, the pair conductors 30 have a recess that is recessed inward from an outer surface in the x direction. As illustrated in FIG. 26, the pair conductors 30 extend along the recess of the base 20. Such a resonator 10 can be manufactured, for example, by dividing a motherboard along the arrangement of through hole conductors. Such pair conductors 30 may be referred to as end face through holes.

Figure 27:
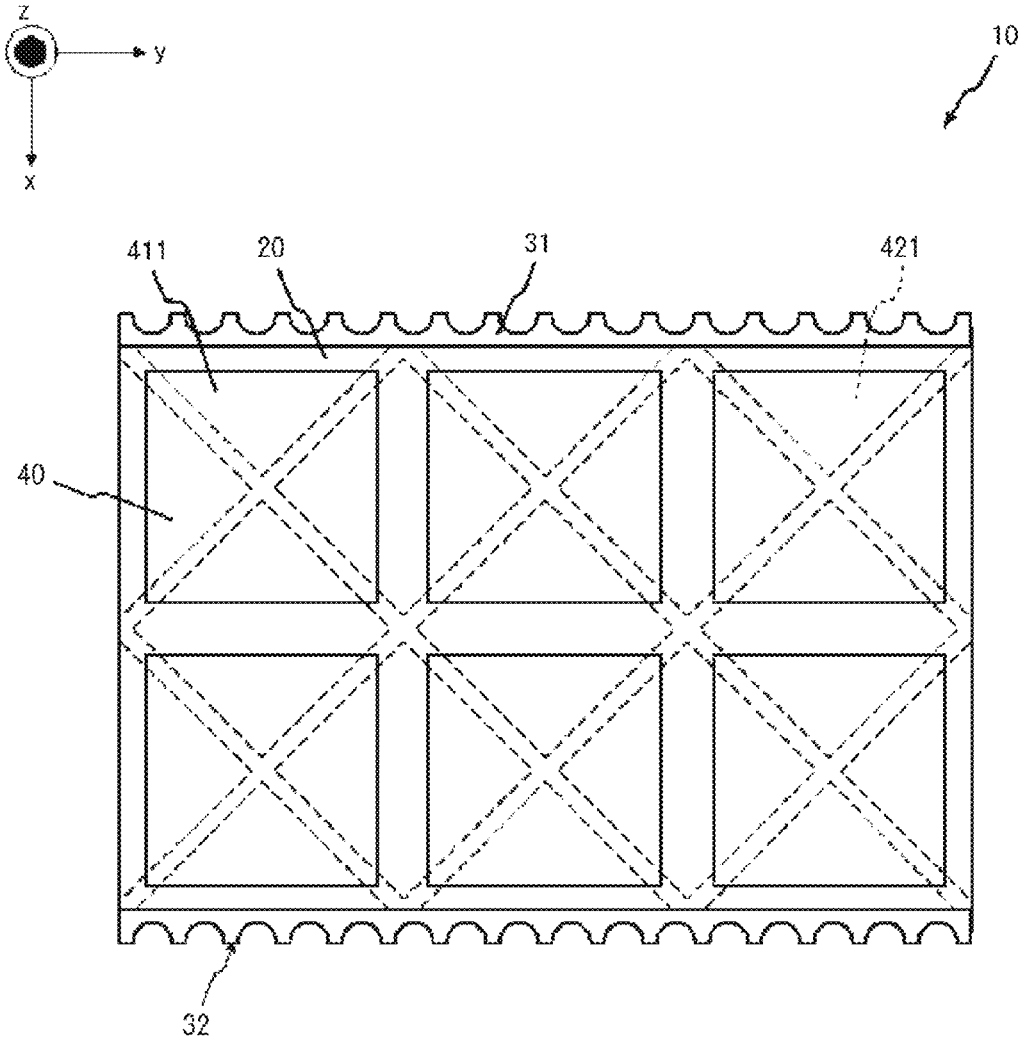
FIG. 27 is a plan view illustrating one embodiment of the resonator.

FIG. 27 is a plan view corresponding to FIG. 18. As illustrated in FIG. 27, the base 20 may have a recess. As illustrated in FIG. 27, the pair conductors 30 have a recess that is recessed inward from an outer surface in the x direction. Such a resonator 10 can be manufactured, for example, by dividing a motherboard along the arrangement of through hole conductors. Such pair conductors 30 may be referred to as end face through holes or the like.

Figure 28:
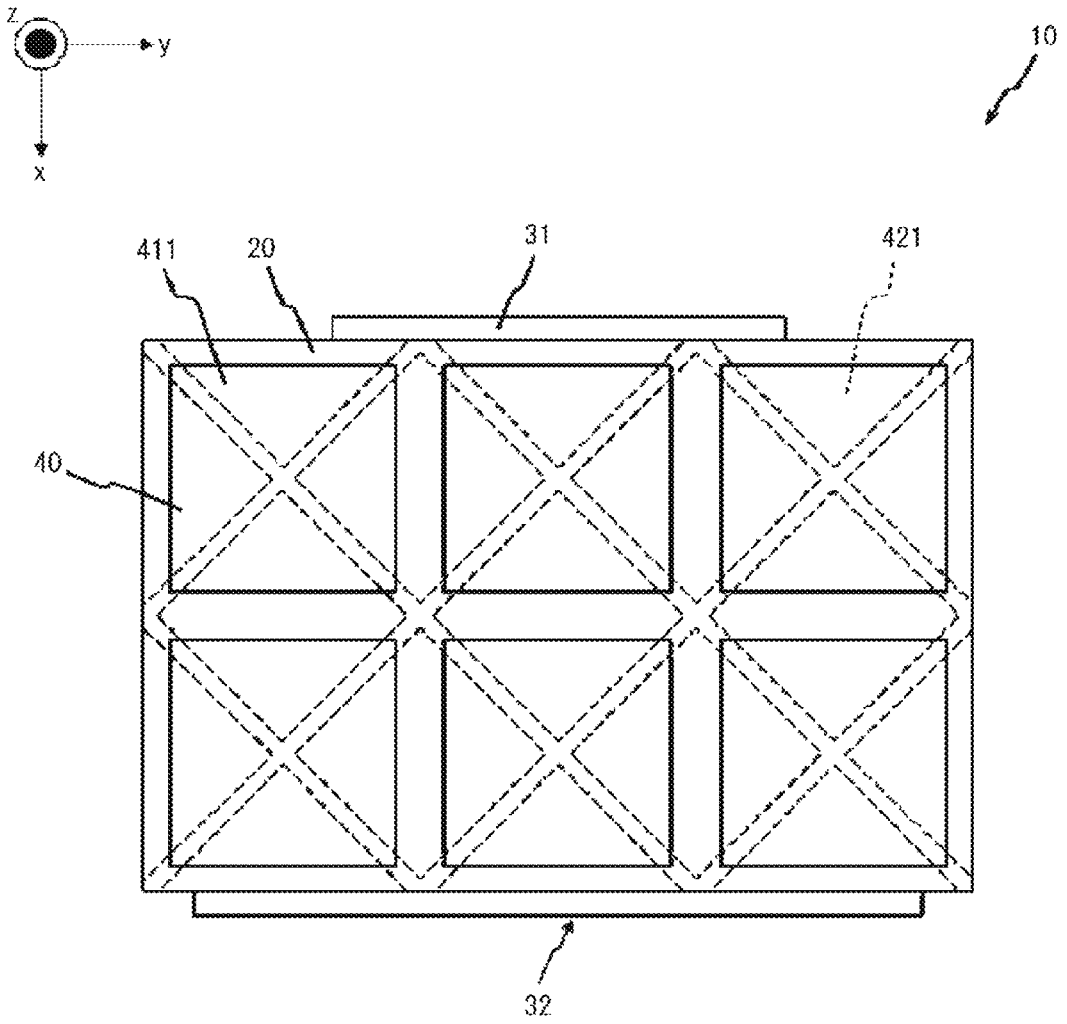
FIG. 28 is a plan view illustrating one embodiment of the resonator.

FIG. 28 is a plan view corresponding to FIG. 18. As illustrated in FIG. 28, the pair conductors 30 may have a shorter length in the x direction than the base 20. The configuration of the pair conductors 30 is not limited to these. The two pair conductors 30 may have different configurations. For example, one pair conductors 30 may include the fifth conductive layer 301 and the fifth conductor 302, and the other pair conductors 30 may be end face through holes.

Figure 29A:
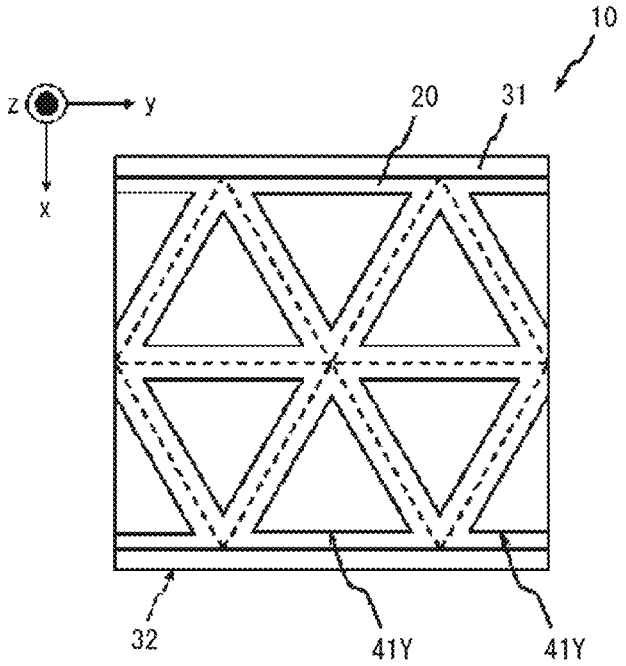
FIG. 29A is a plan view illustrating one embodiment of the resonator.
Figure 29B:
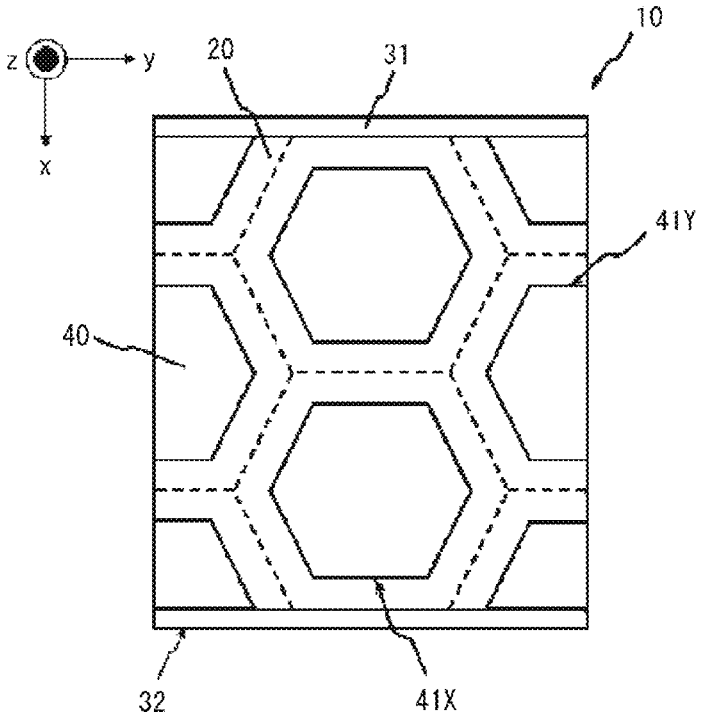
FIG. 29B is a plan view illustrating one embodiment of the resonator.
Figure 30:
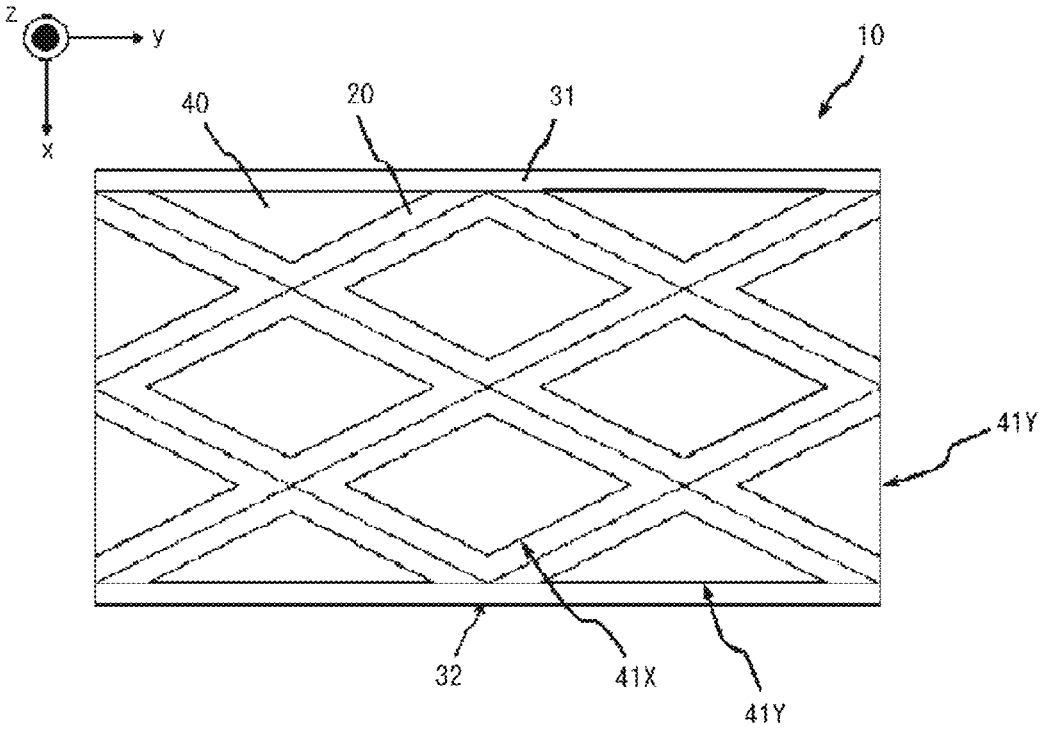
FIG. 30 is a plan view illustrating one embodiment of the resonator.

The third conductors 40 illustrated in FIGS. 1 to 28 is an example. The configuration of the third conductor 40 is not limited to the configuration illustrated in FIGS. 1 to 28. The unit resonator 40X, the first unit resonator 41X, and the second unit resonator 42X are not limited to a square. The unit resonator 40X, the first unit resonator 41X, and the second unit resonator 42X may be referred to as the unit resonator 40X or the like. For example, the unit resonator 40X or the like may be triangular as illustrated in FIG. 29A or hexagonal as illustrated in FIG. 29B. As illustrated in FIG. 30, each side of the unit resonator 40X or the like may extend in an axis different from the x direction and the y direction. In the third conductor 40, the second conductive layer 42 may be located on the base 20, and the first conductive layer 41 may be located in the base 20. In the third conductor 40, the second conductive layer 42 may be located farther from the fourth conductor 50 than the first conductive layer 41 is.

Figure 31A:
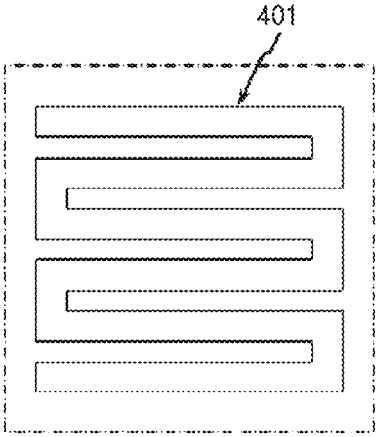
FIG. 31A is a schematic diagram illustrating an example of the resonator.
Figure 31B:
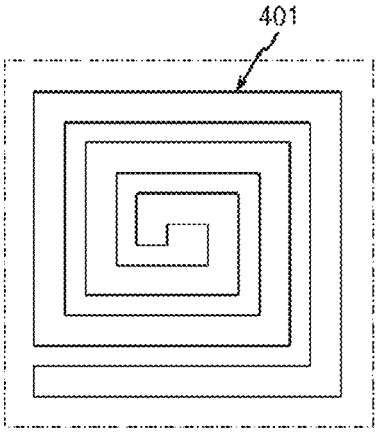
FIG. 31B is a schematic diagram illustrating an example of the resonator.
Figure 31C:
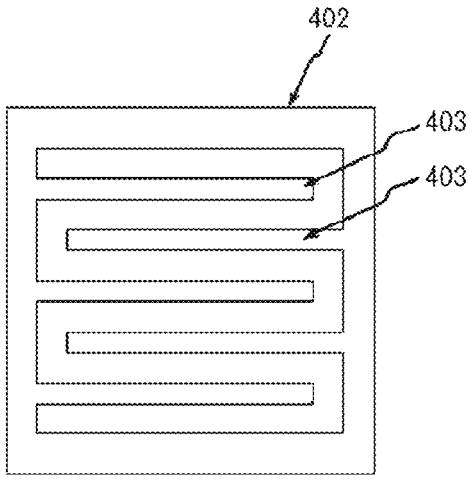
FIG. 31C is a schematic diagram illustrating an example of the resonator.
Figure 31D:
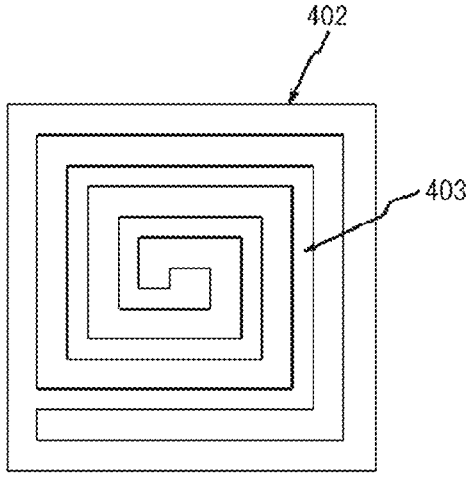
FIG. 31D is a schematic diagram illustrating an example of the resonator.
Figure 32A:
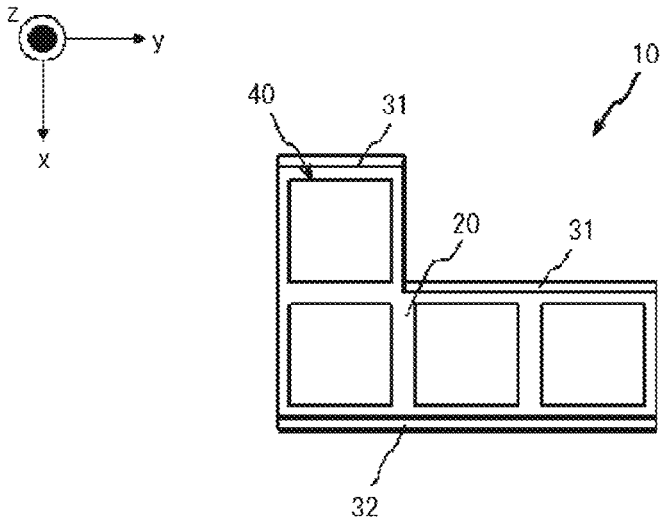
FIG. 32A is a plan view illustrating one embodiment of the resonator.
Figure 32B:
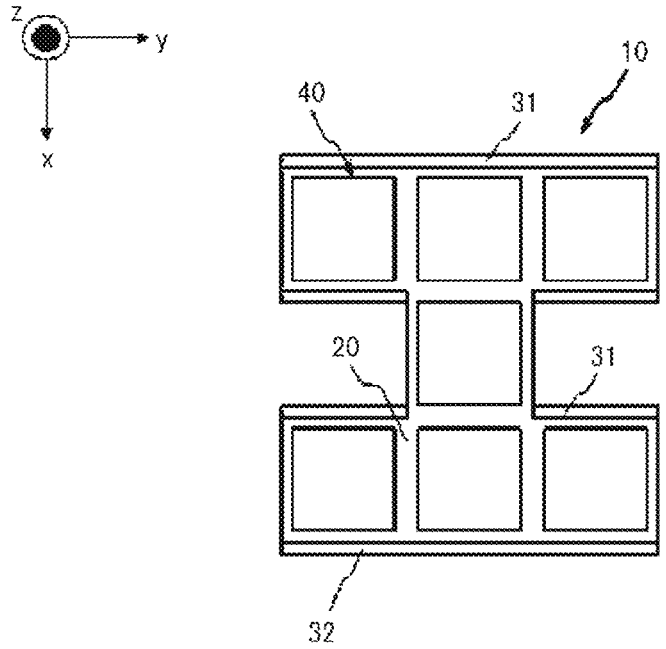
FIG. 32B is a plan view illustrating one embodiment of the resonator.
Figure 32C:
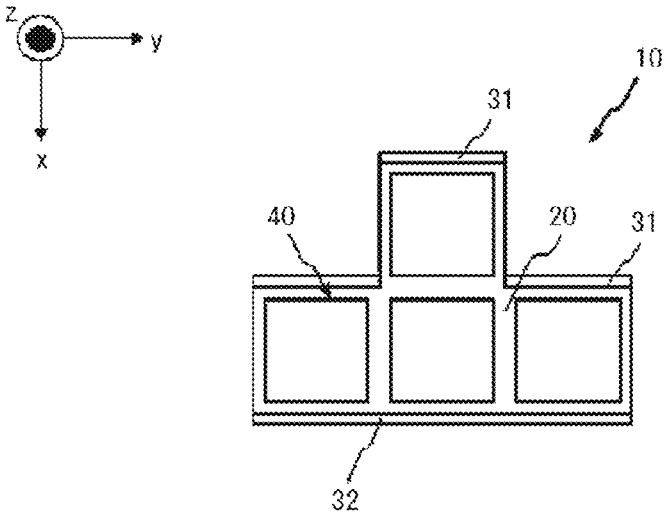
FIG. 32C is a plan view illustrating one embodiment of the resonator.
Figure 32D:
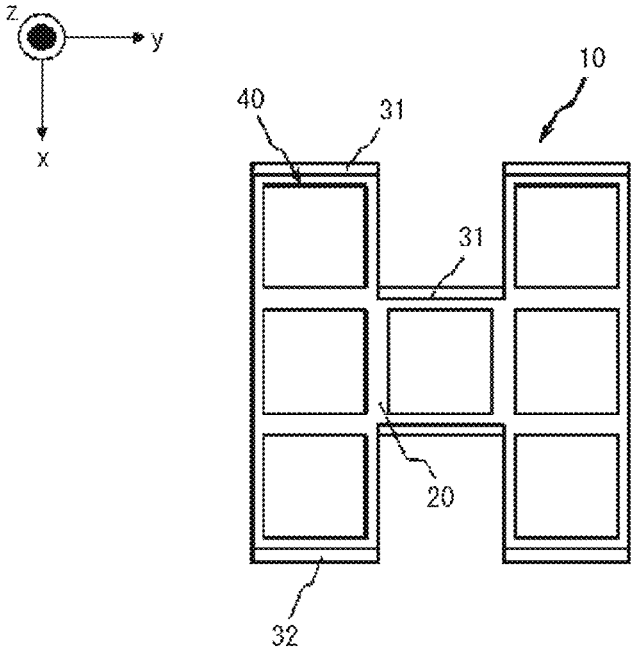
FIG. 32D is a plan view illustrating one embodiment of the resonator.
Figure 33A:
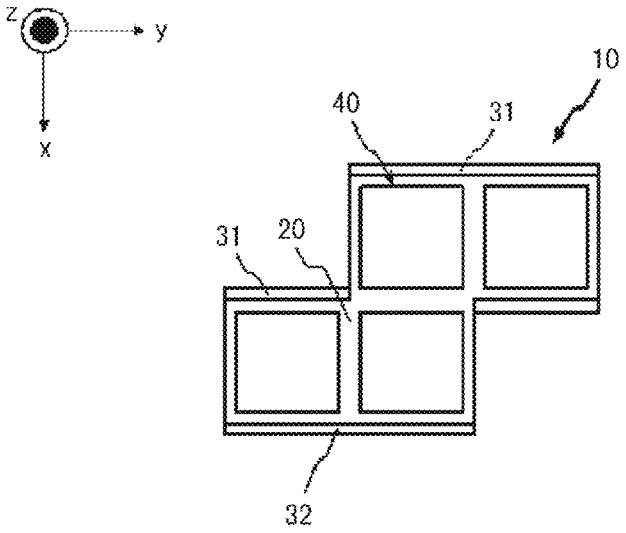
FIG. 33A is a plan view illustrating one embodiment of the resonator.
Figure 33B:
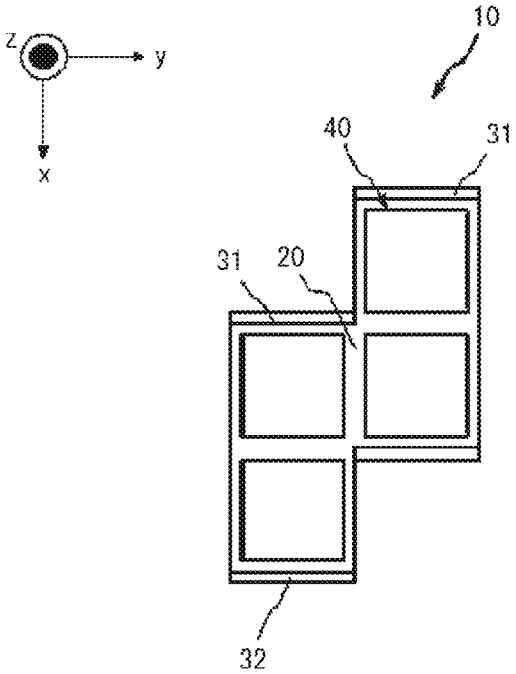
FIG. 33B is a plan view illustrating one embodiment of the resonator.
Figure 33C:
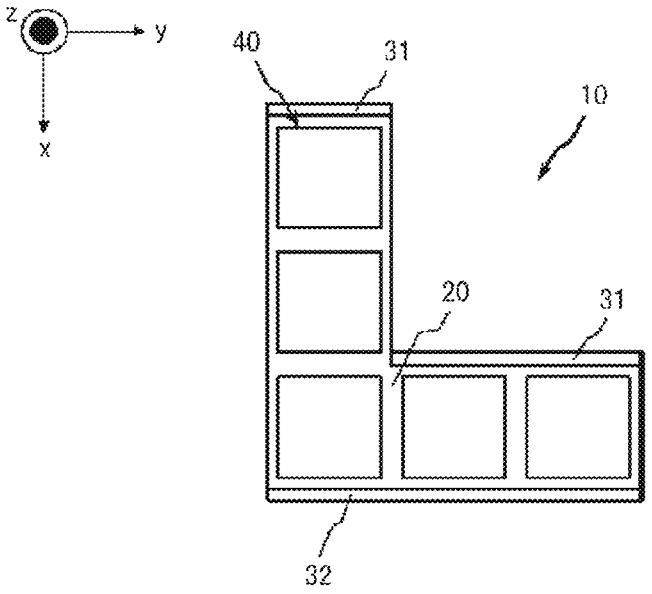
FIG. 33C is a plan view illustrating one embodiment of the resonator.
Figure 33D:
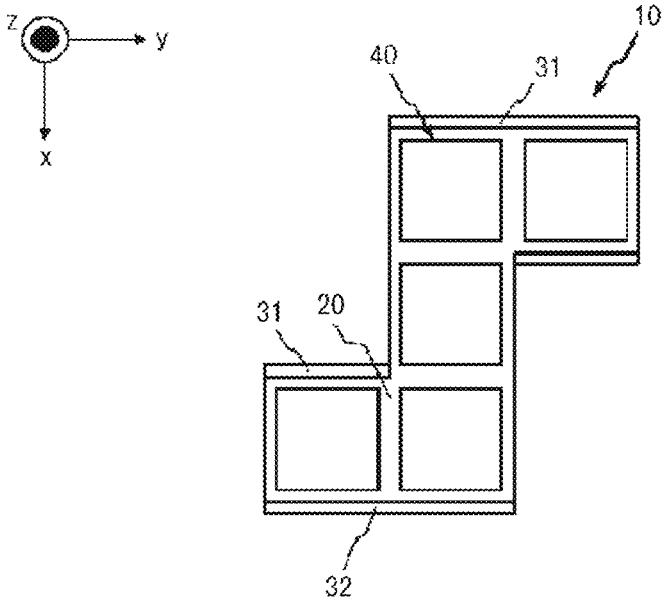
FIG. 33D is a plan view illustrating one embodiment of the resonator.
Figure 34A:
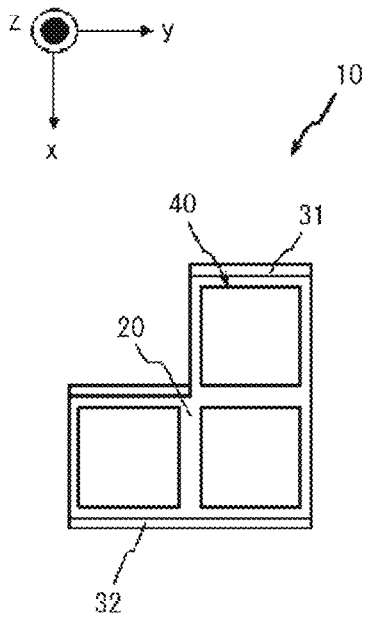
FIG. 34A is a plan view illustrating one embodiment of the resonator.
Figure 34B:
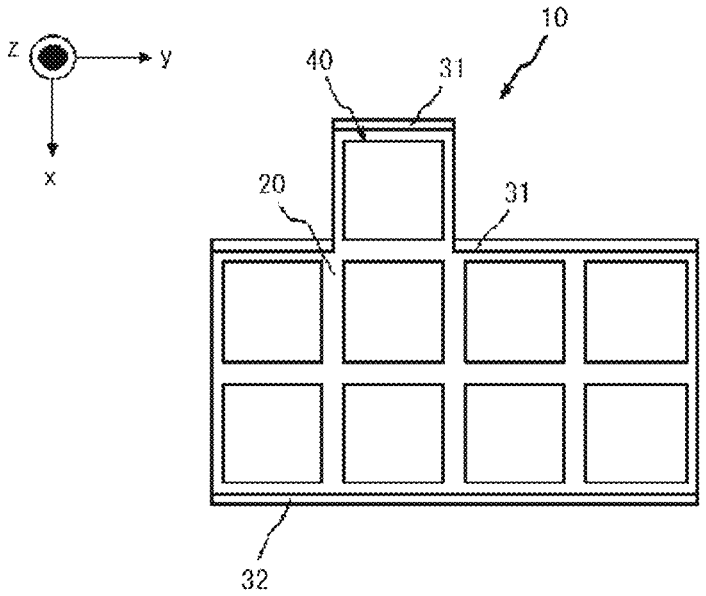
FIG. 34B is a plan view illustrating one embodiment of the resonator.
Figure 34C:
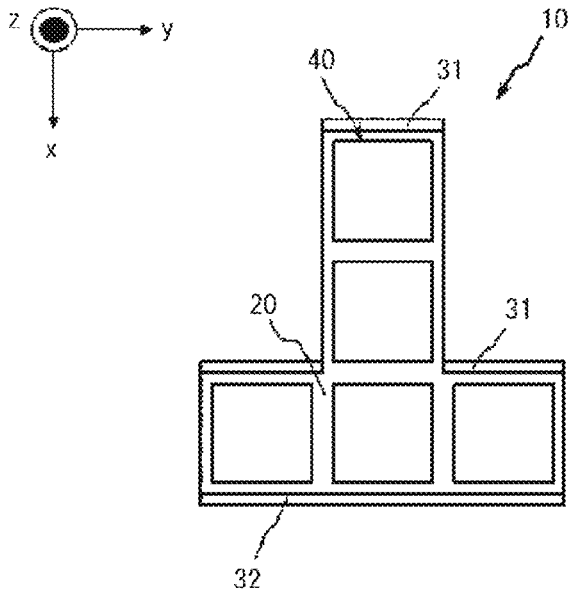
FIG. 34C is a plan view illustrating one embodiment of the resonator.
Figure 34D:
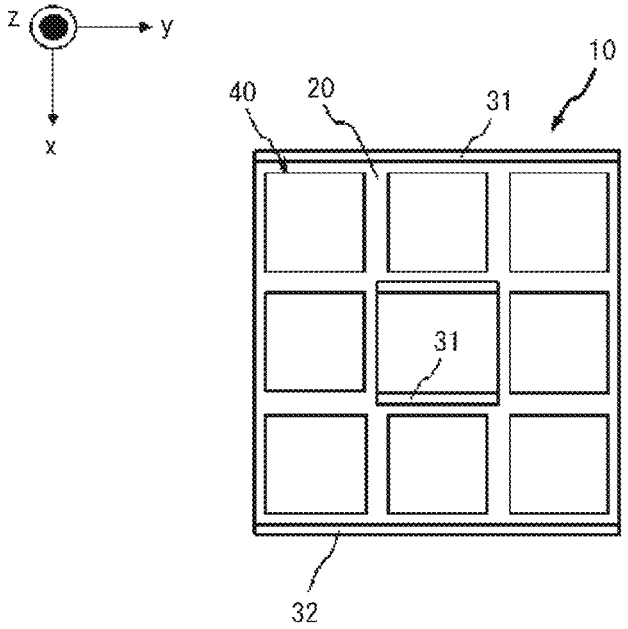
FIG. 34D is a plan view illustrating one embodiment of the resonator.

The third conductors 40 illustrated in FIGS. 1 to 30 is an example. The configuration of the third conductor 40 is not limited to the configuration illustrated in FIGS. 1 to 30. The resonator including the third conductor 40 may be a line type resonator 401. FIG. 31A illustrates a meander line type resonator 401. FIG. 31B illustrates a spiral type resonator 401. The resonator including the third conductor 40 may be a slot type resonator 402. The slot type resonator 402 may have one or more seventh conductors 403 provided at an opening thereof. One end of the seventh conductor 403 in the opening is opened and the other end thereof is electrically connected to a conductor defining the opening. In the unit slot illustrated in FIG. 31C, five seventh conductors 403 are located in the opening. The unit slot has a shape corresponding to a meander line with the seventh conductor 403. In the unit slot illustrated in FIG. 31D, one seventh conductor 403 is located in the opening. The unit slot has a shape corresponding to a spiral with the seventh conductor 403.

The configuration of the resonator 10 illustrated in FIGS. 1 to 31 is an example. The configuration of the resonator 10 is not limited to the configuration illustrated in FIGS. 1 to 31. For example, the pair conductors 30 of the resonator 10 may include three or more. For example, one pair conductors 30 may face two pair conductors 30 in the x direction. The two pair conductors 30 are different in distance from the pair conductors 30. For example, the resonator 10 may include two pairs of pair conductors 30. The two pairs of pair conductors 30 may be different in distance of each pair and length of each pair. The resonator 10 may include five or more first conductors. The unit structure 10X of the resonator 10 may be arranged with another unit structure 10X in the y direction. The unit structure 10X of the resonator 10 can be arranged with the other unit structure 10X without interposing the pair conductors 30 in the x direction. FIGS. 32 to 34 are diagrams illustrating an example of the resonator 10. In the resonator 10 illustrated in FIGS. 32 to 34, the unit resonator 40X of the unit structure 10X is illustrated as a square, but it is not limited thereto.

Figure 35:
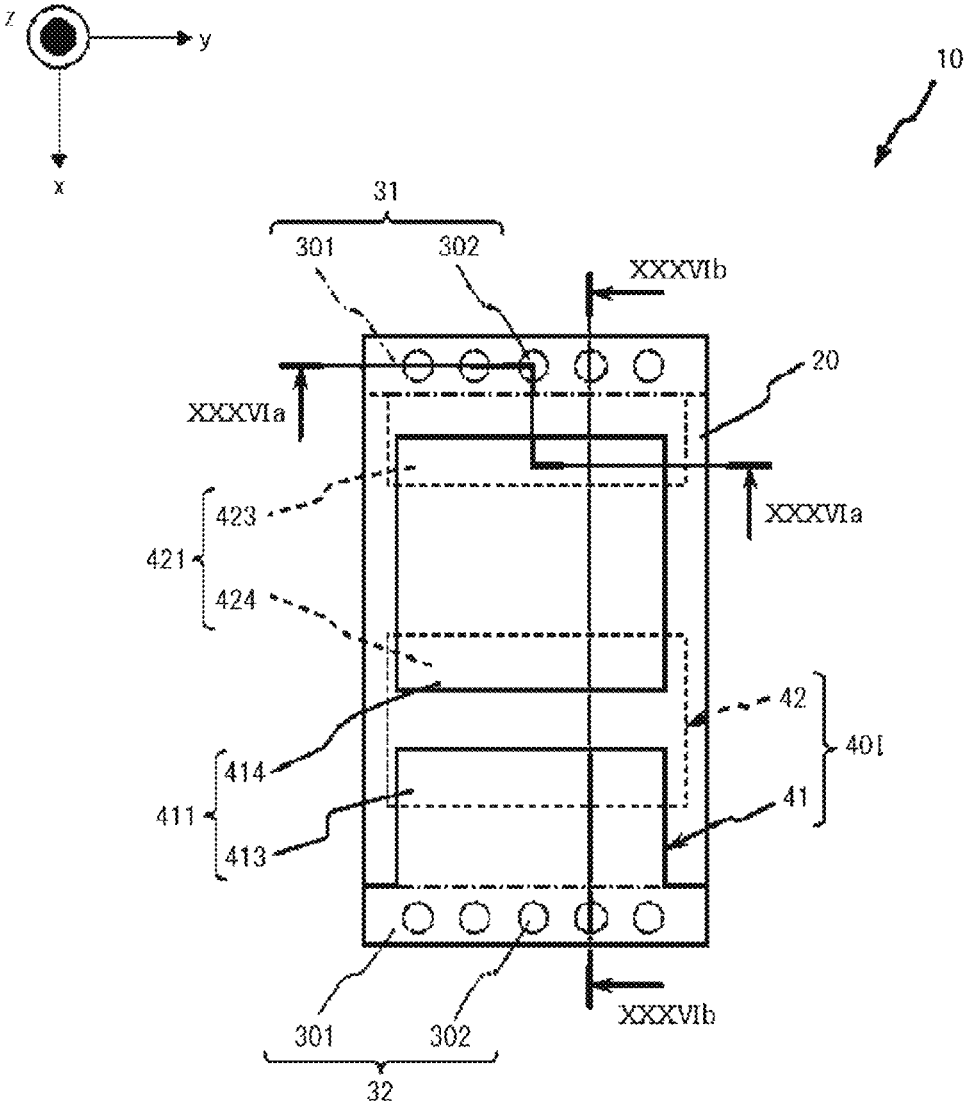
FIG. 35 is a plan view illustrating one embodiment of the resonator.
Figure 36A:
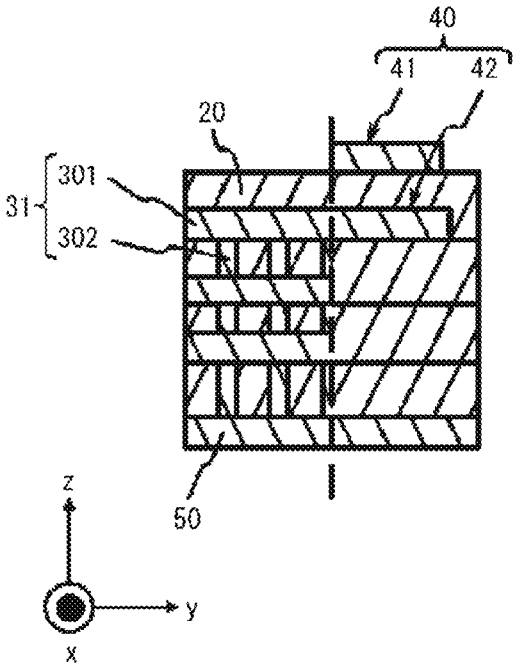
FIG. 36A is a cross-sectional view illustrating one embodiment of a resonator.
Figure 36B:
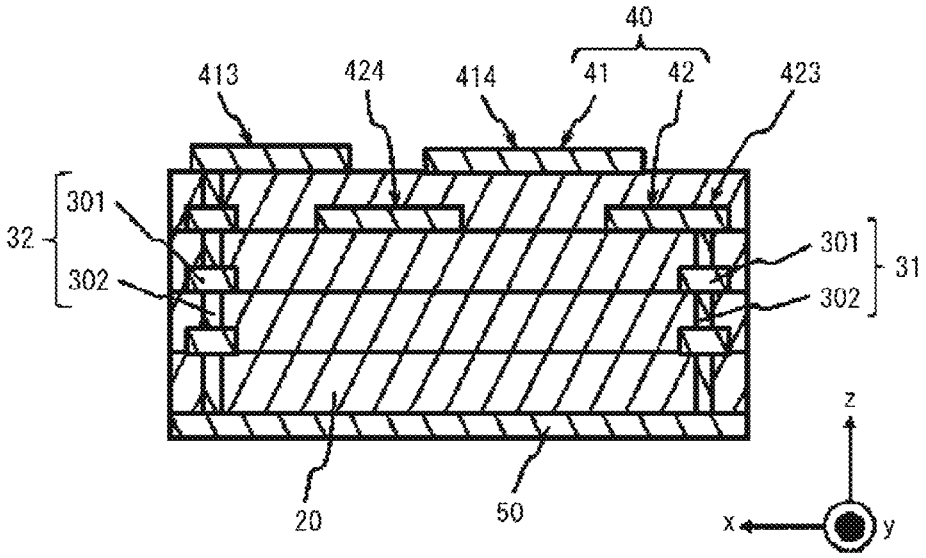
FIG. 36B is a cross-sectional view illustrating one embodiment of a resonator.

The configuration of the resonator 10 illustrated in FIGS. 1 to 34 is an example. The configuration of the resonator 10 is not limited to the configuration illustrated in FIGS. 1 to 34. FIG. 35 is a plan view of the xy plane from the z direction. FIG. 36A is a cross-sectional view taken along line XXXVIa-XXXVIa illustrated in FIG. 35. FIG. 36B is a cross-sectional view taken along line XXXVIb-XXXVIb illustrated in FIG. 35.

In the resonator 10 illustrated in FIGS. 35 and 36, the first conductive layer 41 includes half of the patch type resonator as the first unit resonator 41X. The second conductive layer 42 includes half of the patch type resonator as the second unit resonator 42X. The unit resonator 40X includes one first divisional resonators 41Y and one second divisional resonators 42Y. The unit structure 10X includes the unit resonator 40X as well as a part of the base 20 and a part of the fourth conductor 50 overlapping the unit resonator 40X as viewed in the Z direction. In the resonator 10 illustrated in FIG. 35, three unit resonators 40X are arranged in the x direction. The first unit conductor 411 and the second unit conductor 421 included in the three unit resonators 40X form one current path 40I.

Figure 37:
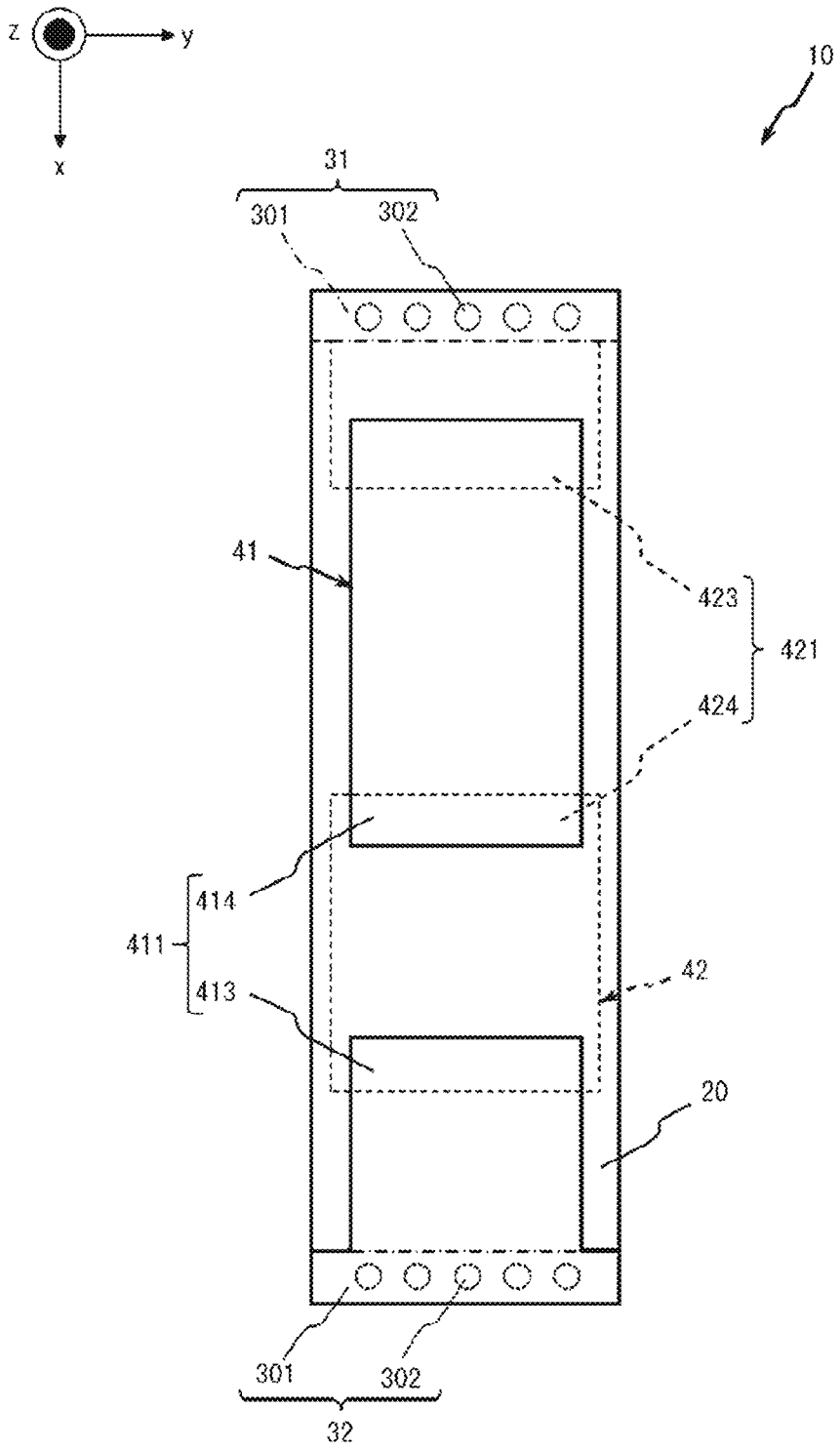
FIG. 37 is a plan view illustrating one embodiment of the resonator.
Figure 38:
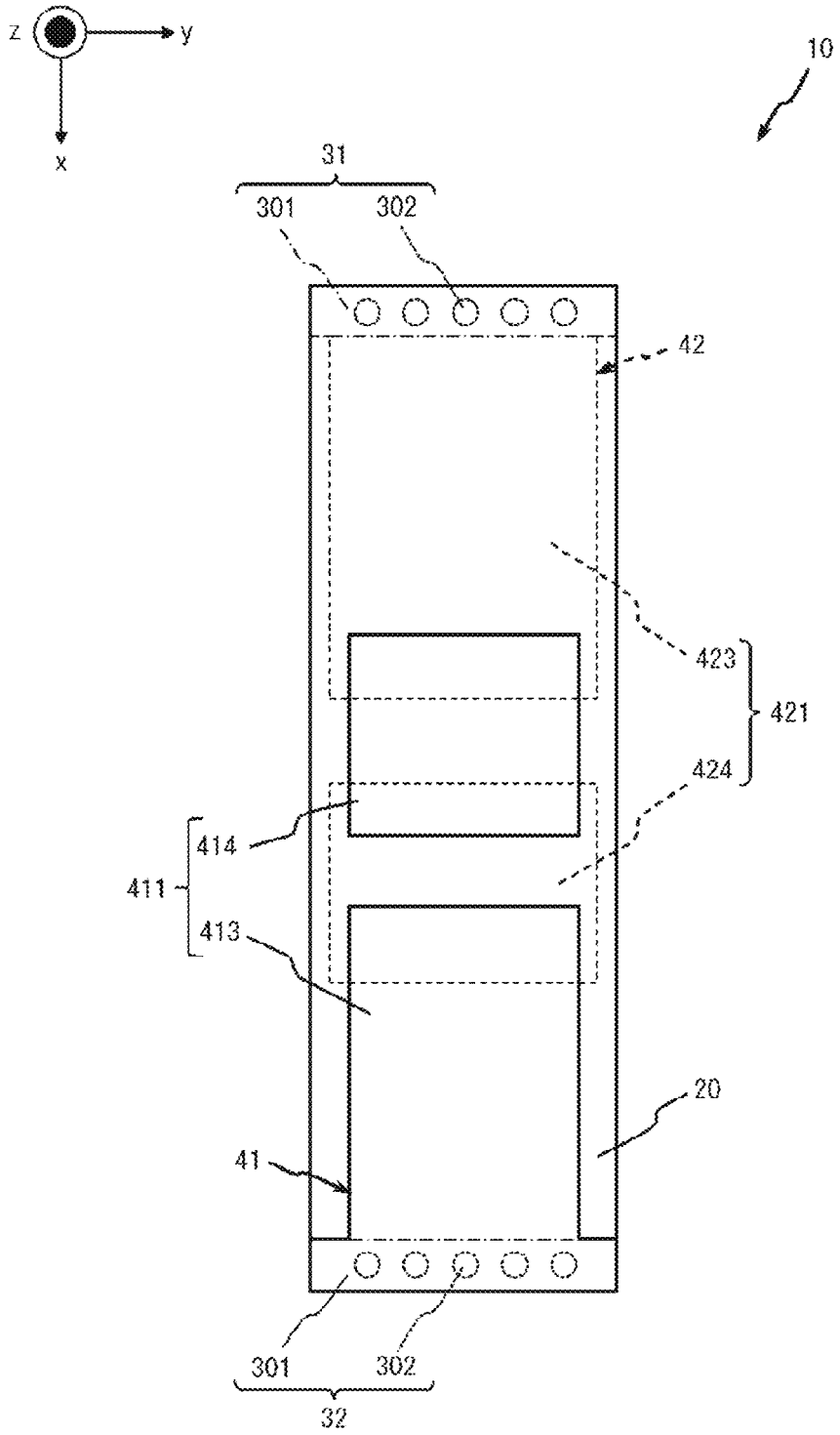
FIG. 38 is a plan view illustrating one embodiment of the resonator.

FIG. 37 illustrates another example of the resonator 10 illustrated in FIG. 35. The resonator 10 illustrated in FIG. 37 has a longer length in the x direction than the resonator 10 illustrated in FIG. 35. A dimension of the resonator 10 is not limited to the resonator 10 illustrated in FIG. 37 and may change as appropriate. In the resonator 10 of FIG. 37, the first connecting conductor 413 is different from the first floating conductor 414 in length in the x direction. In the resonator 10 of FIG. 37, the first connecting conductor 413 has a shorter length in the x direction than the first floating conductor 414. FIG. 38 illustrates another example of the resonator 10 illustrated in FIG. 35. In the resonator 10 illustrated in FIG. 38, the length of the third conductor 40 in the x direction is different. In the resonator 10 of FIG. 38, the first connecting conductor 413 has a longer length in the x direction than the first floating conductor 414.

Figure 39:
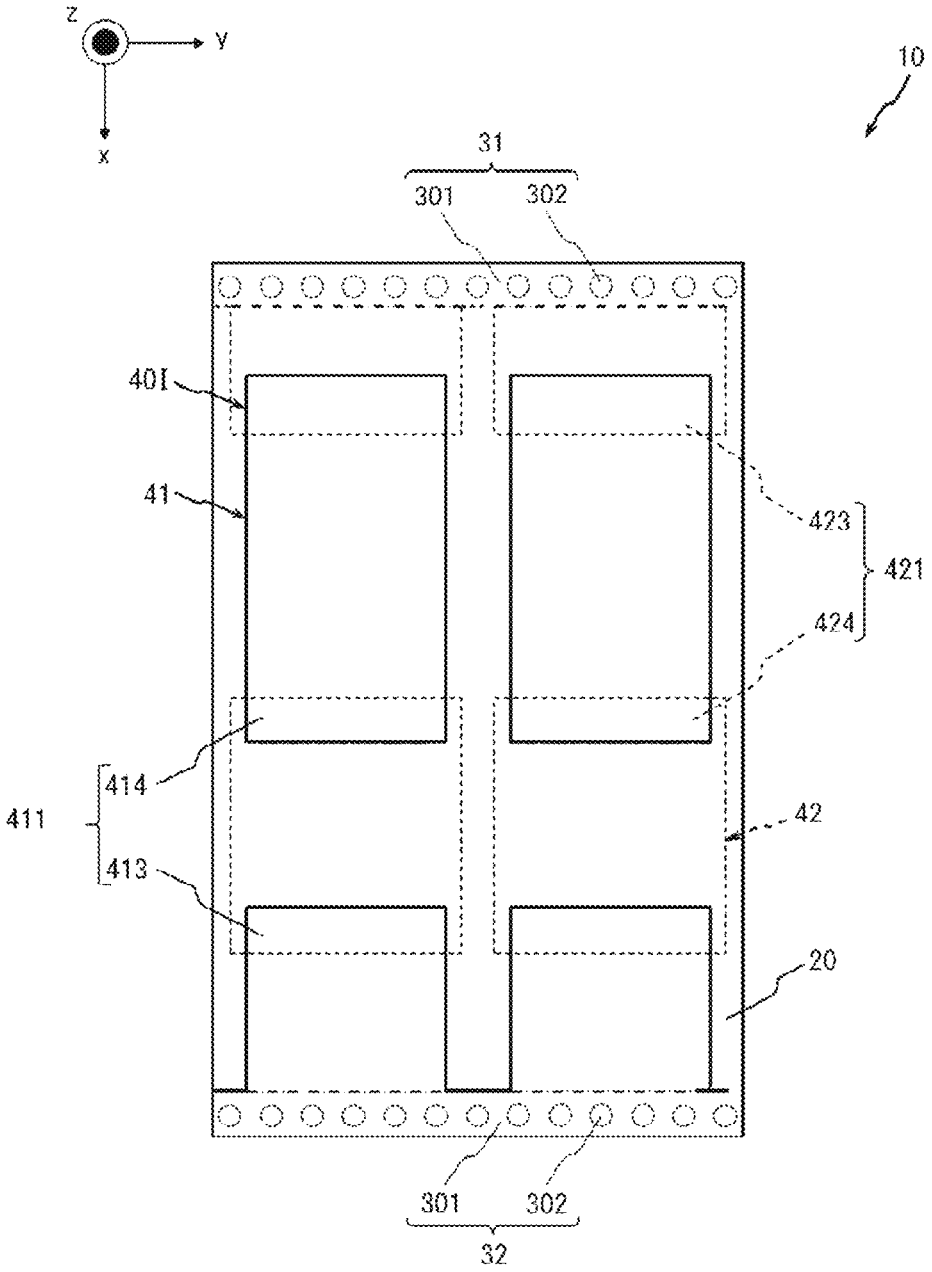
FIG. 39 is a plan view illustrating one embodiment of the resonator.

FIG. 39 illustrates another example of the resonator 10. FIG. 39 illustrates another example of the resonator 10 illustrated in FIG. 37. In a plurality of embodiments, in the resonator 10, a plurality of first unit conductors 411 and a plurality of second unit conductors 421 arranged in the x direction are capacitively coupled to each other. In the resonator 10, two current paths 40I in which no current flows from one side to the other side may be arranged in the y direction.

Figure 40:
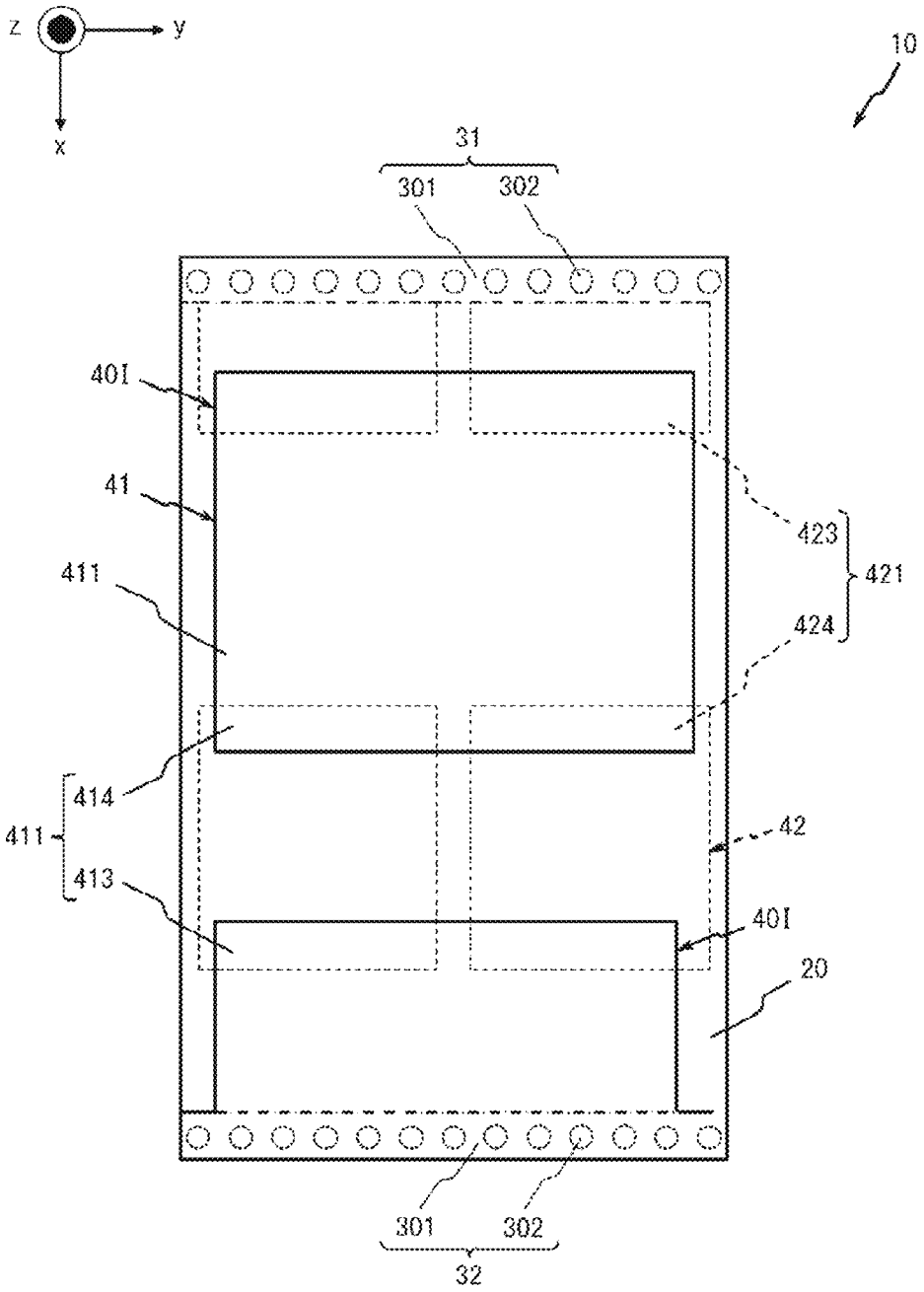
FIG. 40 is a plan view illustrating one embodiment of the resonator.

FIG. 40 illustrates another example of the resonator 10. FIG. 40 illustrates another example of the resonator 10 illustrated in FIG. 39. In a plurality of embodiments, in the resonator 10, the number of conductors connected to the first conductor 31 may differ from the number of conductors connected to the second conductor 32. In the resonator 10 of FIG. 40, one first connecting conductor 413 is capacitively coupled to two second floating conductors 424. In the resonator 10 of FIG. 40, two second connecting conductors 423 are capacitively coupled to one first floating conductor 414. In a plurality of embodiments, the number of first unit conductors 411 may be different from the number of second unit conductors 421 that are capacitively coupled to the first unit conductor 411.

Figure 41:
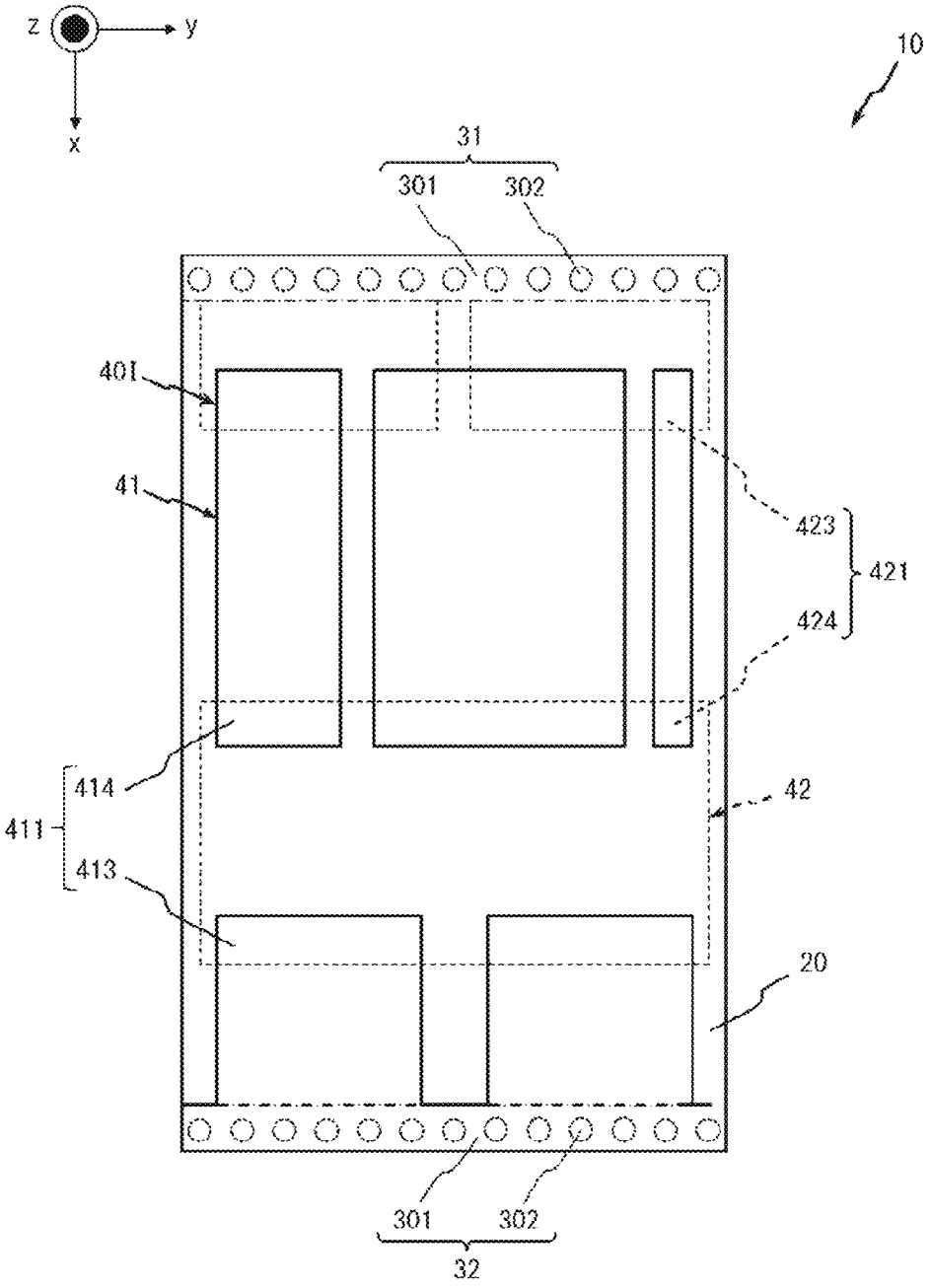
FIG. 41 is a plan view illustrating one embodiment of the resonator.

FIG. 41 illustrates another example of the resonator 10 illustrated in FIG. 39. In a plurality of embodiments, in the first unit conductor 411, the number of second unit conductors 421 capacitively coupled at the first end portion in the x direction may be different from the number of second unit conductors 421 capacitively coupled at the second end portion in the x direction. In the resonator 10 of FIG. 41, in one second floating conductor 424, two first connecting conductors 413 are capacitively coupled to the first end portion in the x direction, and three first floating conductors 414 are capacitively coupled to the second end portion. In a plurality of embodiments, a plurality of conductors arranged in the y direction may have different lengths in the y direction. In the resonator 10 of FIG. 41, the three first floating conductors 414 arranged in the y direction have different lengths in the y direction.

Figure 42:
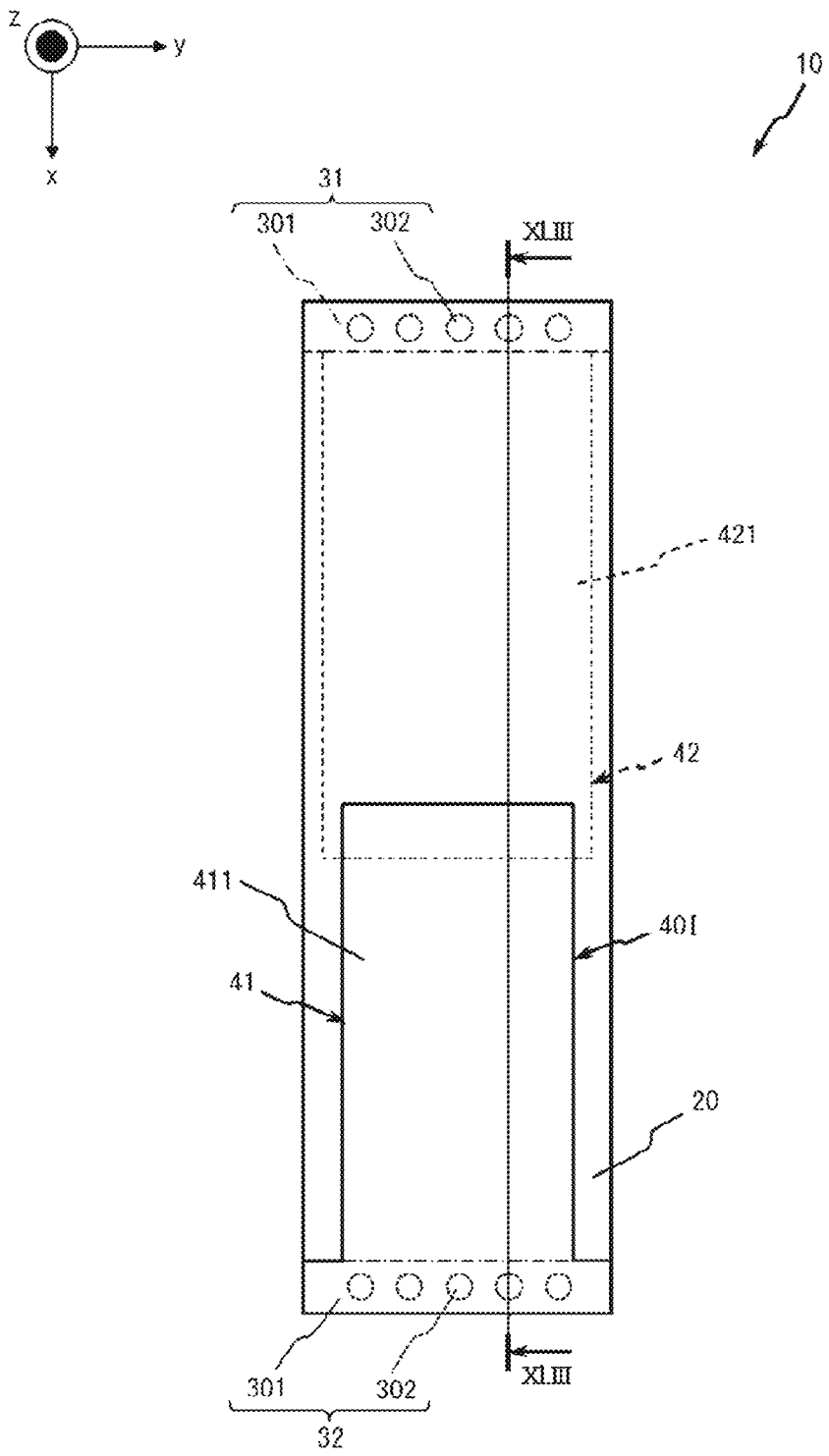
FIG. 42 is a plan view illustrating one embodiment of the resonator.
Figure 43:
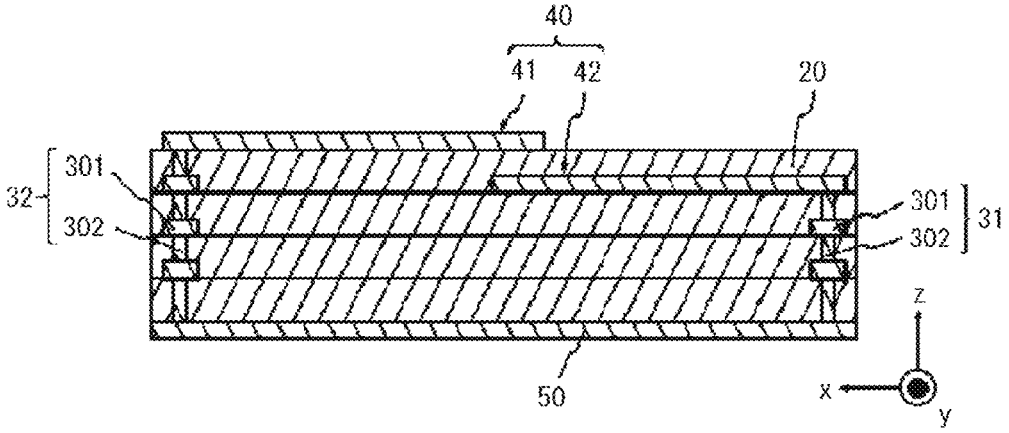
FIG. 43 is a cross-sectional view illustrating one embodiment of a resonator.

FIG. 42 illustrates another example of the resonator 10. FIG. 43 is a cross-sectional view taken along line XLIII-XLIII illustrated in FIG. 42. In the resonator 10 illustrated in FIGS. 42 and 43, the first conductive layer 41 includes half of the patch type resonator as the first unit resonator 41X. The second conductive layer 42 includes half of the patch type resonator as the second unit resonator 42X. The unit resonator 40X includes one first divisional resonators 41Y and one second divisional resonators 42Y. The unit structure 10X includes the unit resonator 40X as well as a part of the base 20 and a part of the fourth conductor 50 overlapping the unit resonator 40X as viewed in the z direction. In the resonator 10 illustrated in FIG. 42, one unit resonator 40X extends in the x direction.

Figure 44:
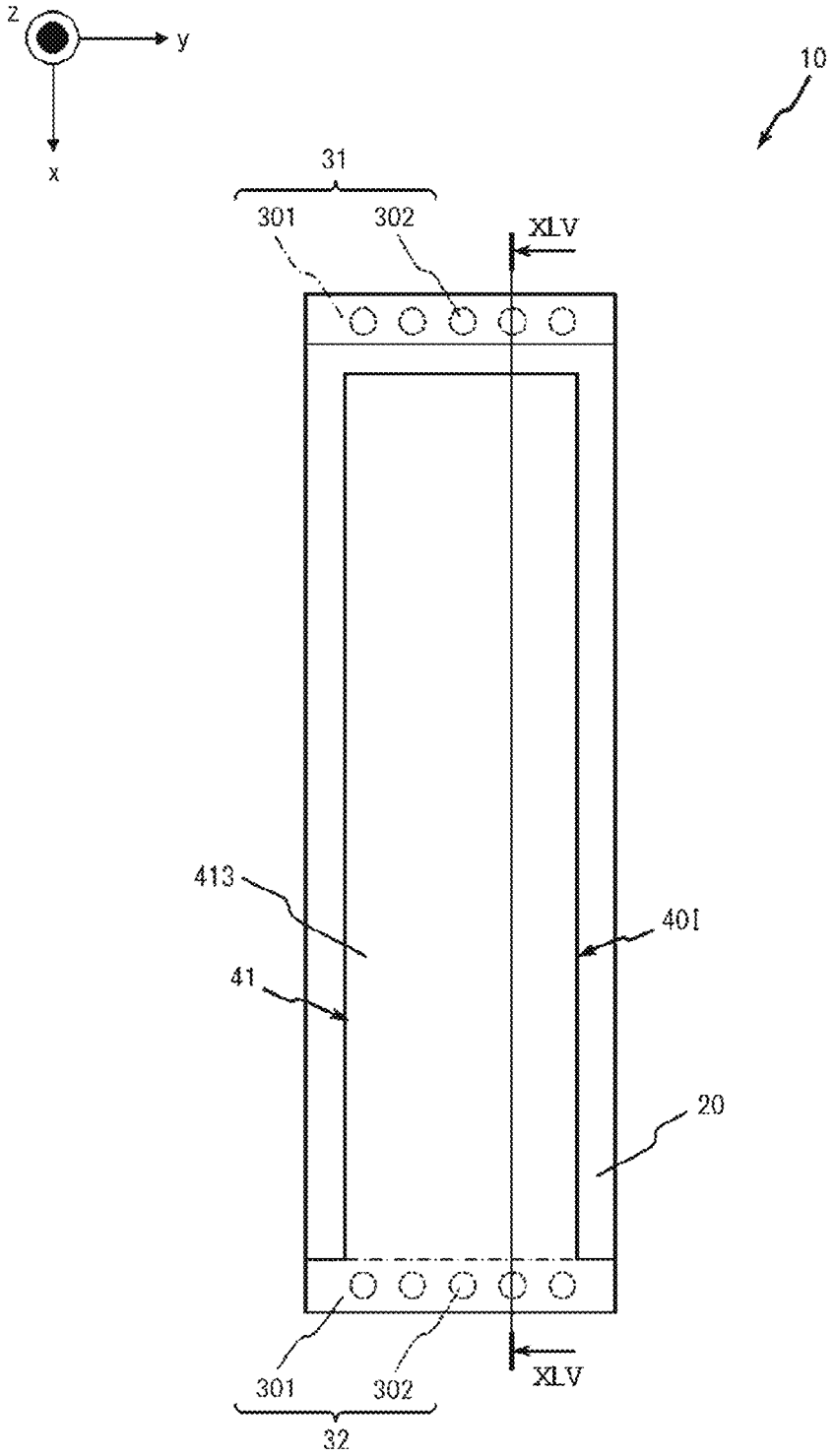
FIG. 44 is a plan view illustrating one embodiment of the resonator.
Figure 45:
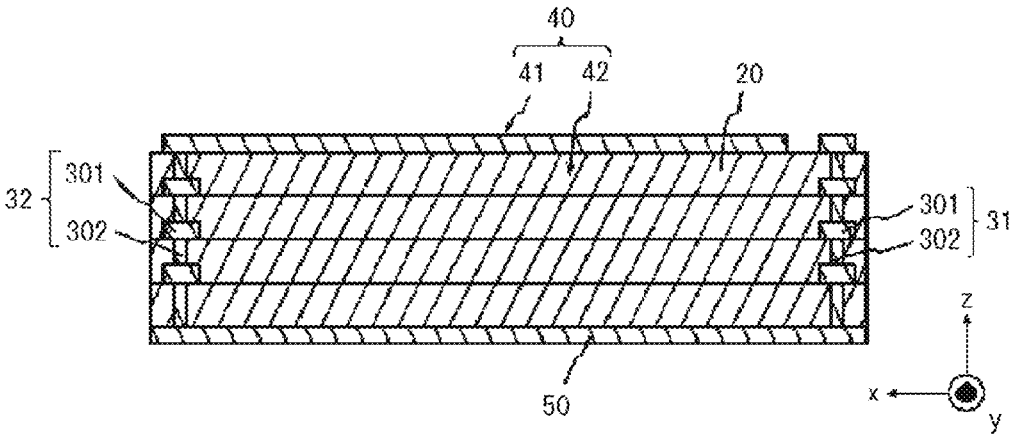
FIG. 45 is a cross-sectional view illustrating one embodiment of a resonator.

FIG. 44 illustrates another example of the resonator 10. FIG. 45 is a cross-sectional view taken along line XLV-XLV illustrated in FIG. 44. In the resonator 10 illustrated in FIGS. 44 and 45, the third conductor 40 includes only the first connecting conductor 413. The first connecting conductor 413 faces the first conductor 31 in the xy plane. The first connecting conductor 413 is capacitively coupled to the first conductor 31.

Figure 46:
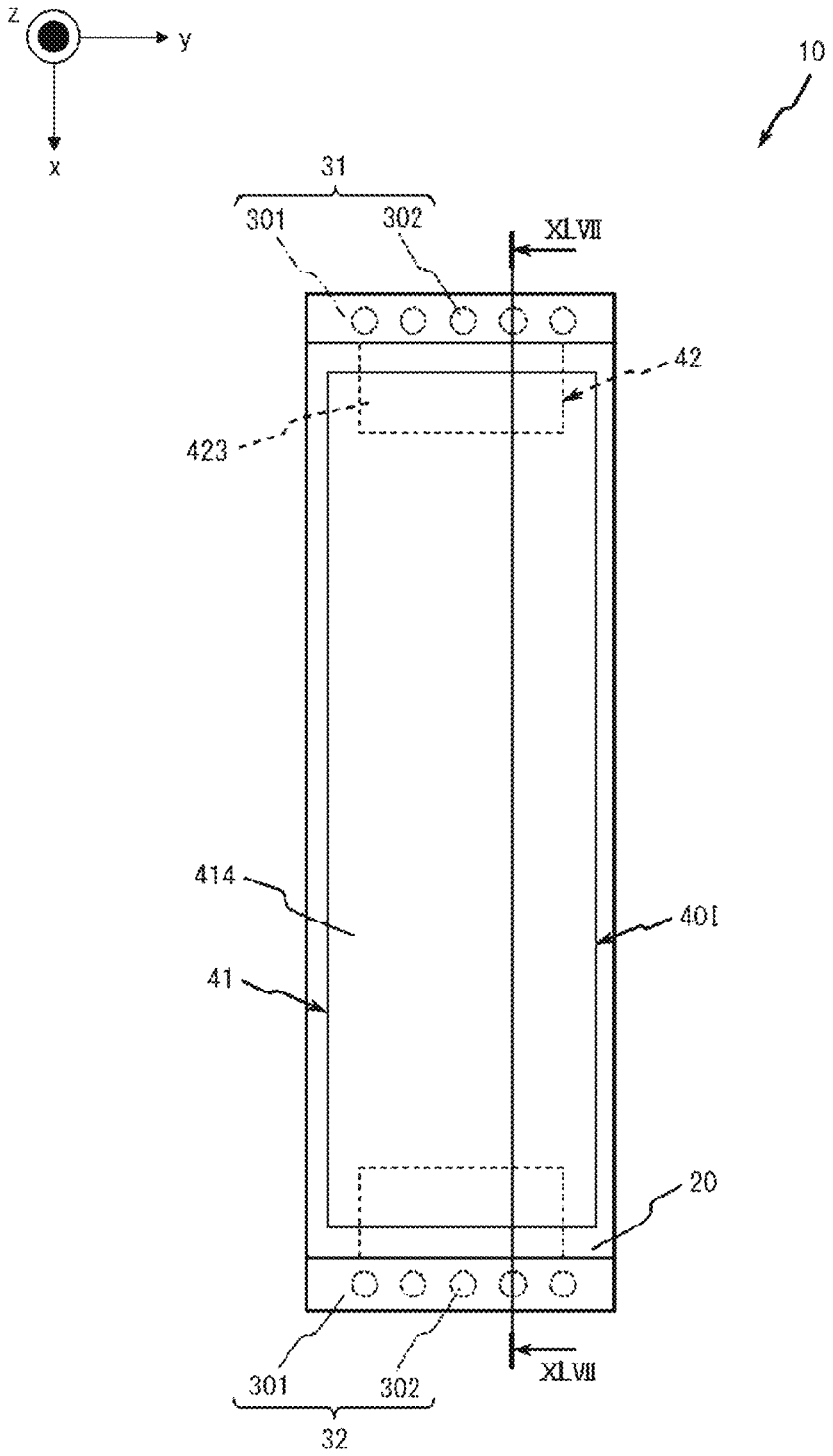
FIG. 46 is a plan view illustrating one embodiment of the resonator.
Figure 47:
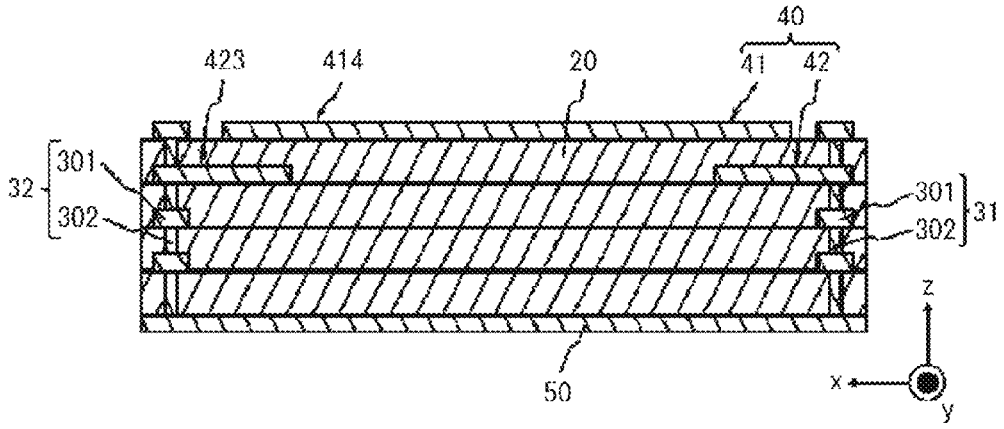
FIG. 47 is a cross-sectional view illustrating one embodiment of a resonator.

FIG. 46 illustrates another example of the resonator 10. FIG. 47 is a cross-sectional view taken along line XLVII-XLVII illustrated in FIG. 46. In the resonator 10 illustrated in FIGS. 46 and 47, the third conductor 40 has the first conductive layer 41 and the second conductive layer 42. The first conductive layer 41 may include one first floating resonator 414. The second conductive layer 42 may include two second connecting conductors 423. The first conductive layer 41 faces the pair conductors 30 in the xy plane. The two second connecting conductors 423 overlap one first floating conductor 414 as viewed in the z direction. One first floating conductor 414 is capacitively coupled to two second connecting conductors 423.

Figure 48:
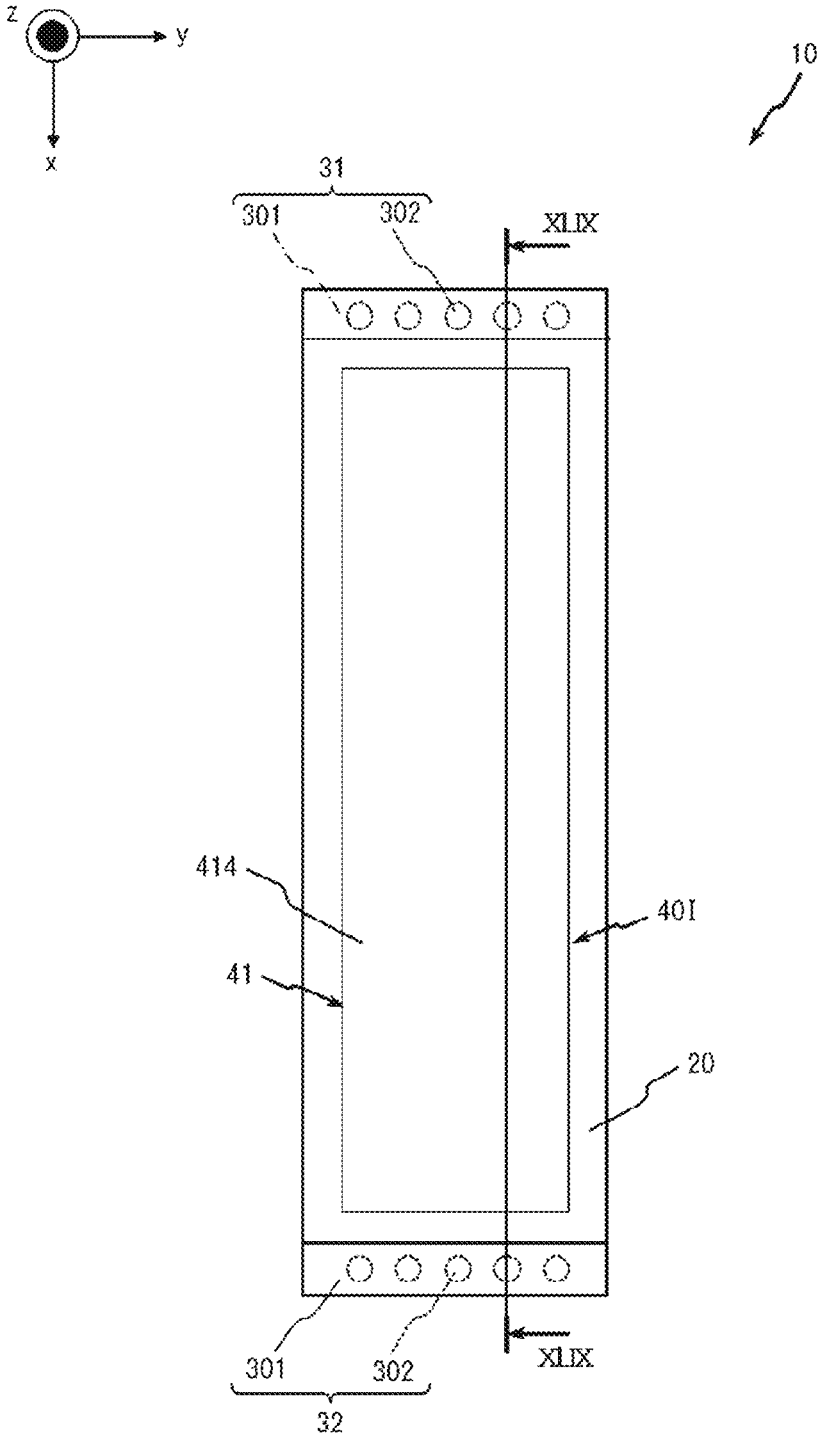
FIG. 48 is a plan view illustrating one embodiment of the resonator.
Figure 49:
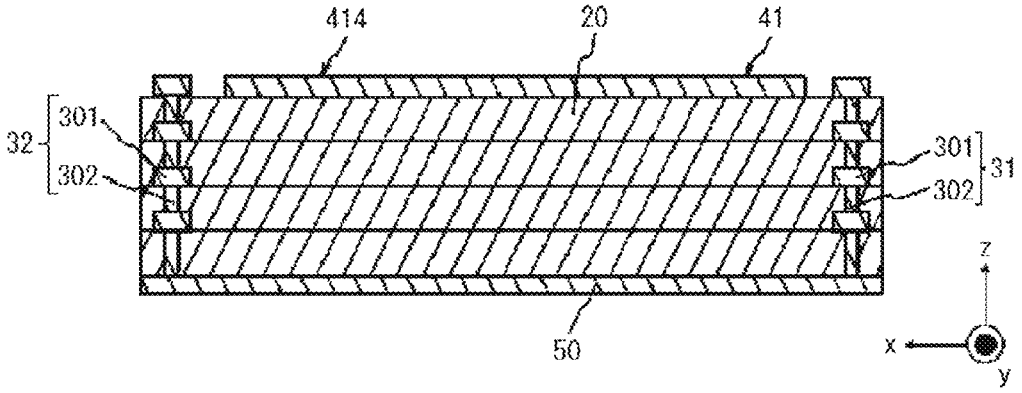
FIG. 49 is a cross-sectional view illustrating one embodiment of a resonator.

FIG. 48 illustrates another example of the resonator 10. FIG. 49 is a cross-sectional view taken along line XLIX-XLIX illustrated in FIG. 48. In the resonator 10 illustrated in FIGS. 48 and 49, the third conductor 40 includes only the first floating conductor 414. The first floating conductor 414 faces the pair conductors 30 in the xy plane. The first connecting conductor 413 is capacitively coupled to the pair conductors 30.

Figure 50:
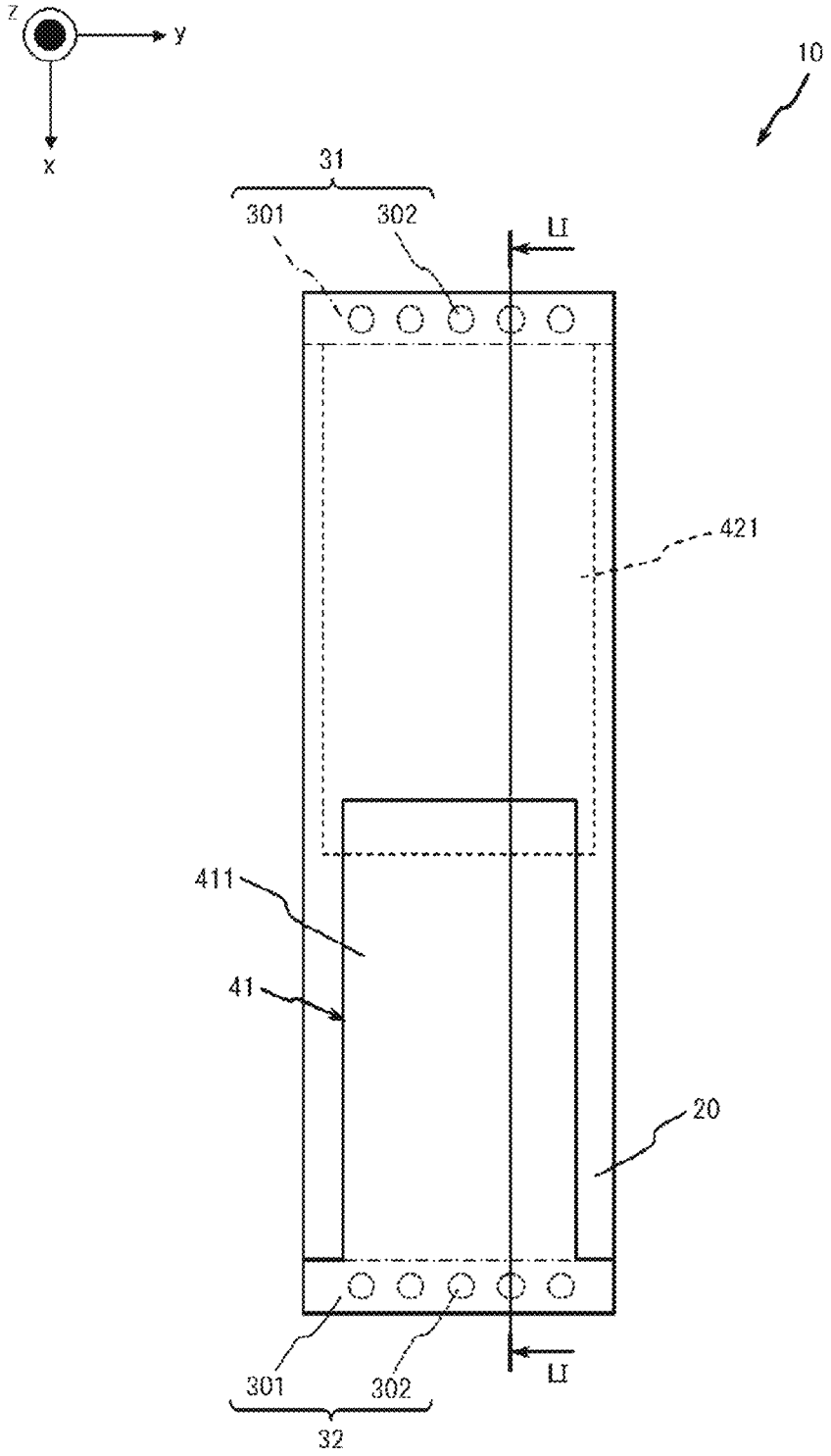
FIG. 50 is a plan view illustrating one embodiment of the resonator.
Figure 51:
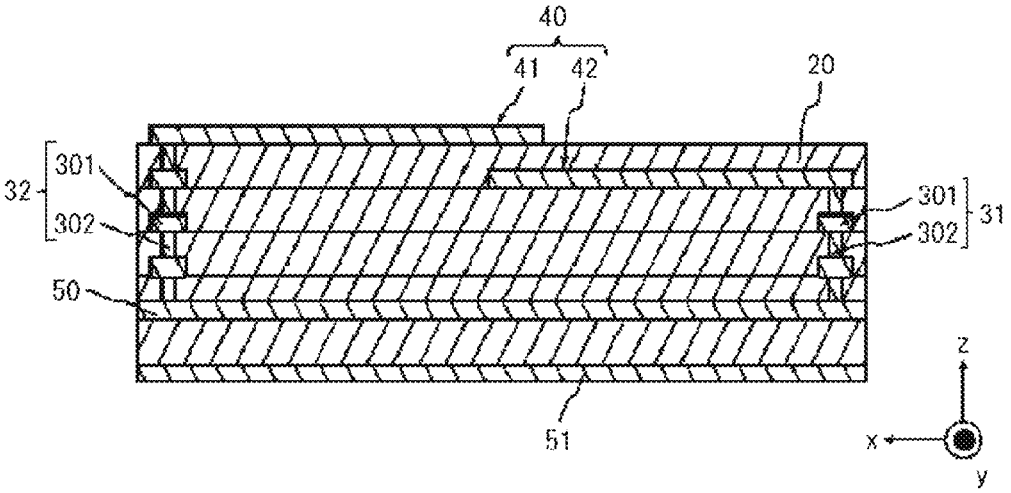
FIG. 51 is a cross-sectional view illustrating one embodiment of a resonator.

FIG. 50 illustrates another example of the resonator 10. FIG. 51 is a cross-sectional view taken along line LI-LI illustrated in FIG. 50. The resonator 10 illustrated in FIGS. 50 and 51 is different from the resonator 10 illustrated in FIGS. 42 and 43 in the configuration of the fourth conductor 50. The resonator 10 illustrated in FIGS. 50 and 51 includes the fourth conductor 50 and the reference potential layer 51. The reference potential layer 51 can be electrically connected to the ground of the device including the resonator 10. The reference potential layer 51 faces the third conductor 40 via the fourth conductor 50. The fourth conductor 50 is located between the third conductor 40 and the reference potential layer 51. An interval between the reference potential layer 51 and the fourth conductor 50 is narrower than an interval between the third conductor 40 and the fourth conductor 50.

Figure 52:
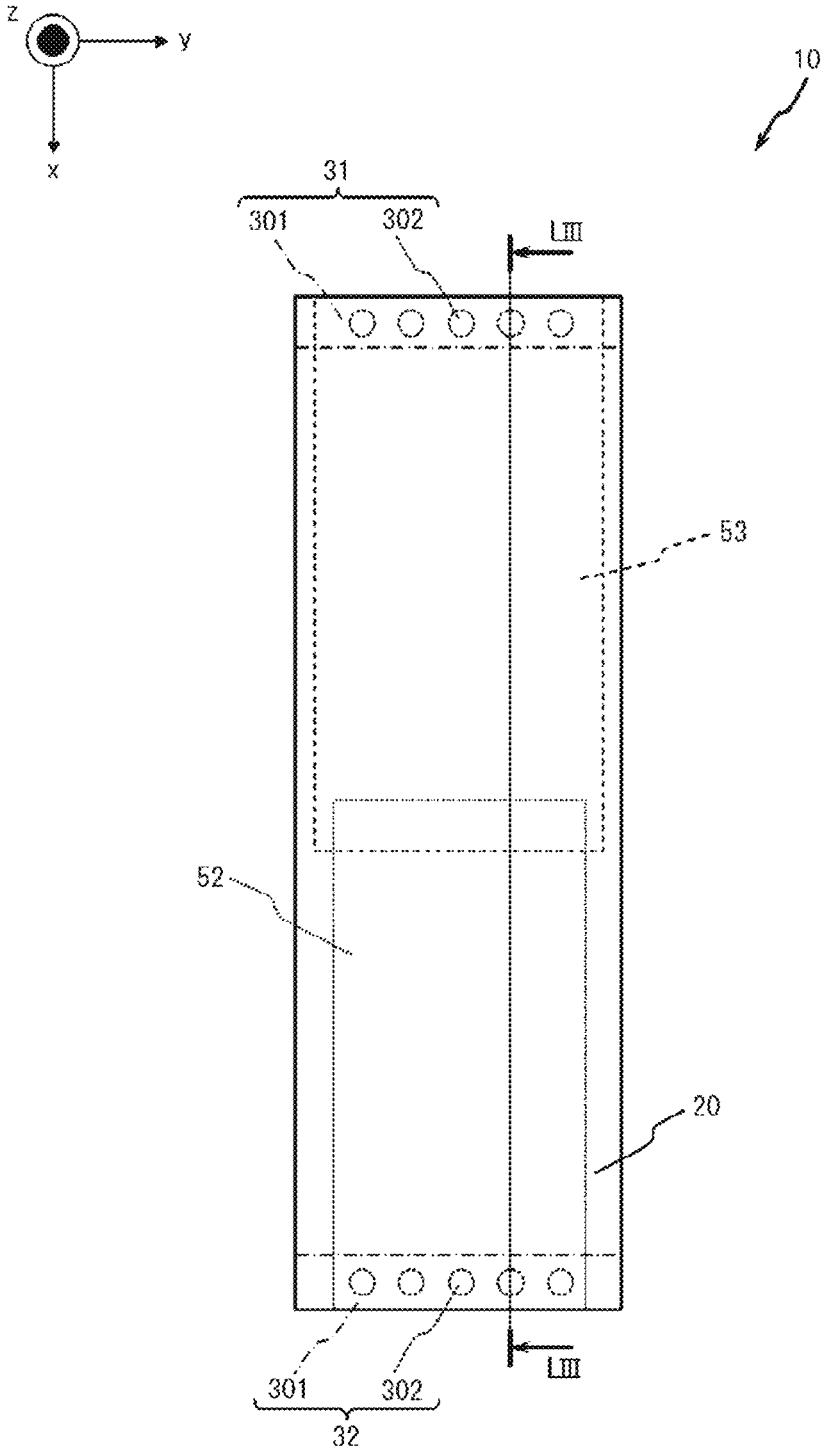
FIG. 52 is a plan view illustrating one embodiment of the resonator.
Figure 53:
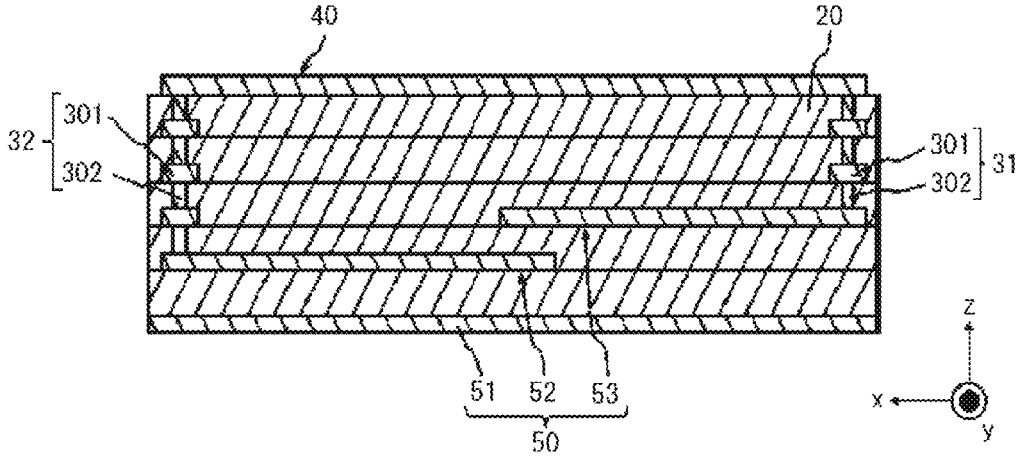
FIG. 53 is a cross-sectional view illustrating one embodiment of the resonator.

FIG. 52 illustrates another example of the resonator 10. FIG. 53 is a cross-sectional view taken along line LIII-LIII illustrated in FIG. 52. The resonator 10 includes the fourth conductor 50 and the reference potential layer 51. The reference potential layer 51 can be electrically connected to the ground of the device including the resonator 10. The fourth conductor 50 includes a resonator. The fourth conductor 50 may include the third conductive layer 52 and the fourth conductive layer 53. The third conductive layer 52 and the fourth conductive layer 53 are capacitively coupled to each other. The third conductive layer 52 and the fourth conductive layer 53 face each other in the z direction. The distance between the third conductive layer 52 and the fourth conductive layer 53 is shorter than the distance between the fourth conductive layer 53 and the reference potential layer 51. The distance between the third conductive layer 52 and the fourth conductive layer 53 is shorter than the distance between the fourth conductor 50 and the reference potential layer 51. The third conductor 40 is one conductive layer.

Figure 54:
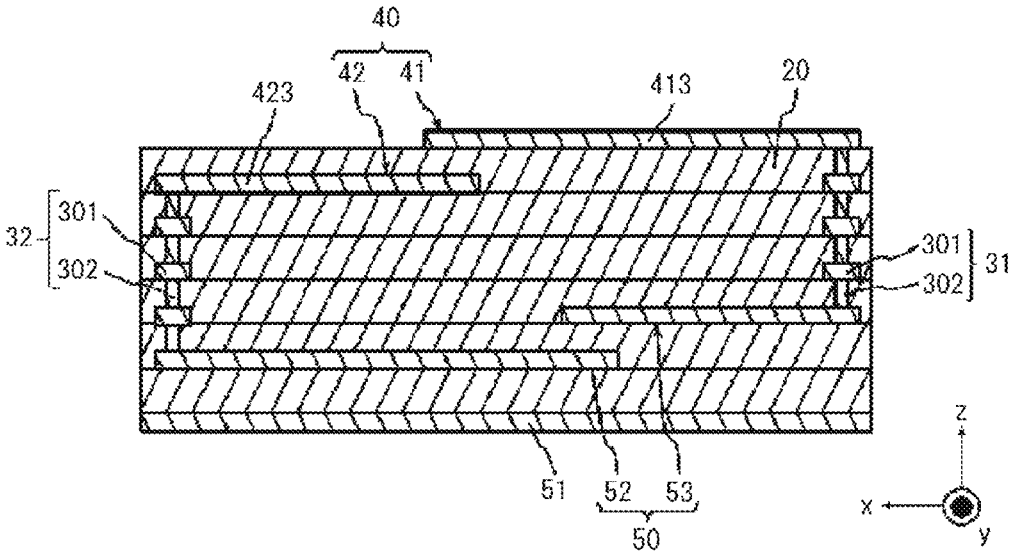
FIG. 54 is a cross-sectional view illustrating one embodiment of the resonator.

FIG. 54 illustrates another example of the resonator 10 illustrated in FIG. 53. The resonator 10 includes the third conductor 40, the fourth conductor 50, and the reference potential layer 51. The third conductor 40 may include the first conductive layer 41 and the second conductive layer 42. The first conductive layer 41 includes the first connecting conductor 413. The second conductive layer 42 includes the second connecting conductor 423. The first connecting conductor 413 is capacitively coupled to the second connecting conductor 423. The reference potential layer 51 can be electrically connected to the ground of the device including the resonator 10. The fourth conductor 50 may include the third conductive layer 52 and the fourth conductive layer 53. The third conductive layer 52 and the fourth conductive layer 53 are capacitively coupled to each other. The third conductive layer 52 and the fourth conductive layer 53 face each other in the z direction. The distance between the third conductive layer 52 and the fourth conductive layer 53 is shorter than the distance between the fourth conductive layer 53 and the reference potential layer 51. The distance between the third conductive layer 52 and the fourth conductive layer 53 is shorter than the distance between the fourth conductor 50 and the reference potential layer 51.

Figure 55:
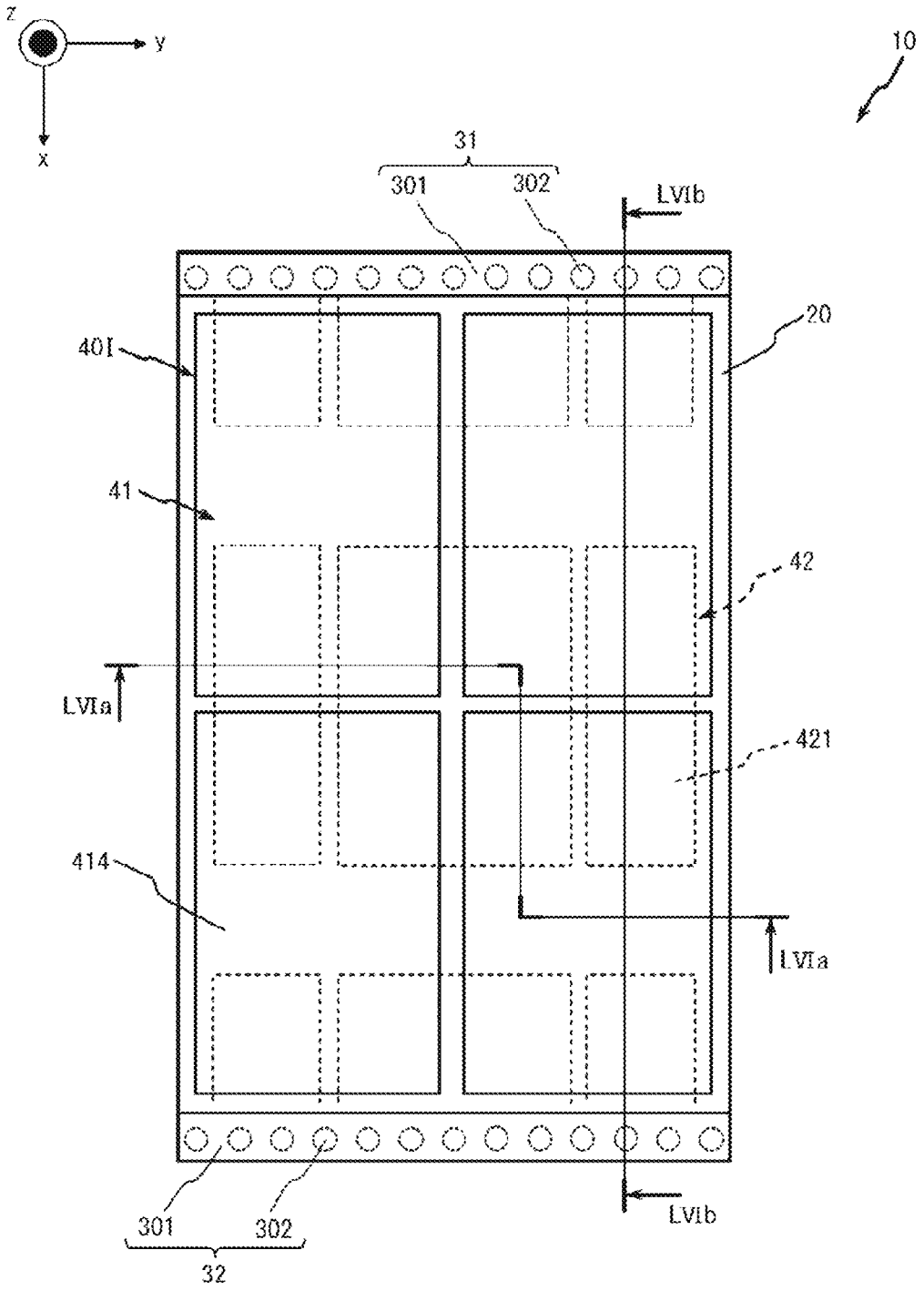
FIG. 55 is a plan view illustrating one embodiment of the resonator.
Figure 56A:
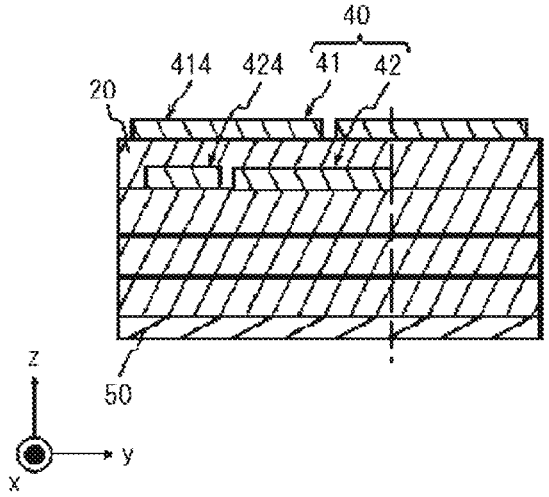
FIG. 56A is a cross-sectional view illustrating one embodiment of a resonator.
Figure 56B:
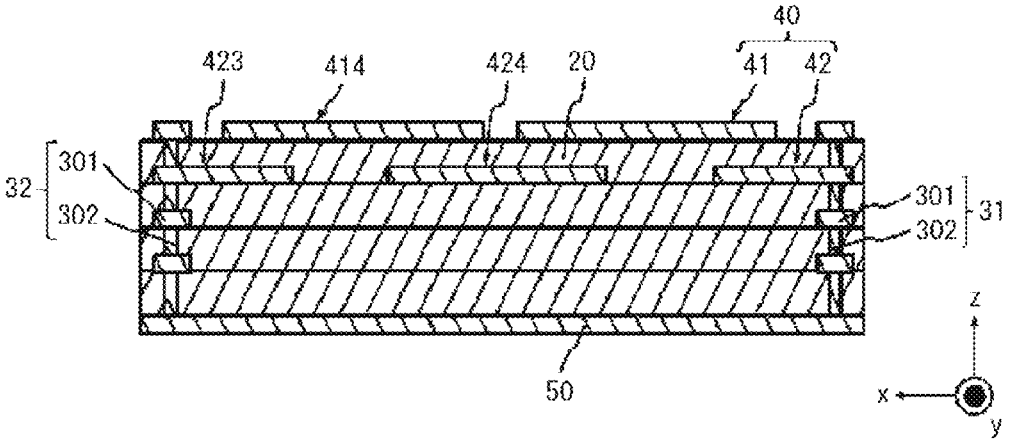
FIG. 56B is a cross-sectional view illustrating one embodiment of the resonator.

FIG. 55 illustrates another example of the resonator 10. FIG. 56A is a cross-sectional view taken along line LVIa-LVIa illustrated in FIG. 55. FIG. 56B is a cross-sectional view taken along line LVIb-LVIb illustrated in FIG. 55. In the resonator 10 illustrated in FIG. 55, the first conductive layer 41 has four first floating conductors 414. The first conductive layer 41 illustrated in FIG. 55 does not have the first connecting conductor 413. In the resonator 10 illustrated in FIG. 55, the second conductive layer 42 has six second connecting conductors 423 and three second floating conductors 424. Two second connecting conductor 423 are capacitively coupled to two first floating conductors 414. One second floating conductor 424 is capacitively coupled to four first floating conductors 414. Two second floating conductors 424 is capacitively coupled to two first floating conductors 414.

Figure 57:
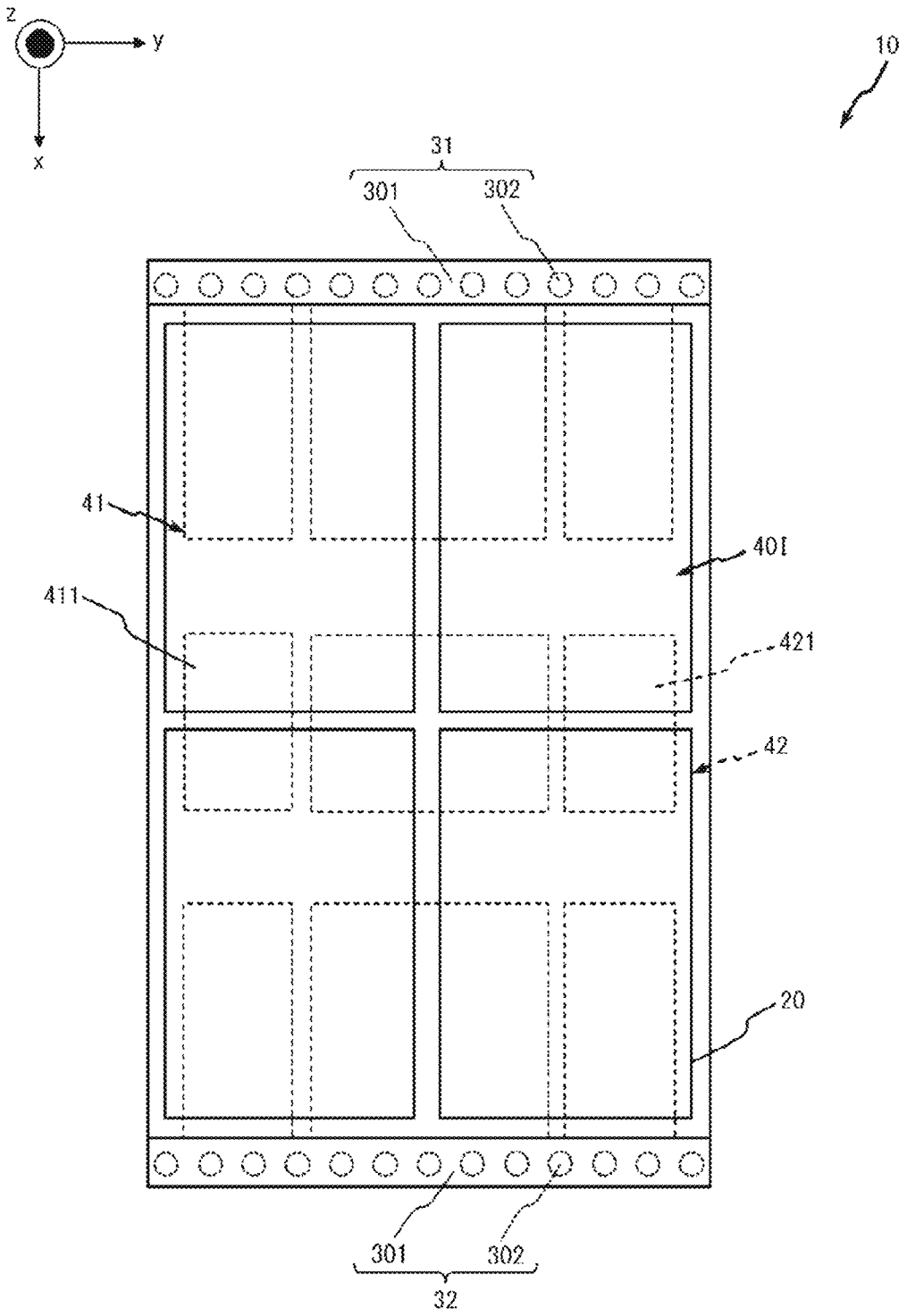
FIG. 57 is a plan view illustrating one embodiment of the resonator.

FIG. 57 is a diagram illustrating another example of the resonator 10 illustrated in FIG. 55. In the resonator 10 of FIG. 57, the size of the second conductive layer 42 is different from that of the resonator 10 illustrated in FIG. 55. In the resonator 10 illustrated in FIG. 57, the length of the second floating conductor 424 along the x direction is shorter than that of the second connecting conductor 423 along the x direction.

Figure 58:
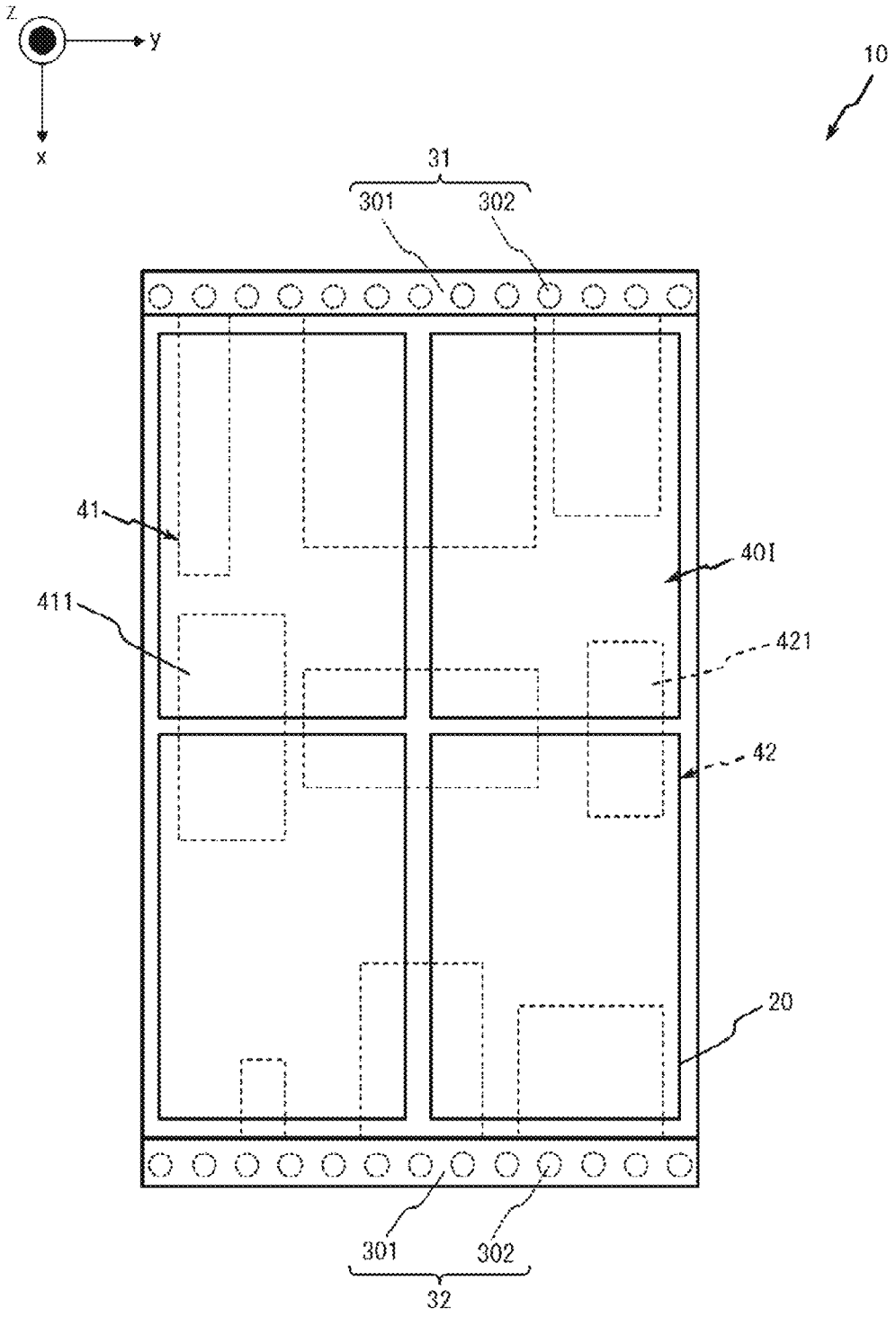
FIG. 58 is a plan view illustrating one embodiment of the resonator.

FIG. 58 is a diagram illustrating another example of the resonator 10 illustrated in FIG. 55. In the resonator 10 of FIG. 58, the size of the second conductive layer 42 is different from that of the resonator 10 illustrated in FIG. 55. In the resonator 10 illustrated in FIG. 58, each of the plurality of second unit conductors 421 have different first surface integrals. In the resonator 10 illustrated in FIG. 58, each of the plurality of second unit conductors 421 have different lengths in the x direction. In the resonator 10 illustrated in FIG. 58, each of the plurality of second unit conductors 421 have different lengths in the y direction. In FIG. 58, the plurality of second unit conductors 421 differ from each other in first surface integral, length, and width, but are not limited thereto. In FIG. 58, the plurality of second unit conductors 421 may differ from each other in some of first surface integral, length, and width. The plurality of second unit conductors 421 may be equal to each other in some or all of first surface integral, length, and width. The plurality of second unit conductors 421 may differ from each other in some or all of first surface integral, length, and width. The plurality of second unit conductors 421 may be equal to each other in some or all of first surface integral, length, and width. Some of the plurality of second unit conductors 421 may be equal to each other in some or all of first surface integral, length, and width.

In the resonator 10 illustrated in FIG. 58, a plurality of second connecting conductors 423 arranged in the y direction have the first surface integrals that are different from each other. In the resonator 10 illustrated in FIG. 58, the plurality of second connecting conductors 423 arranged in the y direction have the lengths that are different from each other in the x direction. In the resonator 10 illustrated in FIG. 58, the plurality of second connecting conductors 423 arranged in the y direction have the lengths that are different from each other in the y direction. In FIG. 58, the plurality of second connecting conductors 423 differ from each other in first surface integral, length, and width, but are not limited thereto. In FIG. 58, the plurality of second connecting conductors 423 may differ from each other in some of first surface integral, length, and width. The plurality of second connecting conductors 423 may be equal to each other in some or all of first surface integral, length, and width. The plurality of second connecting conductors 423 may differ from each other in some or all of first surface integral, length, and width. The plurality of second connecting conductors 423 may be equal to each other in some or all of first surface integral, length, and width. Some of the plurality of second connecting conductors 423 may be equal to each other in some or all of first surface integral, length, and width.

In the resonator 10 illustrated in FIG. 58, the plurality of second floating conductors 424 arranged in the y direction have the first surface integrals that are different from each other. In the resonator 10 illustrated in FIG. 58, the plurality of second floating conductors 424 arranged in the y direction have different lengths in the x direction. In the resonator 10 illustrated in FIG. 58, the plurality of second floating conductors 424 arranged in the y direction have different lengths in the y direction. In FIG. 58, the plurality of second floating conductors 424 differ from each other in first surface integral, length, and width, but are not limited thereto. In FIG. 58, the plurality of second floating conductors 424 may differ from each other in some of first surface integral, length, and width. The plurality of second floating conductors 424 may be equal to each other in first surface integral, length, and width. The plurality of second floating conductors 424 may differ from each other in some or all of first surface integral, length, and width. The plurality of second floating conductors 424 may be equal to each other in some or all of first surface integral, length, and width. Some of the plurality of second floating conductors 424 may be equal to each other in some or all of first surface integral, length, and width.

Figure 59:
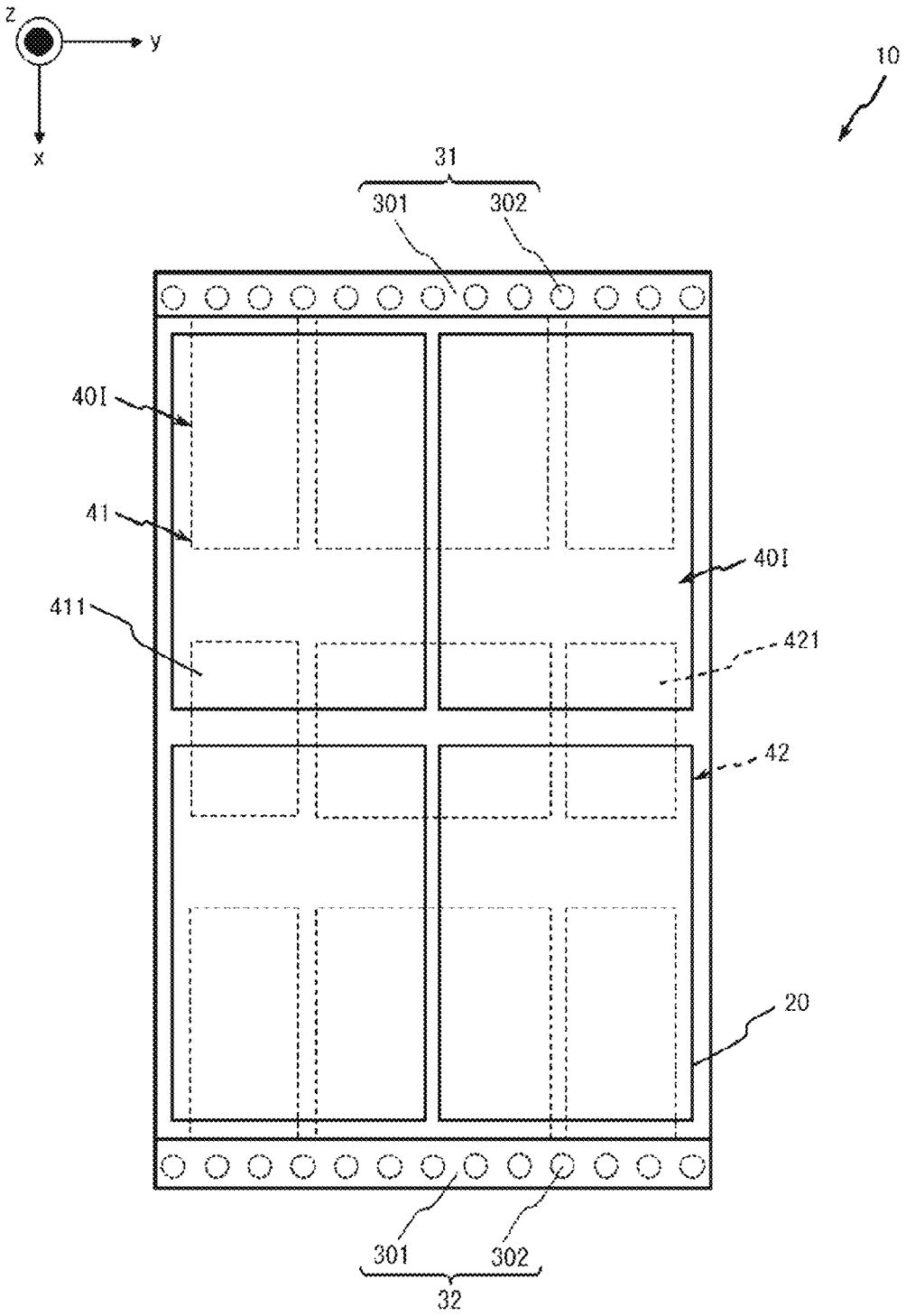
FIG. 59 is a plan view illustrating one embodiment of the resonator.

FIG. 59 is a diagram illustrating another example of the resonator 10 illustrated in FIG. 57. The resonator 10 illustrated in FIG. 59 is different from the resonator 10 illustrated in FIG. 57 in the interval between the first unit conductors 411 in the y direction. In the resonator 10 illustrated in FIG. 59, the interval between the first unit conductors 411 in the y direction is smaller than the interval between the first unit conductors 411 in the x direction. Since the pair conductors 30 of the resonator 10 can function as an electric conductor, current flows in the x direction. In the resonator 10, the current flowing through the third conductor 40 along the y direction can be ignored. The interval between the first unit conductors 411 in the y direction may be shorter than the interval between the first unit conductor 411 in the x direction. The surface integral of the first unit conductor 411 can be increased by shortening the interval between the first unit conductors 411 in the y direction.

Figure 60:
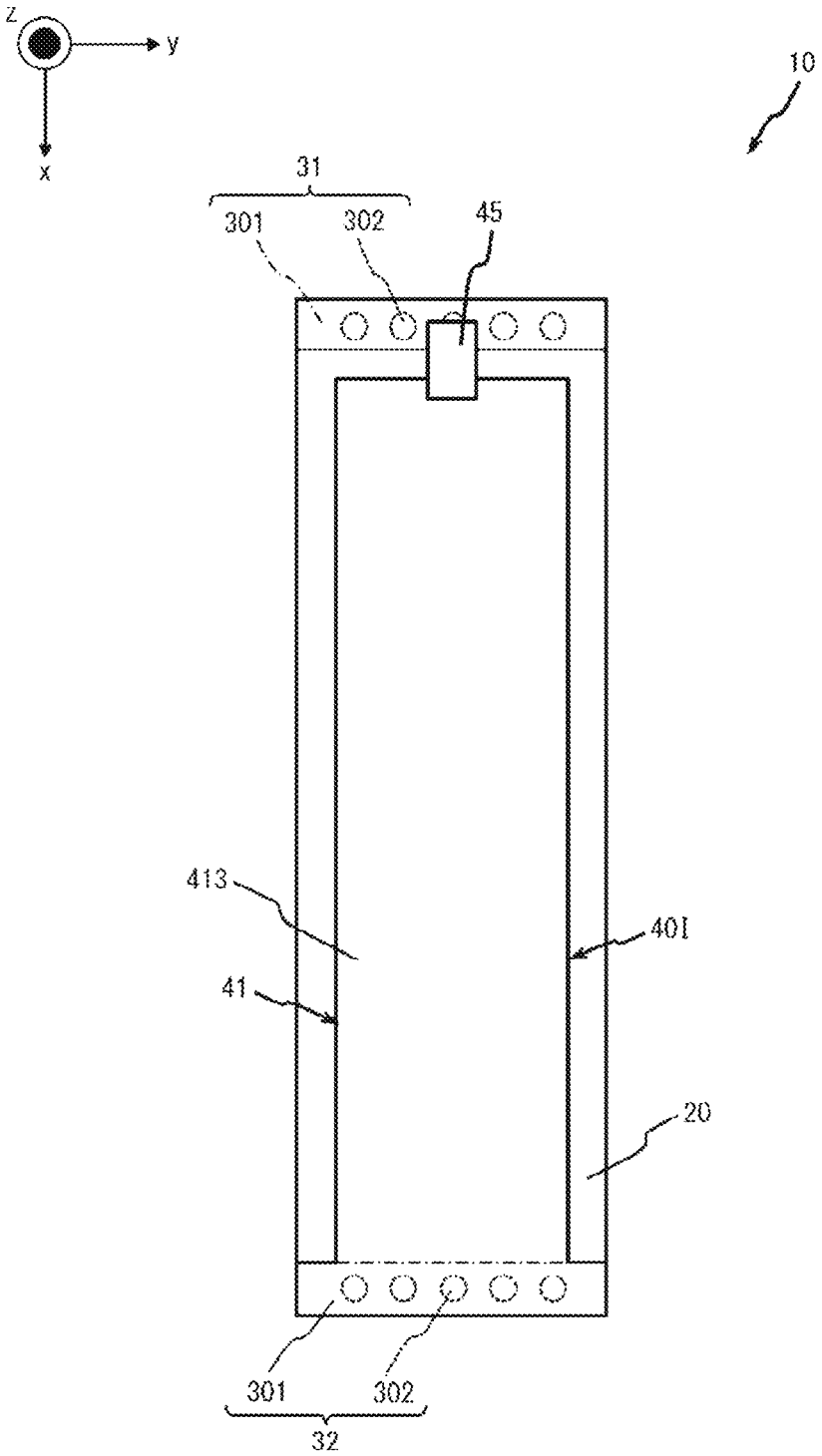
FIG. 60 is a plan view illustrating one embodiment of the resonator.
Figure 61:
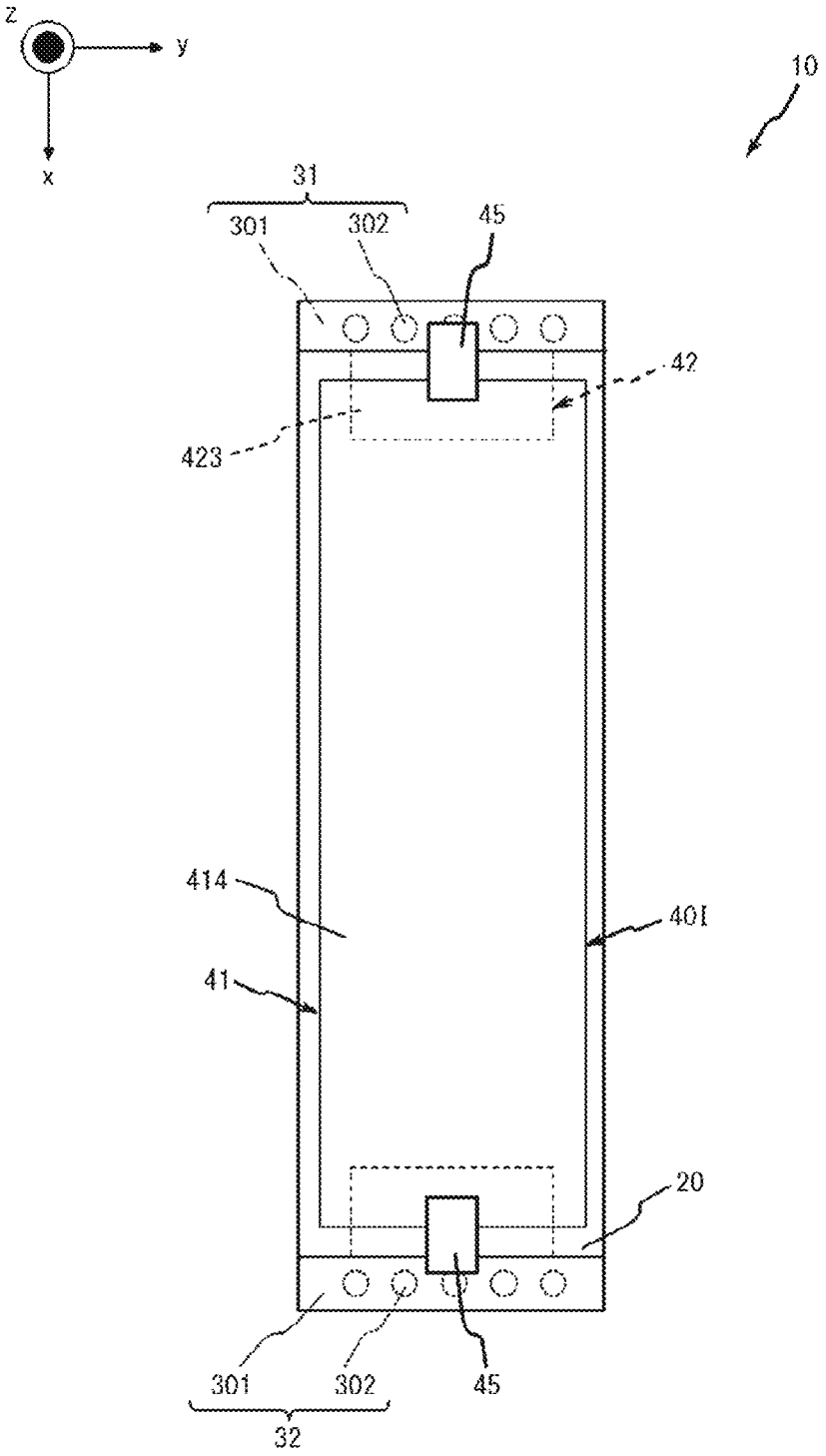
FIG. 61 is a plan view illustrating one embodiment of the resonator.
Figure 62:
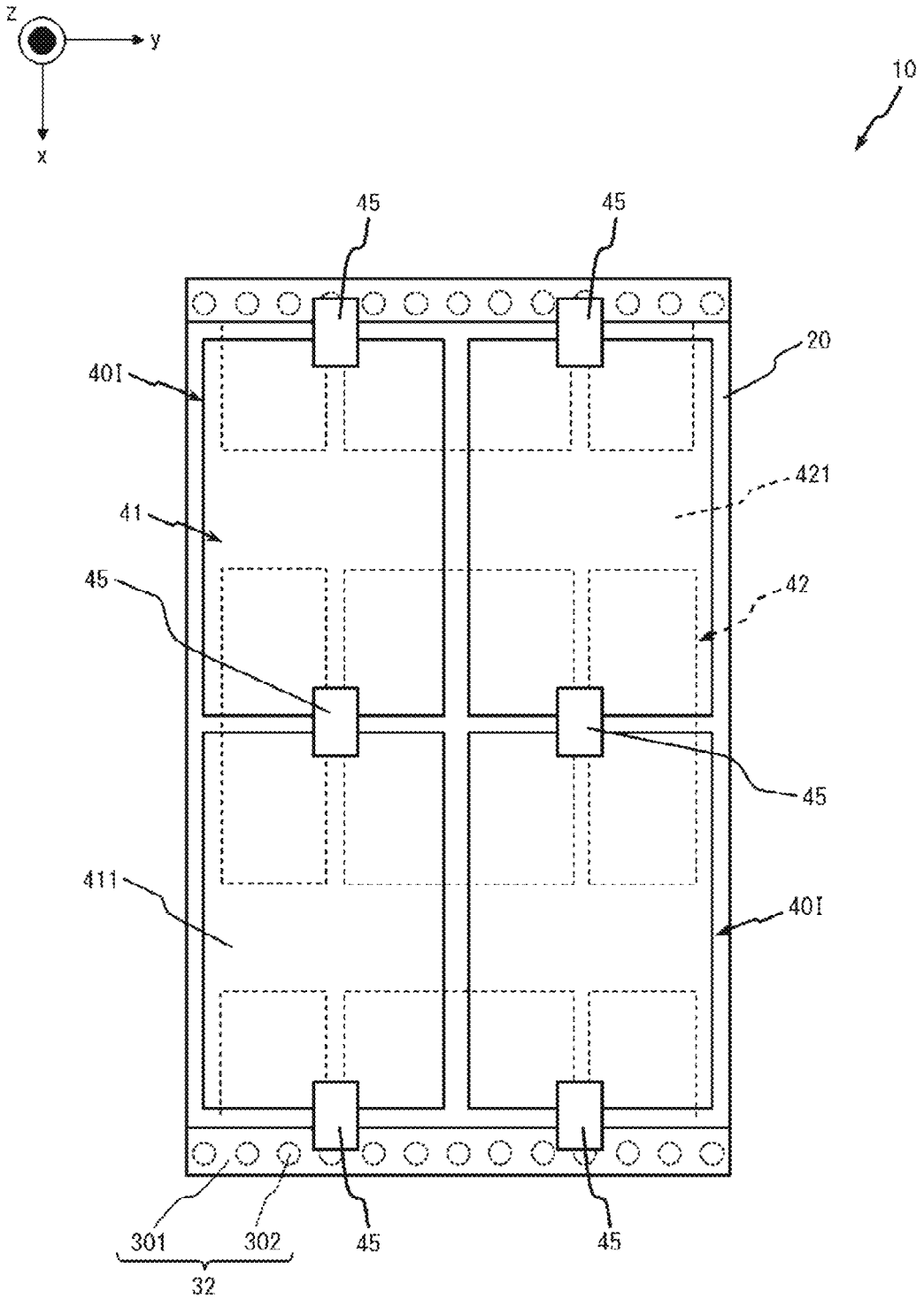
FIG. 62 is a plan view illustrating one embodiment of the resonator.

FIGS. 60 to 62 are diagrams illustrating another example of the resonator 10. These resonators 10 have an impedance element 45. The unit conductor to which the impedance element 45 is connected is not limited to the examples illustrated in FIGS. 60 to 62. The impedance element 45 illustrated in FIGS. 60 to 62 may be partially omitted. The impedance element 45 may have a capacitance characteristic. The impedance element 45 may have an inductance characteristic. The impedance element 45 may be a mechanical or electrical variable element. The impedance element 45 may connect two different conductors in one layer.

The antenna has at least one of a function of radiating electromagnetic waves and a function of receiving electromagnetic waves. The antenna of the present disclosure includes, but not limited to, a first antenna 60 and a second antenna 70.

The first antenna 60 includes the base 20, the pair conductors 30, the third conductor 40, the fourth conductor 50, and a first feeding line 61. In an example, the first antenna 60 has a third base 24 on the base 20. The third base 24 may have a different composition than the base 20. The third base 24 may be located on the third conductor 40. FIGS. 63 to 76 are diagrams illustrating the first antenna 60, which is an example of a plurality of embodiments.

The first feeding line 61 feeds power to at least one of the resonators arranged periodically as an artificial magnetic conductor. When feeding a plurality of resonators, the first antenna 60 may have a plurality of first feeding lines. The first feeding line 61 may be electromagnetically connected to any of the resonators arranged periodically as the artificial magnetic conductor. The first feeding line 61 may be electromagnetically connected to any of a pair of conductors, which can be seen as the electric conductor, from the resonators arranged periodically as the artificial magnetic conductor.

The first feeding line 61 feeds power to at least one of the first conductor 31, the second conductor 32, and the third conductor 40. When feeding a plurality of portions of the first conductor 31, the second conductor 32, and the third conductor 40, the first antenna 60 may have a plurality of first feeding lines. The first feeding line 61 may be electromagnetically connected to any of the first conductor 31, the second conductor 32, and the third conductor 40. When the first antenna 60 includes the reference potential layer 51 in addition to the fourth conductor 50, the first feeding line 61 may be electromagnetically connected to any of the first conductor 31, the second conductor 32, the third conductor 40, and the fourth conductor 50. The first feeding line 61 is electrically connected to either the fifth conductive layer 301 or the fifth conductor 302 of the pair conductors 30. A part of the first feeding line 61 may be integrated with the fifth conductive layer 301.

The first feeding line 61 may be electromagnetically connected to the third conductor 40. For example, the first feeding line 61 is electromagnetically connected to one of the first unit resonators 41X. For example, the first feeding line 61 is electromagnetically connected to one of the second unit resonators 42X. The first feeding line 61 is electromagnetically connected to the unit conductor of the third conductor 40 at a point different from the center in the x direction. In one embodiment, the first feeding line 61 supplies power to at least one resonator included in the third conductor 40. In one embodiment, the first feeding line 61 feeds power from at least one resonator included in the third conductor 40 to the outside. At least a part of the first feeding line 61 may be located in the base 20. The first feeding line 61 may be exposed to the outside from any of two zx planes, two yz planes, and two xy planes of the base 20.

The first feeding line 61 may be in contact with the third conductor 40 from forward and backward directions of the z direction. The fourth conductor 50 may be omitted around the first feeding line 61. The first feeding line 61 may be electromagnetically connected to the third conductor 40 through the opening of the fourth conductor 50. The first conductive layer 41 may be omitted around the first feeding line 61. The first feeding line 61 may be connected to the second conductive layer 42 through the opening of the first conductive layer 41. The first feeding line 61 may be in contact with the third conductor 40 along the xy plane. The pair conductors 30 may be omitted around the first feeding line 61. The first feeding line 61 may be connected to the third conductor 40 through the openings of the pair conductors 30. The first feeding line 61 is connected to the unit conductor of the third conductor 40 while being away from the central portion of the unit conductor.

Figure 63:
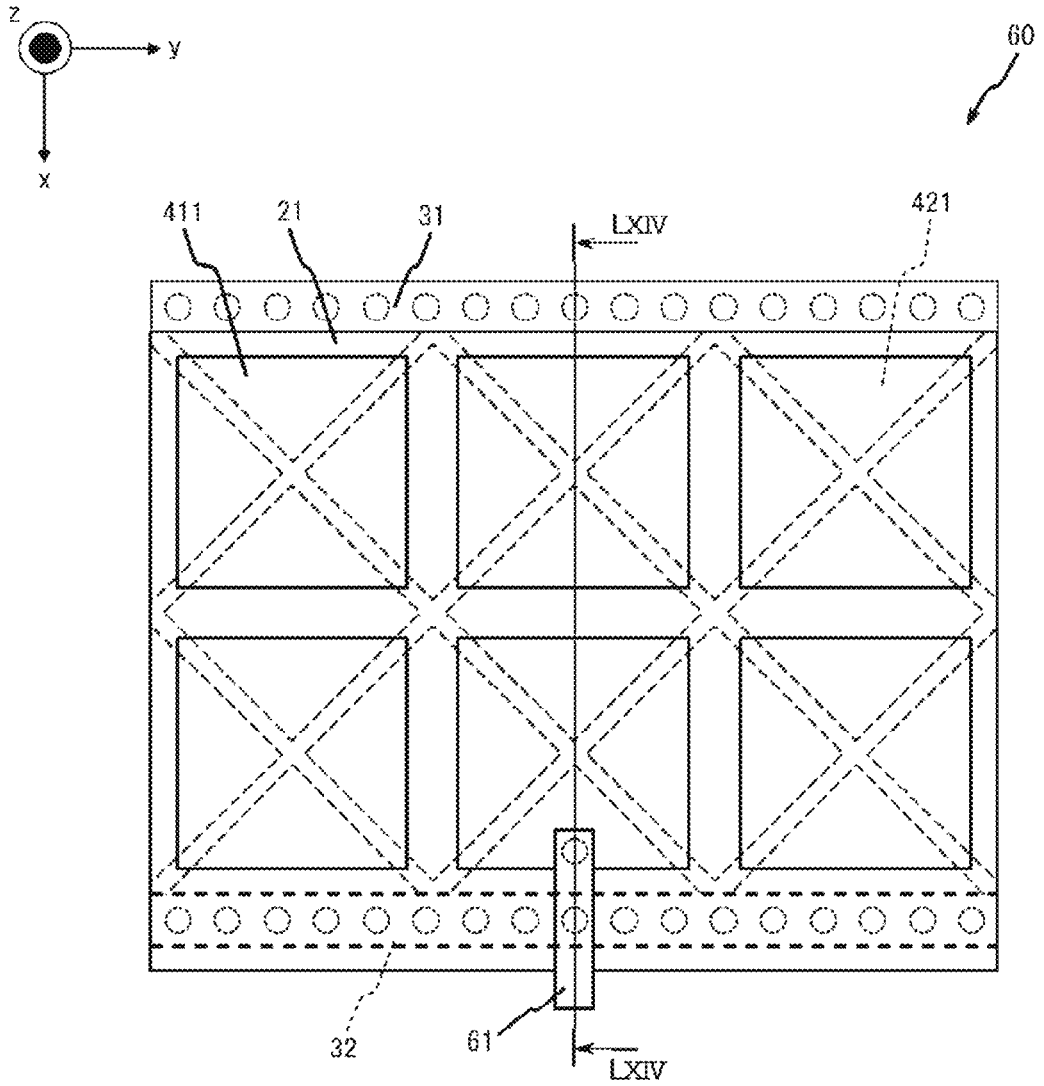
FIG. 63 is a plan view illustrating one embodiment of an antenna.
Figure 64:
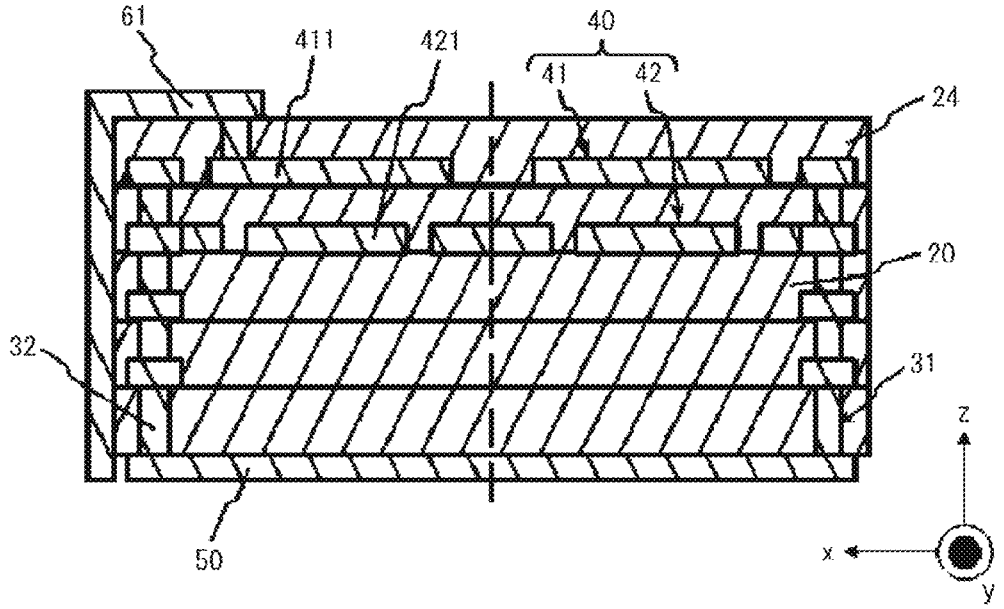
FIG. 64 is a cross-sectional view illustrating one embodiment of the antenna.

FIG. 63 is a plan view of the first antenna 60 when the xy plane is viewed in the z direction. FIG. 64 is a cross-sectional view taken along line LXIV-LXIV illustrated in FIG. 63. The first antenna 60 illustrated in FIGS. 63 and 64 has the third base 24 on the third conductor 40. The third base 24 has an opening on the first conductive layer 41. The first feeding line 61 is electrically connected to the first conductive layer 41 via the opening of the third base 24.

Figure 65:
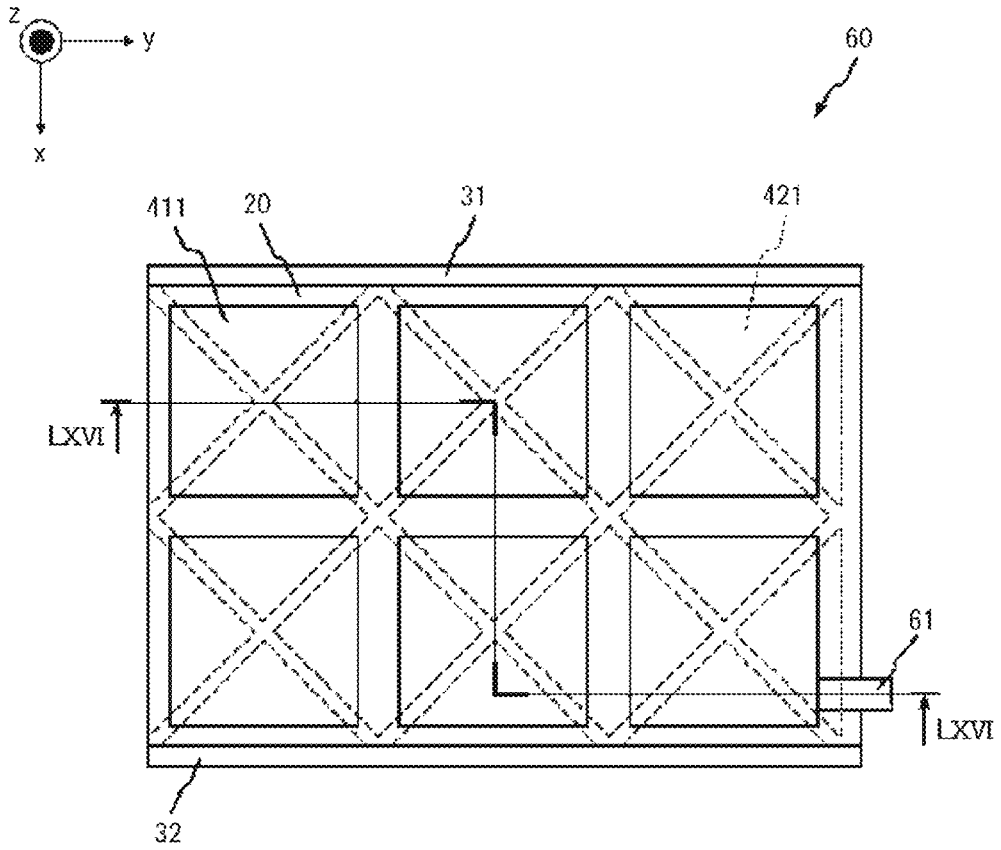
FIG. 65 is a plan view illustrating one embodiment of the antenna.
Figure 66:
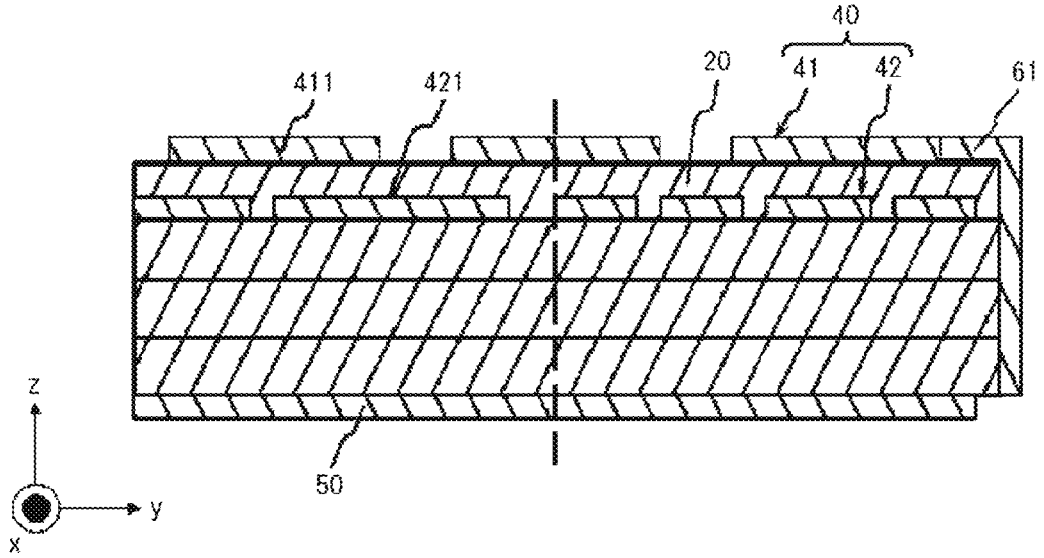
FIG. 66 is a cross-sectional view illustrating one embodiment of the antenna.

FIG. 65 is a plan view of the first antenna 60 when the xy plane is viewed in the z direction. FIG. 66 is a cross-sectional view taken along line LXVI-LXVI illustrated in FIG. 65. In the first antenna 60 illustrated in FIGS. 65 and 66, a part of the first feeding line 61 is located on the base 20. The first feeding line 61 may be connected to the third conductor 40 in the xy plane. The first feeding line 61 may be connected to the first conductive layer 41 in the xy plane. In one embodiment, the first feeding line 61 may be connected to the second conductive layer 42 in the xy plane.

Figure 67:
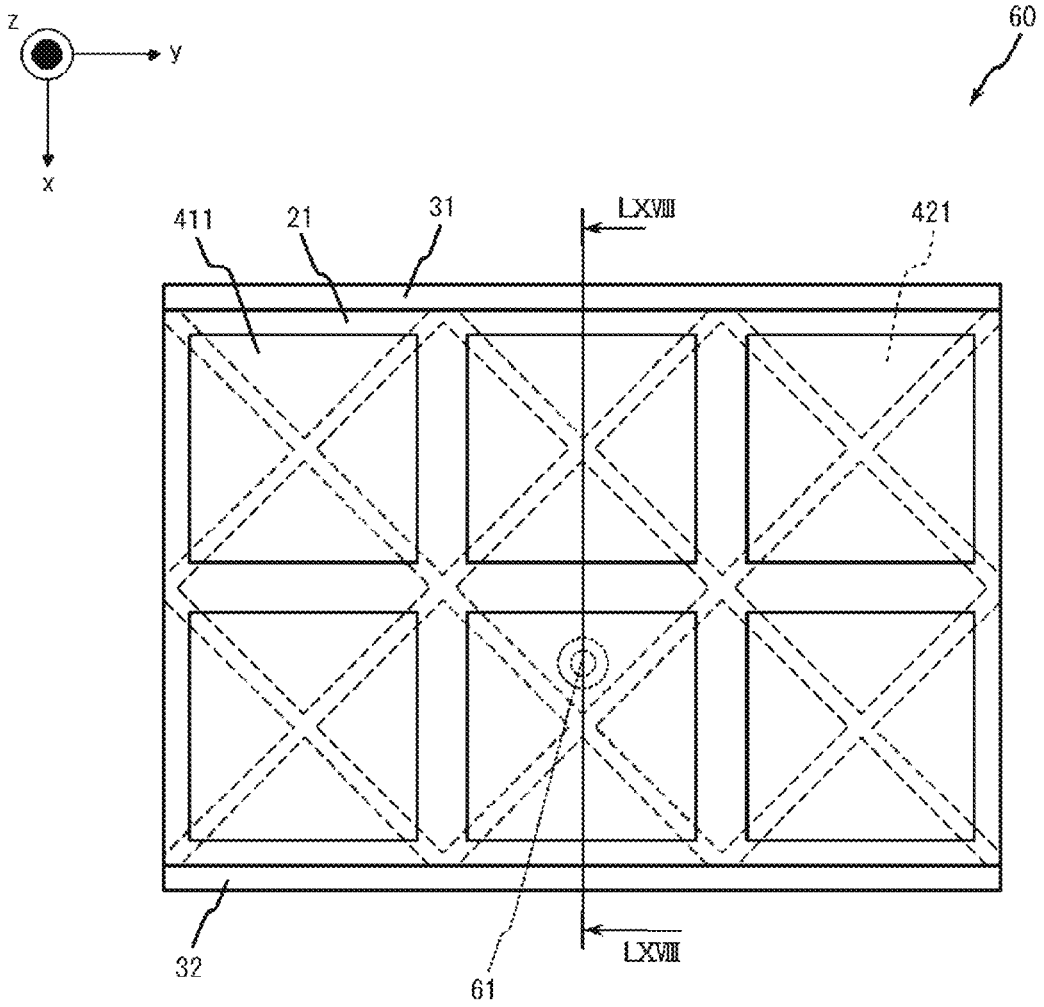
FIG. 67 is a plan view illustrating one embodiment of the antenna.
Figure 68:
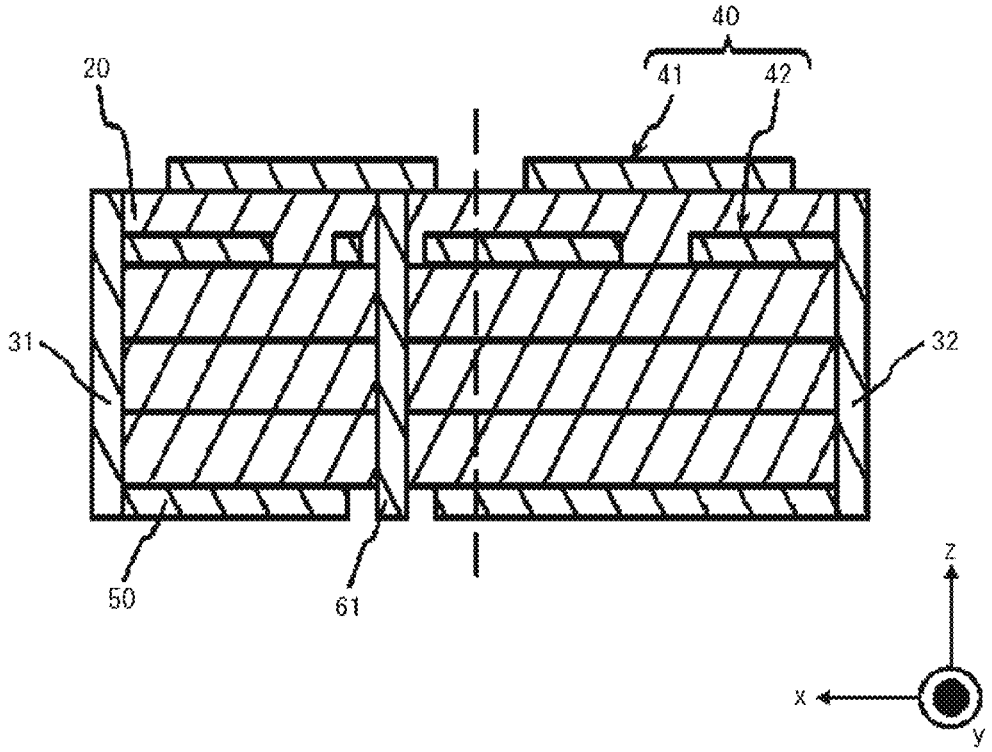
FIG. 68 is a cross-sectional view illustrating one embodiment of the antenna.

FIG. 67 is a plan view of the first antenna 60 when the xy plane is viewed in the z direction. FIG. 68 is a cross-sectional view taken along line LXVIII-LXVIII illustrated in FIG. 67. In the first antenna 60 illustrated in FIGS. 67 and 68, the first feeding line 61 is located in the base 20. The first feeding line 61 may be connected to the third conductor 40 from a backward direction in the z direction. The fourth conductor 50 may have an opening. The fourth conductor 50 may have an opening at a position overlapping the third conductor 40 in the z direction. The first feeding line 61 may be exposed to the outside of the base 20 via the opening.

Figure 69:
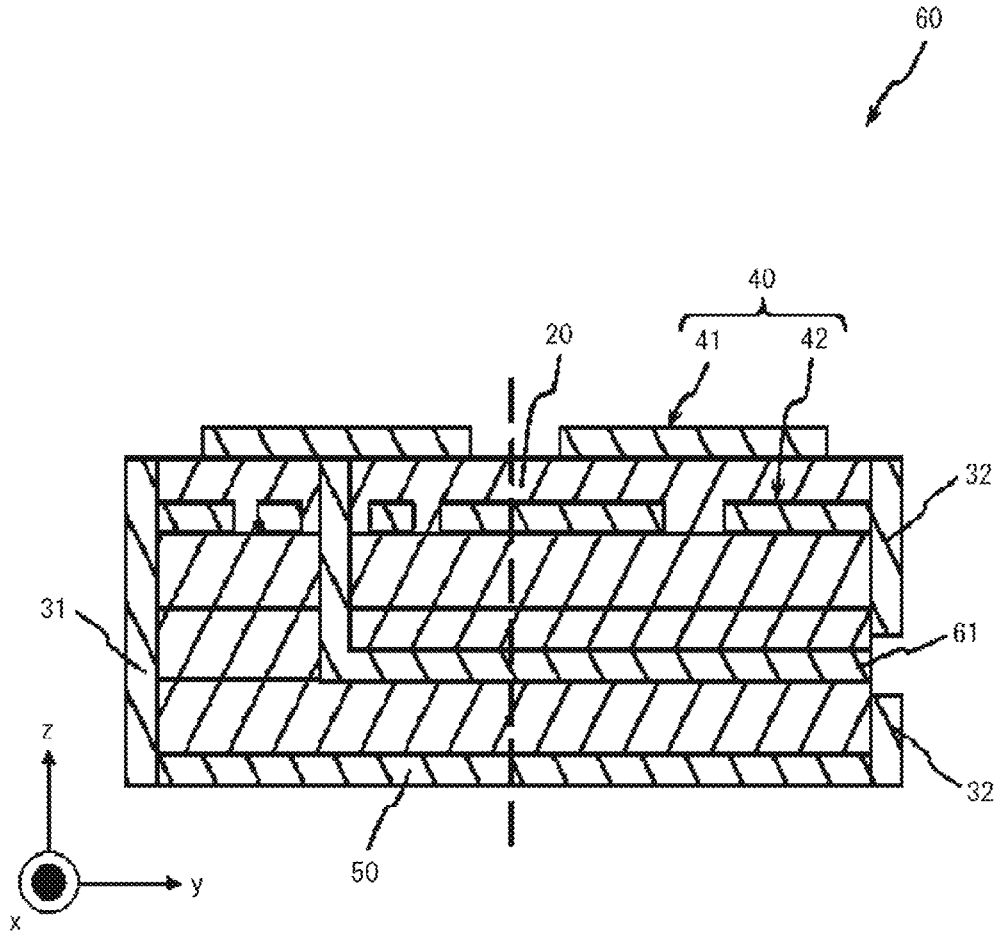
FIG. 69 is a cross-sectional view illustrating one embodiment of the antenna.

FIG. 69 is a cross-sectional view of the first antenna 60 when the yz plane is viewed in the x direction. The pair conductors 30 may have the openings. The first feeding line 61 may be exposed to the outside of the base 20 via the opening.

The electromagnetic waves radiated by the first antenna 60 have a polarization component in the x direction larger than that in the y direction in the first plane. The polarization component in the x direction is less attenuated than the horizontal polarization component when a metal plate approaches the fourth conductor 50 from the z direction. The first antenna 60 may maintain the radiation efficiency when the metal plate approaches from the outside.

Figure 70:
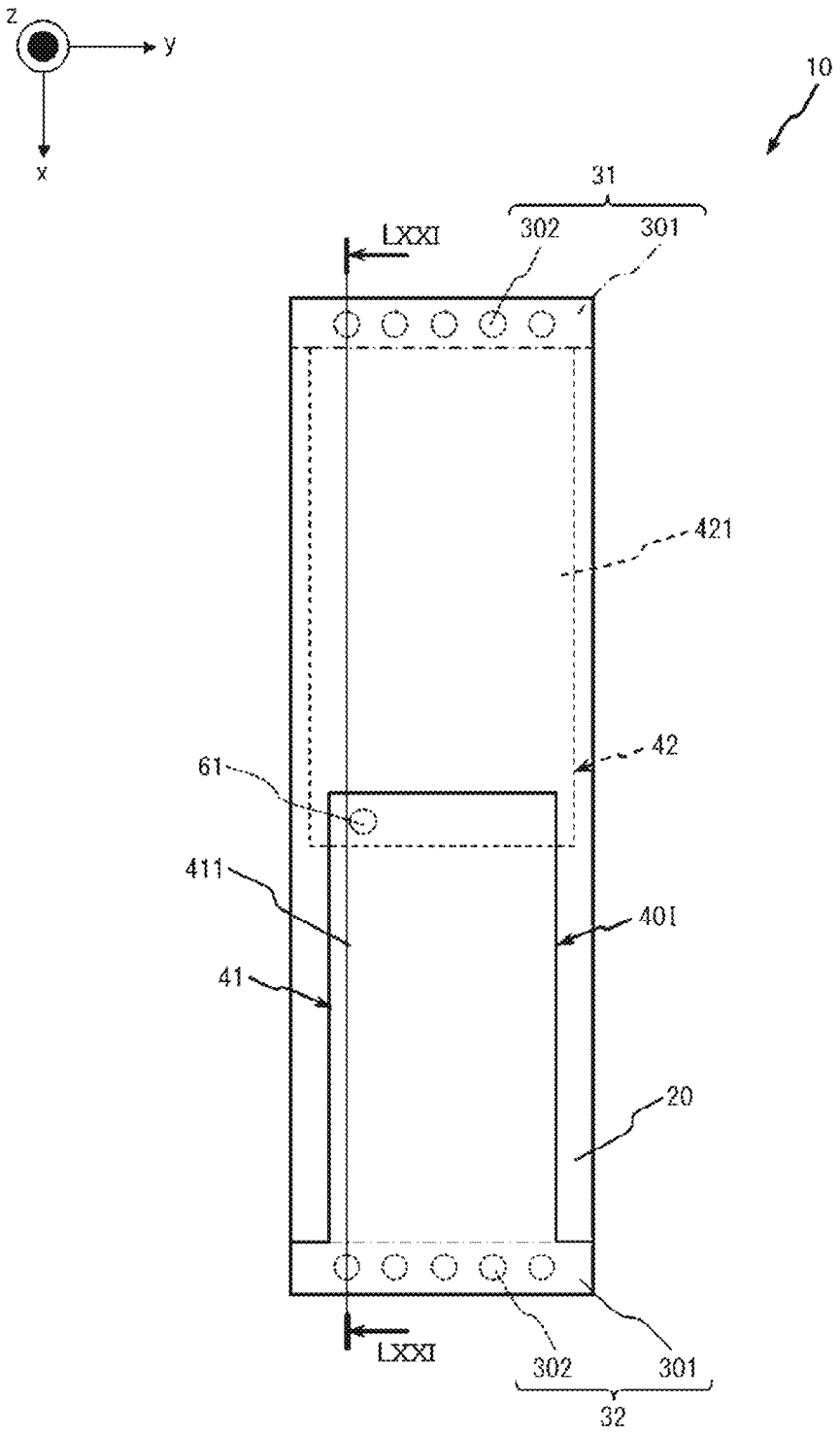
FIG. 70 is a plan view illustrating one embodiment of the antenna.
Figure 71:
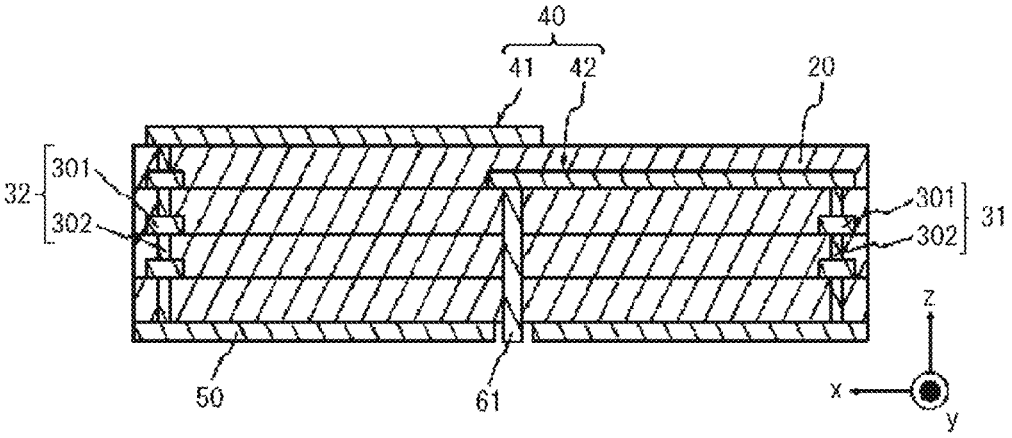
FIG. 71 is a cross-sectional view illustrating one embodiment of the antenna.
Figure 72:
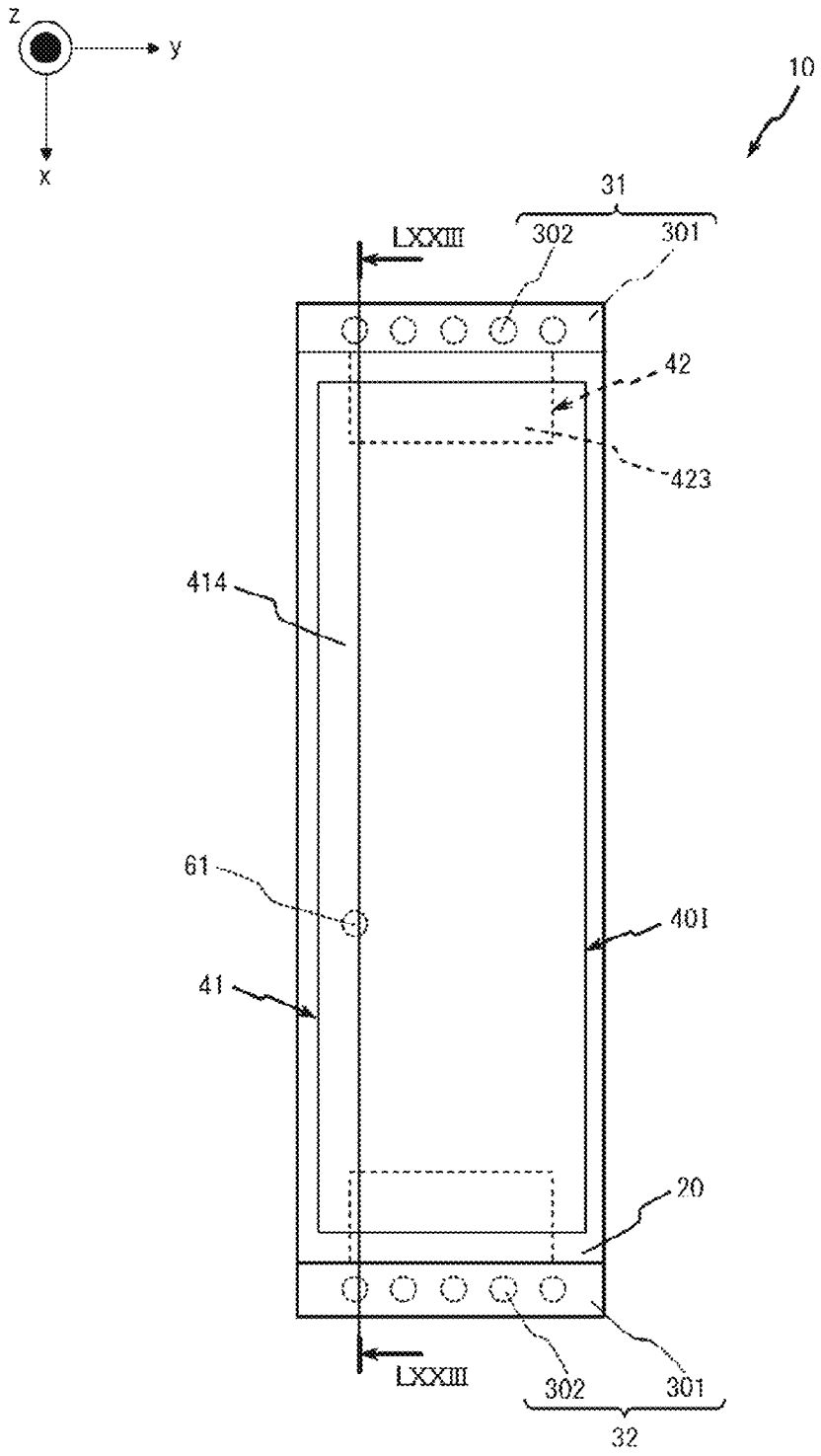
FIG. 72 is a plan view illustrating one embodiment of the antenna.
Figure 73:
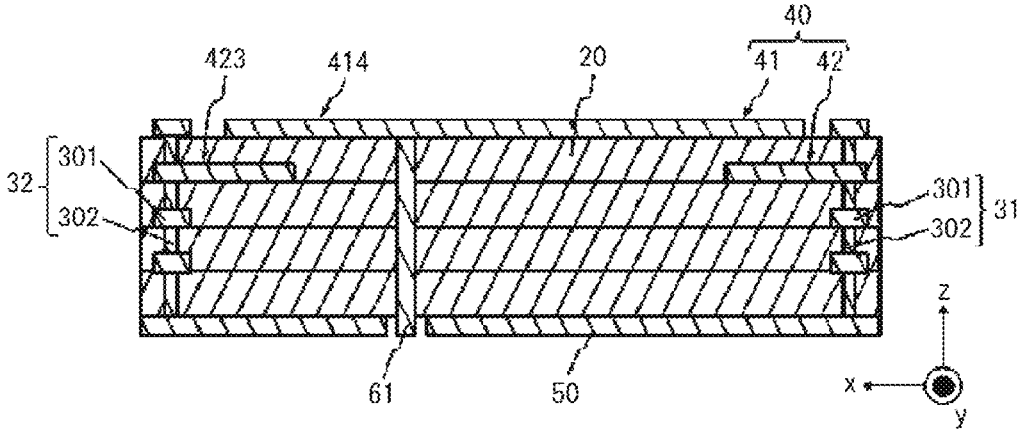
FIG. 73 is a cross-sectional view illustrating one embodiment of the antenna.
Figure 74:
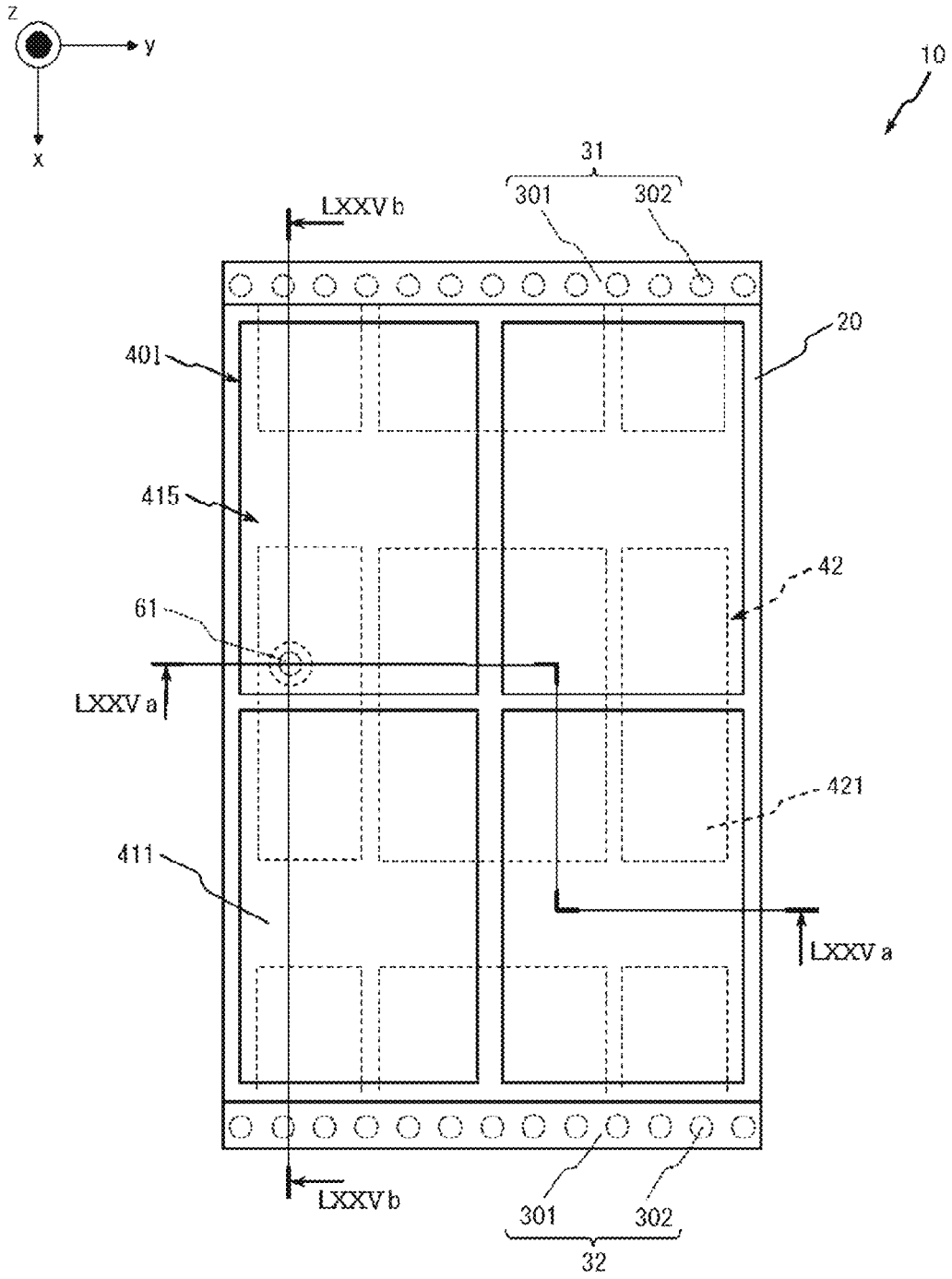
FIG. 74 is a plan view illustrating one embodiment of the antenna.
Figure 75A:
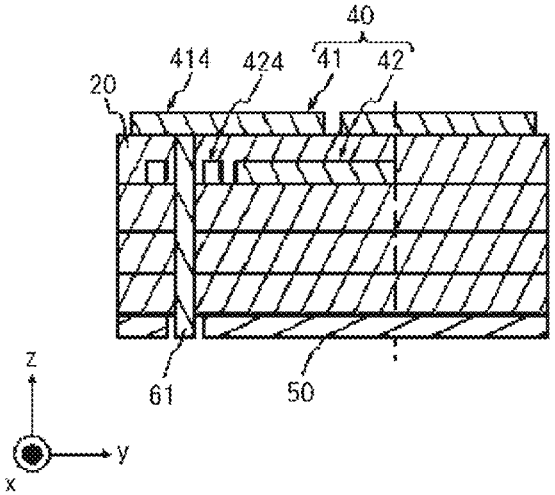
FIG. 75A is a cross-sectional view illustrating one embodiment of the antenna.
Figure 75B:
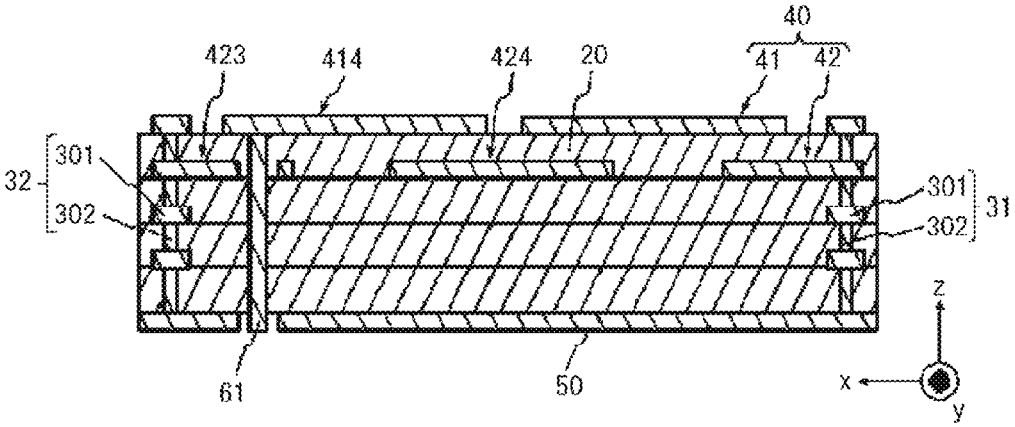
FIG. 75B is a cross-sectional view illustrating one embodiment of the antenna.
Figure 76:
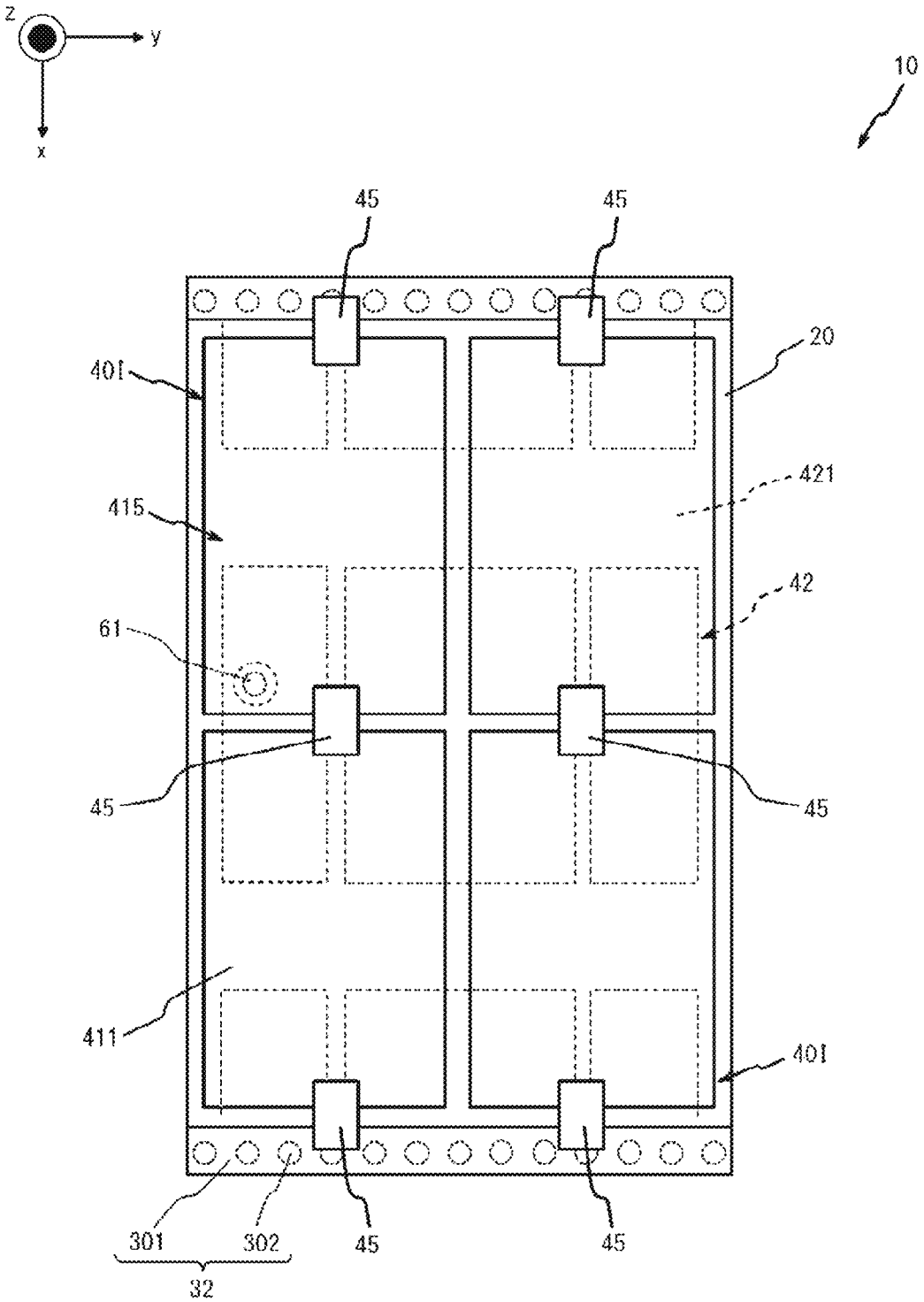
FIG. 76 is a plan view illustrating one embodiment of the antenna.

FIG. 70 illustrates another example of the first antenna 60. FIG. 71 is a cross-sectional view taken along line LXXI-LXXI illustrated in FIG. 70. FIG. 72 illustrates another example of the first antenna 60. FIG. 73 is a cross-sectional view taken along line LXXIII-LXXIII illustrated in FIG. 72. FIG. 74 illustrates another example of the first antenna 60. FIG. 75A is a cross-sectional view taken along line LXXVa-LXXVa illustrated in FIG. 74. FIG. 75B is a cross-sectional view taken along line LXXVb-LXXVb illustrated in FIG. 74. FIG. 76 illustrates another example of the first antenna 60. The first antenna 60 illustrated in FIG. 76 has the impedance element 45.

The operating frequency of the first antenna 60 may change by the impedance element 45. The first antenna 60 includes a first feeding conductor 415 connected to the first feeding line 61 and the first unit conductor 411 not connected to the first feeding line 61. The impedance matching changes when the impedance element 45 is connected to the first feeding conductor 415 and another conductor. The impedance matching of the first antenna 60 may be adjusted by connecting the first feeding conductor 415 and another conductor by the impedance elements 45. In the first antenna 60, the impedance element 45 may be inserted between the first feeding conductor 415 and another conductor to adjust the impedance matching. In the first antenna 60, the impedance element 45 may be inserted between two first unit conductors 411 that are not connected to the first feeding line 61 to adjust the operating frequency. In the first antenna 60, the impedance element 45 may be inserted between the first unit conductor 411 that is not connected to the first feeding line 61 and any of the pair conductors 30 to adjust the operating frequency.

The second antenna 70 includes the base 20, the pair conductors 30, the third conductor 40, the fourth conductor 50, a second feeding layer 71, and a second feeding line 72. In an example, the third conductor 40 may be located in the base 20. In an example, the second antenna 70 has the third base 24 on the base 20. The third base 24 may have a different composition than the base 20. The third base 24 may be located on the third conductor 40. The third base 24 may be located on the second feeding layer 71.

The second feeding layer 71 is located above the third conductor 40 with a space. The base 20 or the third base 24 may be located between the second feeding layer 71 and the third conductor 40. The second feeding layer 71 includes the line type, patch type, and slot type resonators. The second feeding layer 71 may be referred to as an antenna element. In one embodiment, the second feeding layer 71 may be electromagnetically connected to the third conductor 40. The resonance frequency of the second feeding layer 71 changes from a single resonance frequency due to the electromagnetic coupling with the third conductor 40. In an example, the second feeding layer 71 receives power from the second feeding line 72 and resonates with the third conductor 40. In an example, the second feeding layer 71 receives power from the second feeding line 72 and resonates with the third conductor 40 and the third conductor.

The second feeding line 72 is electrically connected to the second feeding layer 71. In one embodiment, the second feeding line 72 transfers power to the second feeding layer 71. In one embodiment, the second feeding line 72 transfers power from the second feeding layer 71 to the outside.

Figure 77:
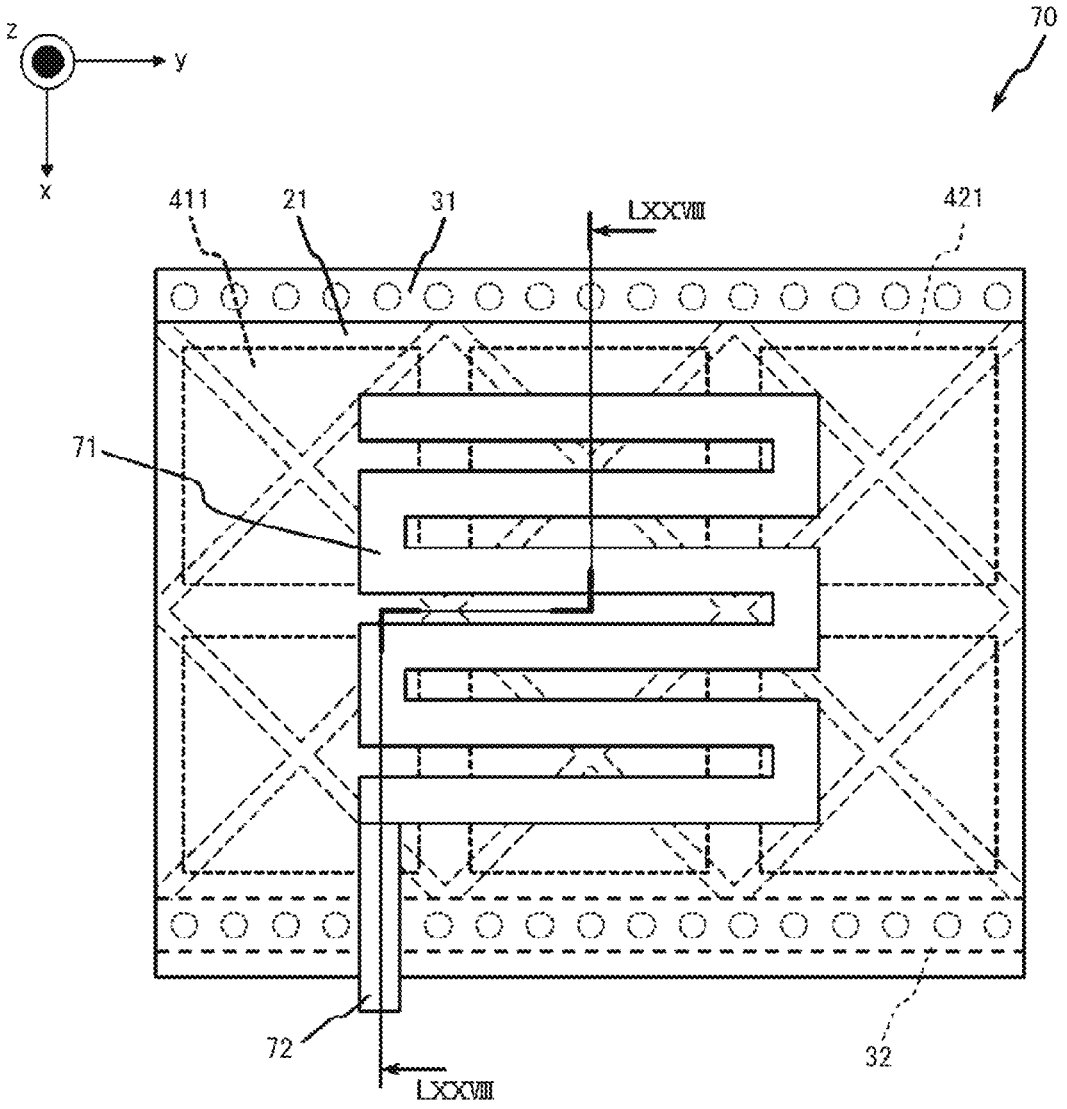
FIG. 77 is a plan view illustrating one embodiment of the antenna.
Figure 78:
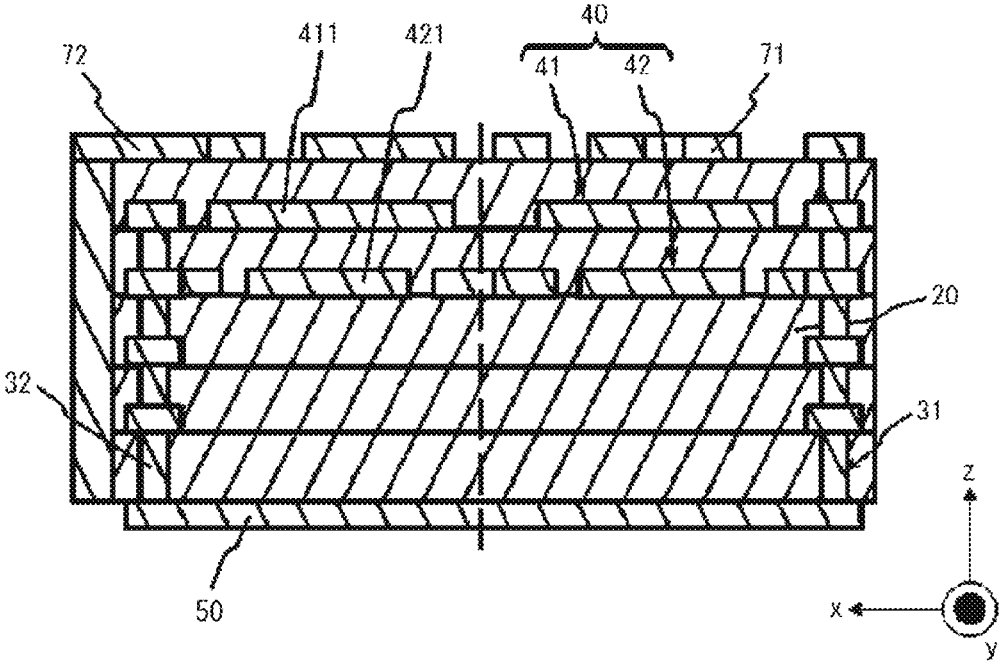
FIG. 78 is a cross-sectional view of the antenna illustrated in FIG. 43.

FIG. 77 is a plan view of the second antenna 70 when the xy plane is viewed in the z direction. FIG. 78 is a cross-sectional view taken along line LXXVIII-LXXVIII illustrated in FIG. 77. In the second antenna 70 illustrated in FIGS. 77 and 78, the third conductor 40 is located in the base 20. The second feeding layer 71 is located on the base 20. The second feeding layer 71 is located overlapping the unit structure 10X as viewed in the z direction. The second feeding line 72 is located on the base 20. The second feeding line 72 is electromagnetically connected to the second feeding layer 71 in the xy plane.

Figure 79:
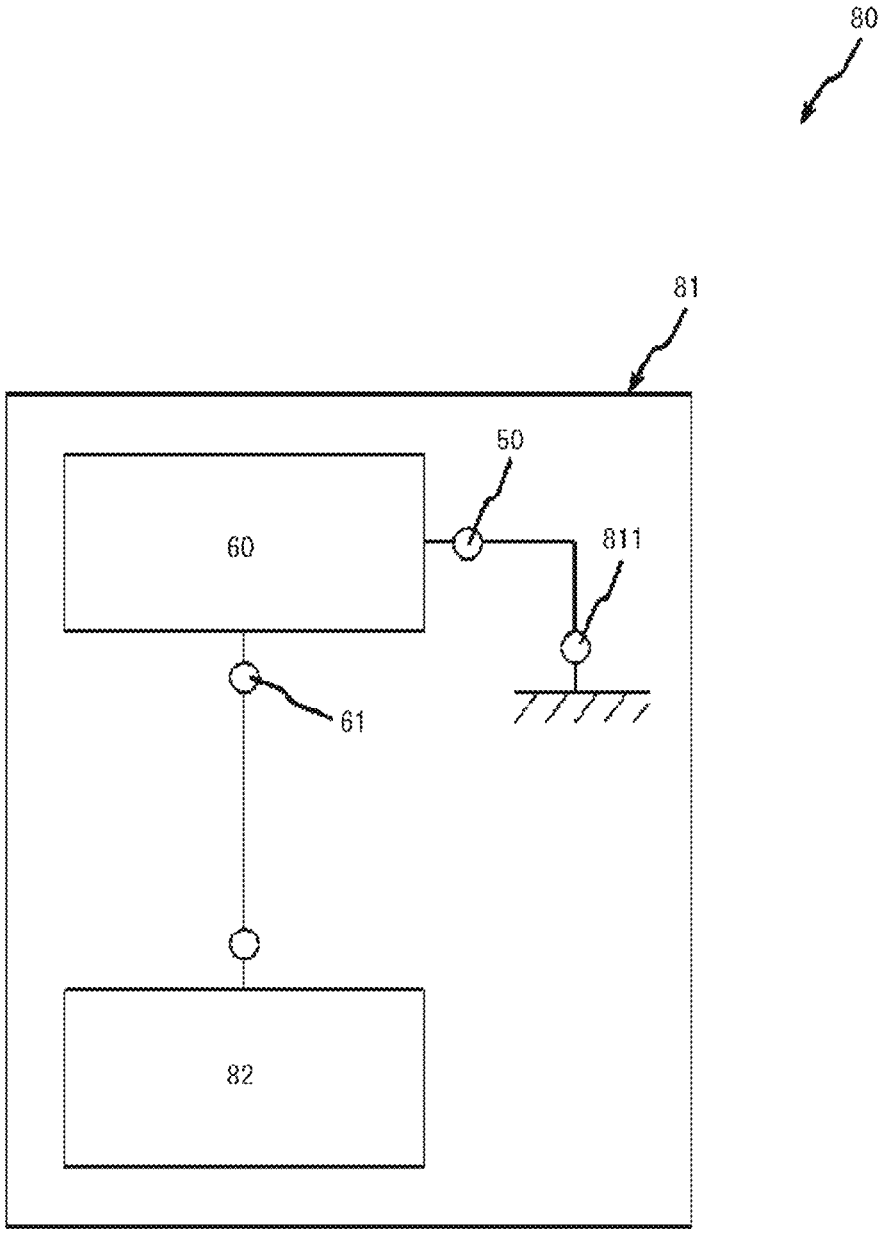
FIG. 79 is a block diagram illustrating one embodiment of a wireless communication module.
Figure 80:
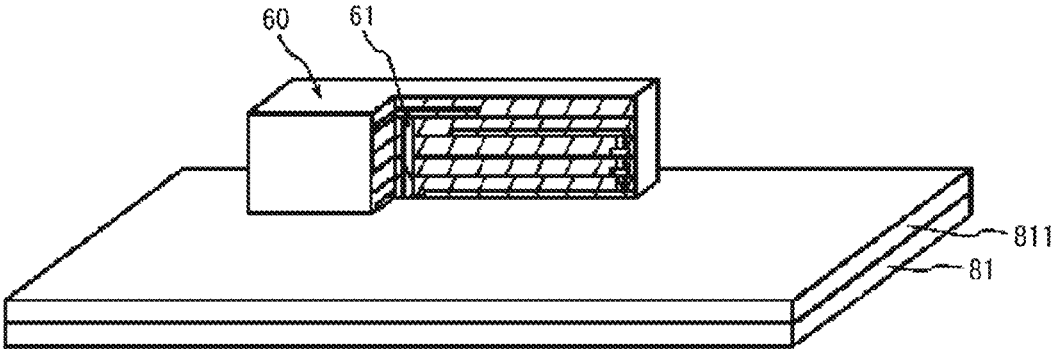
FIG. 80 is a partial cross-sectional perspective view illustrating one embodiment of the wireless communication module.

A wireless communication module of the present disclosure is a wireless communication module 80 according to an example of a plurality of embodiments. FIG. 79 is a block configuration diagram of the wireless communication module 80. FIG. 80 is a schematic configuration diagram of the wireless communication module 80. The wireless communication module 80 includes a first antenna 60, a circuit board 81, and an RF module 82. The wireless communication module 80 may include a second antenna 70 instead of the first antenna 60.

The first antenna 60 is located on the circuit board 81. The first feeding line 61 of the first antenna 60 is electromagnetically connected to an RF module 82 via the circuit board 81. The fourth conductor 50 of the first antenna 60 is electromagnetically connected to a ground conductor 811 of the circuit board 81.

The ground conductor 811 may extend in the xy plane. The ground conductor 811 has a larger surface integral in the xy plane than the fourth conductor 50. The ground conductor 811 is longer than the fourth conductor 50 in the y direction. The ground conductor 811 is longer than the fourth conductor 50 in the x direction. The first antenna 60 may be located closer to an end side than the center of the ground conductor 811 in the y direction. The center of the first antenna 60 may be different from the center of the ground conductor 811 in the xy plane. The center of the first antenna 60 may be different from the centers of the first conductive layer 41 and the second conductive layer 42. A point where the first feeding line 61 is connected to the third conductor 40 may be different from the center of the ground conductor 811 in the xy plane.

In the first antenna 60, the first current and the second current loop via the pair conductors 30. The first antenna 60 is located on the end side in the y direction with respect to the center of the ground conductor 811, so the second current flowing through the ground conductor 811 is asymmetric. When the second current flowing through the ground conductor 811 is asymmetric, the antenna structure including the first antenna 60 and the ground conductor 811 has a large polarization component of radiated waves in the x direction. By increasing the polarization component of the radiated waves in the x direction, the total radiation efficiency of the radiated wave may be improved.

The RF module 82 may control power supplied to the first antenna 60. The RF module 82 modulates a baseband signal and supplies the modulated signal to the first antenna 60. The RF module 82 may modulate an electric signal received by the first antenna 60 into a baseband signal.

The first antenna 60 has a small change in resonance frequency due to a conductor on the circuit board 81 side. The wireless communication module 80 includes the first antenna 60, thereby reducing an influence from the external environment.

The first antenna 60 may be integrated with the circuit board 81. When the first antenna 60 and the circuit board 81 are integrally configured, the fourth conductor 50 and the ground conductor 811 are integrally configured.

Figure 81:
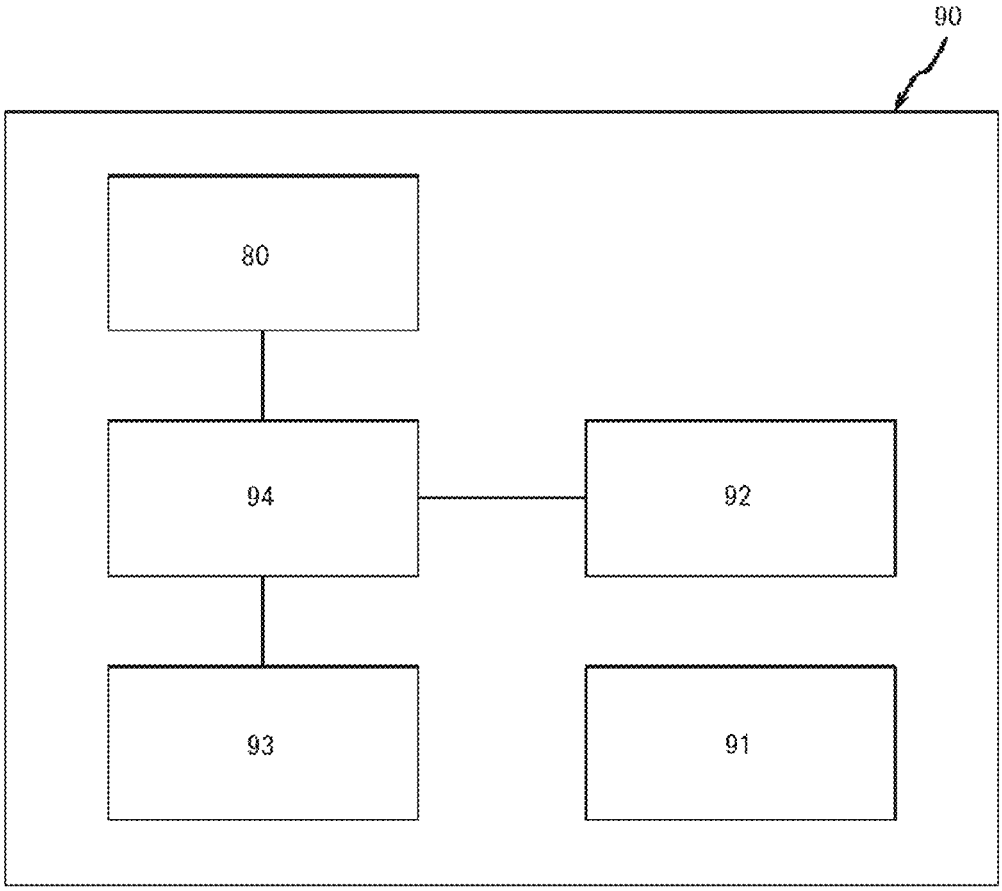
FIG. 81 is a block diagram illustrating one embodiment of a wireless communication device.
Figure 82:
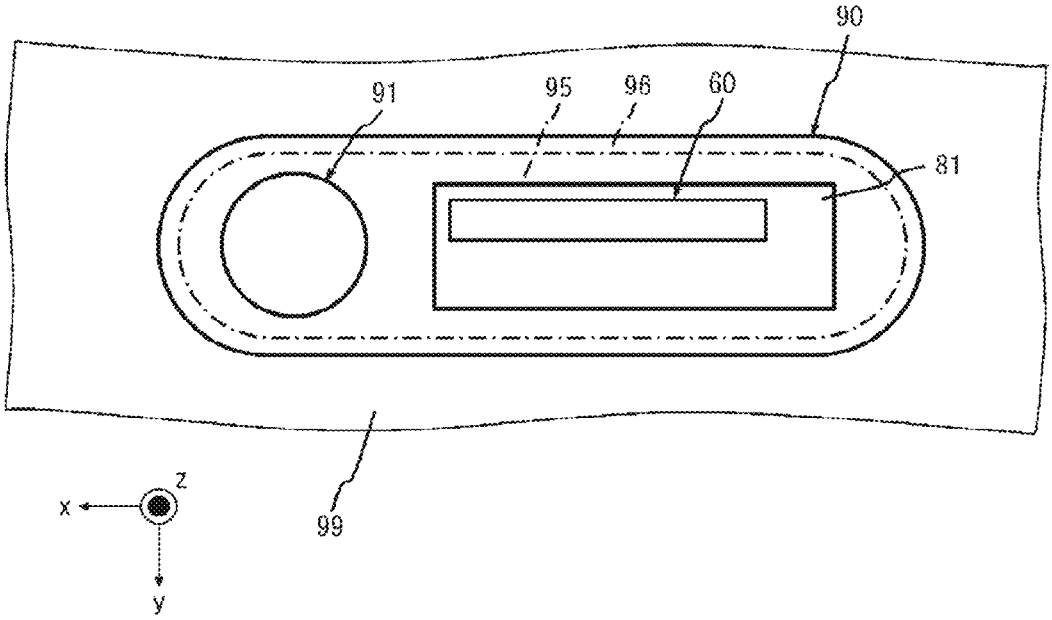
FIG. 82 is a plan view illustrating one embodiment of the wireless communication device.
Figure 83:
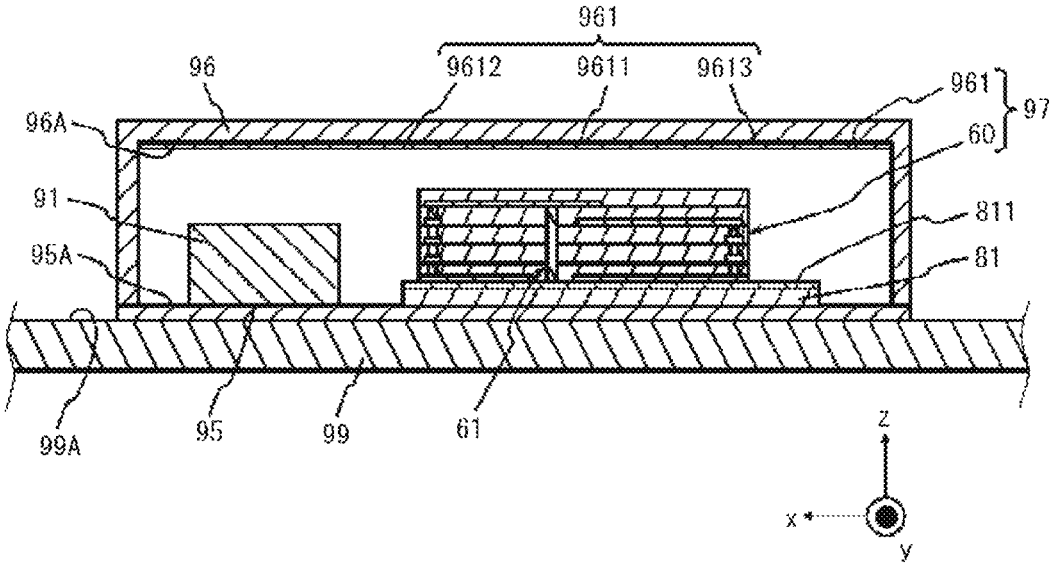
FIG. 83 is a cross-sectional view illustrating one embodiment of the wireless communication device.
Figure 84:
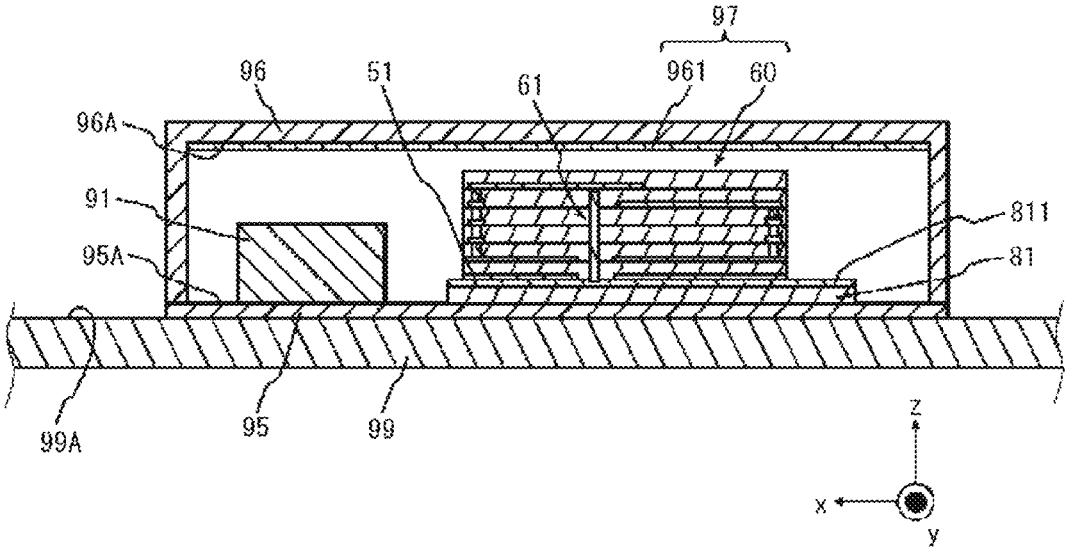
FIG. 84 is a plan view illustrating one embodiment of the wireless communication device.

The wireless communication device of the present disclosure includes a wireless communication device 90 according to an example of a plurality of embodiments. FIG. 81 is a block configuration diagram of the wireless communication device 90. FIG. 82 is a plan view of the wireless communication device 90. A part of the configuration of the wireless communication device 90 illustrated in FIG. 82 is omitted. FIG. 83 is a cross-sectional view of the wireless communication device 90. A part of the configuration of the wireless communication device 90 illustrated in FIG. 83 is omitted. The wireless communication device 90 includes the wireless communication module 80, a battery 91, a sensor 92, a memory 93, a controller 94, a first case 95, and a second case 96. The wireless communication module 80 of the wireless communication device 90 has the first antenna 60, but may have the second antenna 70. FIG. 84 illustrates one of other embodiments of the wireless communication device 90. The first antenna 60 included in the wireless communication device 90 may have the reference potential layer 51.

The battery 91 supplies power to the wireless communication module 80. The battery 91 may supply power to at least one of the sensor 92, the memory 93, and the controller 94. The battery 91 may include at least one of a primary battery and a secondary battery. A negative pole of the battery 91 is electrically connected to a ground terminal of the circuit board 81. The negative pole of the battery 91 is electrically connected to the fourth conductor 50 of the first antenna 60.

Examples of the sensor 92 may include, for example, a speed sensor, a vibration sensor, an acceleration sensor, a gyro sensor, a rotation angle sensor, an angular velocity sensor, a geomagnetic sensor, a magnet sensor, a temperature sensor, a humidity sensor, an atmospheric pressure sensor, a photosensor, an illuminance sensor, a UV sensor, a gas sensor, a gas concentration sensor, an atmosphere sensor, a level sensor, an odor sensor, a pressure sensor, an air pressure sensor, a contact sensor, a wind power sensor, an infrared sensor, a human sensor, a displacement sensor, an image sensor, a weight sensor, a smoke sensor, a liquid leakage sensor, a vital sensor, a battery residual quantity sensor, an ultrasonic sensor, a receiving apparatus receiving a global positioning system (GPS), or the like.

Examples of the memory 93 may include a semiconductor memory, or the like. The memory 93 may function as a work memory for the controller 94. The memory 93 may be included in the controller 94. The memory 93 stores a program describing processing content for implementing each function of the wireless communication device 90, information used for processing in the wireless communication device 90, and the like.

The controller 94 may include, for example, a processor. The controller 94 may include one or more processors. The processor may include a general-purpose processor that reads a specific program and executes a specific function, and a dedicated processor that is specialized for a specific process. The dedicated processor may include an application-specific IC. The application-specific IC is also called an application specific integrated circuit (ASIC). The processor may include a programmable logic device. The programmable logic device is also called a programmable logic device (PLD). The PLD may include a field-programmable gate array (FPGA). The controller 94 may be either a system-on-a-chip (SoC) or a system in a package (SiP), in which one or more processors cooperate. The controller 94 may store, in the memory 93, various types of information, a program for operating each component of the wireless communication device 90, or the like.

The controller 94 generates a transmission signal to be transmitted from the wireless communication device 90. The controller 94 may obtain measurement data from the sensor 92, for example. The controller 94 may generate a transmission signal according to the measurement data. The controller 94 may transmit a baseband signal to the RF module 82 of the wireless communication module 80.

The first case 95 and the second case 96 protect other devices of the wireless communication device 90. The first case 95 may extend in the xy plane. The first case 95 supports other devices. The first case 95 may support the wireless communication module 80. The wireless communication module 80 is located on an upper surface 95A of the first case 95. The first case 95 may support the battery 91. The battery 91 is located on the upper surface 95A of the first case 95. In an example of a plurality of embodiments, the wireless communication module 80 and the battery 91 are arranged in the upper surface 95A of the first case 95 in the x direction. The first conductor 31 is located between the battery 91 and the third conductor 40. The battery 91 is located on an opposite side of the pair conductors 30 when viewed from the third conductor 40.

The second case 96 may cover other devices. The second case 96 includes an under surface 96A located on the z direction side of the first antenna 60. The under surface 96A extends along the xy plane. The under surface 96A is not limited to be flat and may include irregularities. The second case 96 may have an eighth conductor 961. The eighth conductor 961 is located on at least one of an inside, an outer side, and an inner side of the second case 96. The eighth conductor 961 is located on at least one of an upper surface and a side surface of the second case 96.

The eighth conductor 961 faces the first antenna 60. A first body 9611 of the eighth conductor 961 faces the first antenna 60 in the z direction. The eighth conductor 961 may include at least one of a second body facing the first antenna 60 in the x direction and a third body facing the first antenna in the y direction, in addition to the first body 9611. The eighth conductor 961 partially faces the battery 91.

The eighth conductor 961 may include a first extra-body 9612 extending outward of the first conductor 31 in the x direction. The eighth conductor 961 may include a second extra-body 9613 extending outward of the second conductor 32 in the x direction. The first extra-body 9612 may be electrically connected to the first body 9611. The second extra-body 9613 may be electrically connected to the first body 9611. The first extra-body 9612 of the eighth conductor 961 faces the battery 91 in the z direction. The eighth conductor 961 may be capacitively coupled to the battery 91. Capacitance may exist between the eighth conductor 961 and the battery 91

The eighth conductor 961 is separated from the third conductor 40 of the first antenna 60. The eighth conductor 961 is not electrically connected to each conductor of the first antenna 60. The eighth conductor 961 may be separated from the first antenna 60. The eighth conductor 961 may be electromagnetically coupled to any conductor of the first antenna 60. The first body 9611 of the eighth conductor 961 may be electromagnetically coupled to the first antenna 60. The first body 9611 may overlap the third conductor 40 when viewed in plan in the z direction. Since the first body 9611 overlaps the third conductor 40, the propagation due to the electromagnetic coupling can be increased. The eighth conductor 961 may have mutual inductance due to the electromagnetic coupling with the third conductor 40.

The eighth conductor 961 extends along the x direction. The eighth conductor 961 extends along the xy plane. A length of the eighth conductor 961 is longer than that of the first antenna 60 along the x direction. The length of the eighth conductor 961 along the x direction is longer than that of the first antenna 60 along the x direction. The length of the eighth conductor 961 may be longer than ½ of an operating wavelength λ of the wireless communication device 90. The eighth conductor 961 may include a body extending along the y direction. The eighth conductor 961 may be bent in the xy plane. The eighth conductor 961 may include a body extending along the z direction. The eighth conductor 961 may be bent from xy plane to the yz plane or the zx plane.

Figure 85:
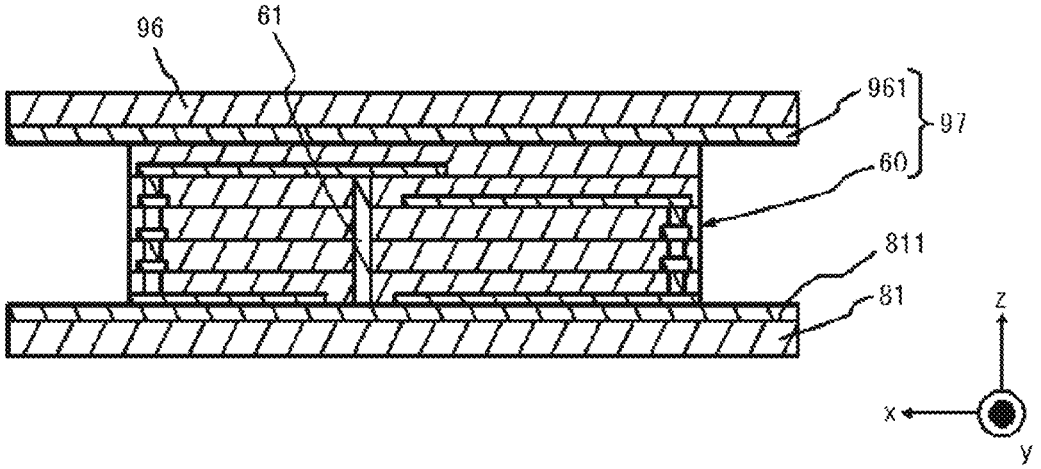
FIG. 85 is a cross-sectional view illustrating one embodiment of the wireless communication device.

In the wireless communication device 90 including the eighth conductor 961, the first antenna 60 and the eighth conductor 961 may be electromagnetically coupled, thereby functioning as a third antenna 97. An operating frequency $f_c$ of the third antenna 97 may be different from the resonance frequency of the first antenna 60 alone. The operating frequency $f_c$ of the third antenna 97 may be closer to the resonance frequency of the first antenna 60 than the resonance frequency of the eighth conductor 961 alone. The operating frequency $f_c$ of the third antenna 97 may be in the resonance frequency band of the first antenna 60. The operating frequency $f_c$ of the third antenna 97 may be outside the resonance frequency band of the eighth conductor 961 alone. FIG. 85 illustrates another embodiment of the third antenna 97. The eighth conductor 961 may be integrated with the first antenna 60. In FIG. 85, a part of the configuration of the wireless communication device 90 is omitted. In the example of FIG. 85, the second case 96 need not include the eighth conductor 961.

In the wireless communication device 90, the eighth conductor 961 is capacitively coupled to the third conductor 40. The eighth conductor 961 is electromagnetically coupled to the fourth conductor 50. The third antenna 97 includes the first extra-body 9612 and the second extra-body 9613 of the eighth conductor in the air, and as a result, a gain thereof is improved as compared with the first antenna 60.

Figure 86:
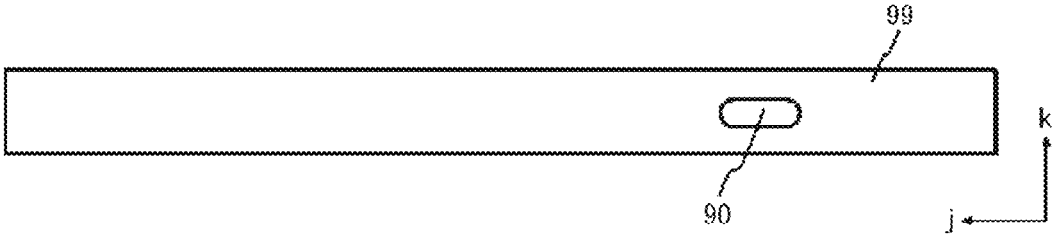
FIG. 86 is a cross-sectional view illustrating one embodiment of the antenna.

The wireless communication device 90 may be located on various objects. The wireless communication device 90 may be located on an electrical conductive body 99. FIG. 86 is a plan view illustrating one embodiment of the wireless communication device 90. The electrical conductive body 99 is a conductor that transmits electricity. Examples of the material of the electrical conductive body 99 include metal, a highly doped semiconductor, conductive plastics, and liquid containing ions. The electrical conductive body 99 may include a non-conductive layer that does not transmit electricity on the surface. The body that conducts electricity and the non-conductive layer may contain a common element. For example, the electrical conductive body 99 containing aluminum may include a non-conductive layer of aluminum oxide on the surface. The body that transmits electricity and the non-conductive layer may contain different elements.

A shape of the electrical conductive body 99 is not limited to a flat plate, and may include a three-dimensional shape such as a box. Examples of the three-dimensional shape formed by the electrical conductive body 99 include a rectangular parallelepiped and a cylinder. Examples of the three-dimensional shape may include a partially recessed shape, a partially penetrated shape, and a partially protruding shape. For example, the electrical conductive body 99 may be of an annular (torus) type.

The electrical conductive body 99 includes an upper surface 99A on which the wireless communication device 90 may be mounted. The upper surface 99A can extend over the entire surface of the electrical conductive body 99. The upper surface 99A may be a part of the electrical conductive body 99. The upper surface 99A may have a larger surface integral than the wireless communication device 90. The wireless communication device 90 may be disposed on the upper surface 99A of the electrical conductive body 99. The upper surface 99A may have a narrower surface integral than the wireless communication device 90. A part of the wireless communication device 90 may be disposed on the upper surface 99A of the electrical conductive body 99. The wireless communication device 90 may be disposed on the upper surface 99A of the electrical conductive body 99 in various orientations. The orientation of the wireless communication device 90 may be arbitrary. The wireless communication device 90 may be appropriately fixed on the upper surface 99A of the electrical conductive body 99 by a fixture. Examples of the fixture include those that are fixed on the surface such as double-sided tape and adhesive. The examples of the fixture include those that are fixed at points such as screws and nails.

The upper surface 99A of the electrical conductive body 99 may include a body extending along a j direction. The body extending along the j direction has a longer length along the j direction than a length along the k direction. The j direction and the k direction are orthogonal. The j direction is a direction in which the electrical conductive body 99 extends long. The k direction is a direction in which the length of the electrical conductive body 99 is shorter than the j direction. The wireless communication device 90 may be disposed on the upper surface 99A so that the x direction is along the j direction. The wireless communication device 90 may be disposed on the upper surface 99A of the electrical conductive body 99 so as to be aligned with the x direction in which the first conductor 31 and the second conductor 32 are aligned. When the wireless communication device 90 is located on the electrical conductive body 99, the first antenna 60 may be electromagnetically coupled to the electrical conductive body 99. The second current flows through the fourth conductor 50 of the first antenna 60 along the x direction. A current is induced by the second current, in the electrical conductive body 99 that is electromagnetically coupled to the first antenna 60. When the x direction of the first antenna 60 and the j direction of the electrical conductive body 99 are aligned, the electrical conductive body 99 has a large current flowing therethrough along the j direction. When the x direction of the first antenna 60 and the j direction of the electrical conductive body 99 are aligned, the electrical conductive body 99 radiates a large amount of radiation due to the induced current. The angle of the x direction with respect to the j direction may be 45° or less.

The ground conductor 811 of the wireless communication device 90 is separated from the electrical conductive body 99. The ground conductor 811 is separated from the electrical conductive body 99. The wireless communication device 90 may be disposed on the upper surface 99A so that a direction along a long side of the upper surface 99A is aligned with the x direction in which the first conductor 31 and the second conductor 32 are arranged. Examples of the shape of the upper surface 99A may include a rhombus and a circle in addition to the rectangular surface. The electrical conductive body 99 may include a rhombus-shaped surface. The rhombus-shaped surface may be the upper surface 99A on which the wireless communication device 90 is disposed. The wireless communication device 90 may be disposed on the upper surface 99A so that a direction along a long diagonal of the upper surface 99A is aligned with the x direction in which the first conductor 31 and the second conductor 32 are arranged. The upper surface 99A is not limited to be flat. The upper surface 99A may include irregularities. The upper surface 99A may include a curved surface. The curved surface includes a ruled surface (ruled surface). The curved surface includes a cylindrical surface.

The electrical conductive body 99 extends in the xy plane. The electrical conductive body 99 may have a longer length along the x direction than a length along the y direction. The electrical conductive body 99 may have a length along the y direction shorter than half of the wavelength $\lambda_c$ at the operating frequency $f_c$ of the third antenna 97. The wireless communication device 90 may be located on an electrical conductive body 99. The electrical conductive body 99 is located away from the fourth conductor 50 in the z direction. The electrical conductive body 99 has a longer length along the x direction than the fourth conductor 50. The electrical conductive body 99 has a larger surface integral in the xy plane than the fourth conductor 50. The electrical conductive body 99 is located away from the ground conductor 811 in the z direction. The electrical conductive body 99 has a longer length along the x direction than the ground conductor 811. The electrical conductive body 99 has a larger surface integral in the xy plane than the ground conductor 811.

The wireless communication device 90 may be disposed on the electrical conductive body 99 in a direction in which the x direction in which the first conductor 31 and the second conductor 32 are arranged is aligned in the direction in which the electrical conductive body 99 extends long. In other words, the wireless communication device 90 may be disposed on the electrical conductive body 99 in an orientation in which the direction in which the current of the first antenna 60 flows and the direction in which the electrical conductive body 99 extends long are aligned in the xy plane.

The first antenna 60 has a small change in resonance frequency due to a conductor on the circuit board 81 side. The wireless communication device 90 includes the first antenna 60 and thereby can reduce the influence from the external environment.

In the wireless communication device 90, the ground conductor 811 is capacitively coupled to the electrical conductive body 99. The wireless communication device 90 includes a body that extends outside the third antenna 97 in the electrical conductive body 99, and the gain thereof is improved as compared with the first antenna 60.

Figure 87:
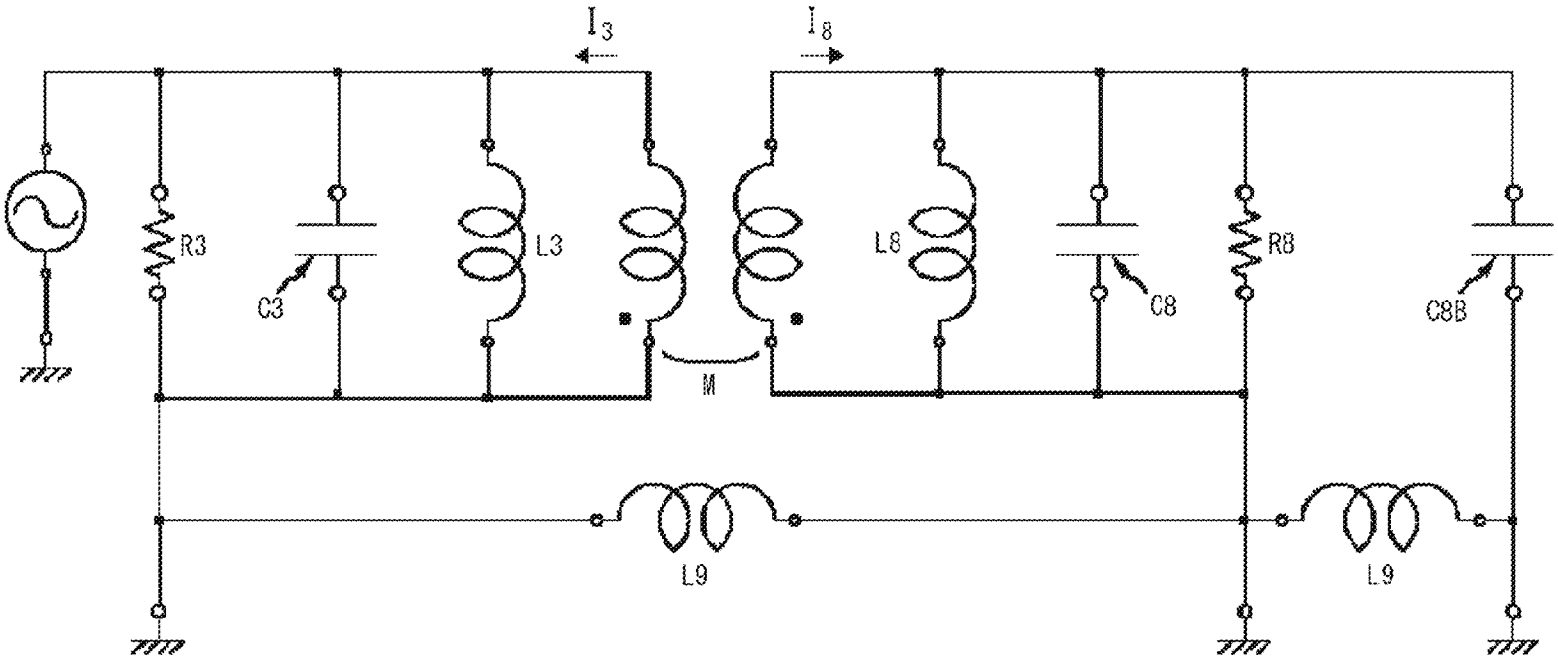
FIG. 87 is a diagram illustrating a schematic circuit of the wireless communication device.
Figure 88:
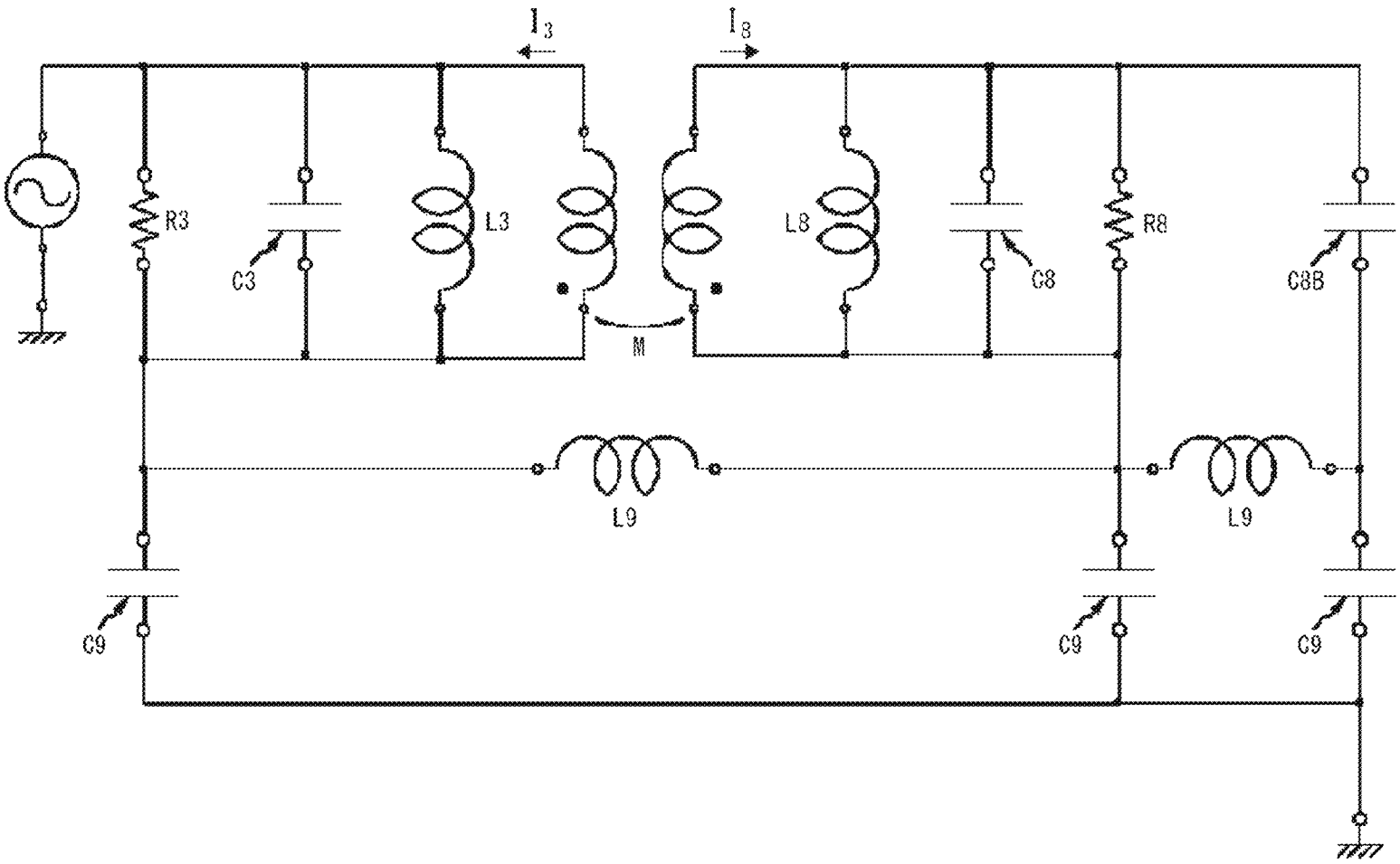
FIG. 88 is a diagram illustrating a schematic circuit of the wireless communication device.

In the wireless communication device 90, the resonant circuit in the air may be different from the resonant circuit on the electrical conductive body 99. FIG. 87 is a schematic circuit of a resonant structure in the air. FIG. 88 is a schematic circuit of the resonant structure formed on the electrical conductive body 99. L3 is inductance of the resonator 10, L8 is inductance of the eighth conductor 961, L9 is an inductance of the electrical conductive body 99, and M is mutual inductance of L3 and L8. C3 is capacitance of the third conductor 40, C4 is capacitance of the fourth conductor 50, C8 is capacitance of the eighth conductor 961, C8B is capacitance of the eighth conductor 961 and the battery 91, and C9 is capacitance of the electrical conductive body 99 and the ground conductor 811. R3 is radiation resistance of the resonator 10 and R8 is radiation resistance of the eighth conductor 961. The operating frequency of the resonator 10 is lower than the resonance frequency of the eighth conductor. In the wireless communication device 90, the ground conductor 811 functions as chassis ground in the air. In the wireless communication device 90, the fourth conductor 50 is capacitively coupled to the electrical conductive body 99. In the wireless communication device 90 on the electrical conductive body 99, the electrical conductive body 99 functions as substantial chassis ground.

In a plurality of embodiments, the wireless communication device 90 has the eighth conductor 961. The eighth conductor 961 is electromagnetically coupled to the first antenna 60 and capacitively coupled to the fourth conductor 50. The wireless communication device 90 can increase the operating frequency when disposed on the electrical conductive body 99 from the air by increasing capacitance C8B due to the electrostatic capacitance coupling. By increasing the mutual inductance M due to the electromagnetic coupling, the wireless communication device 90 can reduce the operating frequency when disposed from the air onto the electrical conductive body 99. By changing a balance between the capacitance C8B and the mutual inductance M, the wireless communication device 90 can adjust the change in the operating frequency when disposed from the air onto the electrical conductive body 99. By changing the balance between the capacitance C8B and the mutual inductance M, the wireless communication device 90 can reduce the change in the operating frequency when disposed from the air onto the electrical conductive body 99.

The wireless communication device 90 has the eighth conductor 961 that is electromagnetically coupled to the third conductor 40 and capacitively coupled to the fourth conductor 50. Having the eighth conductor 961, the wireless communication device 90 can adjust the change in the operating frequency when disposed from the air onto the electrical conductive body 99. Having the eighth conductor 961, the wireless communication device 90 can reduce the change in the operating frequency when disposed from the air onto the electrical conductive body 99.

Similarly, in the wireless communication device 90 that does not include the eighth conductor 961, the ground conductor 811 functions as chassis ground in the air. Similarly, in the wireless communication device 90 that does not include the eighth conductor 961, the electrical conductive body 99 functions as substantial chassis ground on the electrical conductive body 99. The resonant structure including the resonator 10 can oscillate even if the chassis ground changes. This corresponds to the fact that the resonator 10 having the reference potential layer 51 and the resonator 10 not having the reference potential layer 51 can oscillate.

<<Application Example of Wireless Communication Device: Storage Container>>

The wireless communication device 90 can also be used near metal or the like. The wireless communication device 90 may be suitably applied to, for example, storage serving as the electrical conductive body 99 as described below.

Figure 89:
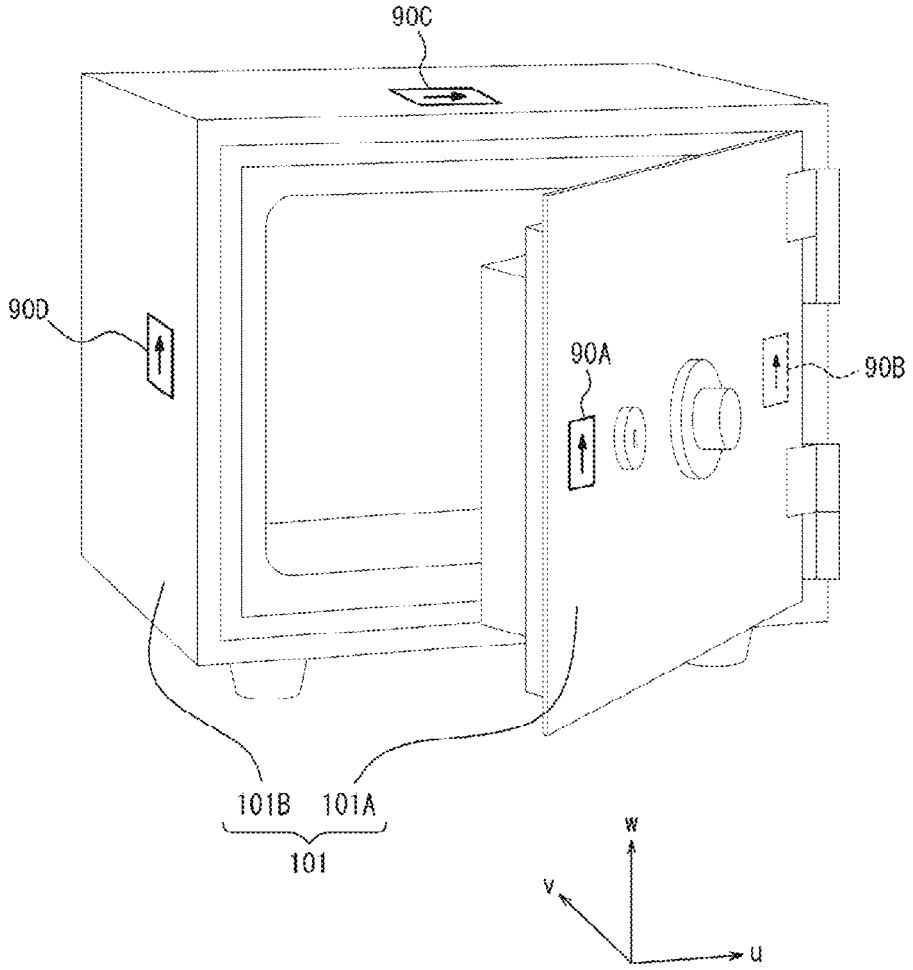
FIG. 89 is a schematic diagram illustrating an application example of the wireless communication device.

FIG. 89 is a diagram exemplifying a state in which the wireless communication device 90 is provided in a safe 101 made of metal, which is an example of safekeeping storage. That is, the electrical conductive body 99 provided with the wireless communication device 90 may be the safe 101. The safe 101 includes a door 101A that can be opened and closed, and a main body 101B. As illustrated in FIG. 89, the wireless communication device 90 may be disposed on a front side of the door 101A, that is, an outer side of the safe 101. As illustrated in FIG. 89, a coordinate system including a u axis, a v axis, and a w axis is defined. A u direction, a v direction, and a w direction correspond to a width direction, a depth direction, and a height direction of the safe 101, respectively. The door 101A made of metal may include a body extending along the w direction. Like a wireless communication device 90A illustrated in FIG. 89, the wireless communication device 90 may be disposed on the front side of the door 101A so that the x direction in which the first conductor 31 and the second conductor 32 are arranged is along the w direction.

As illustrated in FIG. 89, the wireless communication device 90 may be disposed on a back side of the door 101A, that is, the inner side of the safe 101. Like a wireless communication device 90B illustrated in FIG. 89, the wireless communication device 90 may be disposed on the back side of the door 101A so that the x direction in which the first conductor 31 and the second conductor 32 are arranged is along the w direction. As will be described later, when the wireless communication device 90 is disposed on the back side of the door 101A, the opened and closed state of the door 101A of the safe 101 may be detected more accurately.

As illustrated in FIG. 89, the wireless communication device 90 may be disposed on an upper surface of a main body 101B. The upper surface of the main body 101B made of metal may include a body extending along the u direction. Like a wireless communication device 90C illustrated in FIG. 89, the wireless communication device 90 may be disposed on the upper surface of the main body 101B so that the x direction in which the first conductor 31 and the second conductor 32 are arranged is along the u direction.

As illustrated in FIG. 89, the wireless communication device 90 may be disposed on a side surface of the main body 101B. The side surface of the main body 101B made of metal may include a body extending along the w direction. Like a wireless communication device 90D illustrated in FIG. 89, the wireless communication device 90 may be disposed on the side surface of the main body 101B so that the x direction in which the first conductor 31 and the second conductor 32 are arranged is along the w direction.

Like the wireless communication devices 90A to 90D illustrated in FIG. 89, the wireless communication device 90 may be provided in the safe 101 to transmit detection data of the sensor 92 favorably. However, in a case where the wireless communication device 90 is provided on the back side of the door 101A, the wireless communication device 90 transmits the detection data of the sensor 92 when the door 101A is open. The wireless communication device 90 may be disposed so that the fourth conductor 50 faces the safe 101 in whichever case of the wireless communication devices 90A to 90D illustrated in FIG. 89. A plurality of the wireless communication devices 90 may be provided in the safe 101. The wireless communication device 90 may be disposed at a position of at least one of the wireless communication devices 90A to 90D illustrated in FIG. 89, for example. The wireless communication devices 90A to 90D illustrated in FIG. 89 are an example, and the wireless communication device 90 may be disposed at other positions of the safe 101.

The sensor 92 included in the wireless communication device 90 may include, for example, at least one of an acceleration sensor and a magnetic sensor, and may be used to detect the opened and closed state of the door 101A. When the sensor 92 includes an acceleration sensor, the acceleration sensor can detect acceleration associated with the movement of the door 101A. When the sensor 92 includes a magnetic sensor, the magnetic sensor can detect a magnetic field associated with the movement of the door 101A. The magnetic field measured by the magnetic sensor may be generated by, for example, a magnet provided to at least one of the door 101A and the main body 101B. The information on the opened and closed state of the door 101A is transmitted by the first antenna 60 included in the wireless communication device 90. When the wireless communication device 90 is provided on the back side of the door 101A, the sensor 92 may include an illuminance sensor that detects illuminance of ambient light. The wireless communication device 90 can determine that the door 101A is opened when the illuminance sensor detects that the illuminance of ambient light changes brightly. The wireless communication device 90 can determine that the door 101A is closed when the illuminance sensor detects that the ambient light changes to be dark. The wireless communication device 90 can more accurately determine the opened and closed state of the door 101A by using the detection data of the illuminance sensor together with the detection data of other sensors. The other sensor may be, for example, an acceleration sensor. The sensor 92 may include an image sensor. The image sensor captures an image when the door 101A is opened and closed. By transmitting the image captured by the image sensor to the information terminal registered in advance, it is possible to strictly manage the opening and closing. At this time, more strict management can be made by registering a plurality of information terminals in advance.

The sensor 92 included in the wireless communication device 90 may include, for example, at least one of an acceleration sensor and a speed sensor, and may be used to detect abnormalities such as the damage and movement of the safe 101. When the sensor 92 includes an acceleration sensor, the acceleration sensor can detect acceleration associated with falling of the safe 101 or the like. When the sensor 92 includes a speed sensor, the speed sensor can detect a speed generated by taking out the safe 101 or the like. The information indicating the abnormality of the safe 101 is transmitted by the first antenna 60 included in the wireless communication device 90. Since the wireless communication device 90 transmits information indicating the abnormality, the safe 101 can be prevented from being stolen. The wireless communication device 90 can calculate position information based on a signal from a GPS satellite and transmit the position information of the safe 101. Such position information is useful for searching the safe 101 and the like.

The sensor 92 included in the wireless communication device 90 may include a magnetic sensor, for example, and may be used to detect a locked state of the door 101A. When the sensor 92 includes a magnetic sensor, the magnetic sensor can detect the change in the magnetic field associated with the locked state of the door 101A. The locked state of the door 101A includes, for example, a locked and unlocked state. The magnetic field measured by the magnetic sensor may be generated, for example, by a magnet provided to at least one of a key and a keyhole. Information on the locked state of the door 101A is transmitted by the first antenna 60 included in the wireless communication device 90.

The sensor 92 included in the wireless communication device 90 may include, for example, at least one of an infrared sensor and a weight sensor, and may be used to perform management of a storing item of the safe 101. When the sensor 92 includes an infrared sensor, the infrared sensor may receive infrared rays reflected inside the safe 101. When the sensor 92 includes a weight sensor, the weight sensor may detect the weight of the storing item. The wireless communication device 90 may determine a storing item of the safe 101 based on the detection data of the infrared sensor. The wireless communication device 90 can determine the presence or absence and the weight of the storing item of the safe 101 based on the detection data of the weight sensor. The information on the presence or absence of a storing item of the safe 101 is transmitted by the first antenna 60 included in the wireless communication device 90. When managing the storing item of the safe 101, at least a part of the wireless communication device 90 is disposed on the back side of the door 101A or a wall surface inside the main body 101B. The sensor 92 may include sensors such as a temperature sensor and a humidity sensor that detect the environment inside the safe 101. By transmitting the environmental information such as temperature and humidity inside the safe 101 to the information terminal registered in advance, it is possible to strictly manage the internal environment. The sensor 92 may include an image sensor. The image sensor captures an image of the inside of the safe 101, for example, when the door 101A is opened. By transmitting the image captured by the image sensor to the information terminal registered in advance, the strict management can be made.

The sensor 92 included in the wireless communication device 90 may include, for example, an image sensor, and may be used to identify a user who tries to open the safe 101. When the sensor 92 includes an image sensor, the image sensor can acquire a partial image of the user of the safe 101 or an image of an ID of the user. Some images of the user include, for example, an image of a user's face, fingerprint, or the like. The image of the ID includes, for example, an image of an ID card or the like. The wireless communication device 90 may identify the user based on the image from the image sensor. The identification information of the user may be used for locking or unlocking the door 101A for the purpose of crime prevention. The identification information of the user may be transmitted by the first antenna 60 included in the wireless communication device 90. To identify the user, at least a part of the wireless communication device 90 is disposed on the front side of the door 101A or the upper surface or the side surface of an outer side of the main body 101B.

Figure 90:
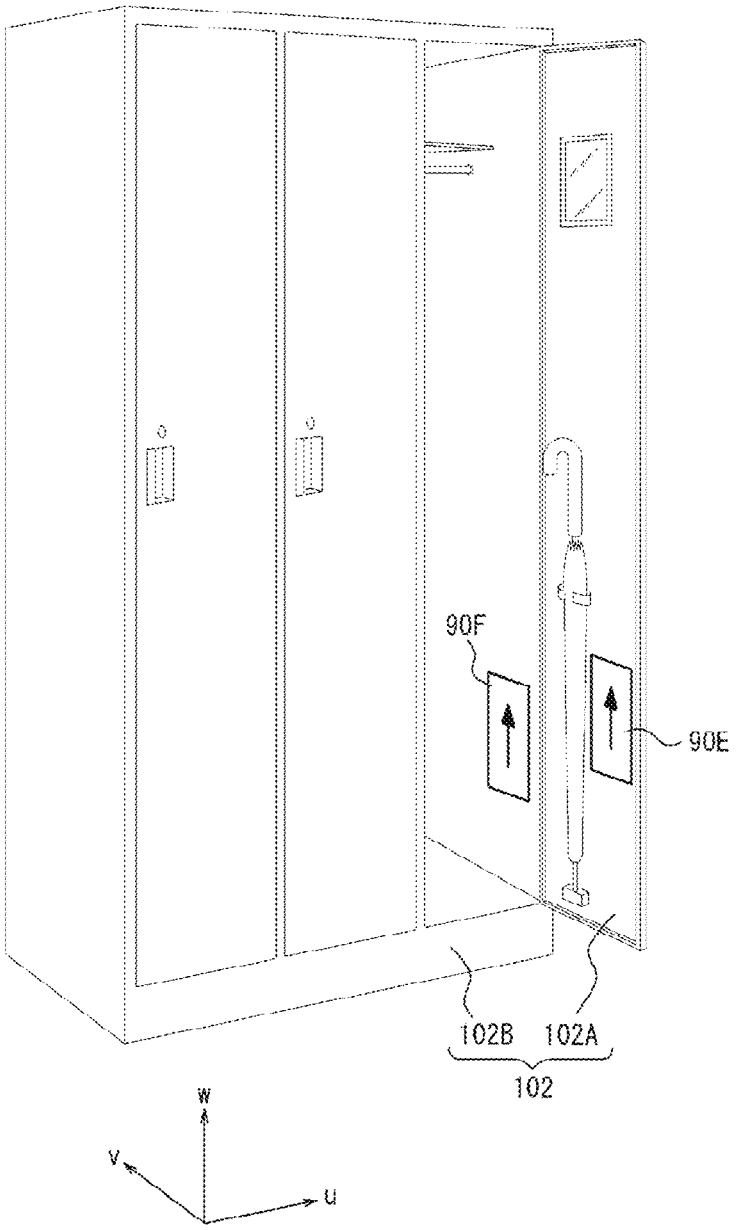
FIG. 90 is a schematic diagram illustrating an application example of the wireless communication device.

FIG. 90 is a diagram exemplifying a state in which the wireless communication device 90 is provided in a locker 102 made of metal, which is an example of safekeeping storage. That is, the electrical conductive body 99 provided with the wireless communication device 90 may be the locker 102. The locker 102 includes a door 102A to be opened and closed, and a main body 102B. As illustrated in FIG. 90, the wireless communication device 90 may be disposed on a back side of the door 102A. The back side of the door 102A may be an inner side of the locker 102. As illustrated in FIG. 90, a coordinate system including a u axis, a v axis, and a w axis is defined. A u direction, a v direction, and a w direction correspond to a width direction, a depth direction, and a height direction of a locker 102, respectively. The door 102A made of metal may include a body extending along the w direction. Like a wireless communication device 90E illustrated in FIG. 90, the wireless communication device 90 may be disposed on the back side of the door 102A so that the x direction in which the first conductor 31 and the second conductor 32 are arranged is along the w direction.

As illustrated in FIG. 90, the wireless communication device 90 may be disposed on a side surface of an inner side of the main body 102B. A side surface of the main body 102B made of metal may include a body extending along the w direction. Like a wireless communication device 90F illustrated in FIG. 90, the wireless communication device 90 may be disposed on the side surface of the inner side of the main body 102B so that the x direction in which the first conductor 31 and the second conductor 32 are arranged is along the w direction.

When the wireless communication device 90 is disposed on an elongated metal plate such as the door 102A, the electromagnetic waves are easily radiated when a direction of current flowing through the first antenna 60 is arranged parallel to the side of the metal plate, in particular, a long side. Generally, in the locker 102, there is a gap between the door 102A and the main body 102B even when the door 102A is closed. Even when the wireless communication device 90 is disposed inside the locker 102, the wireless communication device 90 is disposed near the gap, and as a result, communication can be made with the door 102A closed. The wireless communication device 90 is preferably attached, for example, near a hinge on the door 102A or the side surface of the main body 102B.

In addition, it is preferable that the door 102A and the side surface of the locker 102 are electrically connected to each other by a conductor, with the first antenna 60 of the wireless communication device 90 interposed therebetween and at an integer multiple of half of the wavelength $\lambda$ at the operating frequency. The integer multiple of half of the wavelength $\lambda$ at the operating frequency may be represented by $(n\times\lambda)/2$. Here, n is an integer of 1 or greater. The current induced in the conductor by the first antenna 60 flows around the side surface of the locker 102 and the door 102A. Since gaps connected at intervals of $(n\times\lambda)/2$ function as a slot antenna of $(n\times\lambda)/2$, the wireless communication device 90 can radiate the electromagnetic waves to the outer side of the locker 102. When the wireless communication device 90 is attached, for example, to an elongated metal plate such as the door 102A or an end portion of the metal plate, the wireless communication device 90 is preferably disposed near a central portion of the metal plate. In addition, it is preferable that the wireless communication device 90 is attached at a position of an odd multiple of a quarter of the wavelength $\lambda$ at the operating frequency from a tip of the metal plate. The odd multiple of half of the wavelength $\lambda$ at the operating frequency may be represented by $(2n-1)\times\lambda/4$. Here, n is an integer of 1 or greater. By the installation, a standing wave of electric current is induced in the metal plate. The metal plate becomes a radiation source of the electromagnetic waves by the standing wave induced. The communication performance of the wireless communication device 90 is improved by such installation.

Like the wireless communication devices 90E and 90F illustrated in FIG. 90, the wireless communication device 90 may be provided in the locker 102 to transmit detection data of the sensor 92 favorably. In whichever case of the wireless communication devices 90E and 90F illustrated in FIG. 90, the wireless communication devices 90 may be disposed so that the fourth conductor 50 faces the locker 102. A plurality of the wireless communication devices 90 may be provided in the locker 102. The wireless communication device 90 may be disposed at a position of at least one of the wireless communication devices 90E and 90F illustrated in FIG. 90, for example. The wireless communication devices 90E and 90F illustrated in FIG. 90 are an example, and the wireless communication device 90 may be disposed at other positions of the locker 102.

The wireless communication device 90 disposed on the locker 102 can perform at least one process such as detection of the opened and closed state of the door 102A, detection of the abnormality such as damage and movement of the locker 102, detection of the locked state of the door 102A, management of the storing item of the locker 102, and identification of a user who tries to open the locker 102. The details of the processes are the same as those of the wireless communication device 90 disposed on the safe 101 described above.

Figure 91:
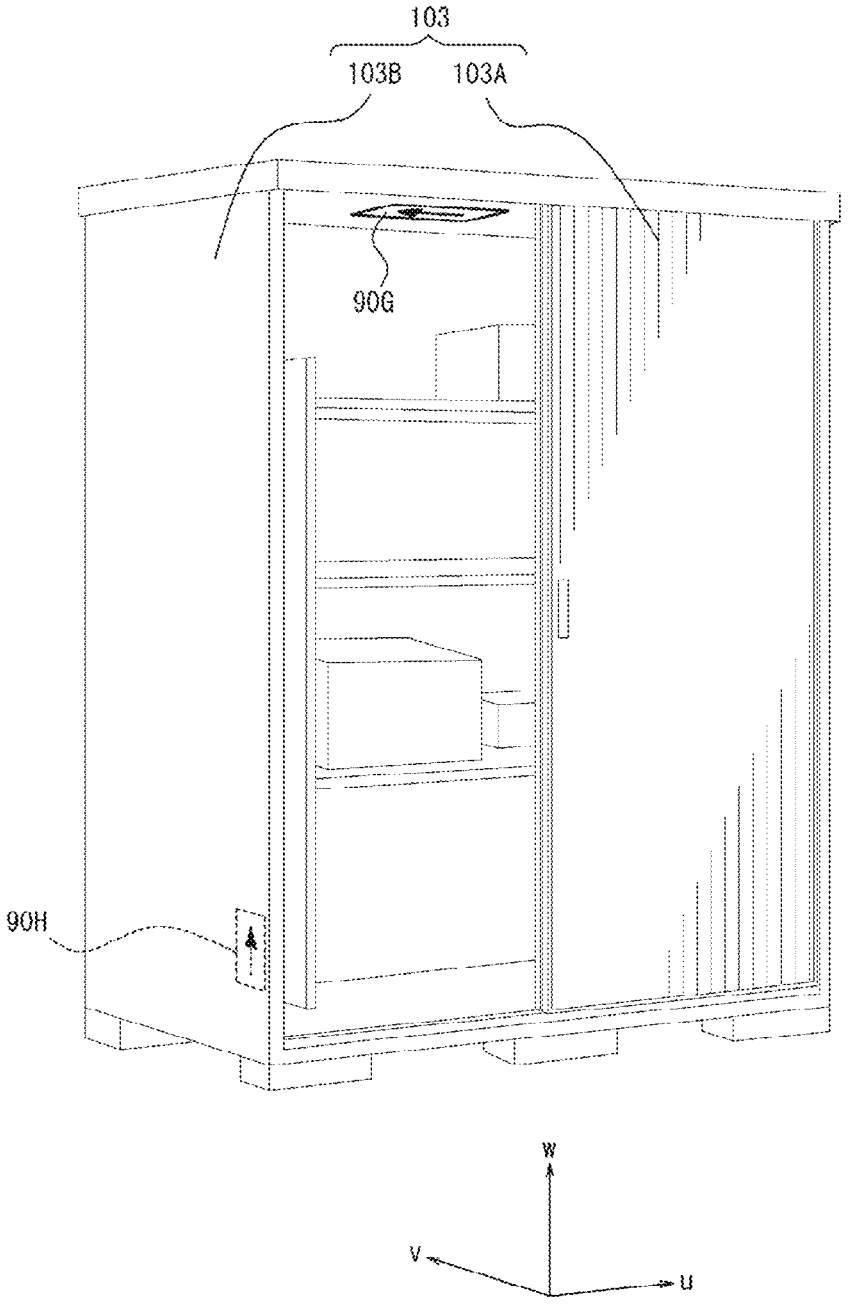
FIG. 91 is a schematic diagram illustrating an application example of the wireless communication device.

FIG. 91 is a diagram exemplifying a state in which the wireless communication device 90 is provided in a shed 103 made of metal, which is an example of safekeeping storage. That is, the electrical conductive body 99 provided with the wireless communication device 90 may be the shed 103. The shed 103 includes a door 103A that is a sliding door and a main body 103B. As illustrated in FIG. 91, the wireless communication device 90 may be disposed on an upper surface of the main body 103B. The upper surface of the main body 103B may be a ceiling of the inner side of the shed 103. As illustrated in FIG. 91, a coordinate system including a u axis, a v axis, and a w axis is defined. A u direction, a v direction, and a w direction correspond to a width direction, a depth direction, and a height direction of the shed 103, respectively. The upper surface of the main body 103B may include a body extending along the u direction. Like a wireless communication device 90G illustrated in FIG. 91, the wireless communication device 90 may be disposed on the upper surface of the main body 103B so that the x direction in which the first conductor 31 and the second conductor 32 are arranged is along the u direction.

As illustrated in FIG. 91, the wireless communication device 90 may be disposed on a side surface of an outer side of the main body 103B. A side surface of the main body 103B made of metal may include a body extending along the w direction. Like a wireless communication device 90H illustrated in FIG. 91, the wireless communication device 90 may be disposed on the side surface of the outer side of the main body 103B so that the x direction in which the first conductor 31 and the second conductor 32 are arranged is along the w direction.

Generally, in the shed 103, there is a gap between the door 103A and the main body 103B even when the door 103A is closed. Even when the wireless communication device 90 is disposed inside the shed 103, the wireless communication device 90 is disposed near the gap, and as a result, communication can be made with the door 103A closed.

Like the wireless communication devices 90G and 90H illustrated in FIG. 91, the wireless communication device 90 may be provided in the shed 103 to transmit detection data of the sensor 92 favorably. The wireless communication devices 90 may be disposed so that the fourth conductor 50 faces the shed 103 even in whichever case of the wireless communication devices 90G and 90H illustrated in FIG. 91. A plurality of the wireless communication devices 90 may be provided in the shed 103. The wireless communication device 90 may be disposed at a position of at least one of the wireless communication devices 90G and 90H illustrated in FIG. 91, for example. The wireless communication devices 90G and 90H illustrated in FIG. 91 are an example, and the wireless communication device 90 may be disposed at other positions of the shed 103.

The wireless communication device 90 disposed in the shed 103 can perform at least one process such as detection of the opened and closed state of the door 103A, detection of the abnormality such as damage and movement of the shed 103, detection of the locked state of the door 103A, management of the storing item of the shed 103, and identification of a user who tries to open the shed 103. The details of the processes are the same as those of the wireless communication device 90 disposed on the safe 101 described above.

It is possible to dispose the wireless communication device 90 even in a cabinet, which is an example of safekeeping storage, as in the shed 103. The cabinet is safekeeping storage where a storage space is pulled out from a case together with the door. In the cabinet, the storage space is stored in the case by closing the door. For example, the wireless communication device 90 may be disposed on the upper surface of the inner side of the cabinet case. The upper surface inside the case may be the ceiling of the inner side of the case. For example, the wireless communication device 90 may be disposed on the side surface of the outer side of the cabinet case. The wireless communication device 90 disposed on the cabinet can perform at least one process such as detection of the opened and closed state of the door, detection of the abnormality such as damage and movement of the cabinet, detection of the locked state of the door, management of the storing item of the cabinet, and identification of a user who tries to open the cabinet.

Figure 92:
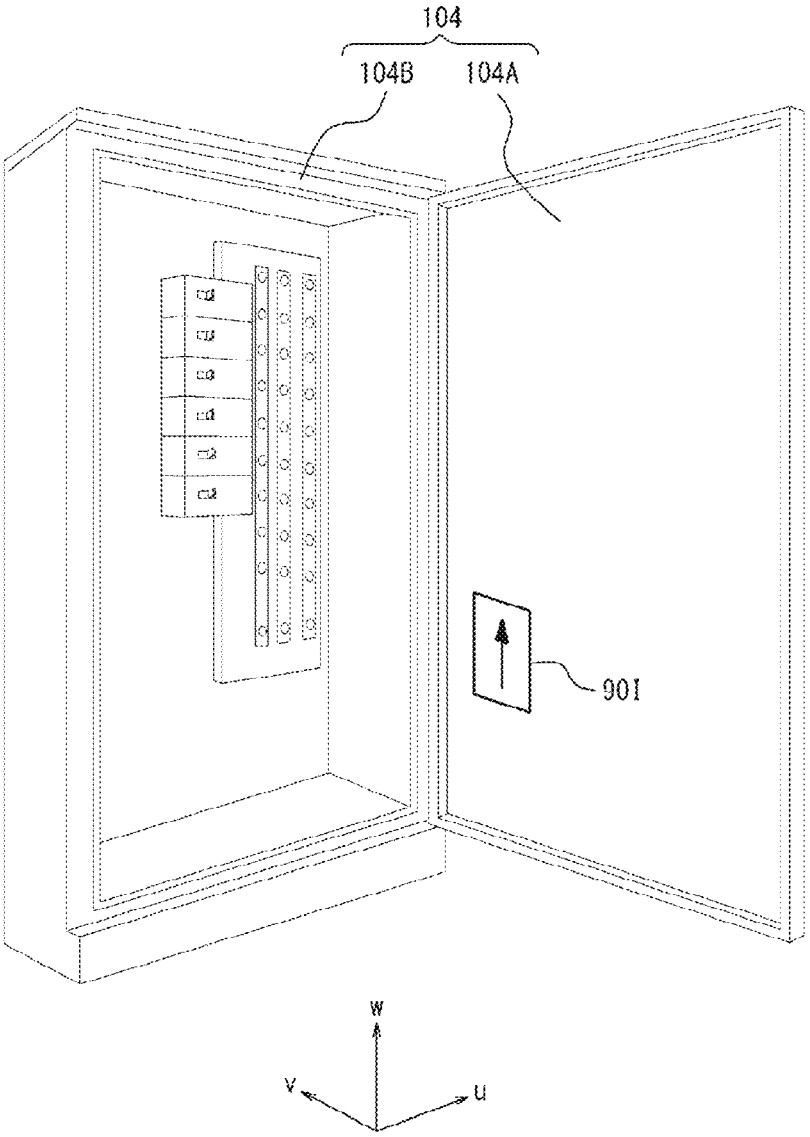
FIG. 92 is a schematic diagram illustrating an application example of the wireless communication device.

FIG. 92 is a diagram exemplifying a state in which the wireless communication device 90 is provided in a switch board 104 made of metal. That is, the electrical conductive body 99 provided with the wireless communication device 90 may be the switch board 104. The switch board 104 includes a door 104A to be opened and closed, and a main body 104B. As illustrated in FIG. 92, the wireless communication device 90 may be disposed on a back side of the door 104A. A back side of the door 104A may be an inner side of the switch board 104. As illustrated in FIG. 92, a coordinate system including a u axis, a v axis, and a w axis is defined. A u direction, a v direction, and a w direction correspond to a width direction, a depth direction, and a height direction of the switch board 104, respectively. The door 104A made of metal may include a body extending along the w direction. Like a wireless communication device 90I illustrated in FIG. 92, the wireless communication device 90 may be disposed on the back side of the door 104A so that the x direction in which the first conductor 31 and the second conductor 32 are arranged is along the w direction. The wireless communication device 90 is disposed so that the fourth conductor 50 faces the switch board 104, and may transmit the detection data of the sensor 92 favorably. The wireless communication device 90I illustrated in FIG. 92 is an example, and the wireless communication device 90 may be disposed at other positions of the switch board 104. A plurality of the wireless communication devices 90 may be provided in the switch board 104.

The wireless communication device 90 disposed on the switch board 104 can perform at least one process such as detection of the opened and closed state of the door 104A, detection of the abnormality such as damage and movement of the switch board 104, detection of the locked state of the door 104A, and identification of a user who tries to open the switch board 104. The details of the processes are the same as those of the wireless communication device 90 disposed on the safe 101 described above.

Circuitry for power distribution is provided in the main body 104B of the switch board 104. Therefore, the management of the storing item is unnecessary. However, the circuitry for the power distribution needs to be periodically inspected by a specific person qualified to perform the inspection. In addition to detecting the opened and closed state of the door 104A, the wireless communication device 90 may transmit a warning signal when the door 104A is not opened and closed within a predetermined period in which the inspection should be performed. That is, the wireless communication device 90 may transmit a signal when the detection result of the opened and closed state of the door 104A of the sensor 92 does not change for a predetermined period.

The wireless communication device 90 may transmit information for distinguishing whether or not the user is a specific person who is qualified to perform the inspection in identifying the user. Based on this information, for example, it is possible to accurately determine whether the inspection was performed by a specific person. The detected abnormality of the switch board 104 may include at least one of temperature rise and current abnormality of the circuitry for the power distribution. The sensor 92 may include at least one of a temperature sensor that detect the temperature inside the switch board 104 and a current sensor, for example.

The electrical conductive body 99 provided with the wireless communication device 90 may be poisonous substance safekeeping storage, which is a storage facility, dedicated to poisonous substances. The electrical conductive body 99 provided with the wireless communication device 90 may be a fire extinguisher storage box which is a facility for storing a fire extinguisher. The poisonous substance safekeeping storage and the fire extinguisher storage box need to be periodically inspected by a specific person who is qualified to perform the inspection. When the wireless communication device 90 is provided in the poisonous substance safekeeping storage or the fire extinguisher storage box, as described above, it can be properly determined whether the door has been opened and closed within a predetermined period and whether the inspection has been performed by a specific person. When the electrical conductive body 99 is the fire extinguisher storage box, the system can be configured so that a fire alarm is activated when a user who is not a specific person opens the door 104A. When the electrical conductive body 99 is the fire extinguisher storage box, the system can be configured to manage an update timing of the fire extinguisher by associating the above-described predetermined period with an expiration date of the fire extinguisher.

Figure 93:
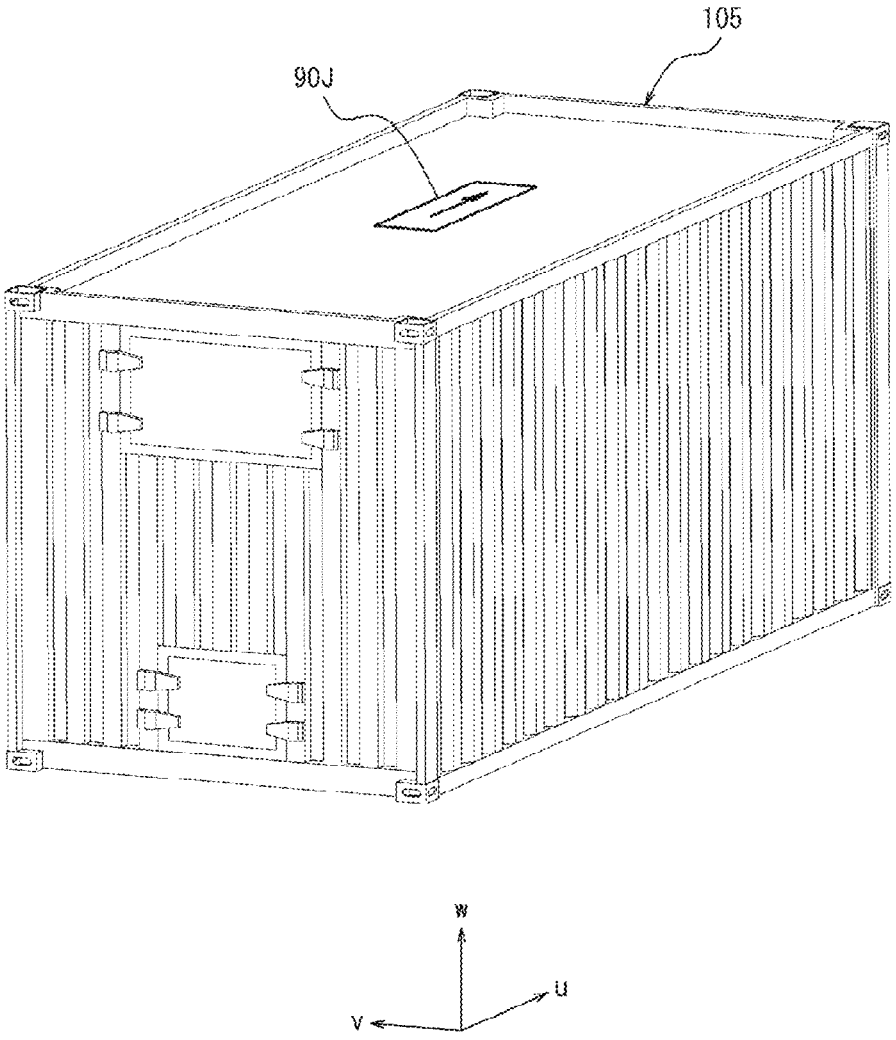
FIG. 93 is a schematic diagram illustrating an application example of the wireless communication device.

FIG. 93 is a diagram exemplifying a state in which the wireless communication device 90 is provided in a container 105 made of metal. That is, the electrical conductive body 99 provided with the wireless communication device 90 may be the container 105. As illustrated in FIG. 93, the wireless communication device 90 may be disposed on an upper surface of an outer side the container 105. The upper surface of the outer side of the container 105 may be a ceiling of the container 105. As illustrated in FIG. 93, a coordinate system including a u axis, a v axis, and a w axis is defined. A u direction, a v direction, and a w direction correspond to a length direction, a width direction, and a height direction of the container 105, respectively. The upper surface of the container 105 may include a body extending along the u direction. Like a wireless communication device 90J illustrated in FIG. 93, the wireless communication device 90 may be disposed on the upper surface of the container 105 so that the x direction in which the first conductor 31 and the second conductor 32 are arranged is along the u direction. The wireless communication device 90 is disposed so that the fourth conductor 50 faces the container 105, and may transmit the detection data of the sensor 92 favorably. The wireless communication device 90J illustrated in FIG. 93 is an example, and the wireless communication device 90 may be disposed at other positions of the container 105. A plurality of the wireless communication devices 90 may be provided in the container 105.

The wireless communication device 90 disposed on the container 105 may transmit the position information of the container 105, for example. When calculating the position information based on the signal from the GPS satellite, it is preferable that the wireless communication device 90 is disposed on the upper surface of the container 105 in order to improve GPS sensitivity. The GPS uses circular polarized waves, but the polarized waves used by the antenna of the wireless communication device 90 are limited to linear polarized waves in principle. Therefore, it is more preferable to use two antennas so that the polarized waves are orthogonal.

When the wireless communication device 90 is provided inside the container 105, the wireless communication device 90 may record, in the memory 93, the detection data of the sensor 92. The sensor 92 may include, for example, a temperature sensor and an acceleration sensor. The wireless communication device 90 may transmit a history of heat, shock, and the like that are recorded in the memory 93 when the door of the container 105 is opened. At this time, the wireless communication device 90 makes it possible to grasp the state while the container 105 is being transported. When the wireless communication device 90 is provided at the door of the container 105, the wireless communication device 90 may detect the opened and closed state of the door.

Figure 94:
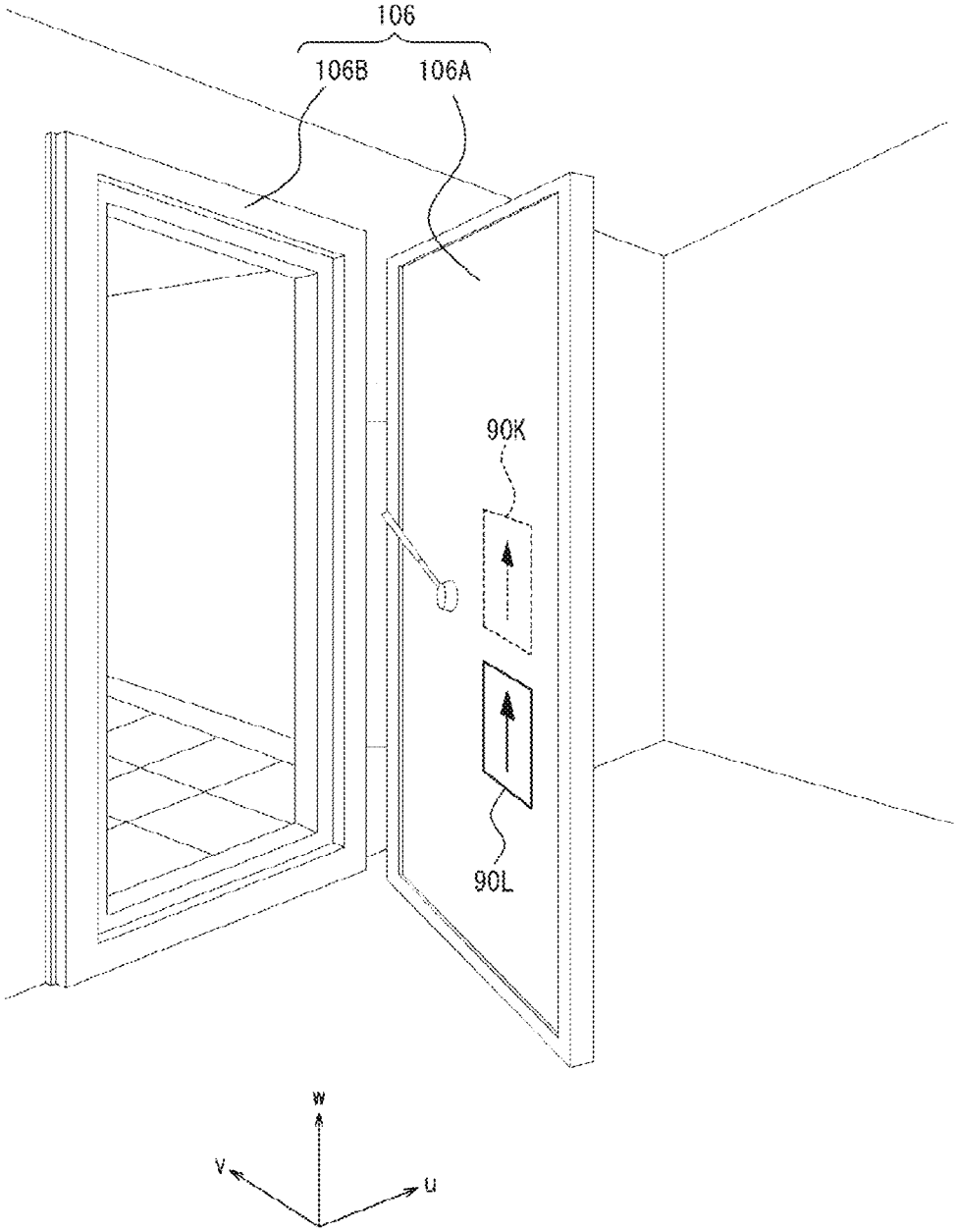
FIG. 94 is a schematic diagram illustrating an application example of the wireless communication device.

FIG. 94 is a diagram exemplifying a state in which the wireless communication device 90 is provided in a shield room 106. That is, the electrical conductive body 99 provided with the wireless communication device 90 may be the shield room 106. The shield room 106 is a room that shields the electromagnetic waves. The shield room 106 includes a door 106A to be opened and closed, and a main body 106B. As illustrated in FIG. 94, the wireless communication device 90 may be disposed on a front side of the door 106A. The front side of the door 106A may be an outer side of the shield room 106. As illustrated in FIG. 94, a coordinate system including a u axis, a v axis, and a w axis is defined. A u direction, a v direction, and a w direction correspond to a longitudinal direction, a transverse direction, and a height direction of the shield room 106, respectively. The door 106A made of metal may include a body extending along the w direction. Like a wireless communication device 90K illustrated in FIG. 94, the wireless communication device 90 may be disposed on the front side of the door 106A so that the x direction in which the first conductor 31 and the second conductor 32 are arranged is along the w direction. Like a wireless communication device 90L illustrated in FIG. 94, the wireless communication device 90 may be disposed on the back side of the door 106A so that the x direction in which the first conductor 31 and the second conductor 32 are arranged is along the w direction. The back side of the door 106A may be an inner side of the shield room 106. In whichever case of the wireless communication devices 90K and 90L illustrated in FIG. 94, the wireless communication device 90 is disposed so that the fourth conductor 50 faces the shield room 106, and may transmit the detection data of the sensor 92 favorably. A plurality of the wireless communication devices 90 may be provided in the shield room 106. The wireless communication devices 90K and 90L illustrated in FIG. 94 are an example, and the wireless communication device 90 may be disposed at other positions of the shield room 106.

The wireless communication device 90 disposed on the shield room 106 can detect the opened and closed state of the door 106A, for example. The details of the detection of the opened and closed state are the same as those of the wireless communication device 90 disposed on the safe 101 described above.

There are cases where it is desired to measure shielding performance of the electromagnetic waves by the shield room 106 from the outside. For example, the shielding performance of the electromagnetic waves by the shield room 106 can be measured by externally receiving a signal, which is transmitted from the wireless communication device 90L disposed on the back side of the door 106A, while opening and closing the door 106A, and measuring the change in the signal.

Figure 95:
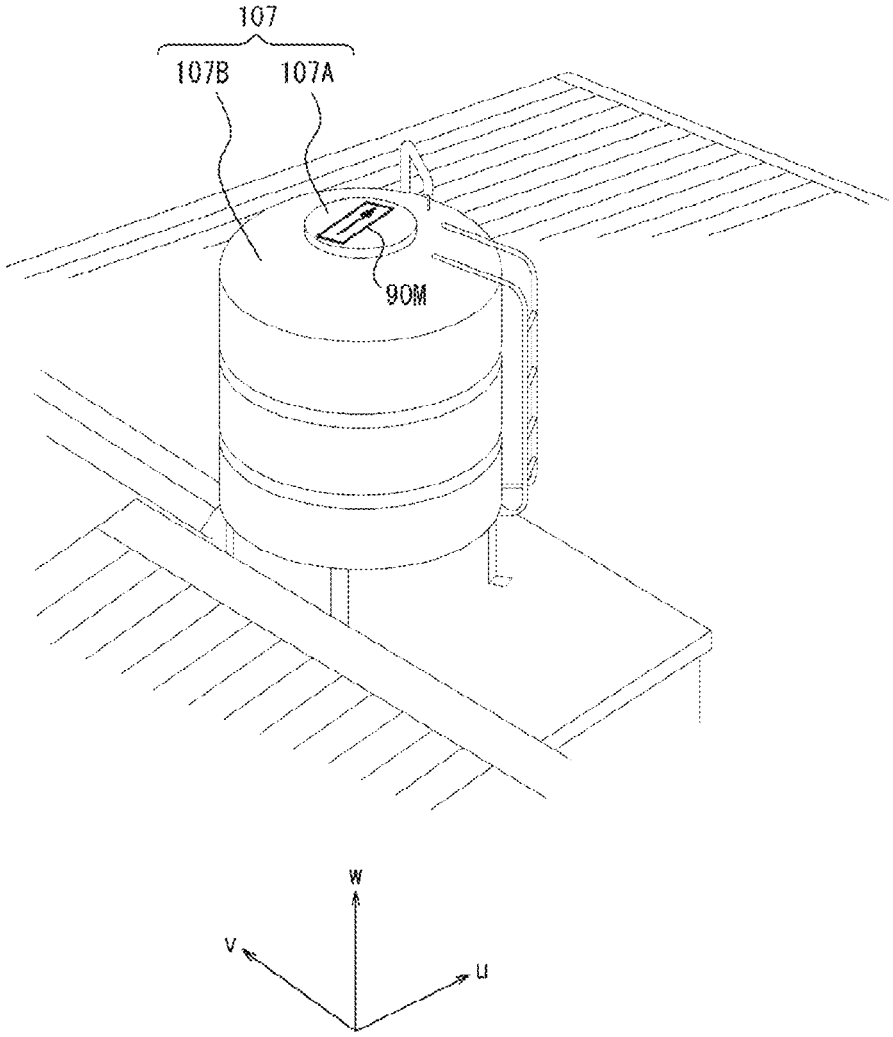
FIG. 95 is a schematic diagram illustrating an application example of the wireless communication device.

FIG. 95 is a diagram exemplifying a state in which the wireless communication device 90 is provided in a water feed tank 107. That is, the electrical conductive body 99 provided with the wireless communication device 90 may be the feed tank 107. The feed tank 107 is a tank that stores water and is provided in architecture such as building. The feed tank 107 includes a door 107A to be opened and closed, and a main body 107B. As illustrated in FIG. 95, the wireless communication device 90 may be disposed on the door 107A at an upper portion of the main body 107B. As illustrated in FIG. 95, a coordinate system including a u axis, a v axis, and a w axis is defined. A u direction, a v direction, and a w direction correspond to a width direction, a depth direction, and a height direction of the feed tank 107, respectively. The door 107A made of metal may include a body extending along the u direction. Like a wireless communication device 90M illustrated in FIG. 95, the wireless communication device 90 may be disposed on the door 107A so that the x direction in which the first conductor 31 and the second conductor 32 are arranged is along the u direction. The wireless communication device 90 is disposed so that the fourth conductor 50 faces the feed tank 107, and may transmit the detection data of the sensor 92 favorably. The wireless communication device 90M illustrated in FIG. 95 is an example, and the wireless communication device 90 may be disposed at other positions of the feed tank 107. A plurality of the wireless communication devices 90 may be provided in the feed tank 107.

The wireless communication device 90 disposed on the feed tank 107 can detect the opened and closed state of the door 107A, for example. The details of the detection of the opened and closed state are the same as those of the wireless communication device 90 disposed on the safe 101 described above.

When the wireless communication device 90 is provided inside the feed tank 107, the wireless communication device 90 may record the detection data of the sensor 92 in the memory 93. The sensor 92 may include, for example, a water level sensor using ultrasonic waves or the like. The wireless communication device 90 may transmit a history of the water level that is recorded in the memory 93 when the door 107A is opened. The sensor 92 may include, for example, an image sensor. The wireless communication device 90 may transmit an image of the stored water when the door 107A is opened. The image of the stored water may be used to determine water quality, the presence or absence of algae generation, and the like.

Figure 96:
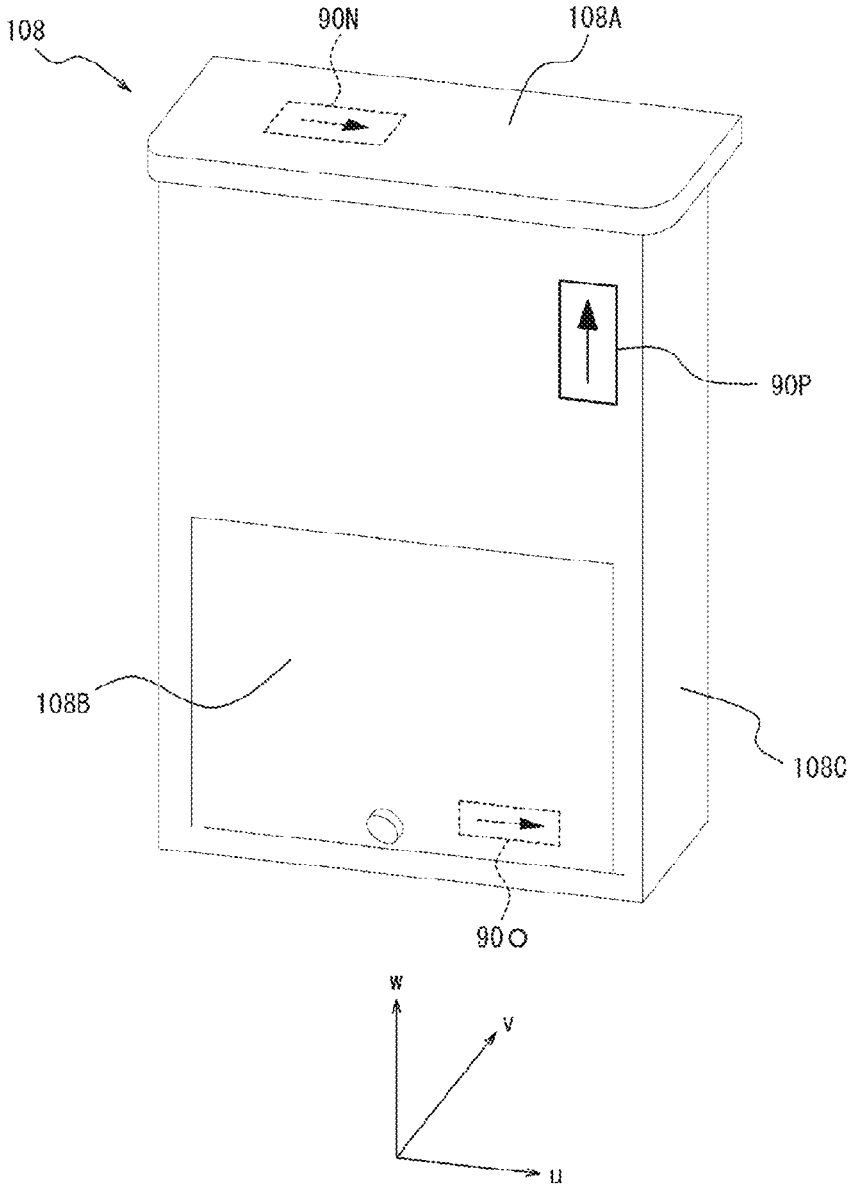
FIG. 96 is a schematic diagram illustrating an application example of the wireless communication device.

FIG. 96 is a diagram exemplifying a state in which the wireless communication device 90 is provided in a mail box 108 made of metal. That is, the electrical conductive body 99 provided with the wireless communication device 90 may be the mail box 108. The mail box 108 is a box into which postal mail and package are placed and which is installed in detached houses, apartment houses, and commercial buildings. The mail box 108 can be a post office box. The mail box 108 is not limited to a box having a size for receiving postal mail, and may be, for example, a delivery box.

The mail box 108 includes a first door 108A and a second door 108B that are opened and closed, and a main body 108C. The first door 108A, which is a moving part, is provided at a mailing opening for postal mail or the like, which is a first opening. The mailing opening is covered with the first door 108A when the first door 108A is closed. When the first door 108A is opened, the mailing opening is exposed to the outside. The second door 108B, which is the moving part, is provided at a pickup opening for postal mail or the like, which is a second opening. The pickup opening is covered with the second door 108B when the second door 108B is closed. When the second door 108B is opened, the pickup opening is exposed to the outside.

As illustrated in FIG. 96, the wireless communication device 90 may be disposed on a back side of the first door 108A. The back side of the first door 108A may be an inner side of the mail box 108. As illustrated in FIG. 96, a coordinate system including a u axis, a v axis, and a w axis is defined. A u direction, a v direction, and a w direction correspond to a width direction, a depth direction, and a height direction of the mail box 108, respectively. The first door 108A may include a body extending along the u direction. Like a wireless communication device 90N illustrated in FIG. 96, the wireless communication device 90 may be disposed on the back side of the first door 108A so that the x direction in which the first conductor 31 and the second conductor 32 are arranged is along the u direction.

As illustrated in FIG. 96, the wireless communication device 90 may be disposed on a back side of the second door 108B. The back side of the second door 108B may be the inner side of the mail box 108. The second door 108B may include a body extending along the u direction. Like a wireless communication device 90O illustrated in FIG. 96, the wireless communication device 90 may be disposed on the back side of the second door 108B so that the x direction in which the first conductor 31 and the second conductor 32 are arranged is along the u direction.

As illustrated in FIG. 96, the wireless communication device 90 may be disposed on a front surface of the main body 108C. The front surface of the main body 108C may include a body extending along the w direction. Like a wireless communication device 90P illustrated in FIG. 96, the wireless communication device 90 may be disposed on the front surface of the main body 108C so that the x direction in which the first conductor 31 and the second conductor 32 are arranged is along the w direction.

One wireless communication device 90 may be provided, but a plurality of the wireless communication devices 90 may be provided in the locker 102. The plurality of the wireless communication devices 90 may include a plurality of types of sensors 92 having different configurations. Hereinafter, assuming that a plurality of the wireless communication devices 90 are disposed at the positions of wireless communication devices 90N to 90P illustrated in FIG. 96, an application example of the wireless communication device 90 to the mail box 108 will be described. The number of openings of the mail box 108 is not limited to two. For example, the wireless communication device 90 may be applied to the mail box 108 having one opening in which the mailing opening and the pickup opening are integrated. In this case, the second door 108B and the wireless communication device 90O illustrated in FIG. 96 are omitted, and the wireless communication device 90N also has the function of the wireless communication device 90O. The wireless communication devices 90N to 90P illustrated in FIG. 96 are an example, and the wireless communication device 90 may be disposed at other positions of the mail box 108.

As illustrated in FIG. 96, the wireless communication device 90N is disposed on the back side of the first door 108A provided at the mailing opening of the mail box 108. The first door 108A provided at the mailing opening may be an example of the moving part provided at the first opening. The sensor 92 included in the wireless communication device 90N may include a first sensor, and may be used to detect a locked state of the first door 108A. The first sensor may be at least one of an acceleration sensor and a magnetic sensor, for example. The information on the opened and closed state of the first door 108A is transmitted by the first antenna 60 included in the wireless communication device 90N. A transmission destination may be an information terminal registered in advance. The transmission destination may be an intercom of a house of an owner of the mail box 108. By receiving the information that the first door 108A is opened, the owner can determine that the postal mail or the like arrives while staying at home. The information on the opened and closed state of the first door 108A may be transmitted based on a detection result of the sensor 92 included in the wireless communication device 90N and a signal received by the first antenna 60 included in another wireless communication device 90. Another wireless communication device 90 may be, for example, the wireless communication device 90P. For example, the signal indicating the opened and closed state may be transmitted on the condition that the detection result that the first door 108A is opened and that the first antenna 60 included in another wireless communication device 90 has received a transmission request signal from the owner.

As illustrated in FIG. 96, the wireless communication device 90O is disposed on the back side of the second door 108B provided at the pickup opening of the mail box 108. The second door 108B provided at the pickup opening may be an example of the moving part provided at the second opening. The sensor 92 included in the wireless communication device 90O may include a second sensor, and may be used to detect the opened and closed state of the second door 108B. The second sensor may be at least one of an acceleration sensor and a magnetic sensor, for example. The information on the opened and closed state of the second door 108B is transmitted by the first antenna 60 included in the wireless communication device 90O. The transmission destination may be the information terminal registered in advance or a facility of the owner's house. The facility of the owner's house may be, for example, the intercom. By receiving the information that the second door 108B is opened, the owner can determine that the postal mail or the like is taken out while staying at home.

When there is a gap between the second door 108B and the main body 108C, the wireless communication device 90O can transmit information indicating the inside state of the mail box 108 even when the second door 108B is closed. The sensor 92 included in the wireless communication device 90O includes a third sensor and may be used to detect whether or not contents are accumulated in the mail box 108. The third sensor may be, for example, an infrared sensor. The contents include the postal mail, the cargo, and the like. The infrared sensor may receive infrared ray reflected from a bottom portion of the mail box. The wireless communication device 90O can generate information indicating the internal state of the mail box 108 from the state of the infrared ray received by the infrared sensor and transmit the generated information to the transmission destination. The internal state of the mail box 108 may be, for example, the degree of accumulation of the postal mail. For example, the wireless communication device 90O can transmit a warning signal when the postal mail and the like are accumulated and the second door 108B is not opened for a predetermined period. The predetermined period may be, for example, 24 hours.

The wireless communication devices 90N to 90P may perform processing such as the transmission processing by using the detection result of the sensor 92 included in another wireless communication device 90. The wireless communication device 90O transmits the information on the opened and closed state of the second door 108B as described above. The wireless communication device 90O may perform the transmission process based on the detection result of the sensor 92 included in the wireless communication device 90N and the detection result of the sensor 92 included in the own device. The detection result of the sensor 92 included in the wireless communication device 90N includes, for example, the opened and closed state of the first door 108A. The detection result of the sensor 92 included in the wireless communication device 90O includes, for example, the opened and closed state of the second door 108B. At this time, the wireless communication device 90O may not perform notification even if the second door 108B is opened, when the postal mail and the like is not posted, that is, when the first door 108A is not opened. The wireless communication device 90O transmits a warning signal according to time, when the postal mail and the like are accumulated as described above. The wireless communication device 90O may perform the transmission process based on the detection result of the sensor 92 included in the wireless communication device 90N and another detection result of the sensor 92 included in the own device. The detection result of the sensor 92 included in the wireless communication device 90N includes, for example, the opened and closed state of the first door 108A. The detection result of the sensor 92 included in the wireless communication device 90O includes, for example, the degree of accumulation of the postal mail and the like. In this case, the wireless communication device 90O may transmit a stronger warning signal to the transmission destination when the postal mail and the like are accumulated and the postal mail and the like are posted, that is, when the first door 108A is opened. The warning signal may be a signal associated with sound in addition to blinking light, for example.

As illustrated in FIG. 96, the wireless communication device 90P may be disposed on the front surface in which the pickup opening is provided, in each surface of the main body 108C. The sensor 92 included in the wireless communication device 90P may include, for example, the image sensor, and may be used to identify a user who opens the second door 108B. The image sensor may acquire an image of a part of the user who opens the second door 108B or an image of an ID of the user. The image of a part of the user includes, for example, an image of a user's face, fingerprint, or the like. The image of the ID may include, for example, an image of an ID card or the like. The wireless communication device 90 may identify the user who opens the second door 108B based on the image from the image sensor. The identification information of the second door 108B may be transmitted by the first antenna 60 included in the wireless communication device 90P. The wireless communication device 90 may compare the identification information of the user who opens the second door 108B with the identification information of the owner stored in advance, and may transmit a theft warning signal when the identification information of the user does not match the identification information of the owner.

The sensor 92 included in the wireless communication device 90P may include, for example, the human sensor. The wireless communication device 90P may perform the identification processing of the user when the human sensor detects the approach of the user. The wireless communication device 90 may change at least one of the transmission destination and the transmission content by comparing the identification information of the user with the identification information of the owner stored in advance. For example, the wireless communication device 90 may transmit, to the owner's residential facility, a signal warning that a user is a suspicious person when the sensor 92 detects the approach of the user and determines that the user is not the owner. For example, the wireless communication device 90 may transmit information to the pre-registered information terminal of the user who is the owner when the sensor 92 detects the approach of the user and determines that the user is the owner. The information transmitted to the information terminal registered in advance may be, for example, the history of the opened and closed state of the first door 108A and the like.

The wireless communication device 90P may detect the opened and closed state of the first door 108A together with the wireless communication device 90N or instead of the wireless communication device 90N. The sensor 92 included in the wireless communication device 90P may include, for example, an infrared sensor. A member to be detected by the infrared sensor is disposed on the back side of the first door 108A of the mail box 108. The first door 108A of the mail box 108 may be an example of the moving part of the storage. The member to be detected may be an irradiation member that radiates infrared rays toward the infrared sensor. The member to be detected may be a reflecting member that reflects the infrared rays output by the infrared sensor. The wireless communication device 90P may generate information on the opened and closed state of the first door 108A from the change in the infrared rays received by the infrared sensor. The information on the opened and closed state of the first door 108A may be transmitted by the first antenna 60 included in the wireless communication device 90P.

The moving part of the storage is not limited to the door. For example, the moving part provided at the second opening may be a key or a cylinder part. The cylinder may be, for example, a keyhole. The sensor 92 included in the wireless communication device 90O may include, for example, a magnetic sensor, and may detect the opened and closed state of the second door 108B from the change in the magnetic field. The magnetic field measured by the magnetic sensor may be generated, for example, by a magnet provided inside the cylinder.

As described above, the wireless communication device 90 is provided in the storage of the electrical conductive body 99 by the above configuration. Examples of the storage of the electrical conductive body 99 include the safekeeping storage, the switch board 104, the container 105, the shield room 106, the feed tank 107, the mail box 108, and the like. For example, the electromagnetic waves are reflected by the electrical conductive body 99 made of metal and the like, but the wireless communication device 90 can be used while being directly disposed on the electrical conductive body 99. The wireless communication device 90 has a very low profile because a radiation conductor can be installed in parallel to the electrical conductive body 99. Further, the first antenna 60 included in the wireless communication device 90 can radiate radio waves more strongly and can receive radio waves more favorably when the first antenna 60 is attached to the elongated electrical conductive body 99 or near the end portion of the electrical conductive body 99. Therefore, the wireless communication device 90 may desirably be used for applications such as the detection of the opened and closed state of the storage of the electrical conductive body 99 in a remote place, the detection of the abnormalities such as damage and movement, the detection of the locked state, the management of the storing item, and the identification of the user.

Application Example of Wireless Communication Device: Automatic Door

The wireless communication device 90 can also be used near metal or the like. The wireless communication device 90 may be suitably applied to, for example, an automatic door having a metal part, as described below.

Figure 97:
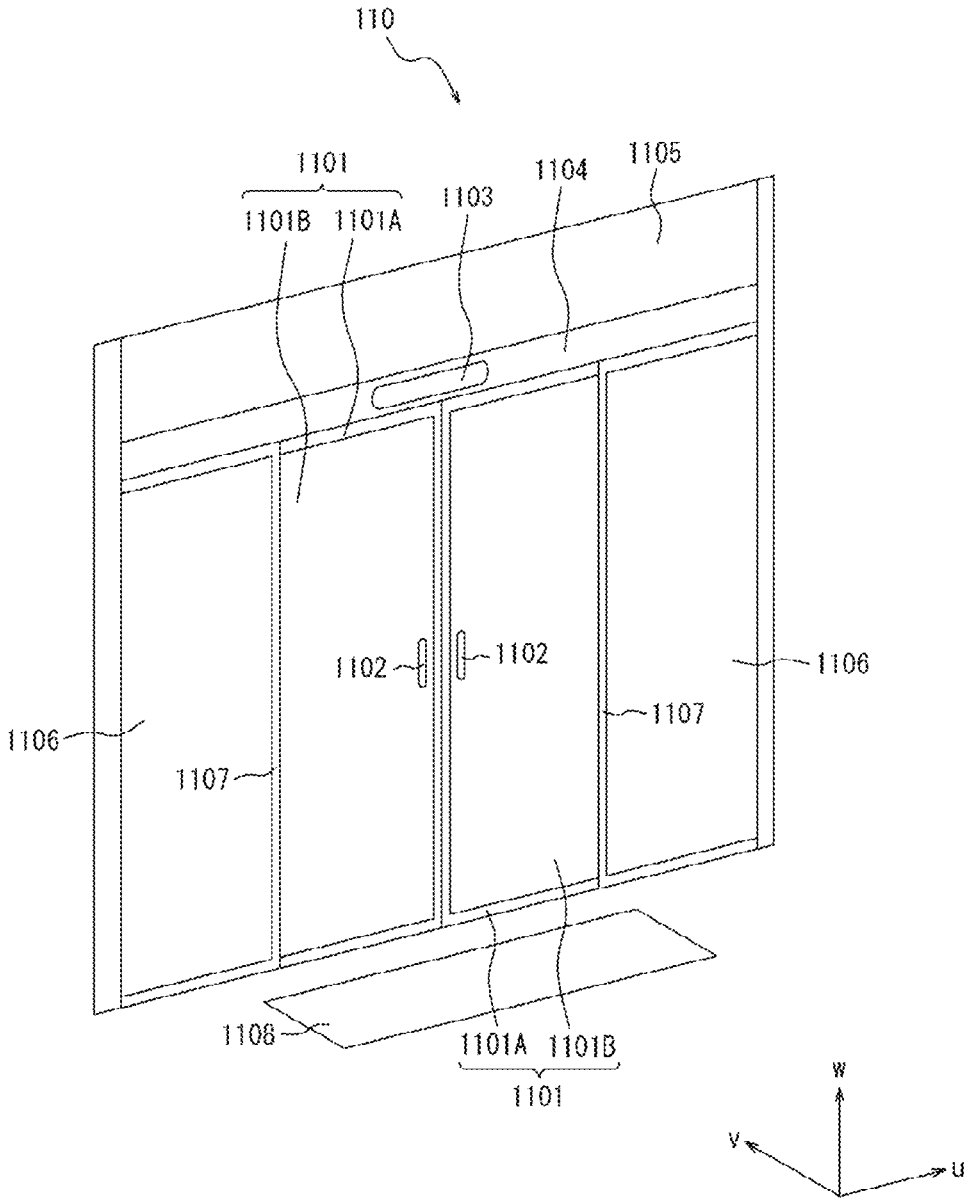

FIG. 97 is a diagram illustrating a configuration example of an automatic door 110. The automatic door 110 illustrated in FIG. 97 includes sliding doors 1101. The sliding doors 1101 are provided at an entrance of a building or the like. The automatic door 110 illustrated in FIG. 97 is only an example. Examples of the automatic door include various doors that perform opening and closing with power. Examples of the power include, for example, electricity, a pneumatic pressure, a negative pressure, and a hydraulic pressure. The automatic door is not limited to a door provided in a building structure to allow a person to enter and leave a room or a facility, and the examples thereof may include gates for various entrances and exits. The automatic door is not limited to one fixed to a specific building structure, but the examples thereof may include a movable door used at, for example, an event site and the like. A target that the automatic door allows to pass is not limited to a human being, and may be an animal, a vehicle, a ship, or the like. In the present disclosure, the target is mainly described as a human being. The description that the target is a human being may be appropriately replaced with another target.

The automatic door 110 illustrated in FIG. 97 includes the sliding doors 1101. The left and right sliding doors 1101 are opened and closed so that a person can pass therethrough in the opened state. As illustrated in FIG. 97, a coordinate system including a u axis, a v axis, and a w axis is defined. A u direction, a v direction, and a w direction correspond to a width direction, a depth direction, and a height direction of the automatic door 110, respectively. The sliding doors 1101 move in the u direction. When the sliding doors 1101 are opened, a person can pass therethrough in the v direction. The sliding door 1101 includes a door frame 1101A made of metal, for example, and a main body 1101B made of glass, for example. The door frame 1101A is an example of a conductor part of the automatic door 110. Each of the left and right sliding doors 1101 may include a touch switch 1102. The touch switch 1102 is an example of a moving part. Details of the touch switch 1102 will be described later.

The automatic door 110 includes a fix 1106, which is a fixed member that is not opened and closed. When the sliding door 1101 is opened, the fix 1106 and the sliding door 1101 overlap as viewed in the v direction. That is, the sliding door 1101 in the opened state is stored in a space behind the fix 1106. The fix 1106 includes, for example, a main body made of glass and a door frame made of metal. In a longitudinal direction of the door frame of the fix 1106, a part that serves as a partition with the sliding door 1101 in the closed state is called a doorjamb 1107.

The automatic door 110 includes a rammer 1105 in the upper direction (in the w forward direction) with respect to the sliding door 1101 and the fix 1106. The automatic door 110 includes a transom 1104 that separates the sliding door 1101 and the fix 1106 from the rammer 1105. The transom 1104 is made of metal, for example. The transom 1104 and the rammer 1105 are provided so as to cover a driving mechanism of the sliding door 1101 disposed therebehind (in v forward direction).

The automatic door 110 includes a human sensor 1103. The human sensor 1103 may be provided at the transom 1104. As will be described later, the human sensor 1103 may detect a person coming and going near the automatic door 110. The automatic door 110 includes a mat 1108. The mat 1108 may define an area in which the human sensor 1103 detects the coming and going person. As another example, the mat 1108 may be a mat switch used instead of the touch switch 1102.

Figure 98:
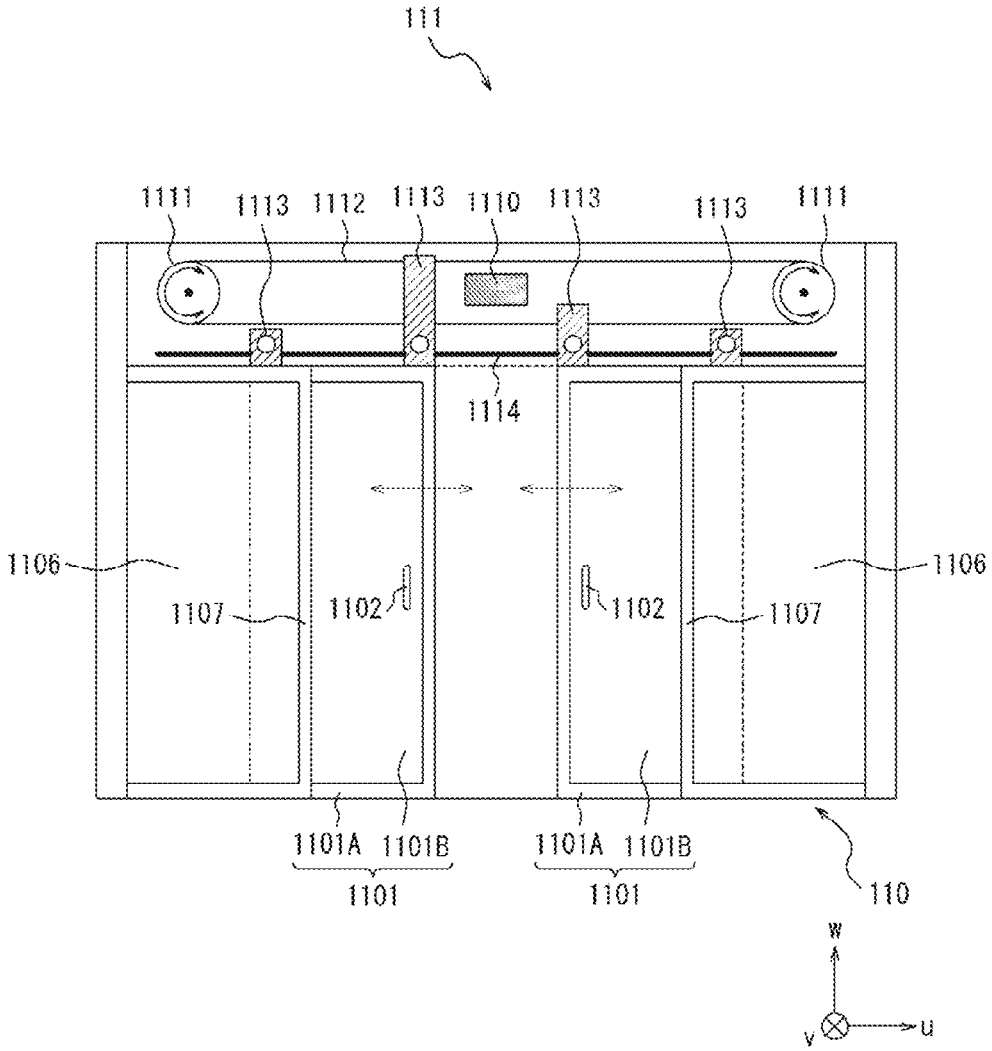

FIG. 98 is a schematic diagram illustrating a configuration example of an automatic door system 111. The automatic door system 111 includes a driving mechanism of the automatic door 110 and the sliding doors 1101 illustrated in FIG. 97. The driving mechanism of the sliding doors 1101 includes a controller 1110, pulleys 1111, a belt 1112, hanging sash rollers 1113, and a rail 1114.

The pulley 1111 is rotated by a motor or the like. The plurality of pulleys 1111 except one pulley may be driven pulleys that are driven. The belt 1112 connects the plurality of pulleys 1111. The belt 1112 moves according to the rotation of the pulleys 1111.

The rails 1114 are provided along a moving direction (u direction) of the left and right sliding doors 1101. The hanging sash rollers 1113 hang the sliding doors 1101 and move along the rail 1114. At least one of the hanging sash rollers 1113 provided at the left and right sliding doors 1101 is connected to the belt 1112. When the belt 1112 moves due to the rotation of the pulleys 1111, the sliding doors 1101 moves in the u direction.

The controller 1110 controls the operation of the motor or the like that rotates the pulleys 1111. As described below, the controller 1110 receives a signal transmitted from the wireless communication device 90 used in the automatic door 110. The signal transmitted from the wireless communication device 90 may be the signal for opening the automatic door 110, for example. The controller 1110 controls the rotation direction and the rotation speed of the pulleys 1111 based on the signal transmitted from the wireless communication device 90 to open and close the automatic door 110.

Figure 99:
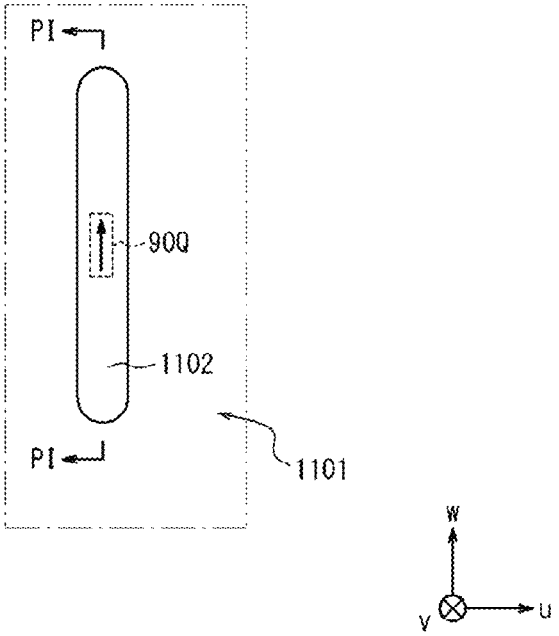
Figure 100:
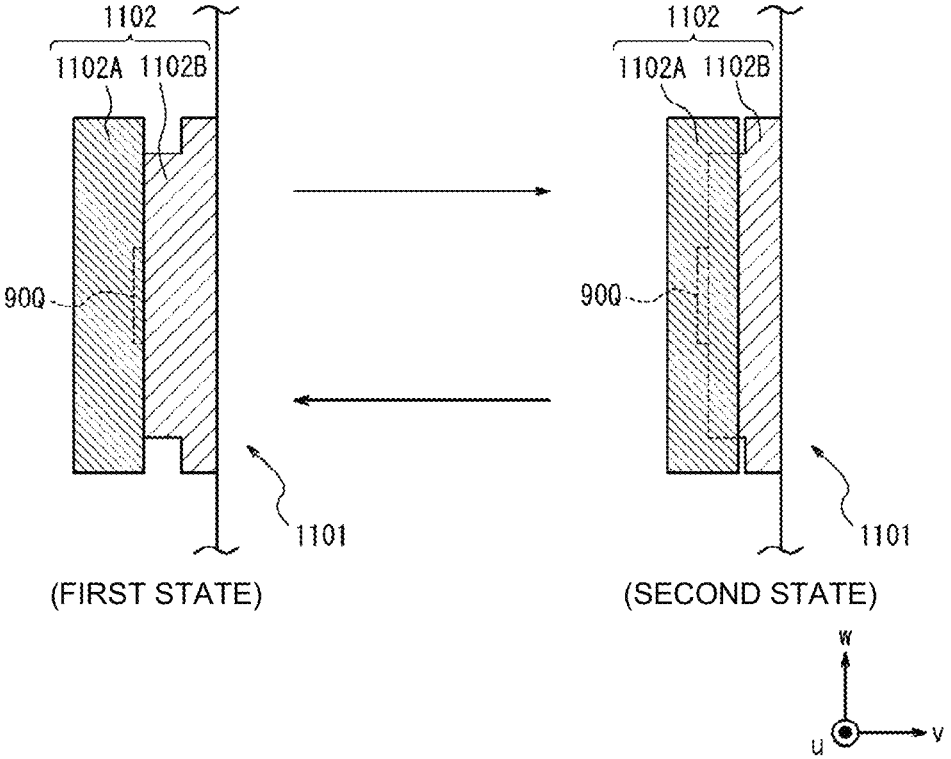

As illustrated in FIG. 99, the wireless communication device 90 may be disposed on a surface of the touch switch 1102. FIG. 100 is a cross-sectional view taken along the line PI-PI of the wireless communication device 90 and the touch switch 1102 illustrated in FIG. 99. The touch switch 1102 includes a movable metal part 1102A and a fixed part 1102B provided on the sliding door 1101. A part pressed by a user or a part touched by a hand is a metal part 1102A. The wireless communication device 90 may be disposed on the fixed part 1102B of the touch switch 1102. As illustrated in FIG. 100, the touch switch 1102 changes from a first state to a second state by being pressed from the outside. The first state is a state in which there is a predetermined gap between the metal part 1102A and the fixed part 1102B. The touch switch 1102 is in the first state when the touch switch 1102 is not pressed from the outside. When pressed from the outside, the touch switch 1102 changes from the first state to the second state. The second state is a state in which a gap between the metal part 1102A and the fixed part 1102B is smaller than the predetermined gap. When not pressed from the outside, the touch switch 1102 changes from the second state to the first state. For example, the touch switch 1102 includes a spring between the metal part 1102A and the fixed part 1102B, and returns to the first state when not pressed from the outside. The distance between the first antenna 60 of the wireless communication device 90 and the metal part 1102A differs between the first state and the second state, and thus the degree of electromagnetic coupling changes. That is, the antenna characteristics change between the first state and the second state. The touch switch 1102 is not limited to those arranged in the main body 1101B of the sliding door 1101. For example, the touch switch 1102 may be arranged in the door frame 1101A of the sliding door 1101. The wireless communication device 90 may be disposed on the touch switch 1102 arranged in the door frame 1101A.

The metal part 1102A of the touch switch 1102 may include a body extending along the w direction. Like a wireless communication device 90Q illustrated in FIG. 99, the wireless communication device 90 may be disposed so that the x direction in which the first conductor 31 and the second conductor 32 are arranged is along the w direction. The wireless communication device 90Q illustrated in FIG. 99 is an example, and the wireless communication device 90 may be disposed at other positions of the touch switch 1102.

The wireless communication device 90 is provided to the touch switch 1102 and may transmit a signal favorably. As illustrated in FIG. 99, in the wireless communication device 90, the fourth conductor 50 faces the metal part 1102A as the conductor part of the automatic door 110 and is capacitively coupled to the conductor part. The wireless communication device 90 can radiate a large amount of electromagnetic waves as compared with the case of radiating the electromagnetic waves alone. In the wireless communication device 90, the third conductor 40 is electromagnetically coupled to the metal part 1102A included in the touch switch 1102. Therefore, the wireless communication device 90 can transmit stronger electromagnetic waves.

The sensor 92 included in the wireless communication device 90 may include at least one of an acceleration sensor, a magnetic sensor, a pressure sensor, and a contact sensor, and may be used to detect the first state and the second state of the touch switch 1102. When the sensor 92 includes an acceleration sensor, the acceleration sensor may detect acceleration associated with a change from the first state to the second state or a reverse change. When the sensor 92 includes a magnetic sensor, the magnetic sensor may detect a change in magnetic field associated with the change from the first state to the second state or the reverse change. The magnetic field measured by the magnetic sensor may be generated by, for example, a magnet provided to at least one of the metal part 1102A and the fixed part 1102B. When the sensor 92 includes a pressure sensor, the pressure sensor may detect a change in pressure associated with the change from the first state to the second state or the reverse change. When the sensor 92 includes a contact sensor, the contact sensor may detect a change to a conducting state at the time of changing from the first state to the second state or a change to a non-conducting state associated with the reverse change.

The wireless communication device 90 may transmit the signal for opening the automatic door 110 to the controller 1110 when the touch switch 1102 changes from the first state to the second state by the first antenna 60. The touch switch 1102 being changed from the first state to the second state corresponds to the touch switch 1102 being pressed by the user, for example. As described above, the touch switch 1102 in the second state returns to the first state when there is no pressure from the outside. Therefore, the wireless communication device 90 may transmit the signal for opening the automatic door 110 to the controller 1110 when the touch switch 1102 changes from the second state to the first state by the first antenna 60 or when the touch switch 1102 returns from the second state to the first state.

Figure 101:
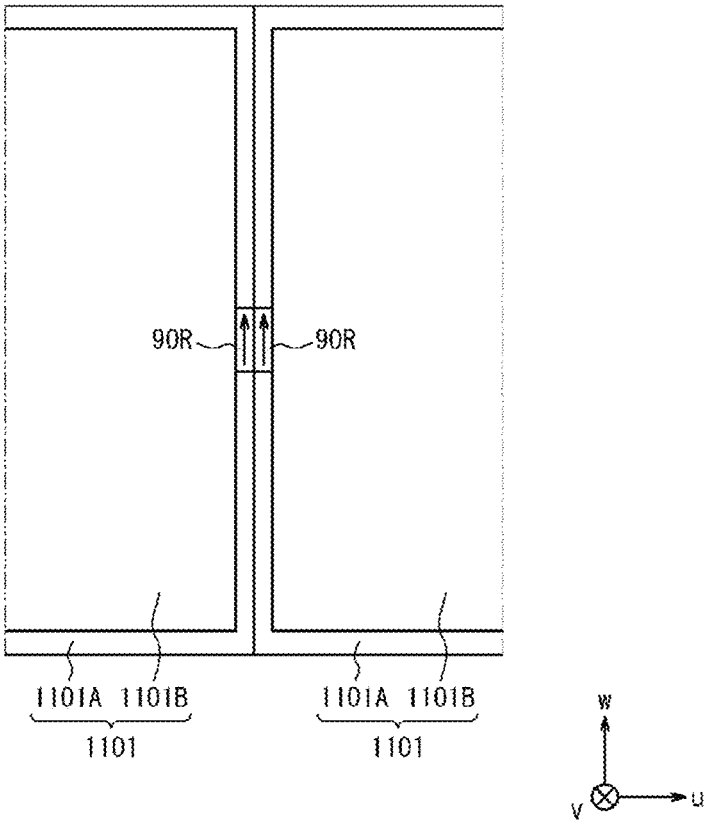

As illustrated in FIG. 101, the wireless communication device 90 may not be disposed on the touch switch 1102, but may be directly disposed on the door frame 1101A of the sliding door 1101. Like a wireless communication device 90R illustrated in FIG. 101, the wireless communication device 90 may be disposed so that the x direction in which the first conductor 31 and the second conductor 32 are arranged is along the w direction. That is, the wireless communication device 90 may be disposed so that the fourth conductor 50 faces the door frame 1101A which is the conductor part of the automatic door 110. The wireless communication device 90 is touched by the user as described later. The wireless communication device 90 is preferably disposed so that the x direction is along the longitudinal direction (w direction) of the door frame 1101A. As another example, the wireless communication device 90 may be disposed on the main body 1101B of the sliding door 1101.

The sensor 92 included in the wireless communication device 90 includes a touch sensor, for example, and may be used to detect a predetermined operation on the sliding door 1101 by the user. The predetermined operation may be an operation of touching the wireless communication device 90 provided at the sliding door 1101, for example. The wireless communication device 90 may transmit the signal for opening the automatic door 110 to the controller 1110 by the first antenna 60 when the touch sensor detects a user's touch. That is, the wireless communication device 90 may transmit the signal when the predetermined operation is performed. In the case of the configuration, the sliding door 1101 can omit the touch switch 1102. That is, instead of the touch switch 1102, the low-profile wireless communication device 90 can be arranged in the sliding door 1101. Compared to the touch switch 1102, the wireless communication device 90 has a higher degree of freedom in the arrangement position, and the position of the wireless communication device 90 is more easily adjusted.

The sensor 92 included in the wireless communication device 90 may include, for example, an image sensor. The predetermined operation detected by the sensor 92 may be, for example, a part of the user's body approaching from the sliding door 1101 to a predetermined position. A part of the user's body includes, for example, a user's finger or the like. The wireless communication device 90 may transmit the signal for opening the automatic door 110 to the controller 1110 by the first antenna 60 when it is determined that the user approaches the predetermined position based on the image acquired by the image sensor.

Figure 102:
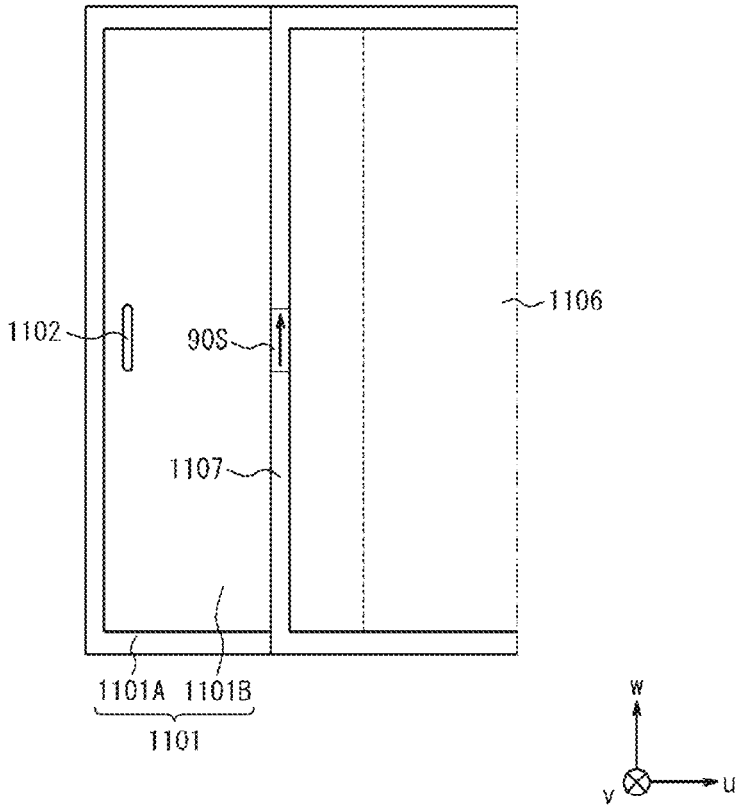

As illustrated in FIG. 102, the wireless communication device 90 may be disposed directly on the door frame of the fix 1106 made of metal. For example, the wireless communication device 90 may be disposed so that the fourth conductor 50 faces the conductor part of the doorjamb 1107. The conductor part of the doorjamb 1107 is included in a surface portion of the doorjamb 1107, for example. Like a wireless communication device 90S illustrated in FIG. 102, the wireless communication device 90 may be disposed so that the x direction in which the first conductor 31 and the second conductor 32 are arranged is along the w direction. The wireless communication device 90S illustrated in FIG. 102 is an example, and the wireless communication device 90 may be disposed at other positions of the door frame of the fix 1106.

The sensor 92 included in the wireless communication device 90 may include, for example, the image sensor. The predetermined operation detected by the sensor 92 may be, for example, an operation of pressing the touch switch 1102 by the user. The predetermined operation detected by the sensor 92 may be, for example, a part of the user's body approaching from the sliding door 1101 to a predetermined position. A part of the user's body includes, for example, a user's finger or the like. The wireless communication device 90 may transmit the signal for opening the automatic door 110 to the controller 1110 by the first antenna 60 when it is determined that the touch switch 1102 is pressed based on the image acquired by the image sensor. The wireless communication device 90 may transmit the signal for opening the automatic door 110 to the controller 1110 by the first antenna 60 when it is determined that the user approaches the predetermined position based on the image acquired by the image sensor.

The sensor 92 included in the wireless communication device 90 may include, for example, an infrared sensor. For example, the infrared sensor may be provided so that the infrared sensor cannot receive infrared rays when the touch switch 1102 is in the first state. Then, the wireless communication device 90 can determine that the touch switch 1102 is in the second state when the infrared sensor receives the infrared rays, and may transmit the signal for opening the automatic door 110 to the controller 1110. The second state may be a state in which the touch switch 1102 is pressed.

Figure 103:
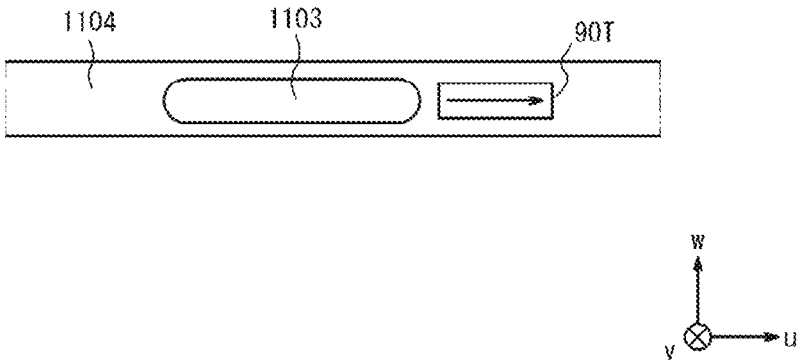

As illustrated in FIG. 103, the wireless communication device 90 may be directly disposed on the transom 1104. The wireless communication device 90 may be disposed so that the fourth conductor 50 faces the conductor part of the transom 1104. The conductor part of the transom 1104 is included in, for example, a surface portion of the transom 1104 and the like. Like a wireless communication device 90T illustrated in FIG. 103, the wireless communication device 90 may be disposed so that the x direction in which the first conductor 31 and the second conductor 32 are arranged is along the u direction. The wireless communication device 90T illustrated in FIG. 103 is an example, and the wireless communication device 90 may be disposed at other positions of the transom 1104. Other positions include, for example, a position away from the human sensor 1103 and the like. The wireless communication device 90 may be located in the human sensor 1103.

Figure 104:
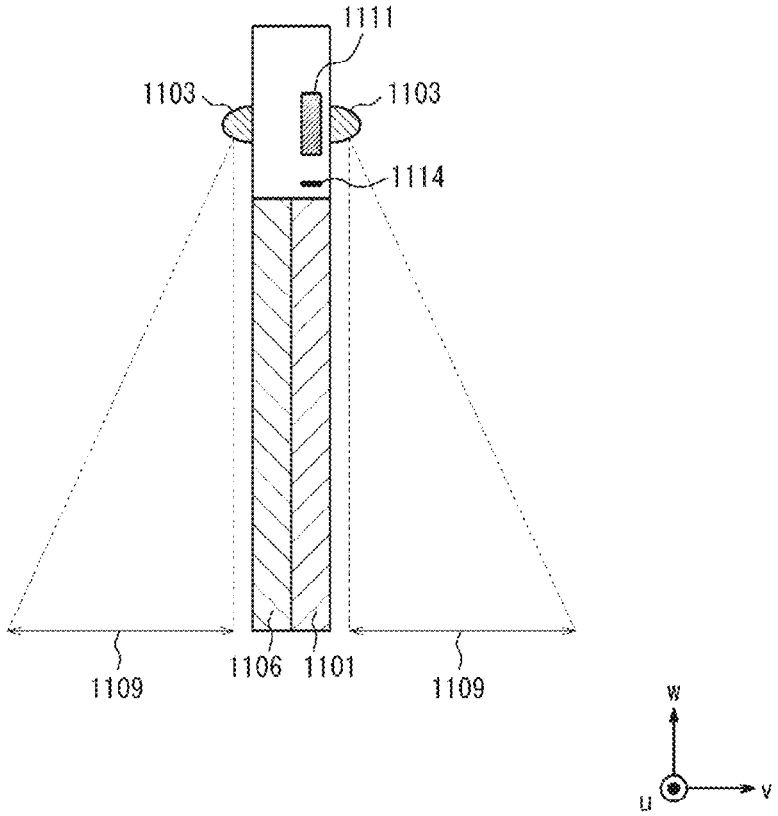

The sensor 92 included in the wireless communication device 90 may include the human sensor 1103. That is, the wireless communication device 90 can acquire data from the human sensor 1103 and handle the data as the data detected by the sensor 92. The human sensor 1103 may detect a person coming and going near the automatic door 110. FIG. 104 is a schematic cross-sectional view of the automatic door 110. The human sensor 1103 may be provided on both sides of the automatic door 110, that is, on the v forward side and the v backward side of the automatic door 110. The human sensor 1103 can detect, for example, a person in an area 1109 illustrated in FIG. 104 in the v direction. The area detectable by the human sensor 1103 may be visually recognized by arranging the mat 1108, for example.

The wireless communication device 90 may transmit the signal for opening the automatic door 110 to the controller 1110 by the first antenna 60 when the human sensor 1103 detects a person approaching the automatic door 110. The wireless communication device 90 transmits a signal for closing the automatic door 110 to the controller 1110 when the human sensor 1103 does not detect a person coming and going near the automatic door 110 after transmitting the signal for opening the automatic door 110.

As described above, the wireless communication device 90 is provided at the automatic door by the above configuration. The automatic door may include parts such as the touch switch 1102, the door frame 1101A, the doorjamb 1107, and the transom 1104. For example, unlike the conventional technology such as a monopole antenna, the wireless communication device 90 can be disposed in a very low profile because a radiation conductor can be provided in parallel to the electrical conductive body. The first antenna 60 or the second antenna 70 included in the wireless communication device 90 can be directly arranged in the elongated electrical conductive body to more strongly transmit and receive electromagnetic waves. Therefore, the wireless communication device 90 can appropriately transmit, to the controller 1110, the signal based on the detection data of the sensor 92 detected at the position away from the controller 1110 of the automatic door system 111.

<<Application Example of Wireless Communication Device: Monitoring System>>

Hereinafter, details of a monitoring system in which the wireless communication device 90 according to one embodiment of the present disclosure is provided will be described.

Figure 105:
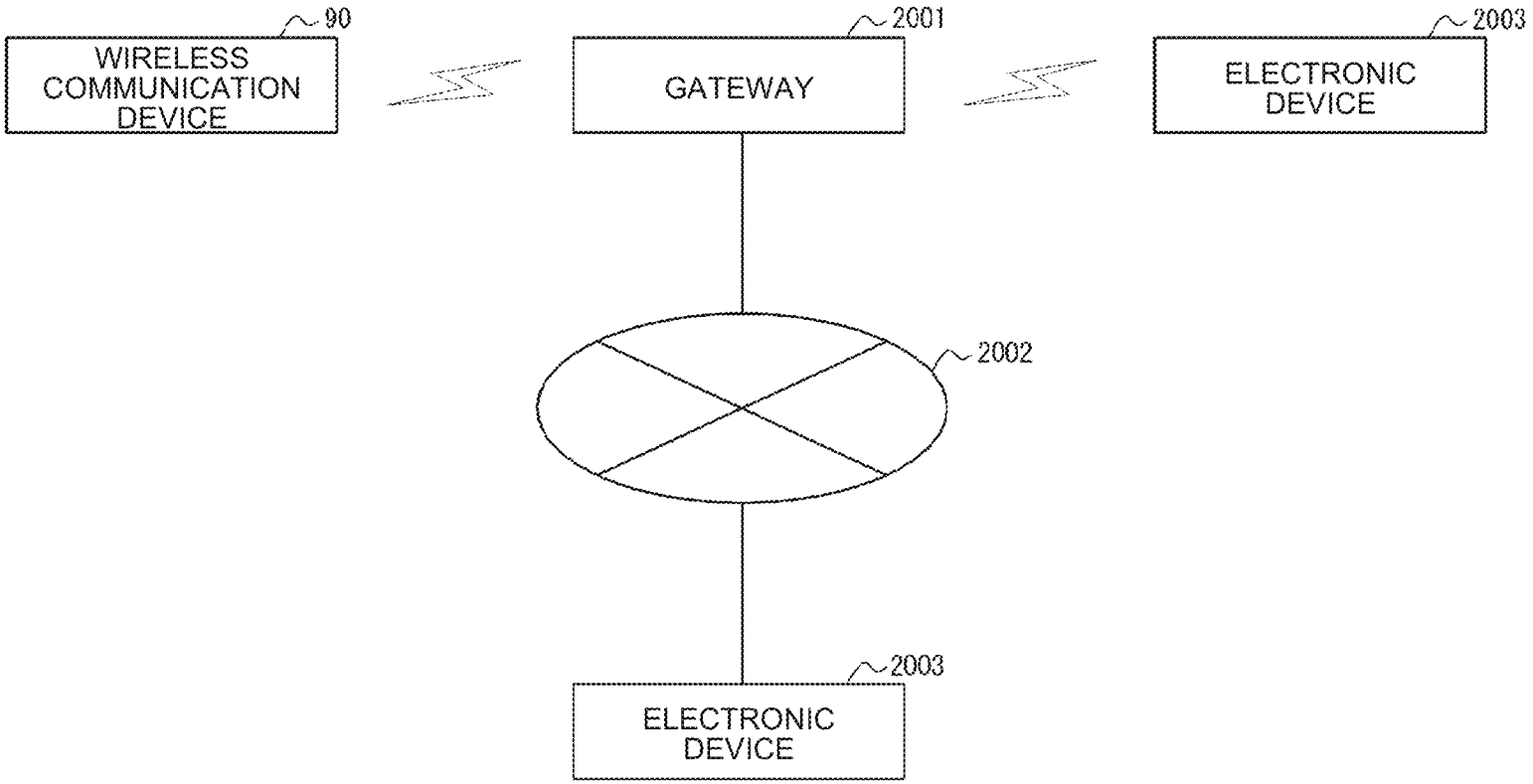

FIG. 105 is a diagram illustrating a schematic configuration of a monitoring system including the wireless communication device according to one embodiment of the present disclosure. The wireless communication device 90 is provided to a fixed object. The fixed object may be, for example, an architecture, a fitting, a fitting part, an indoor tool, a storing item, and a component. Examples of the architecture may include a beam, a column, a ceiling, a wall, a floor, a parking lot. Examples of the fitting may include a door, a shutter, and a rain door. Examples of the fitting part include a handle. Examples of the indoor tool may include a blind and a toilet paper holder. Examples of the storing item may include a container. Examples of the component may include a liquid leakage sensor module and a battery.

The wireless communication device 90 has the sensor as described above and detects a state of a target to be measured. The wireless communication device 90 has an antenna as described above, and wirelessly communicates with, for example, a gateway 2001 arranged around the wireless communication device 90. A communication standard between the wireless communication device 90 and the gateway 2001 may be a short-range communication standard. The short-range communication standard may include WiFi (registered trademark), Bluetooth (registered trademark), or a wireless LAN.

The wireless communication device 90 may include a motor in addition to the wireless communication module 80, the battery 91, the sensor 92, the memory 93, the controller 94, the first case 95, and the second case 96.

The information stored in the memory 93 may include, for example, information and the like that are used to allow the wireless communication device 90 to perform wireless communication with an electronic device 2003. The memory 93 may store information such as a communication protocol for implementing communication with the electronic device 2003 as the information used for performing the wireless communication.

The controller 94 may drive the motor based on the signal received by the wireless communication device 90.

By attaching the first case 95 to the structure, the wireless communication device 90 may be fixed to the structure. The second case 96 may be fixed to the structure by engaging the second case with the first case 95. The fourth conductor 50 may face the first case 95 with the second case 96 engaged with the first case 95.

The second case 96 includes the wireless communication module 80 including the first antenna 60 or the second antenna 70. The second case 96 includes the wireless communication module 80 in an internal space defined by engaging with the first case 95.

The first case 95 and the second case 96 may not accommodate all components constituting the wireless communication device 90. For example, the sensor 92 may be provided outside the first case 95 and the second case 96, and may be connected to the controller 94 by a power supply line and an electric signal transmission line.

The electrical conductive body 99 may be included in the fixed object to which the wireless communication device 90 is fixed. The wireless communication device 90 may be fixed to the fixed object at an attitude where the fourth conductor 50 facing the fixed object that is the electrical conductive body 99.

In the wireless communication device 90, the first antenna 60 or the second antenna 70 may be provided at an end of the electrical conductive body 99 in its extending direction. In the wireless communication device 90, the first antenna 60 or the second antenna 70 may be provided between both ends of the electrical conductive body 99 in the extending direction, for example, provided near a center therebetween.

The gateway 2001 may transmit the detection result of the sensor of the wireless communication device 90 to the electronic device 2003 such as a notification device, a management device, and a mobile terminal via a network 2002.

The network 2002 may include at least one of an internal network and an external network of a facility where the wireless communication device 90 is provided. A communication standard between the gateway 2001 and the electronic device 2003 may be a telecommunication standard. Examples of the telecommunication standard may include 2nd generation (2G), a 3rd generation (3G), 4th generation (4G), long term evolution (LTE), worldwide interoperability for microwave access (WiMAX), and personal handy-phone system (PHS).

The notification device may include, for example, a speaker that emits sound, a light that emits light, and a display that displays an image. The management device may include a server provided in, for example, an apartment house, a commercial building, or the like. The mobile terminal may include, for example, a smartphone and a tablet carried by a person.

The gateway 2001 may transmit the detection result of the sensor of the wireless communication device 90 to the electronic device 2003 such as a notification device, a portable terminal therearound. The communication standard between the gateway 2001 and the electronic device 2003 may be a short-range communication standard.

The antenna included in the wireless communication device 90 is the artificial magnetic conductor having the ground conductor as described above. With such a configuration, even if the antenna is provided at the conductor such as a steel frame used for a skeleton of a building structure or the like, it is possible to reduce the influence of the conductor when radiating electromagnetic waves. Therefore, the wireless communication device 90 may be provided to the fixed object and used for various applications described later.

A more specific use mode of the above-described wireless communication device 90 will be described below.

(Door)

Figure 106:
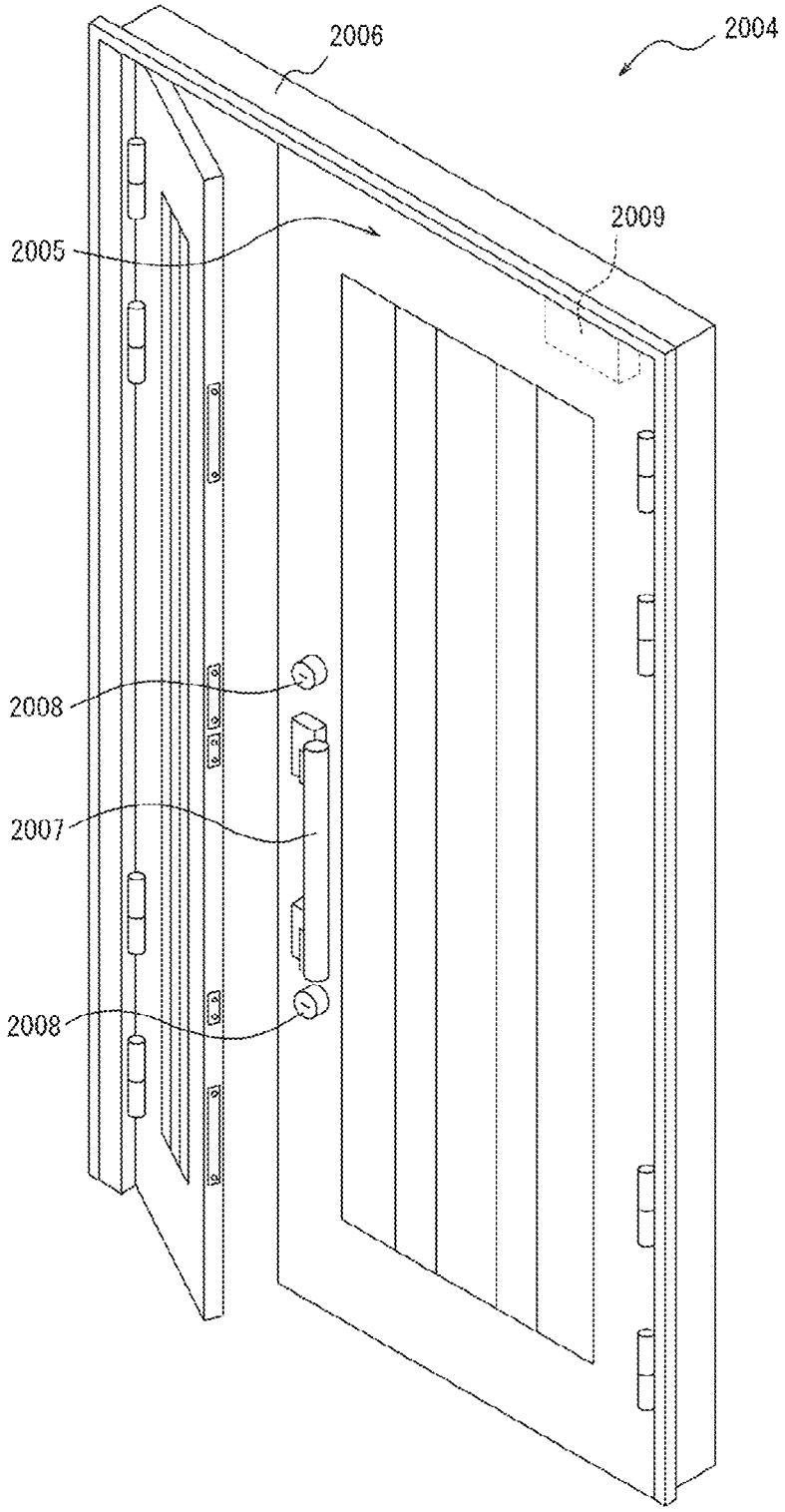

As illustrated in FIG. 106, the wireless communication device 90 may be fixed to a door 2004. The door 2004 may be, for example, an entrance/exit door of a building, an interior door, a fire door, or the like. At least one of a body part 2005, a frame 2006, a handle 2007, a lock 2008, and a door closer 2009 included in the door 2004 may be made of metal. The sensor 92 of the wireless communication device 90 may be provided at various portions included in the door 2004 depending on the type of the sensor 92.

The sensor 92 of the wireless communication device 90 fixed to the door 2004 is, for example, at least any one of a 9-axis sensor, a 6-axis sensor, an acceleration sensor, an angular velocity sensor, a geomagnetic sensor, a temperature sensor, a humidity sensor, an atmospheric pressure sensor, an illumination sensor, a wind power sensor, an infrared sensor, a magnet sensor, a human sensor, an image sensor, a photosensor, and an ultrasonic sensor. The 9-axis sensor includes an acceleration sensor, an angular velocity sensor, and a geomagnetic sensor, and each sensor measures three independent axes. The 6-axis sensor includes an acceleration sensor and an angular velocity sensor, and each sensor measures three independent axes. When the sensor 92 is at least one of an acceleration sensor, an angular velocity sensor, a geomagnetic sensor, and a magnet sensor, the sensor 92 may be fixed to a body part 2005 that moves when the door opens or closes or the lock 2008 that moves when the door is locked or unlocked. When the sensor 92 is at least one of a temperature sensor, a humidity sensor, an atmospheric pressure sensor, an illuminance sensor, a wind power sensor, an infrared sensor, a human sensor, an image sensor, a photosensor, and an ultrasonic sensor, the sensor 92 may be fixed to the interior side of any one of components such as the body part 2005 and the frame 2006 that included in the door 2004.

When the sensor 92 includes at least one of a 9-axis sensor, a 6-axis sensor, an acceleration sensor, an angular velocity sensor, a geomagnetic sensor, and a magnet sensor, the sensor 92 may detect the opening and closing of the body part 2005. The detection of the opening and closing of the body part 2005 by the sensor 92 is based on the detection of the presence or absence of movement of the body part 2005. When the sensor 92 includes at least one of a temperature sensor, a humidity sensor, an atmospheric pressure sensor, an illuminance sensor, a wind power sensor, an infrared sensor, an image sensor, and an optical sensor, the sensor 92 may detect the opening and closing of the body part 2005. The detection of the opening and closing of the body part 2005 by the sensor 92 is based on the change in the detected value associated with the change in the indoor state due to the opening and closing of the body part 2005.

When the sensor 92 includes at least one of a 9-axis sensor, a 6-axis sensor, and an acceleration sensor, the sensor 92 may detect the presence or absence of a person in a room to which the door 2004 is attached. The detection of the presence or absence of a person by the sensor 92 is based on detection of vibration of the door 2004 caused by activity of the person. When the sensor 92 includes at least one of an angular velocity sensor, a geomagnetic sensor, an illumination sensor, an infrared sensor, a human sensor, and an ultrasonic sensor, the sensor 92 may detect the presence or absence of a person in a room to which the door 2004 is attached. The detection of the presence or absence of a person by the sensor 92 is based on the change in the detected value due to the activity of the person.

When the sensor 92 includes at least one of a 9-axis sensor, a 6-axis sensor, an acceleration sensor, an angular velocity sensor, and a geomagnetic sensor, the sensor 92 may detect the locked state of the door 2004. The detection of the locked state by the sensor 92 is based on the detection of the presence or absence of the movement of the lock 2008 that occurs during the locking or unlocking.

When the sensor 92 includes at least one of a 9-axis sensor, a 6-axis sensor, an acceleration sensor, an angular velocity sensor, a geomagnetic sensor, a vibration sensor, a pressure sensor, a weight sensor, a displacement sensor, an image sensor, a photosensor, and an ultrasonic sensor, the sensor 92 may detect the abnormality occurrence of the door closer 2009. The abnormality detection of the door closer 2009 by the sensor 92 is based on the difference between the detected value at the time of opening and closing and the value at the time under normal conditions.

The wireless communication module 80 may be fixed together with the sensor 92 via the first case 95. Alternatively, the wireless communication module 80 may be fixed to the body part 2005, the frame 2006, the handle 2007, the lock 2008, the door closer 2009, or the like in the vicinity of the sensor 92 via the first case 95.

When the wireless communication module 80 is fixed to the body part 2005, the wireless communication module 80 may be fixed so that the first axis is parallel to the side of the body part 2005 having a rectangular shape. When the wireless communication module 80 is fixed to the body part 2005, the wireless communication module 80 may be fixed to an end of the body part 2005 and further to the end face.

When the wireless communication module 80 is fixed to the frame 2006, the wireless communication module 80 may be fixed to an end of the frame 2006.

When the wireless communication module 80 is fixed to the handle 2007, the wireless communication module 80 may be fixed to a surface of the handle 2007 made of metal or a recess formed in the handle 2007. In the configuration in which the wireless communication module 80 is arranged in the recess of the handle 2007, the recess may be closed with a lid made of a resin after the wireless communication module 80 is fixed. In the configuration in which the lid is made of resin, the wireless communication module 80 may be fixed so that the electrical conductive body 99 included in the handle 2007 faces the fourth conductor 50.

In the configuration in which the wireless communication module 80 is fixed to the door closer 2009, the wireless communication module 80 may be fixed to the metal surface of the case of the door closer 2009.

The controller 94 of the wireless communication device 90 fixed to the door 2004 transmits the detection result of the sensor 92 or the information obtained by analyzing the detection result of the sensor 92 to the electronic device 2003 via the wireless communication module 80. The information obtained by analyzing the detection result may include, for example, the presence or absence of opening and closing of the door 2004, the presence or absence of a person in the room, the locked state of the door 2004, or the presence or absence of an abnormality in the door closer 2009. The information obtained by analyzing the detection result may include the presence or absence of an illegal intrusion or the disaster prevention state based on the opened and closed state of the door 2004. The controller 94 or the electronic device 2003 may add a time stamp to the detection result of the sensor 92 or the analyzed information.

When the electronic device 2003 that acquires the detection result or the analyzed information is a notification device, the electronic device 2003 may notify various information by, for example, emitting specific sound, light, or image. The information to be notified may include the presence or absence of the opening and closing of the door 2004, the presence or absence of a person in the room, the locked state of the door 2004, the presence or absence of an abnormality occurrence of the door closer 2009, the presence or absence of an illegal intrusion, or the disaster prevention state. The electronic device 2003 as the notification device may transmit various information to a specific communication device.

When the electronic device 2003 that acquires the detection result or the analyzed information is a management device, a display included in the electronic device 2003 may display various information. The various information may include the presence or absence of the opening and closing of the door 2004, the presence or absence of a person in the room, the locked state of the door 2004, the presence or absence of an abnormality occurrence of the door closer 2009, the presence or absence of an illegal intrusion, or the disaster prevention state. The electronic device 2003 may store the presence or absence of the opening and closing of the door 2004, the presence or absence of a person in the room, the locked state of the door 2004, the presence or absence of an abnormality occurrence in the door closer 2009, the presence or absence of an illegal intrusion, or the disaster prevention state in the memory of the electronic device 2003.

When the electronic device 2003 that acquires the detection result or the analyzed information is a mobile terminal, the electronic device 2003 may notify a mobile terminal toter of various information. The various information may include the presence or absence of the opening and closing of the door 2004, the presence or absence of a person in the room, the locked state of the door 2004, the presence or absence of an abnormality occurrence of the door closer 2009, the presence or absence of an illegal intrusion, or the disaster prevention state. The electronic device 2003 may perform a notification by mail, social networking service (SNS), short message service (SMS), or the like. The SMS may also be called a text message.

(Blind)

Figure 107:
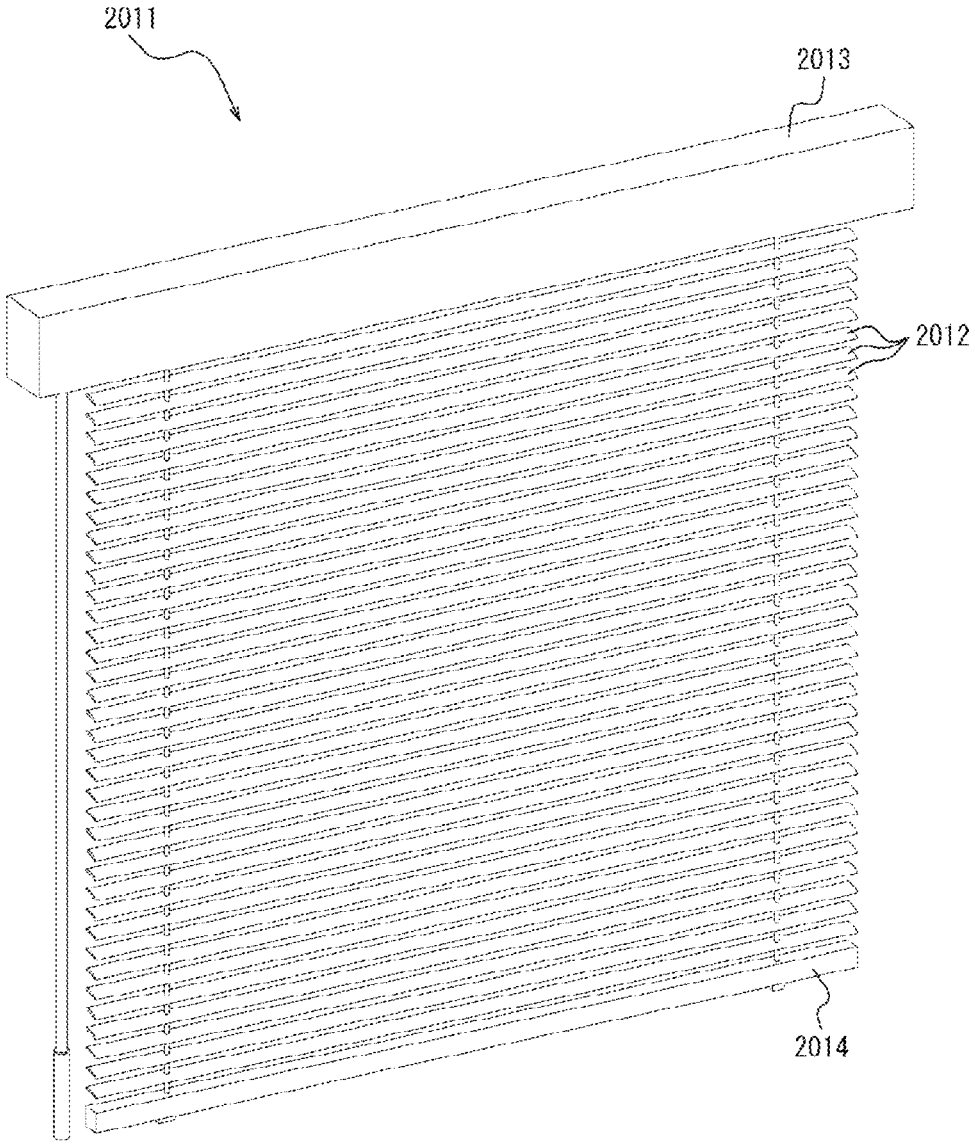

As illustrated in FIG. 107, the wireless communication device 90 may be fixed to a blind 2011. At least one of a slat 2012, a headbox 2013, and a slat bottom rail 2014 that are included in the blind 2011 may be made of metal. The sensor 92 of the wireless communication device 90 may be provided at various portions included in the blind 2011 depending on the type of the sensor 92.

The sensor 92 of the wireless communication device 90 fixed to the blind 2011 may include, for example, at least any one of a 9-axis sensor, a 6-axis sensor, an acceleration sensor, an angular velocity sensor, a geomagnetic sensor, an illumination sensor, and a wind power sensor. When the sensor 92 is at least one of an acceleration sensor, an angular velocity sensor, and a geomagnetic sensor, the sensor 92 may be fixed to the slat 2012 that moves when the blind moves up and down and the angle is adjusted. When the sensor 92 is at least one of an illuminance sensor and a wind power sensor, the sensor 92 may be fixed to the interior side of any one of parts such as the slat 2012, the headbox 2013, and the slat bottom rail 2014 included in the blind 2011.

When the sensor 92 includes at least one of a 9-axis sensor, a 6-axis sensor, an acceleration sensor, and an angular velocity sensor, the sensor 92 may detect the raising and lowering of the blind 2011. The detection of the raising and lowering of the blind 2011 by the sensor 92 is based on the detection of movement of the slat 2012. When the sensor 92 includes at least one of an illuminance sensor and a wind power sensor, the sensor 92 may detect the raising and lowering of the blind 2011. The detection of the raising and lowering of the blind 2011 by the sensor 92 is based on the change in the detected value associated with the change in the interior state.

The wireless communication module 80 may be fixed to the blind 2011 together with the sensor 92 via the first case 95. Alternatively, the wireless communication module 80 may be fixed to the slat 2012, the headbox 2013, the slat bottom rail 2014, or the like near the sensor 92 via the first case 95.

When the wireless communication module 80 is fixed to the slat 2012, the wireless communication module 80 may be fixed to an end of the slat 2012.

When the wireless communication module 80 is fixed to the headbox 2013, the wireless communication module 80 may be fixed to an end of the headbox 2013.

When the wireless communication module 80 is fixed to the slat bottom rail 2014, the wireless communication module 80 may be fixed to an end of the slat bottom rail 2014.

The controller 94 of the wireless communication device 90 fixed to the blind 2011 transmits the detection result of the sensor 92 or the information obtained by analyzing the detection result of the sensor 92 to the electronic device 2003 via the wireless communication module 80. The information obtained by analyzing the detection result may include, for example, the presence or absence of the raising/lowering of the blind 2011. The information analyzed by the detection result may include the presence or absence of an illegal intrusion based on the raising and lowering state of the blind 2011, the shielding and blindfold state, or the opening and closing degree of the slats 2012. The controller 94 or the electronic device 2003 may add a time stamp to the detection result of the sensor 92 or the analyzed information.

When the electronic device 2003 that acquires the detection result or the analyzed information is a notification device, the electronic device 2003 may notify various information by, for example, emitting specific sound, light, or image. The information to be notified may include the presence or absence of the raising and lowering of the blind 2011, the presence or absence of an illegal intrusion, the shielding and blindfold state, or the opening and closing degree of the slats 2012. The electronic device 2003 as the notification device may transmit various information to a specific communication device.

When the electronic device 2003 that acquires the detection result or the analyzed information is a management device, a display included in the electronic device 2003 may display various information. Various information may include the presence or absence of the raising and lowering of the blind 2011, the presence or absence of an illegal intrusion, the shielding and blindfold state, or the opening and closing degree of the slats 2012. The electronic device 2003 may store the presence or absence of the raising and lowering of the blind 2011, the presence or absence of an illegal intrusion, the shielding and blinding state, or the opening and closing degree of the slats 2012 in the memory of the electronic device 2003.

When the electronic device 2003 that acquires the detection result or the analyzed information is a mobile terminal, the electronic device 2003 may notify a mobile terminal toter of various information. Various information may include the presence or absence of the raising and lowering of the blind 2011, the presence or absence of an illegal intrusion, the shielding and blindfold state, or the opening and closing degree of the slats 2012. The electronic device 2003 may perform a notification by mail, SNS, SMS, or the like.

(Shutter)

Figure 108:
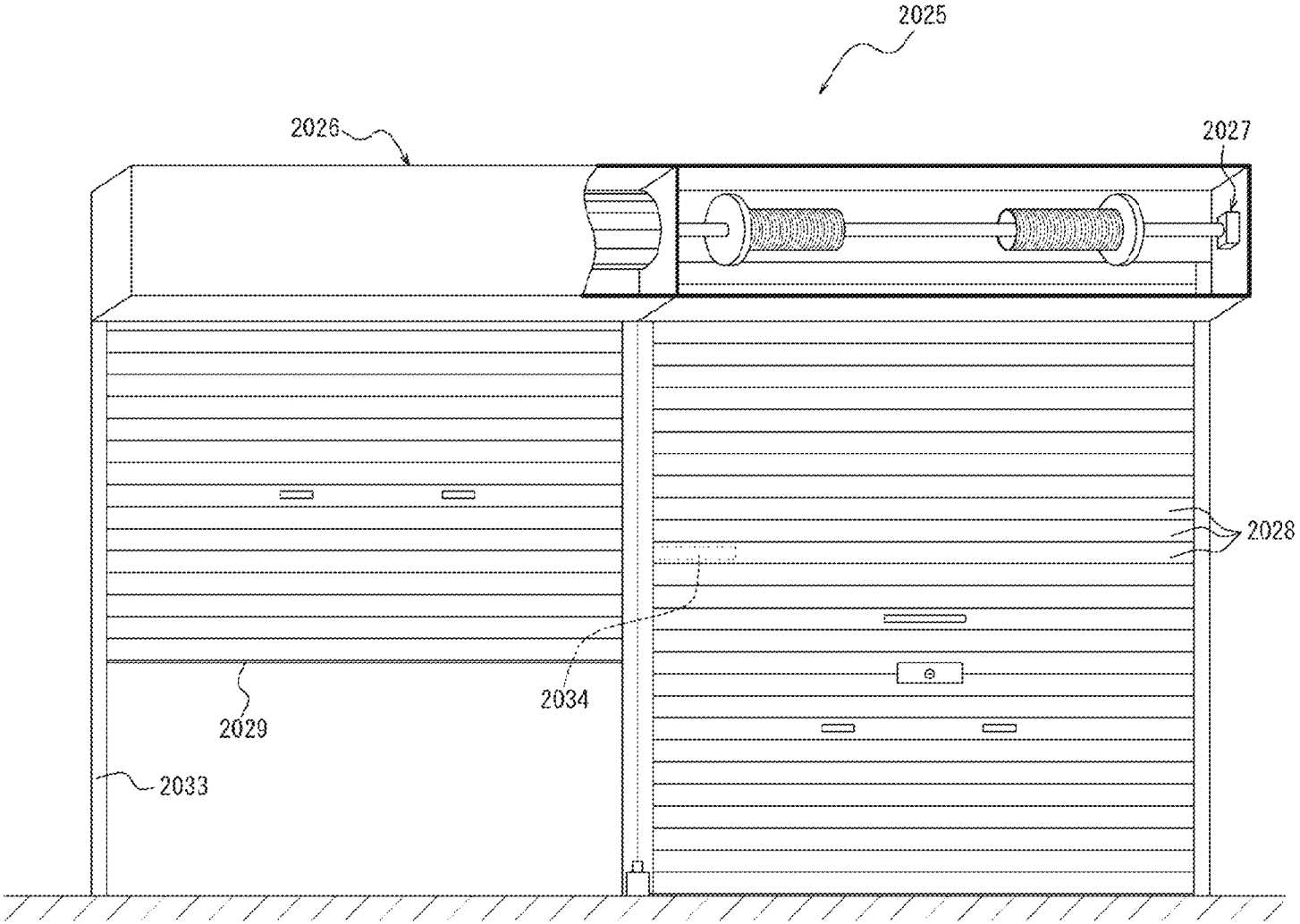

As illustrated in FIG. 108, the wireless communication device 90 may be fixed to a shutter 2025. At least one of a case 2026, a bearing 2027, slats 2028, a strainer 2029, a guide rail 2033, and a lock 2034 included in the shutter 2025 may be made of metal. The sensor 92 of the wireless communication device 90 may be provided at various portions included in the shutter 2025 depending on the type of the sensor 92.

The sensor 92 of the wireless communication device 90 fixed to the shutter 2025 may include, for example, at least any one of a 9-axis sensor, a 6-axis sensor, an acceleration sensor, an angular velocity sensor, a geomagnetic sensor, a temperature sensor, a humidity sensor, an atmospheric pressure sensor, an illumination sensor, a wind power sensor, an infrared sensor, and a human sensor. When the sensor 92 is at least one of an acceleration sensor, an angular velocity sensor, and a geomagnetic sensor, the sensor 92 may be fixed to the slat 2028 or the strainer 2029 that moves when the shutter opens or closes, or the lock 2034 that moves when the shutter is locked or unlocked. When the sensor 92 is at least one of a temperature sensor, a humidity sensor, an atmospheric pressure sensor, an illuminance sensor, a wind power sensor, an infrared sensor, and a human sensor, the sensor 92 may be fixed to an interior side of any one of the exposed components such as the case 2026, the slats 2028, the strainer 2029, the guide rail 2033, and the lock 2034 included in the shutter 2025.

When the sensor 92 includes at least one of a 9-axis sensor, a 6-axis sensor, an acceleration sensor, and an angular velocity sensor, the sensor 92 may detect the opening and closing of the shutter 2025. The detection of the opening and closing of the shutter 2025 by the sensor 92 is based on the detection of movement of the slats 2028 or the strainer 2029. When the sensor 92 includes at least one of a temperature sensor, a humidity sensor, an atmospheric pressure sensor, an illuminance sensor, a wind power sensor, and an infrared sensor, the sensor 92 may detect the opening and closing of the shutter 2025. The detection of the opening and closing of the shutter 2025 by the sensor 92 is based on the change in the detected value associated with the change in the interior state.

When the sensor 92 includes at least one of a 9-axis sensor, a 6-axis sensor, and an acceleration sensor, the sensor 92 may detect the presence or absence of a person in an interior to which the shutter 2025 is attached. The detection of the presence or absence of a person by the sensor 92 is based on detection of vibration of the shutter 2025 caused by activity of the person. When the sensor 92 includes at least one of an angular velocity sensor, a geomagnetic sensor, an illumination sensor, an infrared sensor, a human sensor, and an ultrasonic sensor, the sensor 92 may detect the presence or absence of a person in the room to which the shutter 2025 is attached. The detection of the presence or absence of a person by the sensor 92 is based on the change in the detected value due to the activity of the person. For example, when a person or the like is detected on a flow line of the shutter 2025 when the shutter 2025 is closed, the shutter 2025 may stop the closing operation.

When the sensor 92 includes at least one of a 9-axis sensor, a 6-axis sensor, an acceleration sensor, an angular velocity sensor, and a geomagnetic sensor, the sensor 92 may detect the locked state of the shutter 2025. The detection of the locked state by the sensor 92 is based on the detection of the presence or absence of a movement of the lock 2034 that occurs during the locking or unlocking.

The wireless communication module 80 may be fixed together with the sensor 92 via the first case 95. Alternatively, the wireless communication module 80 may be fixed to the case 2026, the bearing 2027, the slat 2028, the strainer 2029, the guide rail 2033, the lock 2034, or the like in the vicinity of the sensor 92 via the first case 95.

When the wireless communication module 80 is fixed to the case 2026, the wireless communication module 80 may be fixed so that the first axis is parallel to a side of a rectangular surface of the case 2026. When the wireless communication module 80 is fixed to the case 2026, the wireless communication module 80 may be fixed to an end of the case 2026.

When the wireless communication module 80 is fixed to the bearing 2027, the wireless communication module 80 may be fixed to an end of the bearing 2027.

When the wireless communication module 80 is fixed to the slat 2028, the wireless communication module 80 may be fixed to an end of the slat 2028.

When the wireless communication module 80 is fixed to the strainer 2029, the wireless communication module 80 may be fixed to an end of the strainer 2029.

When the wireless communication module 80 is fixed to the guide rail 2033, the wireless communication module 80 may be fixed to an end of the guide rail 2033.

The controller 94 of the wireless communication device 90 fixed to the shutter 2025 transmits the detection result of the sensor 92 or the information obtained by analyzing the detection result of the sensor 92 to the electronic device 2003 via the wireless communication module 80. The information obtained by analyzing the detection result may include, for example, the presence or absence of the opening and closing of the shutter 2025, the presence or absence of a person in the room, or the locked state of the shutter 2025. The information obtained by analyzing the detection result may include the presence or absence of an illegal intrusion or the disaster prevention state based on the opened and closed state of the shutter 2025. The controller 94 or the electronic device 2003 may add a time stamp to the detection result of the sensor 92 or the analyzed information.

When the electronic device 2003 that acquires the detection result or the analyzed information is a notification device, the electronic device 2003 may notify various information by, for example, emitting specific sound, light, or image. The various information may include the presence or absence of the opening and closing of the shutter 2025, the presence or absence of a person in the room, the locked state of the shutter 2025, the presence or absence of an illegal intrusion, or disaster prevention state. The electronic device 2003 as the notification device may transmit various information to a specific communication device.

When the electronic device 2003 that acquires the detection result or the analyzed information is a management device, a display included in the electronic device 2003 may display various information. The various information may include the presence or absence of the opening and closing of the shutter 2025, the presence or absence of a person in the room, the locked state of the shutter 2025, the presence or absence of an illegal intrusion, or disaster prevention state. The electronic device 2003 may store the presence or absence of the opening and closing of the shutter 2025, the presence or absence of a person in the room, the locked state of the shutter 2025, the presence or absence of an illegal intrusion, or the disaster prevention state in the memory of the electronic device 2003.

When the electronic device 2003 that acquires the detection result or the analyzed information is a mobile terminal, the electronic device 2003 may notify a mobile terminal toter of various information. The various information may include the presence or absence of the opening and closing of the shutter 2025, the presence or absence of a person in the room, the locked state of the shutter 2025, the presence or absence of an illegal intrusion, or disaster prevention state. The electronic device 2003 may perform a notification by mail, SNS, SMS, or the like.

(Rain Door)

As illustrated in FIG. 109, the wireless communication device 90 may be fixed to a rain door 2035. At least one of a casing 2036, a panel 2037, a door pocket frame 2038, an end plate 2039, and a lock 2043 included in the rain door 2035 may be made of metal. The sensor 92 of the wireless communication device 90 may be provided at various portions included in the rain door 2035 depending on the type of the sensor 92.

The sensor 92 of the wireless communication device 90 fixed to the rain door 2035 may include, for example, at least any one of a 9-axis sensor, a 6-axis sensor, an acceleration sensor, an angular velocity sensor, a geomagnetic sensor, a temperature sensor, a humidity sensor, an atmospheric pressure sensor, an illumination sensor, a wind power sensor, and an infrared sensor. When the sensor 92 is at least one of a 9-axis sensor, a 6-axis sensor, an acceleration sensor, an angular velocity sensor, and a geomagnetic sensor, the sensor 92 may be fixed to the panel 2037 that moves when the rain door opens or closes or the lock 2043 that moves when the rain door is locked or unlocked. When the sensor 92 is at least one of a temperature sensor, a humidity sensor, an atmospheric pressure sensor, an illuminance sensor, a wind power sensor, and an infrared sensor, the sensor 92 may be fixed to an interior side of any one of the exposed components such as the casing 2036, the panel 2037, and the door pocket frame 2038 included in the rain door 2035.

When the sensor 92 includes at least one of a 9-axis sensor, a 6-axis sensor, an acceleration sensor, an angular velocity sensor, and a geomagnetic sensor, the sensor 92 may detect the opening and closing of the rain door 2035. The detection of the opening and closing of the rain door 2035 by the sensor 92 is based on the detection of movement of the panel 2037. When the sensor 92 includes at least one of a temperature sensor, a humidity sensor, an atmospheric pressure sensor, an illuminance sensor, a wind power sensor, and an infrared sensor, the sensor 92 may detect the opening and closing of the rain door 2035. The detection of the opening and closing of the rain door 2035 by the sensor 92 is based on the change in the detected value associated with the change in the interior state.

When the sensor 92 includes at least one of a 9-axis sensor, a 6-axis sensor, an acceleration sensor, an angular velocity sensor, and a geomagnetic sensor, the sensor 92 may detect the locked state of the rain door 2035. The detection of the locked state by the sensor 92 is based on the detection of the presence or absence of a movement of the lock 2043 that occurs during the locking or unlocking.

The wireless communication module 80 may be fixed together with the sensor 92 via the first case 95. Alternatively, the wireless communication module 80 may be fixed to the casing 2036, the panel 2037, the door pocket frame 2038, the end plate 2039, or the like near the sensor 92 via the first case 95.

When the wireless communication module 80 is fixed to the casing 2036, the wireless communication module 80 may be fixed to an end of the casing 2036.

When the wireless communication module 80 is fixed to the panel 2037, the wireless communication module 80 may be fixed so that the first axis is parallel to a side of a rectangular surface of the panel 2037. When the wireless communication module 80 is fixed to the panel 2037, the wireless communication module 80 may be fixed to an end of the panel 2037.

When the wireless communication module 80 is fixed to the door pocket frame 2038, the wireless communication module 80 may be fixed to an end of the door pocket frame 2038.

When the wireless communication module 80 is fixed to the end plate 2039, the wireless communication module 80 may be fixed so that the first axis is parallel to a side on a rectangular surface of the end plate 2039. When the wireless communication module 80 is fixed to the end plate 2039, the wireless communication module 80 may be fixed to an end of the end plate 2039.

The controller 94 of the wireless communication device 90 fixed to the rain door 2035 transmits the detection result of the sensor 92 or the information obtained by analyzing the detection result of the sensor 92 to the electronic device 2003 via the wireless communication module 80. The information obtained by analyzing the detection result may include, for example, the presence or absence of the opening and closing of the rain door 2035 or the locked state of the rain door 2035. The information obtained by analyzing the detection result may include the presence or absence of an illegal intrusion based on the opened and closed state of the rain door 2035. The controller 94 or the electronic device 2003 may add a time stamp to the detection result of the sensor 92 or the analyzed information.

When the electronic device 2003 that acquires the detection result or the analyzed information is a notification device, the electronic device 2003 may notify various information by, for example, emitting specific sound, light, or image. The various information may include the presence or absence of the opening and closing of the rain door 2035, the locked state of the rain door 2035, or the presence or absence of an illegal intrusion. The electronic device 2003 as the notification device may transmit various information to a specific communication device.

When the electronic device 2003 that acquires the detection result or the analyzed information is a management device, a display included in the electronic device 2003 may notify various information. The various information may include the presence or absence of the opening and closing of the rain door 2035, the locked state of the rain door 2035, or the presence or absence of an illegal intrusion. The electronic device 2003 may store the presence or absence of the opening and closing of the rain door 2035, the locked state of the rain door 2035, or the presence or absence of an illegal intrusion in the memory of the electronic device 2003.

When the electronic device 2003 that acquires the detection result or the analyzed information is a mobile terminal, the electronic device 2003 may notify a mobile terminal toter of various information. The information to be notified may include the presence or absence of the opening and closing of the rain door 2035, the locked state of the rain door 2035, or the presence or absence of an illegal intrusion. The electronic device 2003 may perform a notification by mail, SNS, SMS, or the like.

(Parking Lot)

The wireless communication device 90 may be fixed to a facility of a parking lot. As illustrated in FIGS. 110 to 113, the facility of the parking lot include, for example, a motor-driven gate 2044, an opening and closing bar 2046, a post 2047, a ticketing machine 2048, a rain seal 2049, a vehicle locking device 2054, vehicle mounting equipment 2055 for a multistory parking lot, and the like. As illustrated in FIG. 110, at least one of a casing 2056, a grid 2057, and a post 2058 included in the motor-driven gate 2044 may be made of metal. As illustrated in FIG. 111, at least one of the opening and closing bar 2046, the post 2047, a case of the ticketing machine 2048, and a frame of the rain seal 2049 may be made of metal. As illustrated in FIG. 112, at least one of cases of a flap 2059 and a flap driving device 2062 included in the vehicle locking device 2054 may be made of metal. As illustrated in FIG. 113, at least one of a frame 2063 and a base plate 2064 included in the vehicle mounting equipment 2055 for the multistory parking lot may be made of metal. The sensor 92 of the wireless communication device 90 may be provided at various portions included in the facility of the parking lot depending on the type of the sensor 92.

The sensor 92 of the wireless communication device 90 fixed to the facility of the parking lot may include, for example, at least any one of a 9-axis sensor, a 6-axis sensor, an acceleration sensor, an angular velocity sensor, a geomagnetic sensor, a temperature sensor, a humidity sensor, an atmospheric pressure sensor, an illumination sensor, a wind power sensor, an infrared sensor, and a pressure sensor. When the sensor 92 is at least one of an acceleration sensor, an angular velocity sensor, and a geomagnetic sensor, the sensor 92 may be fixed to the casing 2056, the grid 2057, or the post 2058 of the motor-driven gate 2044 that moves when the motor-driven gate opens or closes, the opening and closing bar 2046, the flap 2059, or the frame 2063 or the base plate 2064 of the vehicle mounting equipment 2055. When the sensor 92 is at least one of a temperature sensor, a humidity sensor, an atmospheric pressure sensor, an illuminance sensor, a wind power sensor, an infrared sensor, and a pressure sensor, the sensor 92 may be fixed near a parking position of the vehicle in the facility of the parking lot.

When the sensor 92 includes at least one of a 9-axis sensor, a 6-axis sensor, an acceleration sensor, an angular velocity sensor, and a geomagnetic sensor, the sensor 92 may detect a loading and unloading into the parking lot. The detection of the loading and unloading by the sensor 92 is based on the detection of the presence or absence of a movement of the motor-driven gate 2044, the opening and closing bar 2046, the flap 2059, or the vehicle mounting equipment 2055. When the sensor 92 includes at least one of a temperature sensor, a humidity sensor, an atmospheric pressure sensor, an illuminance sensor, a wind power sensor, an infrared sensor, a pressure sensor, and an ultrasonic sensor, the sensor 92 may detect the loading and unloading into the parking lot. The detection of the loading and unloading by the sensor 92 is based on the change in the detected value associated with a change in a parking area by the movement of the vehicle.

The wireless communication module 80 may be fixed together with the sensor 92 via the first case 95. Alternatively, the wireless communication module 80 may be fixed to the casing 2056, the grid 2057, or the post 2058 of the motor-driven gate 2044, the opening and closing bar 2046, the post 2047, the case of the ticketing machine 2048, the frame of the rain seal 2049, the flap 2059 of the vehicle locking device 2054 or the case of the flap driving device 2062, the frame 2063 and the base plate 2064 of the vehicle mounting equipment 2055, or the like in the vicinity of the sensor 92 via the first case 95.

When the wireless communication module 80 is fixed to the casing 2056 of the motor-driven gate 2044, the wireless communication module 80 may be fixed to an end of the casing 2056. When the wireless communication module 80 is fixed to the grid 2057 of the motor-driven gate 2044, the wireless communication module 80 may be fixed to an end of the grid 2057. When the wireless communication module 80 is fixed to the post 2058 of the motor-driven gate 2044, the wireless communication module 80 may be fixed to an end of the post 2058.

When the wireless communication module 80 is fixed to the opening and closing bar 2046, the wireless communication module 80 may be fixed to an end of the opening and closing bar 2046. When the wireless communication module 80 is fixed to the post 2047, the wireless communication module 80 may be fixed to an end of the post 2047.

When the wireless communication module 80 is fixed to the case of the ticketing machine 2048, the wireless communication module 80 may be fixed to a metal surface of the case. When the wireless communication module 80 is fixed to the case of the ticketing machine 2048, the wireless communication module 80 may be fixed so that the first axis is parallel to a side of any rectangular surface of the case. When the wireless communication module 80 is fixed to the case, the wireless communication module 80 may be fixed to an end of the any surface.

When the wireless communication module 80 is fixed to the frame of the rain seal 2049, the wireless communication module 80 may be fixed to an end of the frame.

When the wireless communication module 80 is fixed to the flap 2059, the wireless communication module 80 may be fixed so that the first axis is parallel to the side of the flap 2059. When the wireless communication module 80 is fixed to the flap 2059, the wireless communication module 80 may be fixed to an end of the flap 2059.

When the wireless communication module 80 is fixed to the case of the flap driving device 2062, the wireless communication module 80 may be fixed to the metal surface of the case. When the wireless communication module 80 is fixed to the case of the flap driving device 2062, the wireless communication module 80 may be fixed so that the first axis is parallel to a side of any rectangular surface of the case. When the wireless communication module 80 is fixed to the case of the flap driving device 2062, the wireless communication module 80 may be fixed to an end of the any surface.

When the wireless communication module 80 is fixed to the frame 2063 of the vehicle mounting equipment 2055, the wireless communication module 80 may be fixed to the end of the frame 2063. When the wireless communication module 80 is fixed to the base plate 2064 of the vehicle mounting equipment 2055, the wireless communication module 80 may be fixed so that the first axis is parallel to the side of the rectangular base plate 2064. When the wireless communication module 80 is fixed to the base plate 2064, the wireless communication module 80 may be fixed to an end of the base plate 2064, and furthermore an end face thereof.

The controller 94 of the wireless communication device 90 fixed to the facility of the parking lot transmits the detection result of the sensor 92 or the information obtained by analyzing the detection result of the sensor 92 to the electronic device 2003 via the wireless communication module 80. The information obtained by analyzing the detection result may include, for example, the loading and unloading into the parking lot and the parking state. The information obtained by analyzing the detection result may include the presence or absence of an abnormality occurrence such as theft, flooding, fire, and movement obstacles in the multistory parking lot based on the loading and unloading state. The controller 94 or the electronic device 2003 may add a time stamp to the detection result of the sensor 92 or the analyzed information.

When the electronic device 2003 that acquires the detection result or the analyzed information is a notification device, the electronic device 2003 may notify various information by, for example, emitting specific sound, light, or image. The information to be notified may include the presence or absence of the loading and unloading into the parking lot, the parking state, or the presence or absence of an abnormality occurrence. The electronic device 2003 as the notification device may transmit various information to a specific communication device.

When the electronic device 2003 that acquires the detection result or the analyzed information is a management device, a display included in the electronic device 2003 may display various information. Various information may include the presence or absence of the loading and unloading into the parking lot, the parking state, or the presence or absence of an abnormality occurrence. The electronic device 2003 may store the presence/absence of the loading and unloading into the parking lot, the parking state, or the presence or absence of an abnormality occurrence in the memory of the electronic device 2003.

When the electronic device 2003 that acquires the detection result or the analyzed information is a mobile terminal, the electronic device 2003 may notify a mobile terminal toter of various information. Various information may include the presence or absence of the loading and unloading into the parking lot, the parking state, or the presence or absence of an abnormality occurrence. The electronic device 2003 may perform a notification by mail, SNS, SMS, or the like.

When the sensor 92 detects a person, a small animal, or the like when the motor-driven gate 2044 or the vehicle mounting equipment 2055 moves, the controller 94 may stop the operation of the motor-driven gate 2044 or the vehicle mounting equipment 2055. The controller 94 may notify the electronic device 2003 of the stop of the operation.

(Toilet)

The wireless communication device 90 may be fixed to an inside of a toilet. As illustrated in FIG. 114, the wireless communication device 90 may be fixed to, for example, a toilet paper holder 2065, a ceiling 2066, a wall 2067, a toilet bowl 2068, a deodorizing device 2069 of the toilet, and the like. At least one of cases of the toilet paper holder 2065, the ceiling 2066, the wall 2067, the toilet bowl 2068, and the deodorizing device 2069 may be made of metal. The sensor 92 of the wireless communication device 90 may be provided at various portions in the toilet depending on the type of the sensor 92.

The sensor 92 of the wireless communication device 90 fixed to the inside of the toilet may include, for example, at least any one of a 9-axis sensor, a 6-axis sensor, an acceleration sensor, an angular velocity sensor, a geomagnetic sensor, a photosensor, an optical sensor, a laser displacement sensor, an atmosphere sensor, a level sensor, and an infrared sensor. When the sensor 92 is at least one of an acceleration sensor, an angular velocity sensor, and a geomagnetic sensor, the sensor 92 may be fixed to a paper cut plate 2073 of the toilet paper holder 2065 as illustrated in FIG. 115. When the sensor 92 is a combination of a photosensor and an optical sensor, the sensor 92 may be fixed to a core part 2074 of the toilet paper holder 2065. When the sensor 92 is a laser displacement sensor, the sensor 92 may be fixed to a sleeve plate part 2075 of the toilet paper holder 2065. When the sensor 92 is an atmosphere sensor, the sensor 92 may be fixed to the ceiling 2066, the wall 2067, the toilet bowl 2068, or the deodorizing device 2069 of the toilet. When the sensor 92 is a level sensor, the sensor 92 may be fixed to at least one of a chemical tank of the toilet bowl 2068 and a tank of a deodorant of the deodorizing device 2069. When the sensor 92 is an infrared sensor, the sensor 92 may be fixed to at least one of the ceiling 2066, the wall 2067, and the toilet bowl 2068 of the toilet.

When the sensor 92 includes at least one of a 9-axis sensor, a 6-axis sensor, an acceleration sensor, an angular velocity sensor, and a geomagnetic sensor, the sensor 92 may detect a residual quantity of toilet paper. The detection of the residual quantity of toilet paper by the sensor 92 is based on a detection of an inclination angle with respect to a reference plane such as a water plane of the paper cut plate 2073. When the sensor 92 includes a combination of a photosensor and an optical sensor, the sensor 92 may detect the residual quantity of toilet paper. The detection of the residual quantity of toilet paper by the sensor 92 is based on a detection of a replacement operation of the toilet paper by the photosensor and a detection of a rotation amount of toilet paper by the optical sensor. When the sensor 92 includes a laser displacement sensor, the sensor 92 may detect the residual quantity of toilet paper. The detection of the residual quantity of toilet paper by the sensor 92 is based on a detection of a thickness of toilet paper by the laser displacement sensor.

When the sensor 92 includes an atmosphere sensor, the sensor 92 may detect the odor in the toilet. The detection of the odor by the sensor 92 is based on a detected value. When the sensor 92 includes a level sensor, the sensor 92 may detect the residual quantity of chemicals or the deodorant. The detection of the residual quantity of chemicals or the deodorant by the sensor 92 is based on the detected value.

When the sensor 92 includes at least one of an infrared sensor and an ultrasonic sensor, the sensor 92 may detect the presence or absence of a person in the toilet. The detection of the presence or absence of a person by the sensor 92 is based on the change in the detected value due to activity of a human being.

The wireless communication module 80 may be fixed together with the sensor 92 via the first case 95. Alternatively, the wireless communication module 80 may be fixed to the toilet paper holder 2065, the ceiling 2066, the wall 2067, and the toilet bowl 2068, the case of the deodorizing device 2069 of the toilet, or the like in the vicinity of the sensor 92 via the first case 95.

When the wireless communication module 80 is fixed to the paper cut plate 2073, the wireless communication module 80 may be fixed so that the first axis is parallel to the side of the paper cut plate 2073 having a rectangular shape. When the wireless communication module 80 is fixed to the paper cut plate 2073, the wireless communication module 80 may be fixed to an end of the paper cut plate 2073.

When the wireless communication module 80 is fixed to the core part 2074, the wireless communication module 80 may be fixed so that the first axis is parallel to an axial direction of the core part 2074. When the wireless communication module 80 is fixed to the core part 2074, the wireless communication module 80 may be fixed to an end of the core part 2074.

When the wireless communication module 80 is fixed to the sleeve plate part 2075, the wireless communication module 80 may be fixed to an end of the sleeve plate part 2075.

The wireless communication module 80 may be fixed to the ceiling 2066, the wall 2067, the toilet bowl 2068, or the deodorizing device 2069 of the toilet, the wireless communication module 80 may be fixed to any part.

The controller 94 of the wireless communication device 90 fixed to the inside of the toilet transmits the detection result of the sensor 92 or the information obtained by analyzing the detection result of the sensor 92 to the electronic device 2003 via the wireless communication module 80. The information obtained by analyzing the detection result may include, for example, the residual quantity of toilet paper, the degree of odor, the residual quantity of chemicals, the residual quantity of deodorant, or the presence or absence of a person in the toilet. The controller 94 or the electronic device 2003 may add a time stamp to the detection result of the sensor 92 or the analyzed information.

When the electronic device 2003 that acquires the detection result or the analyzed information is a notification device provided on, for example, an outside of the toilet, the electronic device 2003 may notify various information by, for example, emitting specific sound, light, or image, for example. The information to be notified may include the residual quantity of toilet paper or the presence or absence of a person in the toilet. The electronic device 2003 as the notification device may transmit various information to a specific communication device.

When the electronic device 2003 that acquires the detection result or the analyzed information is a management device, a display included in the electronic device 2003 may display various information. The various information may include the residual quantity of toilet paper, the degree of odor, the residual quantity of chemicals, the residual quantity of deodorant, or the presence or absence of a person in the toilet. The electronic device 2003 may store the residual quantity of toilet paper, the degree of odor, the residual quantity of chemicals, the residual quantity of deodorant, or the presence or absence of a person in the toilet in the memory of the electronic device 2003. The electronic device 2003 may prompt an administrator to replenish the toilet paper based on the residual quantity of toilet paper. The electronic device 2003 may activate the deodorizing device 2069 in the toilet based on the degree of odor. The electronic device 2003 may prompt the administrator to replenish the deodorant based on the residual quantity of chemicals. The electronic device 2003 may prompt the administrator to replenish the deodorant based on the residual quantity of deodorant.

When the sensor 92 may detect the presence or absence of a person and the movement of the person in the toilet cannot be detected within a predetermined time, the controller 94 may notify the electronic device 2003 of the detection result.

(Architecture, Storing Item, Component)

The wireless communication device 90 may be fixed to the architecture, the storing item, or a component. As illustrated in FIGS. 116 and 117, at least one of a column and a beam included in the architecture, a ceiling 2076, a wall 2077, and a bed 2078 that define the interior of the architecture, a frame 2083 and a wall 2084 included in a storing item 2079, and a case of the component may be made of metal. The sensor 92 of the wireless communication device 90 may be provided at various portions included in the architecture, the storing item, and the component depending on the type of the sensor 92.

The sensor 92 of the wireless communication device 90 fixed to the architecture or the storing item 2079 may include, for example, at least any one of a 9-axis sensor, a 6-axis sensor, an acceleration sensor, an angular velocity sensor, a vibration sensor, a pressure sensor, a weight sensor, a displacement sensor, an image sensor, a temperature sensor, a photosensor, an ultrasonic sensor, a gas concentration sensor, a smoke sensor, and a vital sensor. The wireless communication device 90 fixed to the component may include, for example, at least any one of a liquid leakage sensor and a battery residual quantity sensor. When the sensor 92 is at least one of a 9-axis sensor, a 6-axis sensor, an acceleration sensor, an angular velocity sensor, a vibration sensor, a pressure sensor, a weight sensor, a displacement sensor, an image sensor, a temperature sensor, a photosensor, an ultrasonic sensor, a gas concentration sensor, a smoke sensor, and a vital sensor, the sensor 92 may be fixed to at least one of the column and the beam included in the architecture, the ceiling 2076, the wall 2077, and the bed 2078 that define the interior of the architecture, and the frame 2083 and the wall 2084 included in the storing item 2079. When the sensor 92 is at least one of a liquid leakage sensor and a battery residual quantity sensor, the sensor 92 may be fixed to the case of the component.

When the sensor 92 includes at least one of an image sensor, a photosensor, and a smoke sensor, the sensor 92 may detect a generation state of aerosol such as fog and smoke. The detection of the generation state of the aerosol by the sensor 92 is based on the detection of the state of the interior of the architecture and the inside of the storing item.

When the sensor 92 includes at least one of a 9-axis sensor, a 6-axis sensor, and an acceleration sensor, the sensor 92 may detect the vibration of the architecture or the storing item 2079. The detection of the vibration by the sensor 92 is based on the detection of the vibration itself of the architecture or the storing item 2079. When the sensor 92 includes at least one of a pressure sensor, a weight sensor, a displacement sensor, and an image sensor, the sensor 92 may detect the vibration of the architecture or the storing item 2079. The detection of the vibration by the sensor 92 is based on the change in the detected value due to the vibration of the architecture or the storing item 2079.

When the sensor 92 includes at least one of an image sensor and a temperature sensor, the sensor 92 may detect the occurrence of fire. The detection of the occurrence of fire by the sensor 92 is based on the detected value due to the occurrence of fire inside the architecture or the storing item 2079.

When the sensor 92 includes a gas concentration sensor, the sensor 92 may detect the change in the gas concentration inside the architecture or the storing item 2079. The detection of the change in the gas concentration by the sensor 92 is based on the gas concentration inside the architecture or the storing item 2079.

When the sensor 92 includes at least one of an image sensor and a vital sensor, the sensor 92 may detect a health condition of a human being and animals such as pets in the interior of the architecture. The detection of the health condition by the sensor 92 is based on the detected values for the animals inside the architecture.

As illustrated in FIG. 118, when the sensor 92 includes a liquid leakage sensor, the sensor 92 may detect the presence or absence of liquid leakage in facilities such as a device to which a liquid leakage sensor module 2085 is attached. The presence or absence of the occurrence of the liquid leakage by the sensor 92 is based on the change in the detected value in an intrusion chamber 2086 of the liquid leakage sensor module 2085. The intrusion chamber 2086 is formed so that the liquid leakage from the facility can be intruded, and the detected value of the sensor 92 varies depending on the presence or absence of the liquid leakage.

When the sensor 92 includes a battery sensor, the sensor 92 may detect the residual quantity of the battery. The detection of the residual quantity of the battery by the sensor 92 is based on the calculation using the measured values of the voltage and current of the battery.

The wireless communication module 80 may be fixed together with the sensor 92 via the first case 95. Alternatively, the wireless communication module 80 may be fixed to at least any one of the column and beam included in the architecture, the ceiling 2076, the wall 2077, and the bed 2078 that defines the interior of the architecture, the frame 2083 and the wall 2084 included in the storing item 2079, the component, or the like in the vicinity of the sensor 92 via the first case 95.

When the wireless communication module 80 may be fixed to at least any one of the column and beam included in the architecture and the ceiling 2076, the wall 2077, and the bed 2078 that define the interior of the architecture, the wireless communication module 80 may be fixed to any position. When the wireless communication module 80 is fixed to the column or beam made of metal included in the architecture, the wireless communication module 80 may be fixed so that the first axis is parallel to the longitudinal direction of the column or beam, respectively.

When the wireless communication module 80 is fixed to the ceiling 2076, the wall 2077, or the bed 2078 made of metal that defines the interior of the architecture, the wireless communication module 80 may be fixed so that the first axis is parallel to the side of the ceiling 2076, the wall 2077, or the bed 2078 having a rectangular shape, respectively. When the wireless communication module 80 is fixed to the ceiling 2076, the wall 2077, or the bed 2078 made of metal that defines the interior of the architecture, the wireless communication module 80 may be fixed to an end of the ceiling 2076, the wall 2077, or the bed 2078, respectively.

When the wireless communication module 80 is fixed to the frame 2083 included in the storing item 2079, the wireless communication module 80 may be fixed to the end of the frame 2083. When the wireless communication module 80 is fixed to the wall 2084 included in the storing item 2079, the wireless communication module 80 may be fixed so that the first axis is parallel to the side of the wall 2084 having a rectangular shape. When the wireless communication module 80 is fixed to the wall 2084, the wireless communication module 80 may be fixed to an end of the wall 2084.

When the wireless communication module 80 is fixed to the liquid leakage sensor module 2085 as the component, the wireless communication module 80 may be fixed so that the fourth conductor 50 faces the intrusion chamber 2086 of the liquid leakage sensor module 2085.

When the wireless communication module 80 is fixed to the battery as the component, the wireless communication module 80 may be fixed to a metal surface of the case. When the wireless communication module 80 is fixed to the battery, the wireless communication module 80 may be fixed so that the first axis is parallel to a side of any rectangular surface of the case. When the wireless communication module 80 is fixed to the case of the battery, the wireless communication module 80 may be fixed to an end of the any surface.

The controller 94 of the wireless communication device 90 fixed to at least one of the architecture, the storing item 2079, and the component transmits the detection result of the sensor 92 or the information obtained by analyzing the detection result of the sensor 92 to the electronic device 2003 via the wireless communication module 80. The information obtained by analyzing the detection results may include, for example, the occurrence state of aerosol, the presence or absence of the occurrence of vibration, the presence or absence of the occurrence of fire, the change in the gas concentration, the health condition of a person, the presence or absence of the occurrence of liquid leakage, or the residual quantity of the battery. The controller 94 or the electronic device 2003 may add a time stamp to the detection result of the sensor 92 or the analyzed information.

When the electronic device 2003 that acquires the detection result or the analyzed information is a notification device, the electronic device 2003 may notify various information by, for example, emitting specific sound, light, or image. The information to be notified may include the occurrence state of aerosol, the presence or absence of the occurrence of vibration, the presence or absence of the occurrence of fire, the change in the gas concentration, the health condition of a person, the presence or absence of the occurrence of liquid leakage, or the residual quantity of the battery. The electronic device 2003 as the notification device may transmit various information to a specific communication device.

When the electronic device 2003 that acquires the detection result or the analyzed information is a management device, a display included in the electronic device 2003 may display various information. The various information may include the occurrence state of aerosol, the presence or absence of the occurrence of vibration, the presence or absence of the occurrence of fire, the change in the gas concentration, the health condition of a person, the presence or absence of the occurrence of liquid leakage, or the residual quantity of the battery. The electronic device 2003 may include the occurrence state of aerosol, the presence or absence of the occurrence of vibration, the presence or absence of the occurrence of fire, the change in the gas concentration, the health condition of a person, the presence or absence of the occurrence of liquid leakage, or the residual quantity of the battery in the memory of the electronic device 2003.

When the electronic device 2003 that acquires the detection result or the analyzed information is a mobile terminal, the electronic device 2003 may notify a mobile terminal toter of various information. The various information may include the occurrence state of aerosol, the presence or absence of the occurrence of vibration, the presence or absence of the occurrence of fire, the change in the gas concentration, the health condition of a person, the presence or absence of the occurrence of liquid leakage, or the residual quantity of the battery. The electronic device 2003 may perform a notification by mail, SNS, SMS, or the like.

The wireless communication device 90 configured as described above includes the sensor 92, the first conductor 31 and the second conductor 32, at least one third conductor 40, the fourth conductor 50 extending to the first axis, and the feeding lines 61 and 72 connected to any one of the at least one third conductor 40. In the wireless communication device 90, the first conductor 31 and the second conductor 32 are capacitively connected to each other via the third conductor 40. The wireless communication device 90 has the antennas 60 and 70 that transmit a signal based on the detection result of the sensor 92. With such a configuration, the wireless communication device 90 becomes the artificial magnetic conductor having the ground conductor. As a result, in the wireless communication device 90, even if the antennas 60 and 70 are arranged in the vicinity of the conductor, the antennas 60 and 70 are unlikely to be affected by the conductor when radiating electromagnetic waves. Therefore, the wireless communication device 90 improves the strength of transmission and reception of electromagnetic waves by the antennas 60 and 70, and improves the communication quality of signals based on the detection result of the sensor 92. As described above, the wireless communication device 90 improves the usefulness of the wireless communication technique using the antennas 60 and 70 arranged near the conductor.

The wireless communication device 90 is fixed to a fixed object including the electrical conductive body 99 so that the fourth conductor 50 faces the electrical conductive body 99. With such a configuration, the wireless communication device 90 may use the fixed object to increase the induced current to the electrical conductive body 99 and achieve at least one of the improvement in at least one of the communication distance and the transmission speed, and the reduction in the transmission power.

The wireless communication device 90 includes the first case 95 fixed to the fixed object and the second case 96 that is fixed to the fixed object by engaging with the first case 95 and includes the antennas 60 and 70. In the wireless communication device 90, the fourth conductor 50 faces the first case 95 with the first case 95 and the second case 96 engaged with each other. With such a configuration, the first case 95 in the wireless communication device 90, which may have a lighter and simpler structure than the entire wireless communication device 90, is fixed to the fixed object. The wireless communication device 90 may be easily fixed to the fixed object by engaging the second case 96 including the fixed antennas 60 and 70 with the first case 95.

In the wireless communication device 90, the sensor 92 is a liquid leakage sensor, and the fourth conductor 50 faces the intrusion chamber 2086. As described above, the wireless communication device 90 is unlikely to be affected by the conductor when radiating electromagnetic waves. Therefore, the wireless communication device 90 does not need to be provided in the wireless communication module 80 in the vicinity of the intrusion chamber, which may be a conductor when the liquid leakage is intruded, and contributes to miniaturization of the liquid leakage sensor module including the wireless communication device 90.

The configuration according to the present disclosure is not limited only to the embodiments described above, and various modifications or changes can be made. For example, the functions and the like included in each component can be rearranged so as not to logically contradict, and a plurality of components can be combined into one or divided.

The automatic door 110 may include a switch including at least one of a foot switch, a non-contact switch, and a pull switch instead of the human sensor 1103 or in addition to the human sensor 1103. Then, the wireless communication device 90 may transmit the signal for opening the automatic door 110 to the controller 1110 by the first antenna 60 according to the change in the state of the switch.

A foot switch is a switch that switches the state of the switch by blocking light rays or the like with a tip of a foot. The state of the switch includes, for example, on and off. The non-contact switch refers to, in particular, a switch provided at a position higher than that of the foot switch, and is a switch that switches the state of the switch by blocking light rays or the like with a hand or an instrument. The foot switch and the non-contact switch can open and close the automatic door 110 without being touched by a hand. The pull switch is a switch that switches the state of the switch by pulling a string. The pull switch can be installed at a high position like the transom 1104 and the like.

The wireless communication device 90 provided at the conductor part of the automatic door 110 can independently and satisfactorily transmit a signal. There may be a plurality of wireless communication devices 90 provided at the conductor part of the automatic door 110. Some of the plurality of wireless communication devices 90 may be provided at the conductor part of the automatic door 110 that is different from the conductor part provided with others of the plurality of wireless communication devices 90. Signals transmitted by some of the plurality of wireless communication devices 90 may have different properties from signals transmitted by others of the plurality of wireless communication devices 90. For example, among the plurality of wireless communication devices 90, the first device may be disposed on the surface of the touch switch 1102 and the second device may be disposed on the transom 1104. The first device may transmit the signal for opening the automatic door 110 to the controller 1110 when it is determined that the touch switch 1102 is pressed. The second device may transmit the signal for closing the automatic door 110 to the controller 1110 when the human sensor 1103 does not detect a person coming and going near the automatic door 110. Both the first device and the second device may be disposed in the doorjamb 1107. In this case, the diversity antenna can be configured by disposing the first device in the right doorjamb 1107 and the second device in the left doorjamb 1107.

The sensor 92 included in the wireless communication device 90 may implement the function of the theft prevention. The sensor 92 included in the wireless communication device 90 may include, for example, the image sensor, and may implement the identification of the user who tries to pass through the automatic door 110. The image sensor can acquire an image of a part of the user or an image of the ID of the user. Examples of the image of a part of the user include an image of a user's face, fingerprint, or the like. Examples of the image of the ID include an image of an ID card or the like. The wireless communication device 90 may identify the user based on the image from the image sensor. The identification information of the user may be transmitted by the first antenna 60 included in the wireless communication device 90. The controller 1110 opens and closes the automatic door 110 based on the identification information of the user. When the automatic door 110 is a movable gate or the like, the wireless communication device 90 may transmit the position information. The position information is calculated based on the signal from the GPS satellite, for example.

The automatic door 110 may include the display that provides information. The display may be provided at the main body of the fix 1106. The display may be provided at the main body 1101B of the sliding door 1101. The sensor 92 included in the wireless communication device 90 may have a function of acquiring environmental information around the automatic door 110. The sensor 92 may include, for example, a temperature sensor, an atmospheric pressure sensor, and a wind speed sensor. The wireless communication device 90 may transmit, for example, the information on the outside temperature detected by the temperature sensor to the display and display the information. The wireless communication device 90 may predict a change in weather based on, for example, the information on the atmospheric pressure detected by the atmospheric pressure sensor and the information on the wind speed detected by the wind speed sensor. The wireless communication device 90 may transmit the prediction of the change in weather to the display and display the prediction. The sensor 92 may include, for example, a chemical sensor and the like. The wireless communication device 90 may transmit, for example, the information on the chemical substance in the air detected by the chemical sensor to the display and display the information.

The diagram describing the configuration according to the present disclosure is schematic. The dimensional ratios on the drawings do not always match the actual ones.

In the present disclosure, descriptions such as "first", "second", and "third" are an example of identifiers for distinguishing the configuration. The configurations distinguished by the descriptions such as "first" and "second" in the present disclosure can exchange the numbers in the configurations. For example, a first frequency can exchange the identifiers "first" and "second" with the second frequency. The exchange of identifiers is performed simultaneously. Even after exchanging the identifiers, the configurations are distinguished. The identifier may be deleted. The configuration in which the identifier is deleted is distinguished by a sign. For example, the first conductor 31 can be a conductor 31. Based on only the description of the identifiers such as "first" and "second" in this disclosure, it need not be used to interpret the order of the configuration, to determine the existence of a lower number identifier, or to determine the existence of a higher number identifier. The present disclosure includes a configuration in which the second conductive layer 42 has the second unit slot 422, but the first conductive layer 41 does not have the first unit slot.

The invention claimed is:

1. A wireless communication device used for storage as an electrical conductive body, the wireless communication device comprising:

an antenna, wherein the antenna includes a first conductor and a second conductor that face each other in a first axis, one or more third conductors that are located between the first conductor and the second conductor and extend in the first axis, a fourth conductor that is connected to the first conductor and the second conductor and extends in the first axis, and a feeding line that is electromagnetically connected to any one of the one or more third conductors;

a first sensor, wherein the first sensor is provided at a moving part of the storage; and a third sensor that is configured to detect presence or absence of contents of the storage, wherein the antenna transmits a signal based on a detection result of the first sensor and a detection result of the third sensor, the first conductor and the second conductor are capacitively coupled to each other via the third conductor, and the fourth conductor faces the storage.

2. The wireless communication device according to claim 1, wherein a detection target of the first sensor is provided at the moving part of the storage.

3. The wireless communication device according to claim 2, further comprising:

a further antenna that is different from the antenna, wherein the antenna transmits a further signal based on the detection result of the first sensor and another signal received by the further antenna.

4. The wireless communication device according to claim 2, wherein the antenna transmits a further signal when the detection result of the first sensor does not change for a predetermined period.

5. The wireless communication device according to claim 2, wherein the moving part is provided at a first opening of the storage, and the first sensor is configured to detect opening and closing of the first opening.

6. The wireless communication device according to claim 5, wherein the storage has a second opening that is different from the first opening, the wireless communication device includes a second sensor that is different from the first sensor and configured to detect opening and closing of the second opening, and the antenna transmits a further signal based on the detection result of the first sensor and a detection result of the second sensor.

7. The wireless communication device according to claim 1, further comprising:

a further antenna that is different from the antenna, wherein the antenna transmits a further signal based on the detection result of the first sensor and another signal received by the further antenna.

8. The wireless communication device according to claim 1, wherein the antenna transmits a further signal when the detection result of the first sensor does not change for a predetermined period.

9. The wireless communication device according to claim 1, wherein the moving part is provided at a first opening of the storage, and the first sensor is configured to detect opening and closing of the first opening.

10. The wireless communication device according to claim 9, wherein the storage has a second opening that is different from the first opening, the wireless communication device includes a second sensor that is different from the first sensor and configured to detect opening and closing of the second opening, and the antenna transmits a further signal based on the detection result of the first sensor and a detection result of the second sensor.

11. The wireless communication device according to claim 1, wherein the antenna transmits a further signal when an approach of a user is detected.

12. The wireless communication device according to claim 1, wherein the antenna transmits a further signal to a user when an approach of the user is detected.

* * * * *